US007558520B2

(12) United States Patent
Sugawara et al.

(10) Patent No.: US 7,558,520 B2
(45) Date of Patent: Jul. 7, 2009

(54) HEATING MEMBER FOR AN IMAGE FORMING APPARATUS, HAVING IMPROVED RELEASIBILITY AND CONDUCTIVITY

(75) Inventors: Tomoaki Sugawara, Kanagawa (JP); Tatsuya Satoh, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 258 days.

(21) Appl. No.: 11/165,423

(22) Filed: Jun. 24, 2005

(65) Prior Publication Data

US 2006/0014021 A1 Jan. 19, 2006

Related U.S. Application Data

(63) Continuation of application No. PCT/JP2004/015627, filed on Oct. 21, 2004.

(30) Foreign Application Priority Data

Oct. 24, 2003 (JP) ..... 2003-364598
Mar. 17, 2004 (JP) ..... 2004-076530
Oct. 18, 2004 (JP) ..... 2004-302585

(51) Int. Cl.
*G03G 15/20* (2006.01)

(52) U.S. Cl. ..... 399/333; 428/421

(58) Field of Classification Search ..... 399/333; 428/421; 427/169

See application file for complete search history.

(56) References Cited

U.S. PATENT DOCUMENTS 4,678,717 A * 7/1987 Nickola et al. ..... 428/553
5,187,849 A 2/1993 Kobayashi
5,434,001 A * 7/1995 Yamada et al. ..... 428/335
5,504,272 A * 4/1996 Uchiyama et al. ..... 399/277

(Continued)

FOREIGN PATENT DOCUMENTS

EP 1072963 A2 * 1/2001

(Continued)

OTHER PUBLICATIONS

'Actual Technology for Electrically Conductive Resin', by Nobuto Saito, published by CMC Co. Ltd., p. 64 (2000).

(Continued)

*Primary Examiner*—Quana M Grainger
(74) *Attorney, Agent, or Firm*—Oblon, Spivak, McClelland, Maier & Neustadt, P.C.

(57) ABSTRACT

The present invention is characterized in that, for the purpose of achieving a heating member (fixing member) in which thermal conductivity or electrical conductivity is given to a resin surface layer without loss of releasability, and heating efficiently is improved, the heating member contacting a to-be-heated member and heating the same has a surface layer 15 in which, in a resin material 43 having releasability, a material (for example, metal) 44 having either one or both thermal conductivity and electrical conductivity is mixed, and the material contact successively. Specifically, the heating member (fixing member) according to the present invention has the surface layer 15 in which the metal 44 is mixed into the fluorocarbon resin 43, and the metal 44 forms metal successively contacting part 42 in which the metal 44 successively contacts in such a manner as to surround the fluorocarbon resin part 41. Thereby, it is possible to improve thermal conductivity or electrical conductivity while maintaining releasability.

51 Claims, 58 Drawing Sheets

U.S. PATENT DOCUMENTS

| | | | | |
|---|---|---|---|---|
| 2001/0006712 | A1 * | 7/2001 | Hibino et al. | 428/36.91 |
| 2002/0034409 | A1 | 3/2002 | Furuya et al. | |
| 2002/0044805 | A1 * | 4/2002 | Hasegawa | 399/325 |
| 2002/0051661 | A1 | 5/2002 | Hara et al. | |
| 2004/0156661 | A1 * | 8/2004 | Kagawa et al. | 399/328 |
| 2004/0165917 | A1 | 8/2004 | Sugawara et al. | |

FOREIGN PATENT DOCUMENTS

| | | | |
|---|---|---|---|
| EP | 1 172 711 | A2 | 1/2002 |
| JP | 57146264 | A * | 9/1982 |
| JP | 61-230180 | | 10/1986 |
| JP | 63005912 | A * | 1/1988 |
| JP | 07-188885 | | 7/1989 |
| JP | 02-047671 | | 2/1990 |
| JP | 04-067187 | | 3/1992 |
| JP | 06-043776 | | 2/1994 |
| JP | 06-196884 | | 7/1994 |
| JP | 7-36097 | | 4/1995 |
| JP | 07-325498 | | 12/1995 |
| JP | 10-153918 | | 6/1998 |
| JP | 10-165311 | | 6/1998 |
| JP | 2000-227110 | | 8/2000 |
| JP | 2001-005315 | | 1/2001 |
| JP | 2001-006868 | | 1/2001 |
| JP | 2001-117402 | | 4/2001 |
| JP | 2001-267480 | | 9/2001 |
| JP | 2002-072752 | | 3/2002 |
| JP | 2002-091217 | | 3/2002 |
| JP | 2002-229346 | | 8/2002 |
| JP | 2004-145021 | | 5/2004 |

OTHER PUBLICATIONS

'Surface Treatment for Particle Using Electroless Plating', by Junichi Takeshita, Surface Technology, vol. 47, No. 11, 1996, pp. 896-899.

"Actual Technology for Electrically Conductive Resin", by Nobuto Saito, published by CMC Co. Ltd., p. 64 (2000) (submitting English translation only, 5 pages, reference previously filed in Japanese language on Jun. 24, 2005).

"Surface Treatment for Particle Using Electroless Plating", by Junichi Takeshita, Surface Technology, vol. 47, No. 11, 1999, pp. 896-899 (submitting English translation only, 17 pages, reference previously filed in Japanese language on Jun. 24, 2005).

Patent Abstracts of Japan, JP 61-230180, Oct. 14, 1986 (corr. JP 7-36097 was filed with Application).

U.S. Appl. No. 11/165,423, filed Jun. 24, 2005, Sugawara et al.

* cited by examiner

HEATING MEMBER FOR AN IMAGE FORMING APPARATUS, HAVING IMPROVED RELEASIBILITY AND CONDUCTIVITY

CROSS-REFERENCE TO RELATED APPLICATION

This application is a U.S. continuation application filed under 35 USC 111(a) claiming benefit under 35 USC 120 and 365(c) of PCT application JP2004/015627, filed Oct. 21, 2004, which claims priority to Application Ser. No. 2003-364598 filed on Oct. 24, 2003; 2004-076530 filed on Mar. 17, 2004; and 2004-302585 filed on Oct. 18, 2004. The foregoing applications are hereby incorporated herein by reference.

TECHNICAL FIELD

The present invention relates to a heating member used in a heating device or a fixing device, for heating a to-be-heated member; the heating member surface layer producing method; a fixing member made of the heating member for fixing a non-fixed image onto a sheet-like to-be-heated member (recording material); a heating device employing the heating member; a fixing method and a fixing device employing the fixing member and fixing a non-fixed image to a recording material; and a fixing method and a fixing device employing the heating member and fixing a non-fixed image to a recording material. For more detail, the present invention relates to a heating member and a fixing member in which heat efficiency of a surface layer having release characteristics from toner forming a non-fixed image is improved; a heating device employing the heating member; and a fixing method and a fixing device employing the fixing member or the heating device.

Further, the present invention relates to an image forming apparatus such as a copier, a printer, a plotter, a facsimile machine, a printing machine or such, in which, with the use of an image forming process and a transfer process, a non-fixed image is produced on a sheet-like recording material, and the non-fixed image is fixed onto the recording material with the use of the above-mentioned fixing method or the fixing device.

Further, the present invention relates to preventing a phenomenon that, in a moment of removal of paper after passing through a fixing device, a rear end of the paper is strongly in contact with the fixing roller, and thus, a line-shaped belt electric zone is left on the fixing roller so that a bad influence is applied to an image produced, or to preventing electrostatic adhesion of toner to a fixing roller.

Further, the present invention relates to improvement of heat efficiency of a layer of an outermost surface layer of a fixing roller which should have release characteristics from toner.

BACKGROUND ART

Various types of methods and devices have been developed concerning fixing process of electrophotographic-type image forming apparatus. The most common method thereof is a pressurized heating method employing a heat roller.

In a fixing device in a pressurized heating method with the use of a heating roller (fixing roller), the fixing roller in which a material (mostly, fluorocarbon resin) having release characteristics from toner is formed on a surface thereof is applied, and, fixing is carried out as a result of a toner image side of a to-be-heated member (a recording material such as recording paper, OHP sheet, postcard or such) being made to contact the surface of the fixing roller under a pressure, and being made to pass therethrough.

In such a fixing device, one in which a heat efficiency of an outermost layer of the fixing roller which needs release characteristics from toner is improved is known. For example, Patent Document 1 proposes configuring a surface of a fixing roller by a nickel film in which fluorocarbon resin particles are mixed, and thus, improving thermal conductivity. Patent Document 2 proposes improving thermal conductivity by including carbon fiber in fluorocarbon resin in a surface of a fixing roller. Patent Document 3 proposes a heating roller and a fixing device in which thermal conductivity is improved with the use of crystallized graphite sheet. Patent Document 4 proposes, not a fixing roller, but a configuration in which, for the purpose of producing high temperature conducive complex, filler is dispersed in matrix resin, and the filler is melted and mutually continuously bonded via a metal mesh made of a metal having a low melting point of not more than 500° C. or an eutectic metal. Patent document 5 proposes producing an electrically conductive sheet by causing thermal conductive powder to contact magnetic material. Further, Patent Document 6 describes, as for electromagnetic induction heating, a thin electrically conducive layer made of SUS403 having magnetism with a thickness of 0.3 mm, with a thin fluorine coating on a surface as a surface heating layer. However, ordinarily, a fluorine coating on the order of 20 through 30 μm is required for maintaining release characteristics and durability, and this may degrade thermal conductive efficiency. Patent Document 7 discloses that a lubricative heating layer functions as an electromagnetic induction heating layer, and also, this has a function of improving lubricity of inner surface of a cylindrical fixing film as a heating member. Patent Document 8 discloses to provide a heating roller and a roller heating device superior in safety, by preventing electronic leakage due to contact of a coil with a roller member.

Patent Document 9 proposes blending metal powder having a melting point less than a burning temperature of fluorocarbon resin and more than a roller operation temperature in the fluorocarbon resin in a volume ratio of 0.5 through 40%, so as to provide non-electrification characteristic thereto (not for improving thermal conductivity). Patent Document 10 proposes to provide resin coating in which metal powder is included in a dispersed manner as a roller surface layer. Patent Document 11 proposes to add and disperse three-dimensional tetrapod-like electrically conductive whisker, whereby, thanks to the whisker, a roller surface and a roller shaft of each roller are electrically conducive with one another, so that electricity on the roller surface is effectively removed (implement of thermal conductivity being mentioned in an embodiment). Patent Document 12 discloses that a resin layer includes flake-like metal in a fixing roller having a coating of the non-adhesive releasable resin layer.

According to Patent Document 13, a proper voltage of a fixing member is maintained as a result of carbon black being included in a primer layer between a releasable layer and a core metal, or a bias voltage is applied to a fixing roller, toner's electrostatic adhesion is avoided and image turbulence due to charged roller is avoided. Patent Document 14 relates to an intermediate transfer body, in which varistor powder is dispersed in a belt. Patent Document 15 discloses a configuration in which an electrically conductive mylar is bonded to a transfer paper facing surface of an entrance guide, and thereon, an isolative mylar as a non-electrically conductive sheet part is bonded. Further, a configuration is disclosed in which as a device for applying bias to the electrically conductive part, a configuration is provided to apply a constant voltage of +2 [KV] from a power source. Thereby, toner dust generation on the entire surface of a transfer paper which otherwise may occur due to approach or contact of the transfer paper to the entrance guide can be avoided.

Patent Document 16 discloses an induction heating body manufacturing method characterized in that a complex is produced from a metal porous body having passing through holes with polymer or ceramics which is impregnated, filled with or laminated, or a combination of a plurality thereof.

However, in the invention described in Patent Document 1, since merely fluorocarbon particles are mixed into a nickel layer, releasability of a fixing roller surface may not be sufficient, and offset may occur so that an image may be stained. Further, in a heating method with the use of electromagnetic induction, eddy current is required to flow, and thus, sufficient heating may not be expected in an electric conductor separated by an insulator. As a result, it is not possible to apply it for achieving an object of the present invention. In the invention described in Patent Document 2, it is described that too much mixing of carbon fiber may obstruct releasability, and improvement of thermal conductivity is limited. In the invention described in Patent Document 3, a releasable layer is required on a crystallized graphite sheet for the purpose of ensuring releasability. Thus, improvement in thermal conductivity is limited. In the invention described in Patent Document 4, since merely high temperature conductive complex is produced, releasability from toner which is most important factor of a fixing roller is not provided, and thus, toner easily adheres thereto. Thus, it is not possible to apply it to a fixing roller. In a method such the invention described in Patent Document 5 in which magnetism is utilized, magnetic particles easily agglutinate near to a magnetic field generating source. As a result, magnetic particles having insufficient releasability gather on a surface which needs releasability when this method is applied to a releasable layer, and thus, it is not possible to ensure releasability. Thus, it is not possible to apply it to a fixing roller. In the invention described in Patent Document 6, a fluorine coating layer on the order of 20 through 30 μm is required for keeping durability, which may degrade thermal conductive efficiency, and thus, the performance approaches that of an ordinary halogen lamp. In the invention described in Patent Document 7, thermal conductive efficiency is not sufficient since a heat generation layer is provided inside, heat supply may not be made sufficiently, and thus, a time is required for increasing the temperature of the outermost surface upon starting up.

In the configuration of Patent Document 9, a volume ratio of metal required for improving thermal conductivity is larger than a volume ratio required for non-electrification characteristic. Further, melted metal does not easily cause fluorocarbon resin to get wet therewith, metal agglutinates when the metal is added in a volume ratio necessary to improve the thermal conductivity. Then, after it is cooled, metal particles each having a large diameter result therefrom. Thereby, such metal particles having large particle diameters are exposed, toner easily adhere thereto, and thus, offset may occur. In the configuration of Patent Document 10, since an adiabatic zone of fluorocarbon resin exists even with simple addition of metal powder, it is necessary to increase a blending amount to obtain sufficient thermal conductivity. Thereby, releasability is lost. Thus, offset may occur. In the configuration of Patent Document 11, since an adiabatic zone of fluorocarbon resin exists among whiskers even with simple addition thereof, it is necessary to increase a blending amount to obtain sufficient thermal conductivity. Thereby, releasability is lost. Thus, offset may occur. In the configuration of Patent Document 12, since an adiabatic zone of fluorocarbon resin exists even with simple addition of metal flakes, it is necessary to increase a blending amount to obtain sufficient thermal conductivity. Thereby, releasability is lost. Thus, offset may occur.

In the configuration of Patent Document 13, a part having high resistance remains on an outermost surface. Thereby, a part having a high charged voltage remains, wherewith toner dust may occur. In the configuration of Patent Document 14, an idea of carrying out electric potential control with the use of varistor powder is the same. However, it is not necessary to consider softened toner's releasability, different from a fixing member, and it is possible to achieve the object by dispersing a sufficient amount of varistor powder. Therefore, when applying the same configuration to a fixing member, softened toner's adhesion occurs, and thus, it is not possible to apply. In contrast thereto, according to the present invention, it is directed to controlling electronic potential by minimizing inorganic powder part exposed on the surface. In the configuration of Patent Document 15, the same as the configuration of Patent Document 13, it is difficult to avoid partial generation of toner dusts In the configuration of Patent Document 16, a metal porous body having passing through holes are produced previously, and resin or such is impregnated in gaps thereof. Therefore, it is difficult to produce a uniform configuration with the use of resin (which is not easily impregnated since it has a high viscosity) having a high melting point on a roller or on a belt.

Patent Document 1: Japanese Laid-open Utility-Model Application No. 1-164463;

Patent Document 2: Japanese Laid-open Patent Application No. 6-43776;

Patent Document 3: Japanese Laid-open Patent Application No. 2001-117402;

Patent Document 4: Japanese Laid-open Patent Application No. 6-196884;

Patent Document 5: Japanese Laid-open Patent Application No. 2001-267480;

Patent Document 6: Japanese Laid-open Patent Application No. 2001-5315;

Patent Document 7: Japanese Laid-open Patent Application No. 2001-6868;

Patent Document 8: Japanese Laid-open Patent Application No. 10-153918;

Patent Document 9: Japanese Patent Publication No. 07-036097;

Patent Document 10: Japanese Laid-open Patent Application No. 02-047671;

Patent Document 11: Japanese Laid-open Patent Application No. 2002-91217;

Patent Document 12: Japanese Laid-open Patent Application No. 04-067187;

Patent Document 13: Japanese Laid-open Patent Application No. 7-325498;

Patent Document 14: Japanese Laid-open Patent Application No. 2002-229346;

Patent Document 15: Japanese Laid-open Patent Application No. 2004-145021;

Patent Document 16: Japanese Laid-open Patent Application No. 10-165311; and

Non-Patent Document 1: Written by Nobuo Saito, 'Actual Technology for Electrically Conductive Resin', CMC Co., Ltd., p. 64 (2000).

SUMMARY OF THE INVENTION

Problem to be Solved by the Invention

An important point in a fixing process for an image forming apparatus in an electrophotographic type is that offset of toner particles from a to-be-heated member to a fixing member such as a fixing roller or such does not occur in a regular operation. Offset of toner particles to a fixing member may cause after that transfer of the same to another part of the apparatus or on a to-be-heated member (recording member) in a subsequent copy cycle. Thereby, stain (background) may increase, or copying material may be interfered. The above-mentioned offset includes cold offset and hot offset.

The cold offset is that, in a thermal roller fixing method, when melting does not occur sufficiently around interface between toner and paper, a part of a toner image is removed out due to adhesion with a fixing roller or electrostatic adhesive force. This may also be called low temperature offset. A set temperature of a fixing roller at which this occurs is called a cold offset temperature.

The hot offset is that, in a thermal roller fixing method, when toner is heated excessively, and aggregating force of the toner lowers from an adhesion force with the paper, a toner layer is separated, whereby offset occurs. This may also be called high temperature offset. A set temperature of a fixing roller at which this occurs is called a hot offset temperature.

Hot offset occurs when, due to temperature rise of toner, liquefaction of toner particles occurs, the temperature increases so that the melted toner is divided during fixing operation, and part of the toner is left on the fixing member. The hot offset temperature or lowering of the hot offset temperature depends on fixing roller's pealing characteristics, and thus, it is preferable to provide a fixing roller surface having low surface energy and providing necessary pealing characteristics. Many materials have pealing characteristics and thus function initially during a continuous operation. However, as a result of hot offset of toner, it is likely to be contaminated by paper fiber, paper fragment and toner, and thereby, surface energy increases on the fixing roller surface, and the pealing characteristics may be degraded. Furthermore, once the fixing roller surface is thus contaminated, the hot offset temperature starts lowering, and thus, may become near to or lower than a minimum temperature necessary for fixing a toner image. Thereby, both insufficient fixing of toner image and offset of toner image to the fixing roller may occur. Once a fixing roller starts being contaminated, contamination is transferred to a pressing roller since the pressing roller which is pressed to the fixing roller generally includes high surface energy. After the contamination is thus transferred to a pressing roller and adheres thereto, the contamination may adhere to a reverse side of a to-be-heated member upon fixing, and thus, reverse stain may occur. Thus, the pealing characteristics of a fixing roller surface is an important factor for preventing hot offset.

Further, since a fixing roller has a function to transfer a heat to toner, it is important that heat transmission failure from a heat generation source through toner should be minimized.

On the other hand, occurrence of electrostatic offset is problematic conventionally which occurs due to transfer of toner from a transfer material to a fixing roller during image fixing.

Due to friction electricity charging between a transfer material and a fixing roller, or due to transfer charge of the transfer material, an electric field may occur whereby toner on the transfer material is attracted by the fixing roller, whereby part of the toner is transferred to the fixing roller. The toner thus transferred to the fixing roller is returned to the transfer material after the fixing roller turns once, which becomes image ghost. This is called electrostatic offset.

There are generally two situations in which electrostatic offset occurs. Here, the situations are classified to entire surface offset and pealing offset. Entire surface offset occurs as a result of a transfer material and a fixing roller mutually exchanging charges due to friction electricity changing or such, and thereby the offset electric field occurring constantly, and thus, offset occurs throughout the entire surface of the image.

On the other hand, the pealing offset is that, when a rear end of a transfer material passes through a fixing device, the rear end of the transfer material leaps so that it strongly touch the fixing roller, an electric potential history in a straight line remains on the roller longitudinally, this electronic potential causes offset, and, in an image, it occurs in a straight line along a scanning direction so that both can be distinguished.

In order to control an electric field causing offset, it is preferable that a resistance value of the fixing roller is low. However, if it is too low, a problem of leakage of transfer charge may occur. This is a phenomenon that electrostatic offset occurs as a result of transfer charge held by the transfer material escaping so that a force attracting the transfer material is weakened.

In order to avoid it, it is necessary that a surface resistance of a fixing roller is equal to or more than $1\times10^6$ Ω/□. In contract thereto, in the conventional fixing device of Patent Documents 1 through 8 directed to improvement of heating efficiency, a surface resistance of a heating member is too low, and thus, transfer charge held by a transfer material escapes, whereby a force attracting toner to the transfer material is weakened, so that electrostatic offset may occur.

Concerning a fixing process of electrophotography, various methods and devices have been developed. Thereamong, a most common method is a pressing heating method applying a heating roller. The pressing heating method applying the heating roller is that in which fixing is carried out as a result of a toner image surface of a to-be-fixed sheet being caused to pass through in a contact state on a surface of a heating roller in which a surface is produced by material (mainly, fluorocarbon resin) having releasability with respect to toner. An important matter in a fixing process is that no offset of toner particles for a fixing device member occurs from a supporting body during regular operation. Offset of toner particles for the fixing device member may cause transfer thereof to another part of the apparatus or to the supporting body in a subsequent copy cycle, whereby background stain increases. So-called hot offset occurs when part of toner remains in the fixing device member as a result of temperature rising of the toner, liquefaction of toner particles occurring, separation of melted toner occurring during fixing operation. A hot offset temperature or lowness of the same is a factor of pealing characteristics of a fixing roller, and accordingly, it is preferable to provide a fixing surface having low surface energy and providing sufficient pealing characteristics. Many materials has satisfactory pealing characteristics and thus functions well initially during continuous operation. However, as a result of hot offset of toner, it is likely to be contaminated by paper fiber, paper fragment and toner, and thereby, surface energy increases on the fixing roller surface, and the pealing characteristics may be degraded. Furthermore, once the fixing roller surface is thus contaminated, the hot offset temperature starts lowering, and thus, may become near to or lower than a minimum temperature necessary for fixing a toner image. Thereby, both insufficient fixing of toner image and offset of toner image to the fixing roller may occur. Once a fixing roller starts being contaminated, contamination is transferred to a pressing roller. Thus, the pealing characteristics are an important factor.

Further, since a fixing roller has a function to transfer a heat to toner, setting is made such that heat transmission failure from a heat generation source through toner should be minimized. According to the present invention, a releasable layer is a good thermal conductive layer, and thus, it is possible to reduce temperature lowering on a roller surface which occurs in a conventional fluorocarbon resin material having low thermal conductivity. Therefore, upon continuous paper passing, it is not necessary to carry out reduction of paper passing speed which should be carried out conventionally when the surface temperature lowers in a conventional image forming apparatus. Thereby, it is possible to achieve stable image forming. Further, the improvement of thermal conductivity is also evaluated in measurement of the cold offset temperature for how much a temperature of a roller can be lowered while a non-fixed image can be fixed therewith.

Further, a fixing roller is easily electrically charged negatively since friction is made with paper or a pressing roller. From the electrical charging, the following three phenomena are induced:

1. Negatively charged toner floating in an apparatus is made to go far away. Conversely, when a fixing roller is made to have electrical conductivity and is connected to the ground, toner adheres to the fixing roller according to electrostatic coating principle, and thus, fixing thereof to the fixing roller may easily occur.

2. Non-fixed toner is scattered on paper. So-called toner dusts occur. Thereby, image degradation occur.

3. Paper is caused to wind around a fixing roller. Due to electrostatic force, the paper is not easily removed, and may cause jam.

Thereamong, the trouble 2 or 3 occurs when a negative charge is strong. A proper electric potential is determined from many factors such as paper's line velocity and so forth. It is preferable to carry out control such that the entire surface of a fixing roller has a fixed voltage. Thus, an object of the present invention is that, fluorocarbon resin and a part through which an electric current is made to flow are separated three-dimensionally, function separation is achieved, and thus, while hot offset depending on surface releasability is avoided, electric potential control is achieved for finely on a surface of the fixing roller.

Further, a fixing roller functions to transfer heat to toner. Therefore, setting is made such that thermal conductivity failure from a heat generation source through toner is minimized. According to the present invention, a releasing layer acts as a heat generating layer and a thermal conductive layer. Accordingly, it is possible to remarkably reduce an apparatus starting up time. It is possible to dispose silicon rubber or such used commonly for improving image quality at a deeper position than the heat generating part. Accordingly, it is possible to minimize heating time lag. In a common configuration, necessary fluorocarbon resin for ensuring releasability causes heat efficiency degradation since it has low thermal conductivity. The present invention is advantageous in this point.

Therefore, an object of the present invention is to provide a fixing member satisfying releasability and electrical conductivity, in detail induction heating performance, and to provide a heating device applying it.

The present invention has been devised in consideration of the above-described situation, and an object of the present invention is to provide a heating member having releasability in a surface layer, and superior in thermal conductivity and electrical conductivity. In detail, an object of the present invention is to provide a heating member in which, without losing releasability, thermal conductivity and electrical conductivity are given to a resin surface layer, and heat efficiency is improved. Further, an object of the present invention is to provide a method for producing a surface layer of a heating member in which, without losing releasability, thermal conductivity and electrical conductivity are given to a resin surface layer, and heat efficiency is improved. Further, an object of the present invention is to provide a fixing member applying the above-mentioned heating member, and heating efficiency is improved, in a common heater heating manner. Further, an object of the present invention is to provide a fixing member in which, with the use of the above-mentioned heating member, heating efficiency is improved in electromagnetic induction heating. An object of the present invention is to provide a heating device with a rotating body in which, with the use of the above-mentioned heating member, heat efficiency is improved in electromagnetic induction heating. Further, an object of the present invention is to provide a fixing method and a fixing device in which, with the use of the above-mentioned fixing member or heating device, releasability for toner can be improved, fixing can be achieved within a limitation of releasability of wax or releasing agent and heating efficiency in fixing can be improved. Further, an object of the present invention is to provide an image forming apparatus in which the above-mentioned fixing method or fixing device is used, and, high durability, high image quality, and power saving characteristics are obtained.

Further, an object is to provide a heating member superior in thermal conductivity and resistance control performance while surface layer releasability is ensured. For more detail, an object of the present invention is to provide a heating member in which, without losing releasability, thermal conductivity is given to a resin surface layer, and also, heat efficiently is improved with moderate resistance, also with avoidance of electrostatic offset and pealing offset.

Further, an object is to provide a fixing member in which, with the use of the above-mentioned heating member, heating efficiency in common heating with a heater is improved.

Further, an object is to provide a fixing member in which, with the use of the above-mentioned heating member, and heating efficiency in electromagnetic induction heating is improved.

Further, an object is to provide a method for producing a heating member surface layer in which, without losing releasability, thermal conductivity and moderate resistance can be given to the resin surface layer.

Further, an object is to provide a heating device having a rotating member in which the above-mentioned heating member is used, and heating efficiency in electromagnetic induction heating is improved.

Further, an object is to provide a fixing method and a fixing device in which, with the use of the above-mentioned fixing member or heating device, releasability for toner can be improved, fixing can be achieved within a limitation of releasability of wax or releasing agent and heating efficiency in fixing can be improved.

Further, an object is to provide an image forming apparatus in which the above-mentioned fixing method or fixing device is used, and, high durability, high image quality, and power saving characteristics are obtained.

Further, an object is to provide a fixing member with which it is possible to improve fixing heat efficiency and improving image forming productivity.

More specifically, an object of the present invention is to provide a fixing device having a high efficiency in which a fixing member superior in thermal conductivity with addition of a small amount of good thermal conductive substance.

Further, an object is to provide a fixing device having a high efficiency in which a fixing member superior in thermal conductivity with addition of a small amount of good thermal conductive substance.

Further, an object is to obtain an image having high glossiness.

Further, an object is to produce a surface layer structure of a fixing member with a good releasability, with a small amount of good thermal conductive substance, efficiently.

Further, an object is to obtain a fixing method to achieve releasability for toner and provide durability.

Further, an object is to obtain a fixing device to achieve releasability for toner and provide durability.

Further, an object is to obtain firm tone fixing.

Further, an object is to fix within a limitation of releasability of wax or releasing agent, to avoid toner adhesion.

Further, an object is to obtain an image forming apparatus having high durability, high image quality and energy saving characteristics.

Further, an object of the present invention is to obtain a fixing member in which, with addition of small amount of particles having varistor characteristics, electric potential control of a fixing roller is satisfactory.

Further, an object is to obtain a fixing member in which, with addition of small amount of particles having varistor characteristics, electric potential control of a fixing roller is satisfactory.

Further, an object is to produce a fixing member surface structure in which, with addition of small amount of particles having varistor characteristics, releasability is superior and electric potential control of a fixing roller is satisfactory.

Further, an object is to make possible to produce a fixing member surface structure having superior releasability.

Further, an object is to provide a fixing member having durability so that it is not broken when fixing is carried out.

Further, an object is to obtain an image having high glossiness.

Further, an object is to obtain a fixing method improving releasability for toner, and providing durability.

Further, an object is to obtain firm toner fixing.

Further, an object is fixing within a limitation of releasability of wax or releasing agent, to avoid toner adhesion.

Further, an object is to obtain an image forming apparatus having high durability, high image quality and energy saving characteristics.

Further, an object is to obtain a heating device providing an electrically conductive layer which can generate heat, and having good efficiency.

Further, an object is to obtain an electrically conductive layer in which electrically conductivity is given to a resin surface layer, and usable for induction heating.

Further, an object is to obtain an electrically conductive layer in which non-electrolyte plated layers are made to mutually contact, electrically conductivity is given to a resin surface layer and usable for induction heating.

Further, an object is to obtain an electrically conductive layer in which without losing releasability, electrical conductivity is given to a resin surface layer, and usable for induction heating.

Further, an object is to efficiently produce an electrically conductive layer having electrical conductivity and releasability.

Further, an object is to obtain a heating device having a good durability.

Further, an object is to obtain a heating device having durability in which releasability for toner is improved.

Further, an object is to carry out fixing of both sides at the same time.

Means for Solving the Problem

In order to achieve the above-mentioned objects, the present invention takes the following means:

A first means is characterized in that, in a heating member for contacting a to-be-heated member and heating the same, a surface layer is provided in which, in a resin material having releasability, a material having one of or both of thermal conductivity and electrical conductivity is mixed, and the material having one of or both of thermal conductivity and electrical conductivity contacts successively.

There, the material contacting successively means a state in which the material successively contacts, and, according to the present invention, a state in which more than two particles or fillers of the material having one of or both of thermal conductivity and electrical conductivity contact successively is expressed as contacting successively.

A second means is characterized in that, in the heating member of the first means, the resin material having releasability comprises fluorocarbon resin.

A third means is characterized in that, in the heating member in the second means, the material having one of or both of thermal conductivity and electrical conductivity comprises a metal, the surface layer in which the metal is mixed into fluorocarbon resin is provided, and the metal contacts successively.

A fourth means is characterized in that, in the heating member in the third means, as said fluorocarbon resin, a plurality of types of fluorocarbon resins are provided, and at least fluorocarbon resin having a highest melting point is surrounded by the successively contacting metal.

A fifth means is characterized in that, in the heating member in the third or fourth means, the successively contacting metal has a shape of spherical shell or a shape of a modification thereof, and these spherical shells contact successively.

A sixth means is characterized in that, in the heating member in any one of the third through fifth means, as said metal material, a metal of any one of gold, silver, copper, lead, nickel, zinc, iron, aluminum, magnesium, titanium, tin and bismuth, or particles or fillers of a metal or an alloy including at least any one of these metals are provided.

A seventh means is characterized in that in the heating member in any one of the third through sixth means, as said metal material, metal or alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family, (10) bismuth and (11) silver-bismuth family is provided.

An eighth means is characterized in that in the heating member of any one of the first through seventh means, as said fluorocarbon resin, fluorocarbon resin including carbon family material is applied.

A ninth means is characterized in that in the heating member of an one of the first through eighth means, a contact angle of said surface layer with respect to water is equal to or more than 80°.

A tenth means is characterized in that in the heating means of any one of the third through ninth means, the metal part of said surface layer has a thickness in section thereof equal to or less than 50 μm.

An eleventh means is characterized in that in the heating means of any one of the third through tenth means, the metal part of said surface layer has a maximum width part in section thereof equal to or less than 30 μm.

A twelfth means is characterized in that in the heating member in any one of the third through eleventh means, the metal included in the surface layer has a melting point higher than a temperature in which a to-be-heated member is heated.

A thirteenth means characterized in that in the heating means of any one of the first through twelfth means, a surface roughness (Rz) of the surface layer is equal to or less than 5 μm.

A fourteenth means is characterized in that in the heating means in any one of the first through thirteenth means, the surface layer is provided on a base material shaped like a roller or an endless belt, inside the base material a heating means is provided, and the surface layer functions as a thermal conductive layer.

A fifteenth means is characterized in that in the heating member of any one of the first through thirteenth means, the surface layer is provided on a base material shaped like a roller or an endless belt, the surface layer functions as an electrically conductive layer and heat is generated in said electrically conductive layer as a result of eddy current being generated.

A sixteenth means is characterized in that in the heating means of the fifteenth means, said base material has an elastic layer or a heat insulating layer on a surface on which said surface layer is provided.

A seventeenth means is a method for producing the surface layer of the heating member of any one of the third through sixteenth means, characterized in that powder having surface coating of the metal on the fluorocarbon resin, or powder obtained from mechanical mixing of the powder with the fluorocarbon resin powder is applied, the powder is coated on the base material of the heating member by electrostatic coating, and then, heated so that a film is obtained.

An eighteenth means is a method for producing the surface layer of the heating member of any one of the third through sixteenth means, characterized in that powder having surface coating of the metal on the fluorocarbon resin, or powder obtained from mechanical mixing of the powder with the fluorocarbon resin powder is applied, the powder is dispersed in water solution, coating is made on the base material of the heating member with the powder, and heated so that a film is obtained.

A nineteenth means is characterized in that in the method of producing the heating member surface layer in the seventeenth or eighteenth means, as one obtained from surface coating of metal on fluorocarbon resin particles, metal coated powder obtained from, upon mixing metal powder in fluorocarbon resin, mechanical pressure and shearing force being applied, and thus external heating or and heating by means friction being applied to mixed powder so that metal powder is fixed; or metal coated powder obtained from metal powder being fixed to fluorocarbon resin by impact force is applied.

A twentieth means is a method of producing the surface layer of the heating member in any one of the third through sixteenth means characterized in that fluorocarbon resin and metal with resin coating or powder in which metal is dispersed in resin are mechanically mixed, the thus-mixed powder is coated on a base material of the heating member electrostatically, and then, heat is given, and thus, a film is obtained.

A twenty-first means is a method of producing the surface layer of the heating member in any one of the third through sixteenth means characterized in that fluorocarbon resin and metal with resin coating or powder in which metal is dispersed in resin are dispersed in water solution, the thus-obtained coating liquid is coated on a base material of the heating member, and then, heat is given, and thus, a film is obtained.

A twenty-second means is characterized in that in the heating member surface layer producing method of any one of the seventeenth through twenty-first means, heating is carried out to more than a melting point of the fluorocarbon resin.

A twenty-third means is a method of producing the surface layer of the heating member in any one of the fourth through sixteenth means characterized in that metal is coated on at least fluorocarbon resin particles having the highest melting point from among the plurality of types of fluorocarbon resin particles having different melting points, said plurality of types of fluorocarbon resin particles having different melting points are mixed, and are coated on the base material of the heating member electrostatically, and then, heating is carried out at a temperature lower than the melting point of the fluorocarbon resin particles having the highest melting point, so that a film is obtained.

A twenty-fourth means is a method of producing the surface layer of the heating member in any one of the fourth through sixteenth means characterized in that metal is coated on at least fluorocarbon resin particles having the highest melting point from among the plurality of types of fluorocarbon resin particles having different melting points, said plurality of types of fluorocarbon resin particles having different melting points are coated on the base material of the heating member electrostatically so as to laminate them, and then, heating is carried out at a temperature lower than the melting point of the fluorocarbon resin particles having the highest melting point, so that a film is obtained.

A twenty-fifth means is a method of producing the surface layer of the heating member in any one of the fourth through sixteenth means characterized in that metal is coated on at least fluorocarbon resin particles having the highest melting point from among the plurality of types of fluorocarbon resin particles having different melting points, said plurality of types of fluorocarbon resin particles having different melting points are mixed and dispersed in water solution, thus a coating liquid is produced, the coating liquid is coated on the base material of the heating member, and then, heating is carried out at a temperature lower than the melting point of the fluorocarbon resin particles having the highest melting point, so that a film is obtained.

A twenty-sixth means is a method of producing the surface layer of the heating member in any one of the fourth through sixteenth means characterized in that metal is coated on at least fluorocarbon resin particles having the highest melting point from among the plurality of types of fluorocarbon resin particles having different melting points, said plurality of types of fluorocarbon resin particles having different melting points are dispersed in water solutions, respectively, and thus, coating liquids are produced, the coating liquids are coated on the base material of the heating member so as to laminate them, and then, heating is carried out at a temperature lower than the melting point of the fluorocarbon resin particles having the highest melting point, so that a film is obtained.

A twenty-seventh means is characterized in that in the method of producing the heating member surface layer in any one of the twenty-third through twenty-sixth means, as one obtained from surface coating of the metal on the fluorocarbon resin particles, metal coated powder obtained from, upon mixing the metal powder in the fluorocarbon resin, mechanical pressure and shearing force being applied, and thus external heating or heating by means friction being applied to mixed powder so that metal powder is fixed; or metal coated powder obtained from the metal powder being fixed to the fluorocarbon resin by impact force is applied.

A twenty-eighth means is characterized in that, in a fixing member for contacting a sheet-like recording material, i.e., a to-be-heated member, heating the same, and fixing a non-fixed image on the recording material, the heating member in any one of the fourteenth through sixteenth means is applied.

A twenty-ninth means is characterized in that a heating device comprises exciting means, and a heating member including heating means applying electromagnetic induction heating by generating an eddy current in an electrically conductive layer by means of the exciting means, and, as the heating member, the heating member of the fifteenth or sixteenth means is applied.

A thirtieth means is characterized in that a heating device comprises two rotating bodies for sandwiching and conveying a sheet-like to-be-heated member and a heating means for heating the rotating bodies, and heats and presses the to-be-heated member, wherein said heating means comprises exciting means and a heating member including heating means applying electromagnetic induction heating of generating heat by generating eddy current in an electrically conductive layer by means of the exciting means, and either one or both of said two rotating bodies comprises the heating member in the fifteenth or sixteenth means.

A thirty-first means is characterized in that, in the heating device of the thirtieth means, the two heating means are provided, and the two rotating bodies are heated by the two heating means, respectively.

A thirty-second means is characterized in that, in a fixing method in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, as the fixing member the fixing member of the twenty-eighth means is applied.

A thirty-third means is characterized in that, in the fixing method in the thirty-second means, an image produced on a recording material with the use of a toner including a wax is fixed.

A thirty-fourth means is characterized in that, in a fixing method, the heating device of the twenty-ninth means is applied, and an image produced on a recording material with the use of toner including wax is fixed.

A thirty-fifth means is characterized in that, in a fixing method, the heating device of the thirtieth or thirty-first means is applied, one of the two rotating bodies is applied as the fixing member and the other is applied as the pressing member, a recording material, i.e., a to-be-heated member is sandwiched and conveyed by a part at which the fixing member and the pressing member are pressed by one another, and an image produced on the recording material with the use of toner including wax is fixed.

A thirty-sixth means is characterized in that, in the fixing method in any one of the thirty-second, thirty-third, thirty-fourth and thirty-fifth means, releasing agent is coated on the heating member, or releasing agent is coated on at least the fixing member of the fixing member and the pressing member.

A thirty-seventh means is characterized in that, in a fixing device in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, as the fixing member the fixing member of the twenty-eighth means is applied.

A thirty-eighth means is characterized in that, in the fixing device in the thirty-seventh means, an image produced on a recording material with the use of toner including wax is fixed.

A thirty-ninth means is characterized in that, in a fixing device, the heating device of the twenty-ninth means is applied, and an image produced on a recording material with the use of toner including wax is fixed.

A fortieth means is characterized in that, in a fixing device, the heating device of the thirtieth or thirty-first means is applied, one of the two rotating bodies is applied as the fixing member and the other is applied as the pressing member, a recording material, i.e., a to-be-heated member is sandwiched and conveyed by a part at which the fixing member and the pressing member are pressed by one another, and an image produced on the recording material with the use of toner including wax is fixed.

A forty-first means is characterized in that, in the fixing device in any one of the thirty-seventh, thirty-eighth, thirty-ninth and fortieth means, releasing agent is coated on the heating member, or releasing agent is coated on at least the fixing member of the fixing member and the pressing member.

A forty-second means is characterized in that, in the fixing device in any one of the thirty-seventh, thirty-eighth, thirty-ninth, fortieth and forty-first means, a quotient obtained from dividing a pressing force F [kgf] of the fixing member and the pressing member with respect to the recording material by an area S [$cm^2$] of a contact portion in which both are pressed by one another is equal to or more than 0.5 [$kgf/cm^2$].

A forty-third means is characterized in that, in the fixing device in any one of the thirty-seventh, thirty-eighth, thirty-ninth, fortieth, forty-first and forty-second means, a quotient obtained from dividing a pressing force F [kgf] of the fixing member and the pressing member with respect to the recording material by an area S [$cm^2$] of a contact portion in which both are pressed by one another is equal to or less than 4.0 [$kgf/cm^2$].

A fifty-fourth means is characterized in that in an image forming apparatus provided with an image forming part producing a toner image on a sheet-like recording material, and a fixing part fixing the toner image onto the recording material, the fixing method of any one of the thirty-second through thirty-sixth means is applied in the fixing part.

A forty-fifth means is characterized in that in an image forming apparatus provided with an image forming part producing a toner image on a sheet-like recording material, and a fixing part fixing the toner image onto the recording material, the fixing device of ant one of the thirty-seventh through forty-third means is applied in the fixing part.

A forty-sixth means is characterized in that, in a heating member for contacting a to-be-heated member and heating the same, a surface layer is provided in which, in a resin material having releasability, at least one thermal conductive metal material and at least one thermal conductive non-metal material are mixed, and the thermal conductive metal material and the thermal conductive non-metal material contact successively.

There, the material contacting successively means a state in which the material successively contact, and, according to the present invention, a state in which more than two particles or fillers of the material having one of or both of thermal conductivity and electrical conductivity contact successively is expressed as contacting successively.

A forty-seventh means is characterized in that, in the heating member of the first means, the resin material having releasability comprises fluorocarbon resin.

A forty-eighth means is characterized in that, in the heating member in the forty-eighth means, as said fluorocarbon resin, a plurality of types of fluorocarbon resins having different melting points are included, and at least fluorocarbon resin having a highest melting point is surrounded by the successively contacting metal material and non-metal material.

A forty-ninth means is characterized in that, in the heating member in the forty-seventh or forty-eighth means, the successively contacting metal material or non-metal material has a shape of spherical shell or a shape of a modification thereof, and these spherical shells contact successively.

A fiftieth means is characterized in that, in the heating member in any one of the forty-seventh through forty-ninth means, as said metal material, a metal of any one of gold, silver, copper, lead, nickel, zinc, iron, aluminum, magnesium, titanium, tin and bismuth, or particles or fillers of a metal or an alloy including at least any one thereof are included.

A fifty-first means is characterized in that in the heating member in any one of the forty-seventh through fiftieth means, as said metal material, metal or alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family and (10) bismuth is included.

A fifty-second means is characterized in that in the heating member of any one of the forty-sixth through fifty-first means, as said fluorocarbon resin, fluorocarbon resin including carbon family material is applied.

A fifty-third means is characterized in that in the heating member of any one of the forty-sixth through fifty-second means, a contact angle of said surface layer with respect to water is equal to or more than 80°.

A fifty-fourth means is characterized in that in the heating means of any one of the forty-seventh through fifty-third means, the metal part of said surface layer has a thickness in section thereof equal to or less than 50 μm.

A fifty-fifth means is characterized in that in the heating means of any one of the forty-seventh through fifty-fourth means, the metal part of said surface layer has a maximum width part in section thereof equal to or less than 30 μm.

A fifty-sixth means is characterized in that in the heating member in any one of the forty-seventh through fifty-fifth means, the metal included in the surface layer has a melting point higher than a temperature in which a to-be-heated member is heated.

A fifty-seventh means characterized in that in the heating means of any one of the forty-sixth through fifty-sixth means, a surface roughness of the surface layer is equal to or less than 5 μm in ten-point-average roughness (Rz).

A fifty-eighth means is characterized in that in the heating means in any one of the forty-sixth through fifty-seventh means, the surface layer is provided on a base material shaped like a roller or an endless belt, inside the base material heating means is provided, and the surface layer functions as a thermal conductive layer.

A fifty-ninth means is characterized in that in the heating member of any one of the forty-sixth through fifty-seventh means, the surface layer is provided on a base material shaped like a roller or an endless belt, the surface layer has material having both thermal conductivity and electrical conductivity and material having both thermal conductivity and insulting properties mixed therein, and a thermal conductive layer in which the material having both thermal conductivity and electrical conductivity and the material having both thermal conductivity and insulting properties contact successively and an electrically conductive layer located on the side of the base material and generating heat as a result of generating eddy current are provided.

A sixtieth means is characterized in that in the heating means of the forty-ninth means, said base material has an elastic layer or a heat insulating layer on a surface on which said surface layer is provided.

A sixty-first means is a method for producing the surface layer of the heating member of any one of the forty-seventh through sixtieth means, characterized in that powder having surface coating of the metal material and non-metal material on the fluorocarbon resin, or powder obtained from mechanical mixing of the powder with the fluorocarbon resin powder is applied, the powder is coated on the base material of the heating member by electrostatic coating, and then, heated so that a film is obtained.

A sixty-second means is a method for producing the surface layer of the heating member of any one of the forty-seventh through sixtieth means, characterized in that powder having surface coating of the metal material and the non-metal material on the fluorocarbon resin, or powder obtained from mechanical mixing of the powder with the fluorocarbon resin powder is applied, the powder is dispersed in water solution, coating is made on the base material of the heating member with the coating liquid, and the, heated so that a film is obtained.

A sixty-third means is characterized in that in the method of producing the heating member surface layer in the sixty-first or sixty-second means, as one obtained from surface coating of the metal material and the non-metal material on fluorocarbon resin particles, a coated powder obtained from, upon mixing the metal material powder and the non-metal material powder in fluorocarbon resin, mechanical pressure and shearing force being applied, and thus external heating or and heating by means friction being applied to mixed powder so that the metal material powder and the non-metal material powder are fixed; or coated powder obtained from the metal material powder and the non-metal material powder being fixed to fluorocarbon resin by impact force is applied.

A sixty-fourth means is a method of producing the surface layer of the heating member in any one of the forty-seventh through sixtieth means characterized in that fluorocarbon resin and the metal material and the non-metal material with resin coating or powder in which the metal material and the non-metal material are dispersed in resin are mechanically mixed, the thus-mixed powder is coated on a base material of the heating member electrostatically, and then, heat is given, and thus, a film is obtained.

A sixty-fifth means is a method of producing the surface layer of the heating member in any one of the forty-seventh through sixtieth means characterized in that fluorocarbon resin and the metal material and the non-metal material with resin coating or powder in which the metal material and the non-metal material are dispersed in resin are dispersed in water solution, the thus-obtained coating liquid is coated on a base material of the heating member, and then, heat is given, and thus, a film is obtained.

A sixty-sixth means is characterized in that in the heating member surface layer producing method of any one of the sixty-first through sixty-fifth means, heating is carried out to equal to or more than a melting point of the fluorocarbon resin.

A sixty-seventh means is a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having the different melting points are mixed, and are coated on the base material of the heating member electrostatically, and then, heating is carried out at a temperature lower than the melting point of the fluorocarbon resin particles having the highest melting point, so that a film is obtained.

A sixty-eighth means is a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are coated on the base material of the heating member electrostatically so as to laminate them, and then, heating is carried out at a temperature lower than the melting point of the fluorocarbon resin particles having the highest melting point, so that a film is obtained.

A sixty-ninth means is a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are mixed and thus coating liquid is produced, the coating liquid is coated on the base material of the heating member, and then, heating is carried out at a temperature lower than the melting point of the fluorocarbon resin particles having the highest melting point, so that a film is obtained.

A seventieth means is a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are dispersed in water solutions, respectively, and thus coating liquids are produced, the coating liquids are coated on the base material of the heating member so as to laminate them, and then, heating is carried out at a temperature lower than the melting point of the fluorocarbon resin particles having the highest melting point, so that a film is obtained.

A seventy-first means is characterized in that in the method of producing the heating member surface layer in any one of the sixty-seventh through seventieth means, as one obtained from surface coating of the metal material and the non-metal material on the fluorocarbon resin particles, coated powder obtained from, upon mixing the metal material powder and the non-metal material in the fluorocarbon resin, mechanical pressure and shearing force being applied, and thus external heating or and heating by means friction being applied to mixed powder so that metal material powder and the non-metal material powder are fixed; or coated powder obtained from the metal material powder and the non-metal material powder being fixed to the fluorocarbon resin by impact force is applied.

A seventy-second means is characterized in that, in a fixing member for contacting a sheet-like recording material, i.e., a to-be-heated member, heating the same, and fixing a non-fixed image on the recording material, comprises the heating member in any one of the forty-ninth through sixty-first means.

A seventy-third means is characterized in that a heating device comprises exciting means, and a heating member including heating means applying electromagnetic induction heating by generating eddy current in an electrically conductive layer by means of the exciting means, and, as the heating member, the heating member of the fifty-ninth or sixtieth means is applied.

A seventy-fourth means is characterized in that a heating device comprises two rotating bodies for sandwiching and conveying a sheet-like to-be-heated member and a heating means for heating the rotating bodies, and heats and presses the to-be-heated member, wherein said heating means comprises exciting means and a heating member including heating means applying electromagnetic induction heating of generating heat by generating eddy current in an electrically conductive layer by means of the exciting means, and either one or both of said two rotating bodies comprises the heating member of the fifty-ninth or sixtieth means.

A seventy-fifth means is characterized in that, in the heating device of the seventy-fourth means, the two heating means are provided, and the two rotating bodies are heated by the two heating means, respectively.

A seventy-sixth means is characterized in that, in a fixing method in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, as the fixing member the fixing member of the seventy-second means is applied.

A seventy-seventh means is characterized in that, in the fixing method in the seventy-sixth means, an image produced on a recording material with the use of toner including wax is fixed.

A seventy-eighth means is characterized in that, in a fixing method, the heating device of the seventy-third means is applied, and an image produced on a recording material with the use of toner including was is fixed.

A seventy-ninth means is characterized in that, in a fixing method, the heating device of the seventy-fourth or seventy-fifth means is applied, one of the two rotating bodies is applied as the fixing member and the other is applied as the pressing member, a recording material, i.e., a to-be-heated member is sandwiched and conveyed by a part at which the fixing member and the pressing member are pressed by one another, and an image produced on the recording material with the use of toner including wax is fixed.

An eightieth means is characterized in that, in the fixing method in any one of the seventy-sixth, seventy-seventh and seventy-ninth means, releasing agent is coated on at least the fixing member of the fixing member and the pressing member.

An eighty-first means is characterized in that, in a fixing device in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, and as the fixing member the fixing member of the seventy-second means is applied.

An eighty-second means is characterized in that, in the fixing device in the eighty-first means, an image produced on a recording material with the use of toner including wax is fixed.

An eighty-third means is characterized in that, in a fixing device, the heating device of the seventy-third means is applied, and an image produced on a recording material with the use of toner including wax is fixed.

An eighty-fourth means is characterized in that, in a fixing device, the heating device of the seventy-forth or seventy-fifth means is applied, one of the two rotating bodies is applied as the fixing member and the other is applied as the pressing member, a recording material, i.e., a to-be-heated member is sandwiched and conveyed by a part at which the fixing member and the pressing member are pressed by one another, and an image produced on the recording material with the use of toner including wax is fixed.

An eighty-fifth means is characterized in that, in the fixing device in any one of the eighty-first, eighty-second, and eighty-fourth means, releasing agent is coated on at least the fixing member of the fixing member and the pressing member.

An eighty-sixth means is characterized in that, in the fixing device in any one of the eighty-first, eighty-second, eighty-fourth and eighty-fifth means, a quotient obtained from dividing a pressing force F [kgf] of the fixing member and the pressing member against the recording material by an area S [$cm^2$] of a contact portion in which both are pressed by one another is equal to or more than 0.5 [$kgf/cm^2$].

An eighty-seventh means is characterized in that, in the fixing device in any one of the eighty-first, eighty-second, eighty-fourth, eighty-fifth and eighty-sixth means, a quotient obtained from dividing a pressing force F [kgf] of the fixing member and the pressing member against the recording material by an area S [$cm^2$] of a contact portion in which both are pressed by one another is equal to or less than 4.0 [$kgf/cm^2$].

An eighty-eighth means is characterized in that in an image forming apparatus provided with an image forming part producing a toner image on a sheet-like recording material, and a fixing part fixing the toner image onto the recording material, the fixing method of any one of the seventy-sixth through eightieth means is applied in the fixing part.

An eighty-ninth means is characterized in that in an image forming apparatus provided with an image forming part producing a toner image on a sheet-like recording material, and a fixing part fixing the toner image onto the recording material, the fixing device of any one of the eighty-first through eighty-seventh means is applied in the fixing part.

A ninetieth means is characterized in that, in the fixing member of the twenty-eighth means in which the fixing member having heat generating means and supported in such a manner that a circumferential surface thereof turns and the pressing member pressed onto the fixing member wherein a recording martial passing through a portion at which the pressing member is pressed onto the fixing member is heated and pressed so that a toner image produced on the recording materiel is fixed: the surface layer thereof comprises fluorocarbon resin and a good thermal conductive substance; said good thermal conductive substance contacts successively; said good thermal conductive substance comprises at least one good thermal conductive substance having a melting point lower than that of the fluorocarbon resin; said good thermal conductive substance comprises at least one good thermal conductive substance having a melting point higher than that of the fluorocarbon resin and also having shape anisotropy; the good thermal conductive substance having shape anisotropy is surrounded by the good thermal conducive substance having the melting point lower than that of the fluorocarbon resin.

A ninety-first means is characterized in that, in the fixing member of the ninetieth means, as the good thermal conductive substance having shape anisotropy, good thermal conductive substance previously coated on the metal is applied.

A ninety-second means is characterized in that in the fixing member of the ninetieth or ninety-first means, the successively contacting good thermal conductive substance has a shape of spherical shell or a shape of a modification thereof, and these spherical shells contact successively.

A ninety-third means is characterized in that in the fixing member of any one of the ninetieth through ninety-second means, a contact angle of said surface layer with respect to water is equal to or more than 80°.

A ninety-fourth means is characterized in that in the fixing member of any one of the ninetieth through ninety-third means, a surface roughness of the surface layer is equal to or less than 5 μm in ten-point-averaged surface roughness.

A ninety-fifth means is a method for producing the surface layer of the fixing member of any one of the ninetieth through ninety-fourth means, characterized in that complex powder having surface coating of the metal on the fluorocarbon resin and the good thermal conductive substance having shape anisotropy are mixed and coated on the rotating body, and after that, heat is given so that a film is obtained.

A ninety-sixth means is characterized in that in a method of producing the fixing member surface layer in any one of the ninetieth through ninety-fourth means, as the complex powder obtained from surface coating of the metal on fluorocarbon resin particles, the metal coated powder obtained from, upon mixing the metal powder in fluorocarbon resin, mechanical pressure and shearing force being applied and thus external heating being carried out or heating by means friction being carried out on the mixed powder so that the metal powder is fixed; or the metal coated powder obtained from the metal powder being fixed to fluorocarbon resin by impact force is applied.

A ninety-seventh means is characterized in that, in a fixing method applying the fixing member in any one of the ninetieth through ninety-fourth means, releasing agent is provided to a surface of the surface layer.

A ninety-eighth means is characterized in that, in a fixing method applying the fixing member in any one of the ninetieth through ninety-fourth means, means for providing releasing agent to a surface of the surface layer is provided.

A ninety-ninth means is characterized in that, in an electrophotographic image fixing device applying the fixing device in any one of the ninetieth through ninety-fourth means or the electrophotographic image fixing device of the ninety-eighth means, a quotient obtained from dividing a pressing force F [kgf] by the two rotating bodies against the recording material with an area S [$cm^2$] of a pressed contact portion therebetween is equal to or more than 0.5 [$kgf/cm^2$].

A hundredth means is characterized in that, in an electrophotographic image fixing device applying the fixing device in any one of the ninetieth through ninety-fourth means or the electrophotographic image fixing device of the ninety-eighth means, a quotient obtained from dividing a pressing force F [kgf] by the two rotating bodies against the recording material with an area S [$cm^2$] of a pressed contact portion therebetween is equal to or less than 4.0 [$kgf/cm^2$].

A hundred first means is characterized in that an electrophotographic image fixing device applying the fixing member of any one of the ninetieth through ninety-fourth means or the fixing device of any one of the ninety-eighth through hundredth means is applied.

A hundred second means is characterized in that, in the fixing member of the twenty-eighth means used in a fixing device in which, a fixing member supported in such a manner that a circumferential surface thereof turns, and a pressing member to be pressed onto the fixing member are provided, a recording material passing through a position at which the pressing member is pressed onto the fixing member is heated and pressed, and thus, a non-fixed image carried by the recording material is fixed: a surface layer is provided comprising powder having varistor characteristics or further with other metal particles, and fluorocarbon resin, wherein the particles contact successively.

A hundred third means is characterized in that, in a method of producing the fixing member of the hundred second means, powder in which particles having varistor characteristics or further with other metal particles are fixed to a surface of fluorocarbon resin of the fluorocarbon resin particles is produced; part or all of the powder is applied to be coated on the rotating body, and after that, heat is given so that a film is produced.

A hundred fourth means is characterized in that, in a method of producing the powder in which particles having varistor characteristics or further with other metal particles are fixed to a surface of fluorocarbon resin of the fluorocarbon resin particles, the metal coated powder obtained from, upon mixing the particles having varistor characteristics or further with other metal particles in fluorocarbon resin, mechanical pressure and shearing force being applied and thus external heating being applied or heating being carried out by means friction onto the mixed powder so that the metal powder is fixed on the fluorocarbon resin; or the metal coated powder obtained from the metal powder being fixed to the fluorocarbon resin by impact force is applied.

A hundred fifth means is characterized in that in the producing method of the hundred third or hundred fourth means, heating is carried out for a temperature equal to or more than the melting point of the fluorocarbon resin.

A hundred sixth means is characterized in that in the fixing member of the hundred second means, the surface layer has a metal phase comprising any one of gold, silver, copper, lead, nickel, zinc, iron, aluminum, magnesium, titanium and tin.

A hundred seventh means is the fixing member in the hundred second, hundred third or hundred fourth means having a surface layer characterized in that as the particles having varistor characteristics, powder comprising praseodymium, lanthanum or cobalt with zinc oxide as a chief gradient is applied.

A hundred eighth means is characterized in that, in the producing method of the hundred fourth through hundred fifth means, electrostatic coating is applied, and after that, heating is carried out.

A hundred ninth means is characterized in that, in the producing method of the hundred fourth through hundred fifth means, powder in which varistor characteristics or further with other metal particles are fixed to a surface of the fluorocarbon resin is dispersed in water, it is used for coating, and after that, heating is carried out, and a film is obtained.

A hundred tenth means is characterized in that, in the fixing member of the hundred second means, a contact angle of the surface layer with respect to water is equal to or more than 80°.

A hundred eleventh means is characterized in that, in the fixing member of the hundred second means, the metal phase of the surface layer has a thickness in section thereof equal to or less than 50 μm.

A hundred twelfth means is characterized in that, in the fixing member of any one of the hundred second, hundred sixth and hundred seventh means, the metal included in the surface layer has a melting point higher than that at a time of fixing.

A hundred thirteenth means is characterized in that, in the fixing member of any one of the hundred second, hundred sixth and hundred seventh means, a surface roughness of the surface layer is equal to or less than 5 μm in ten-point-average roughness (Rz).

A hundred fourteenth means is characterized in that, the fixing member of any one of the hundred second, hundred sixth and hundred seventh means is applied, and, with the use of toner including wax, fixing is carried out.

A hundred fifteenth means is an electrophotographic image fixing device characterized in that, toner including wax is applied for fixing.

A hundred sixteenth means is characterized in that, in a fixing method applying the fixing member of any one of the hundred second, hundred sixth and hundred seventh means, the fixing method of the hundred fourteenth means or a fixing method applying the fixing device of the hundred fourteenth means, releasing agent is coated on one or both of the rotating bodies.

A hundred seventeenth means is characterized in that, in a fixing device applying the fixing member of any one of the hundred second, hundred sixth and hundred seventh means, the fixing device applying the fixing method of the hundred fourteenth or hundred sixteenth means or the fixing device of the hundred fifteenth means, releasing agent is coated on one or both of the rotating bodies.

A hundred eighteenth means is characterized in that, in a fixing method applied in the electrophotographic image fixing device of the hundred fifteenth or hundred seventeenth means, a quotient obtained from dividing a pressing force F [kgf] of the rotating bodies against the to-be-heated member by an area S [$cm^2$] of a pressed contact portion between the two rotating bodies is equal to or more than 0.5 [$kgf/cm^2$].

A hundred nineteenth means is characterized in that, in the electrophotographic image fixing device of the hundred fifteenth or hundred seventeenth means, a quotient obtained from dividing a pressing force F [kgf] of the rotating bodies against the to-be-heated member by an area S [$cm^2$] of a pressed contact portion between the two rotating bodies is equal to or less than 4.0 [$kgf/cm^2$].

A hundred twentieth means is an image forming apparatus provided with the fixing device applying the fixing member in any one of the hundred second, hundred sixth and hundred seventh means and an image forming part, wherein said image forming part produces a toner image on a sheet, and said fixing part fixes the toner image onto the sheet.

A hundred twenty-first means is the heating device in the twenty-ninth means characterized in that an exciting means and heat generating means of electromagnetic induction heating for generating heat by generating eddy current in an electrically conductive layer provided in a heat generating body; said heat generating means comprises metal and fluorocarbon resin provided in the heat generating body, and has a surface layer in which the metal has a spherical shell shape or a modified shape thereof, and these spherical shells connect.

A hundred twenty-second means is characterized in that, in the heating device of the twenty-ninth means, two rotating bodies to sandwich and convey the sheet and heating means heating the rotating bodies are provided, and the sheet is heated and pressed therewith: said heating means has an exciting means and heat generating means of electromagnetic induction heating for generating heat by generating eddy current in an electrically conductive layer provided in said rotating bodies, and said heat generating means comprises metal and fluorocarbon resin provided in the rotating bodies, and has a surface layer in which the metal has a spherical shell shape or a modified shape thereof, and these spherical shells connect.

A hundred twenty-third means is characterized in that in a producing method for the heating device of the hundred twenty-first or hundred twenty-second means, said electrically conductive layer is produced by non-electrolyte plating.

A hundred twenty-fourth means is characterized in that in the heating device of the hundred twenty-first or hundred twenty-second means, said electrically conductive layer comprises metal of any one of (1) tin-silver family, (2) tin-copper family, (3) tin-zinc family, (4) tin-silver-copper family, (5) tin-silver-bismuth family, (6) tin-silver-copper-bismuth family, (7) tin family and (8) bismuth.

A hundred twenty-fifth means is characterized in that, in the heating device of any one of the hundred twenty-first, hundred twenty-second and hundred twenty-forth means, said electrically conductive layer is applied as a surface layer of the rotating bodies, and contacts the to-be-heated body.

A hundred twenty-sixth means is characterized in that, in the heating device of the hundred twenty-fifth means, a contact angle of the electric conductive layer of the rotating body with respect to water is equal to or more than 80°.

A hundred twenty-seventh means is characterized in that, in the heating device of any one of the hundred twenty-first, hundred twenty-second, hundred twenty-fourth, hundred twenty-fifth and hundred twenty-sixth means, a metal part of the electrically conductive layer has a maximum width part in section equal to or less than 30 μm.

A hundred twenty-eighth means is a method of producing the electrically conductive layer of the heating device of any one of the hundred twenty-first, hundred twenty-second, hundred twenty-fourth, hundred twenty-fifth, hundred twenty-sixth and hundred twenty-seventh means, sole electrolyte-plated powder of fluorocarbon resin is applied, or the powder and fluorocarbon resin powder are mechanically mixed, the thus-obtained one is applied to coat the rotating body electrostatically, and then, heat is given so that a film is produced.

A hundred twenty-ninth means is a method of producing the electrically conductive layer of the heating device of any one of the hundred twenty-first, hundred twenty-second, hundred twenty-fourth, hundred twenty-fifth and hundred twenty-seventh means, metal-coated powder of fluorocarbon resin is solely applied, or the powder and fluorocarbon resin powder are dispersed in water solution, thus-obtained coating liquid is applied to coat the rotating body electrostatically, and then, heat is given so that a film is produced.

A hundred thirtieth means is characterized in that, in the heating device of any one of the hundred twenty-first, hundred twenty-second, hundred twenty-fourth, hundred twenty-fifth, hundred twenty-sixth and hundred twenty-seventh means, a metal or alloy included in the electrically conductive layer has a melting point higher than a temperature at a time of fixing and heating.

A hundred thirty-first means is characterized in that, in the heating device of any one of the hundred twenty-first, hundred twenty-second, hundred twenty-fourth, hundred twenty-fifth, hundred twenty-sixth and hundred twenty-seventh means, a surface roughness of the surface layer is equal to or less than 5 μm in ten-point-average roughness (Rz).

A hundred thirty-second means is characterized in that, in the heating device of any one of the hundred twenty-first, hundred twenty-second, hundred twenty-fourth, hundred twenty-fifth, hundred twenty-sixth and hundred twenty-seventh means, said heating means comprises two sets thereof, and the two rotating bodies are heated thereby respectively.

A hundred thirty-third means is an electrophotographic image fixing method characterized in that, with the use of the heating device of any one of the hundred twenty-first, hundred twenty-second, hundred twenty-fourth, hundred twenty-fifth, hundred twenty-sixth, hundred twenty-seventh, hundred thirtieth, hundred thirty-first and hundred thirty-second means, fixing is carried out with the use of toner including wax.

A hundred thirty-fourth means is an electrophotographic image fixing device characterized in that, with the use of the heating device of any one of the hundred twenty-first, hundred twenty-second, hundred twenty-fourth, hundred twenty-fifth, hundred twenty-sixth, hundred twenty-seventh, hundred thirtieth, hundred thirty-first and hundred thirty-second means, fixing is carried out with the use of toner including wax.

A hundred thirty-fifth means is an electrophotographic image fixing method characterized in that, in a fixing method applying the heating device of any one of the hundred twenty-first, hundred twenty-second, hundred twenty-fourth, hundred twenty-fifth, hundred twenty-sixth, hundred twenty-seventh, hundred thirtieth, hundred thirty-first and hundred thirty-second means, the fixing method of the hundred thirty-third means or the fixing method of the hundred thirty-fourth means, releasing agent is coated on one of or both of the rotating bodies.

A hundred thirty-sixth means is an electrophotographic image fixing device characterized in that, in a fixing method applying the heating device of any one of the hundred twenty-first, hundred twenty-second, hundred twenty-fourth, hundred twenty-fifth, hundred twenty-sixth, hundred twenty-seventh, hundred thirtieth, hundred thirty-first and hundred thirty-second means, the fixing method of the hundred thirty-third means or the fixing method of the hundred thirty-fourth means, releasing agent is coated on one of or both of the rotating bodies.

A hundred thirty-seventh means is characterized in that, in the electrophotographic image fixing device of the hundred thirty-fourth or hundred thirty-sixth means, a quotient obtained from dividing a pressing force F [kgf] of the two rotating bodies against the to-be-heated member by an area S [$cm^2$] of a pressed contact portion between the two rotating bodies is equal to or more than 0.5 [$kgf/cm^2$].

A hundred thirty-eighth means is characterized in that, in the electrophotographic image fixing device of the hundred thirty-fourth or hundred thirty-sixth means, a quotient obtained from dividing a pressing force F [kgf] of the two rotating bodies against the to-be-heated member by an area S [$cm^2$] of a pressed contact portion between the two rotating bodies is equal to or less than 4.0 [$kgf/cm^2$].

A hundred thirty-ninth means is an image forming apparatus comprising the heating device of any one of the hundred twenty-first, hundred twenty-second, hundred twenty-fourth, hundred twenty-fifth, hundred twenty-sixth, hundred twenty-seventh, hundred thirtieth, hundred thirty-first and hundred thirty-second means, and an image forming part, the image forming part produces a toner image on a sheet, and the heating device fixes the toner image on the sheet.

Effect of the Invention

In the heating member of the first or second means, a surface layer is provided in which material having any one or both of thermal conductivity and electrical conductivity is mixed into resin material (for example, fluorocarbon resin) having releasability, and the material having one or both of thermal conductivity and electrical conductivity successively contacts. Accordingly, when the material with thermal conductivity contacts successively, it is possible to obtain thermal conductivity which cannot be achieved in a simply dispersed condition, heating efficiency improves, and it is possible to avoid temperature lowering upon heating. When the materiel having electrical conductivity contacts successively, the surface layer can act as an electrically conductive layer, the surface layer can generate heat in an electromagnetic induction heating manner, a surface temperature of the heating material can be rapidly raised, and heating efficiency can be improved. By causing material having any one or both of thermal conductivity and electrical conductivity contacts successively mixed into resin material having releasability (for example, fluorocarbon resin), it is possible to reduce an adding amount of the material, and thus, it is possible to control a reduction of the surface layer releasability to a substantially ignorable degree.

In the heating member in the third means, the material having any one or both of thermal conductivity and electrical conductivity is metal, a surface layer in which the metal is mixed into the fluorocarbon resin is provided, and the metal contacts successively. Thereby, it is possible to obtain the heating member in which, without loss of releasability, thermal conductively and electrical conductivity are given to the surface layer, and the heating efficiency is improved. Further, by causing particles or fillers of the metal mixed into the fluorocarbon resin to contact successively, it is possible to reduce an adding amount of the metal, and thus, it is possible to control reduction of surface layer releasability to a substantially ignorable degree.

When fluorocarbon resin is heated and melted so as to produce the surface layer, the successive contact condition of the metal surrounding the fluorocarbon resin before heating may be disturbed, and thereby, variation in thermal conductivity or electrical conductivity may occur among product lots. According to the heating member in the fourth means, the fluorocarbon resin includes two types of fluorocarbon resin having different melting points, and at least the fluorocarbon resin having the highest melting point is surrounded by the metal contacting successively. Thereby, it is possible to control disturbance of the successively contacting state of the metal successively contacting part due to the fluorocarbon resin's melt flowing, and thus, it is possible to ensure sufficient thermal conductivity or electrical conductivity.

In the heating member in the fifth means, the successively contacting metal has a spherical shell or a modified shape thereof, and the spherical shapes contact successively. Thereby, even when various requirements are applied for the surface layer thickness of the heating member, it is possible to efficiently produce a passage of heat or electricity merely by stacking the spherical shells since the structure in which the spherical shells connect is employed.

In the sixth means, as the above-mentioned metal material, any one of gold, silver, copper, lead, nickel, zinc, iron, aluminum, magnesium, titanium, tin and bismuth, or a metal or an alloy including at least any one thereof is included. Thereby, even when various requirements are applied for strength, hardness or such of the heating member's surface layer, it is possible to produce the surface layer meeting the required characteristics in which passage efficiency of heat or electricity is satisfactory by selecting the metal. In the seventh means, as the above-mentioned metal material, any one metal of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family, (10) bismuth and (11) silver-bismuth family, or an alloy thereof is included. Thereby, even when various requirements are applied for strength, hardness or such of the heating member's surface layer, it is possible to produce the surface layer meeting the required characteristics in which passage efficiency of heat or electricity is satisfactory since the metals can be bonded by low-melting-point metal thereof.

Further, in the eighth means, as the above-mentioned fluorocarbon resin, fluorocarbon resin including carbon family material is applied, and thereby, it is possible to improve friction resistant property and thermal conductivity of the surface layer.

In the ninth means, as the contact angle of the surface layer with respect to water is equal to or more than 80°, it is possible to hold macroscopic surface energy in a state of sole fluorocarbon resin by controlling size and distribution of the metal. Thereby, it is possible to ensure toner's releasability. That is, macroscopic contact angle is not affected from small exposure of metal, and thus, releasability can be ensured.

In the tenth means, a thickness of a metal part of the surface layer is equal to or less than 50 μm in its section. Thereby, by controlling size and distribution of the metal, it is possible to hold macroscopic surface energy in a state of sole fluorocarbon resin, and thereby, releasability of toner can be ensured. That is, macroscopic contact angle is not affected from small exposure of metal, and thus, releasability can be ensured.

According to the eleventh means, in the heating member of any one of the third through tenth means, a thickness of a metal part of the surface layer has a maximum with part equal to or less than 30 μm in its section. Thereby, by controlling size and distribution of the metal, it is possible to hold macroscopic surface energy in a state of sole fluorocarbon resin, and thereby, releasability of toner can be ensured. That is, macroscopic contact angle is not affected from small exposure of metal, and thus, releasability can be ensured.

In the twelfth means, the metal included in the surface layer has a melting point higher than that for when the to-be-heated member is heated, and thereby, the successively contacting of the metal is prevented from being destroyed due to melting thereof when it is heated. Thus, durability of the surface layer is improved.

In the thirteenth means, a surface roughness of the above-mentioned surface layer is made to be equal to or less than 5 μm in ten-point-average roughness (Rz), and thereby, for when it is applied in a fixing member, image quality, in particular, for a solid image, brightness improves by means of the surface member having a smooth surface since a surface of the fixing member is transferred.

According to the fourteenth means, in the heating member of any one of the first through thirteenth means, the surface layer is provided on a roller-like or endless belt like base material, heating means is provided inside of the base material, and the surface layer acts as a thermal conductive layer. Thereby, it is possible to efficiently thermally transmit heat of the heating means to the surface, and thus it is possible to improve heating efficiency and to reduce temperature lowering upon heating.

According to the fifteenth means, in the heating member of any one of the first through thirteenth means, the surface layer is provided on a roller-like or endless belt like base material, the surface layer acts as an electrically conductive layer, and eddy current is generated in the electrically conductive layer. Thereby, it is possible to cause the surface layer to generate heat due to electromagnetic induction manner, the surface temperature of the heating member can be rapidly raised, and thus, heating efficiency can be improved.

According to the sixteenth means, in the heating member of the fifteenth means, the above-mentioned base material has an elastic layer or a heat insulating layer on a surface on which the surface layer is produced, and thus, heat generated from the surface layer is prevented from escaping to the side of the base material, and thus, the to-be-heated member can be efficiently heated.

According to the seventeenth means, in a method for producing the heating member of any one of the third through sixteenth means, powder in which metal is coated on a surface of fluorocarbon resin particles, or powder in which this powder is mechanically mixed with fluorocarbon resin powder is applied, the powder is electrostatically coated on the base material of the heating member, and after that it is heated to produce a film. Thereby, it is possible to produce the surface layer of the heating member without changing a conventional fluorocarbon resin coating process, by means of powder adjustment (providing electrostatic property).

According to the eighteenth means, in a method for producing the heating member of any one of the third through sixteenth means, powder in which metal is coated on a surface of fluorocarbon resin particles, or powder in which this powder is mechanically mixed with fluorocarbon resin powder is applied, the powder is dispersed in water solution, this coating liquid is applied to coat the base material of the heating member, and after that, it is heated so as to produce a film. Thereby, it is possible to produce the surface layer of the heating member without changing a conventional fluorocarbon resin coating process, by means of powder adjustment (improving dispersibility).

According to the nineteenth means, in the heating member surface layer producing method in the seventeenth or eighteenth means, as the fluorocarbon resin particles on surface of which metal is coated, metal coated powder produced as a result of mechanical pressure and shearing force being applied while metal powder is mixed into fluorocarbon resin, and the metal powder being fixed by means of external heat or friction applied to the mixed powder, or metal coated powder obtained as a result of the metal powder being fixed to the fluorocarbon resin due to impact force is applied. Thereby, it is possible to relatively easily cover the fluorocarbon resin by the metal powder by the method of driving in and fixing the metal powder to the fluorocarbon resin with mechanical pressure or shearing force, or impact force. With the use of this powder, heat or electricity passage can be easily produced, and, thermal conductivity or electrical conductivity can be improved by a reduced metal adding amount. Further, since distribution of the fluorocarbon resin and metal can be made uniform, a part at which releasability is bad is hardly produced.

According to the twentieth means, in a method for producing the heating member of any one of the third through sixteenth means, fluorocarbon resin and resin coated metal or powder in which metal is dispersed in resin is mechanically mixed, this mixed powder is electrostatically coated on the base material of the heating member, and after that it is heated to produce a film. Thereby, it is possible to produce the surface layer of the heating member without changing a conventional fluorocarbon resin coating process, by means of powder adjustment (providing electrification characteristic).

According to the twenty-first means, in a method for producing the heating member of any one of the third through sixteenth means, fluorocarbon resin and resin coated metal or powder in which metal is dispersed in resin is dispersed in water solution, this coating liquid is applied to coat the base material of the heating member, and after that, it is heated so as to produce a film. Thereby, it is possible to produce the surface layer of the heating member without changing a conventional fluorocarbon resin coating process, by means of powder adjustment (improving dispersibility).

According to the twenty-second means, in a method of producing the heating member surface layer in any one of the seventeenth through twenty-first means, heating is carried out for a temperature equal to or higher than the melting point of the fluorocarbon resin, thereby, the fluorocarbon resin connects with each other, and thus, the film having durability.

According to the twenty-third means, in a method for producing the heating member of any one of the fourth through sixteenth means, the metal is coated in the surface of at least fluorocarbon resin having the highest melting point from among a plurality of types of fluorocarbon resins having different melting points, the plurality of types of fluorocarbon resins having different melting points are mixed and are electrostatically coated on the base material of the heating member, and after that the thus-obtained produced is heated for a temperature lower than the melting point of the fluorocarbon resin having the highest melting point to produce a film. Thereby, it is possible to produce the surface layer of the heating member without changing a conventional fluorocarbon resin coating process, by means of powder adjustment (providing electrification characteristic).

According to the twenty-fourth means, in a method for producing the heating member of any one of the fourth through sixteenth means, the metal is coated in the surface of at least fluorocarbon resin having the highest melting point from among a plurality of types of fluorocarbon resins having different melting points, the plurality of types of fluorocarbon resins having different melting points are electrostatically coated on the base material of the heating member in such a manner of lamination, and after that the thus-obtained produced is heated for a temperature lower than the melting point of the fluorocarbon resin having the highest melting point to produce a film. Thereby, it is possible to produce the surface layer of the heating member without changing a conventional fluorocarbon resin coating process, by means of powder adjustment (providing electrification characteristic).

According to the twenty-fifth means, in a method for producing the heating member of any one of the fourth through sixteenth means, the metal is coated in the surface of at least fluorocarbon resin having the highest melting point from among a plurality of types of fluorocarbon resins having different melting points, the plurality of types of fluorocarbon resins having different melting points are mixed and dispersed in water solution. The thus-obtained coating liquid is electrostatically coated on the base material of the heating member, and after that the thus-obtained produced is heated for a temperature lower than the melting point of the fluorocarbon resin having the highest melting point to produce a film. Thereby, it is possible to produce the surface layer of the heating member without changing a conventional fluorocarbon resin coating process, by means of powder adjustment (improving dispersibility).

According to the twenty-sixth means, in a method for producing the heating member of any one of the fourth through sixteenth means, the metal is coated in the surface of at least fluorocarbon resin having the highest melting point from among a plurality of types of fluorocarbon resins having different melting points, the plurality of types of fluorocarbon resins having different melting points are dispersed in water solutions respectively. The thus-obtained coating liquids are electrostatically coated on the base material of the heating member in a manner of lamination, and after that the thus-obtained produced is heated for a temperature lower than the melting point of the fluorocarbon resin having the highest melting point to produce a film. Thereby, it is possible to produce the surface layer of the heating member without changing a conventional fluorocarbon resin coating process, by means of powder adjustment (improving dispersibility).

According to the twenty-seventh means, in the heating member surface layer producing method in the twenty-third or twenty-sixth means, as the fluorocarbon resin particles on surface of which metal is coated, metal coated powder produced as a result of mechanical pressure and shearing force being applied while metal powder is mixed into fluorocarbon resin, and the metal powder being fixed by means of external heat or friction applied to the mixed powder, or metal coated powder obtained as a result of the metal powder being fixed to the fluorocarbon resin due to impact force is applied. Thereby, it is possible to relatively easily cover the fluorocarbon resin by the metal powder by the method of driving the metal powder in and fixing the same to the fluorocarbon resin with mechanical pressure and shearing force, or impact force. With the use of this powder, a heat or electricity passage can be easily produced, and, thermal conductivity or electrical conductivity can be improved by a reduced metal adding amount. Further, since distribution of the fluorocarbon resin and metal can be made uniform, a part at which releasability is bad is hardly produced.

According to the twenty-eighth means, in a fixing member contacting a sheet-like recording material or a to-be-heated member, heating the same and fixing a non-fixed image on the recording material, the heating member in any one of the fourteenth through sixteenth means is provided. Thereby, it is possible to obtain the fixing member from which the same advantages as those of any one of the fourteenth through sixteenth means are obtained.

According to the twenty-ninth means, a heating device comprises exciting means, and a heating member includes heating means applying electromagnetic induction heating for heating by generating an eddy current in an electrically conductive layer by means of the exciting means, and, as the heating member, the heating member of the fifteenth or sixteenth means is applied. In this configuration, the surface layer of the heating member acts as the electrically conductive layer, and the eddy current is generated in the electrically conductive layer so that heat is generated from the surface layer. Thereby, it is possible to rapidly raise the surface temperature of the heating member, and thus, the heating efficiency can be improved. Further, in a configuration in which an elastic layer or a heat insulating layer is provided on a surface of the base material of the heating member on which the surface layer is produced, heat generated from the surface layer is prevented from escaping to the side of the base material, and thus, the to-be-heated member can be effectively heated.

In the thirtieth means, a heating device comprises two rotating bodies for sandwiching and conveying a sheet-like to-be-heated member and a heating means for heating the rotating bodies, and heats and presses the to-be-heated member, wherein said heating means comprises exciting means and a heating member including heating means applying electromagnetic induction heating of generating heat by generating eddy current in an electrically conductive layer by means of the exciting means, and either one or both of said two rotating bodies comprises the heating member in the fifteenth or sixteenth means. Thereby, heat generation is carried out from the electrical conductor layer also acting as a releasing layer, thus the surface temperature of the rotating bodies can be rapidly heated, and thus, the to-be-heated member can be efficiently heated. Further, as the electrically conductive layer is made of the metal and fluorocarbon resin, releasability can also be ensured. Further, in a configuration in which an elastic layer or a heat insulating layer is provided on a surface of the base material of the heating member on which the surface layer is produced, heat generated from the surface layer is prevented from escaping to the side of the base material, and thus, the to-be-heated member can be effectively heated.

According to the thirty-first means, in the heating device of the thirtieth means, the two heating means are provided, and the two rotating bodies are heated by the two heating means, respectively. Thereby, the to-be-heated member can be heated from both sides efficiently.

According to the thirty-second means, in a fixing method in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, and, as the fixing member, the fixing member of the twenty-eighth means is applied. Thereby, it is possible to improve the heating efficiency while releasability is ensured.

According to the thirty-third means, in the fixing method in the thirty-second means, toner including wax is applied, and an image produced on a recording material is fixed. Thereby, releasability is further improved from the wax in the toner.

According to the thirty-fourth means, in a fixing method, the heating device of the twenty-ninth means is applied, and an image produced on a recording material is fixed with the use of toner including wax. Thereby, fixing can be carried out in an electromagnetic induction manner, and thus, the heating efficiency upon heating can be improved while releasability is maintained. Furthermore, releasability is further improved from the wax in the toner.

According to the thirty-fifth means, in a fixing method, the heating device of the thirtieth or thirty-first means is applied, one of the two rotating bodies is applied as the fixing member and the other is applied as the pressing member, a recording material, i.e., a to-be-heated member is sandwiched and conveyed with a part at which the fixing member and the pressing member are pressed by one another, and an image produced on the recording material is fixed with the use of toner containing wax. Thereby, fixing can be carried out in an electromagnetic induction manner, and thus, the heating efficiency upon heating can be improved while releasability is maintained. Furthermore, releasability is further improved from the wax in the toner.

According to the thirty-sixth means, in the fixing method in any one of the thirty-second, thirty-third, thirty-fourth and thirty-fifth means, releasing agent is coated on the heating member, or releasing agent is coated on at least the fixing member of the fixing member and the pressing member. Thereby, by means of the releasing agent, releasability between the toner and the heating member (fixing member) contacting the toner is further improved.

According to the thirty-seventh means, in a fixing device in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, as the fixing member, the fixing member of the twenty-eighth means is applied. Thereby, the heating efficiency upon heating can be improved while releasability is maintained.

According to the thirty-eighth means, in the fixing device in the thirty-seventh means, toner including wax is applied, and an image produced on a recording material is fixed. Thereby, by means of the wax in the toner, releasability is further improved.

According to the thirty-ninth means, in a fixing device, the heating device of the twenty-ninth means is applied, and an image produced on a recording material is fixed with the use of toner including wax. Thereby, fixing can be carried out in an electromagnetic induction manner, and thus, the heating efficiency upon heating can be improved while releasability is maintained. Furthermore, releasability is further improved from the wax in the toner.

According to the fortieth means, in a fixing device, the heating device of the thirtieth or thirty-first means is applied, one of the two rotating bodies is applied as the fixing member and the other is applied as the pressing member, a recording material, i.e., a to-be-heated member is sandwiched and conveyed with a part at which the fixing member and the pressing member are pressed by one another, and an image produced on the recording material is fixed with the use of toner including wax. Thereby, fixing can be carried out in an electromagnetic induction manner, and thus, the heating efficiency upon heating can be improved while releasability is maintained. Furthermore, releasability is further improved from the wax in the toner.

According to the forty-first means, in the fixing device in any one of the thirty-seventh, thirty-eighth, thirty-ninth and fortieth means, releasing agent is coated on the heating member, or releasing agent is coated on at least the fixing member of the fixing member and the pressing member. Thereby, by means of the releasing agent, releasability between the toner and the heating member (fixing member) contacting the toner is further improved.

According to the forty-second means, in the fixing device in any one of the thirty-seventh, thirty-eighth, thirty-ninth, fortieth and forty-first means, a quotient obtained from dividing a pressing force F [kgf] of the fixing member and the pressing member with respect to the recording material by an area S [$cm^2$] of a contact portion in which both are pressed by one another is equal to or more than 0.5 [$kgf/cm^2$]. Fixing performance of toner depends on a pressure in many cases, and in particular, image fixing performance is improved as a result of a pressure equal to or more than 0.5 [$kgf/cm^2$] being applied.

According to the forty-third means, in the fixing device in any one of the thirty-seventh, thirty-eighth, thirty-ninth, fortieth, forty-first and forty-second means, a quotient obtained from dividing a pressing force F [kgf] of the fixing member and the pressing member with respect to the recording material by an area S [$cm^2$] of a contact portion in which both are pressed by one another is equal to or les than 4.0 [$kgf/cm^2$]. In the condition of equal to or more than 4.0 [$kgf/cm^2$], the wax in the toner has or the releasing agent such as silicon oil exits from the toner resin and the roller releasing layer. However, releasability is maintained in the condition of equal to or less than this pressure.

In the above-mentioned heating member (fixing member) concerning the present invention, the releasing layer is good thermal conductive layer, and thus, temperature lowering on the heating member (fixing member) surface occurring due to conventional low thermal conductivity fluorocarbon resin material can be reduced. Thereby, when it is applied as a fixing member of an image forming apparatus, paper feeding speed reduction, which is carried out upon surface temperature lowering in a conventional image forming apparatus upon successive paper feeding should not be carried out, and stable image production is achieved. Further, improvement of thermal conductivity may also be evaluated from measurement of cold offset temperature which is a lowest temperature of a fixing member at which non-fixed image can be fixed. According to the present invention, the heating efficiency upon fixing can be improved, a fixing member in which productivity of image production can be improved can be provided, and a fixing device with the use thereof can be provided.

Further, since the releasing layer of the surface layer can also act as a heat generation layer (electrically conductive layer) or a thermal conductive layer according to the present invention, it is possible to shorten a starting up time upon heating. Further, since silicon rubber or such which is used for image quality improvement commonly can be placed at a position rear from the heat generating part (on the side of the base material). Therefore, a time lag for heating can be minimized. Furthermore, commonly, since fluorocarbon resin which is necessary for maintaining releasability has low thermal conductivity, the heating efficiency is degraded. However, according to the present invention, the releasing layer also acts as the heat generation layer (electrically conductive layer) or the thermal conductive layer. Thereby, electrical conductivity is given to the surface layer while releasability is not lost, and it can be used for electromagnetic induction heating. Accordingly, it is very advantageous.

In the fifty-fourth means, in an image forming apparatus provided with an image forming part producing a toner image on a sheet-like recording material, and a fixing part fixing the toner image onto the recording material, a fixing method of employing a heating member (fixing member) having a surface layer having high releasability and high thermal conductivity or high electrical conductivity is applied in the fixing part. Thereby, it is possible to provide the image forming apparatus having high durability, high reliability, and high energy efficiency.

In the fifty-fifth means, in an image forming apparatus provided with an image forming part producing a toner image on a sheet-like recording material, and a fixing part fixing the toner image onto the recording material, a fixing device of employing a heating member (fixing member) having a surface layer having high releasability and high thermal conductivity or high electrical conductivity is applied in the fixing part. Thereby, it is possible to provide the image forming apparatus having high durability, high reliability, and high energy efficiency.

According to the forty-sixth or forty-seventh means, in a heating member, a surface layer is provided in which, in a resin material having releasability, at least one thermal conductive metal material and at least one thermal conductive non-metal material are mixed, and the thermal conductive metal material and the thermal conductive non-metal material contact successively. When the thermal conductive material contacts successively, thermal conductivity which cannot be obtained from a simply dispersed state can be obtained. Thus, heating efficiency improves, and temperature lowering upon heating can be avoided. The non-metal martial according to the present invention means a semiconductor such as silicon, silicon carbide, zinc oxide, or such; or an insulator such as alumina, crystalline silica, boron nitride, aluminum nitride, boron carbide, titanium carbide, silicon nitride, diamond or such. Then, by controlling a ratio between the thermal conductive metal material and the thermal conductive non-metal material, it is possible to obtain a heating member in which a surface layer has a moderate surface resistance equal to or more than $1.0\times10^6$ Ω/□ in comparison to a case where only the thermal conductive metal material is mixed and is caused to contact successively.

Thereby, it is possible to avoid a phenomenon in which transfer electric charge held by a transfer material escapes, thereby a force attracting toner on the transfer material is weakened, and as a result, electrostatic offset occurs.

Further, by causing thermal conductive metal material and thermal conductive non-metal material mixed into resin material (for example, fluorocarbon resin) having releasability to contact successively, it is possible to reduce an adding amount of the material, and thus, it is possible to reduce a reduction of releasability on the surface layer to an ignorable amount.

When fluorocarbon resin is heated, melted and thus, is used to produce the surface layer, the successively contacting state of the thermal conductive metal material and thermal conducive non-metal material which surround the fluorocarbon resin before heating is disturbed along with flow of the fluorocarbon resin in a configuration of a single type of fluorocarbon resin. Thereby, variation in thermal conductivity or electrical conductivity may occur among product lots. However, according to the forty-eighth means, as the fluorocarbon resin, a plurality of types of fluorocarbon resins having different melting points are included, and at least fluorocarbon resin having a highest melting point is surrounded by the successively contacting metal material and non-metal material. Thereby, it is possible to suppress disturbance of the successively contacting state at the successively contacting part due to flow of the melted fluorocarbon resin. As a result, sufficient thermal conductivity or resistance control performance can be ensured.

According to the forty-ninth means, the successively contacting metal material or non-metal material has a shape of a spherical shell or a shape of a modification thereof, and these spherical shells contact successively. As a result, even when various sorts of requirements are applied, since a thickness of the heating member surface layer has a structure in which the spherical shells contact, it is possible to effectively produce a heat or electricity passage merely by laminating it.

According to the fiftieth means, as said metal material, a metal of any one of gold, silver, copper, lead, nickel, zinc, iron, aluminum, magnesium, titanium, tin and bismuth, or particles or fillers of a metal or an alloy including at least any one of these metals are included. Thereby, even when various sorts of requirements are applied for strength or rigidity of the heating member surface layer, the surface layer efficient for passage of heat or electricity meeting the required characteristics can be produced by selecting a type of the metal.

According to the fifty-first means, as said metal material, metal or alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family and (10) bismuth is included. Thereby, even when various sorts of requirements are applied for strength or rigidity of the heating member surface layer, the surface layer efficient for passage of heat or electricity meeting the required characteristics can be produced by selecting a type of the metal, since the metals can be bonded in low-melting-point metals thereof According to the fifty-second means, as said fluorocarbon resin, fluorocarbon resin including carbon family material is applied. Thereby, it is possible to improve abrasion resistance and thermal conductivity of the surface layer.

According to the fifty-third means, a contact angle of said surface layer with respect to water is equal to or more than 80°. Thereby, it is possible to hold macroscopic surface energy in a state of sole fluorocarbon resin as a result of controlling size and distribution of the metal material and the non-metal material. Thereby, it is possible to ensure releasability for the toner. That is, macroscopic contact angle is not affected by small exposure of metal part and ceramic part, and thus, it is possible to ensure releasability.

According to the fifty-fourth means, the metal part or the ceramic part of said surface layer has a thickness in section thereof equal to or less than 50 μm. Thereby, it is possible to hold macroscopic surface energy in a state of sole fluorocarbon resin as a result of controlling size and distribution of the metal material and the non-metal material. Thereby, it is possible to ensure releasability of the toner. That is, macroscopic contact angle is not affected by small exposure of metal part and ceramic part, and thus, it is possible to ensure releasability.

According to the fifty-fifth means, in the heating member of any one of the second through ninth means, the metal part or the ceramic part of said surface layer has a maximum width part in section thereof equal to or less than 30 μm. Thereby, it is possible to hold macroscopic surface energy in a state of sole fluorocarbon resin as a result of controlling size and distribution of the metal material and the non-metal material. Thereby, it is possible to ensure releasability of the toner. That is, macroscopic contact angle is not affected by small exposure of metal part and ceramic part, and thus, it is possible to ensure releasability.

According to the fifth-sixth means, the metal and the non-metal part included in the surface layer have a melting point higher than a temperature in which a to-be-heated member is heated. Thereby, it is possible to avoid a situation in which the metal material and the non-metal material melt upon heating, and thus, the successively contacting is destroyed. Thus, the surface layer's durability improves.

According to the fifty-seventh means, a surface roughness of the surface layer is equal to or less than 5 μm in ten-point-average roughness (Rz). Thereby, when it is applied in a fixing member, glossiness improves by means of the heating member having a smooth surface since a surface of the fixing member is transferred for an image quality, in particular, for a solid image.

According to the fifty-eighth means, in the heating member of any one of the forty-sixth through fifty-seventh means, the surface layer is provided on a base material shaped like a roller or an endless belt, inside the base material a heating means is provided, and the surface layer functions as a thermal conductive layer. Thereby, it is possible to effectively transmit heat from the heating mean to the surface, heating effectively improves, and it is possible to reduce temperature lowering upon heating.

According to the fifty-ninth means, in the heating member of any one of the forty-sixth through fifty-seventh means, the surface layer is provided on a base material shaped like a roller or an endless belt, the surface layer has material having both thermal conductivity and electrical conductivity and material having both thermal conductivity and insulting properties mixed therein, and a thermal conductive layer in which the material having both thermal conductivity and electrical conductivity and the material having both thermal conductivity and insulting properties contact successively and an electrically conductive layer located on the side of the base material and generating heat as a result of generating eddy current are provided. Thereby, heat generation can be achieved from electromagnetic induction heating, the surface temperature of the heating member can be rapidly raised via the thermal conductive layer, and heating efficiency can be improved.

There, the electrically conductive layer may be one in which, in the resin material, the thermal conductive metal material is mixed, and the thermal conductive metal material contacts successively, or one in which the resin material is filled with scaly electrically conductive material.

According to the sixtieth means, in the heating means of the fifty-ninth means, said base material has an elastic layer or a heat insulating layer on a surface on which said surface layer is provided. Thereby, heat generated in the surface layer is prevented from escaping to the side of the base material, and a to-be-heated member can be efficiently heated.

According to the sixty-first means, in a method for producing the surface layer of the heating member of any one of the forty-seventh through sixtieth means, powder having surface coating of the metal material and non-metal material on the fluorocarbon resin, or powder obtained from mechanical mixing of the powder with the fluorocarbon resin powder is applied, the powder is coated on the base material of the heating member by electrostatic coating, and then, heated so that a film is obtained. Thereby, it is possible to produce the surface layer of the heating member in the present configuration without remarkably changing a conventional fluorocarbon resin coating process by means of powder adjustment (providing chargeability).

According to the sixty-second means, in a method for producing the surface layer of the heating member of any one of the forty-seventh through sixtieth means, powder having surface coating of the metal material and the non-metal material on the fluorocarbon resin, or powder obtained from mechanical mixing of the powder with the fluorocarbon resin powder is applied, the powder is dispersed in water solution, coating is made on the base material of the heating member with the coating liquid, and the, heated so that a film is obtained. Thereby, it is possible to produce the surface layer of the heating member in the present configuration without remarkably changing a conventional fluorocarbon resin coating process by means of powder adjustment (improving dispersibility).

According to the sixty-third means, in the method of producing the heating member surface layer in the sixty-first or sixty-second means, as one obtained from surface coating of the metal material and the non-metal material on fluorocarbon resin particles, a coated powder obtained from, upon mixing the metal material powder and the non-metal material powder in fluorocarbon resin, mechanical pressure and shearing force being applied, and thus external heating or and heating by means friction being applied to mixed powder so that the metal material powder and the non-metal material powder is fixed; or coated powder obtained from the metal material powder and the non-metal material powder being fixed to fluorocarbon resin by impact force, is applied. Thereby, it is possible to easily cover the fluorocarbon resin with the metal material powder and the non-metal material powder in the method in which the metal material powder and the non-metal material powder are driven in the fluorocarbon resin by mechanical pressure or shearing force, or by impact force. With the use of the thus-obtained powder, a heat or electricity passage can be easily produced, and, even with a small adding amount thereof, the heat conductivity can be improved, or resistance control can be achieved. Further, since distribution between the fluorocarbon resin and the metal can be made uniform, a part in which releasability is degraded may not be likely to occur.

According to the sixty-fourth means, in a method of producing the surface layer of the heating member in any one of the forty-seventh through sixtieth means, the fluorocarbon resin and the metal material and the non-metal material with resin coating or powder in which the metal material and the non-metal material are dispersed in resin are mechanically mixed, the thus-mixed powder is coated on a base material of the heating member electrostatically, and then, heat is given, and thus, a film is obtained. Thereby, it is possible to produce the surface layer of the heating member without changing a conventional fluorocarbon resin coating process, by means of powder adjustment (providing electrification characteristic).

According to the sixty-fifth means, in a method of producing the surface layer of the heating member in any one of the forty-seventh through sixtieth means, the fluorocarbon resin and the metal material and the non-metal material with resin coating or powder in which the metal material and the non-metal material are dispersed in resin are dispersed in water solution, the thus-obtained coating liquid is coated on a base material of the heating member, and then, heat is given, and thus, a film is obtained. Thereby, it is possible to produce the surface layer of the heating member without changing a conventional fluorocarbon resin coating process, by means of powder adjustment (improving dispersibility).

According to the sixty-sixth means, in the heating member surface layer producing method of any one of the sixty-first through sixty-fifth means, heating is carried out to more than a melting point of the fluorocarbon resin. Thereby, the fluorocarbon resin strongly connects mutually, and thus, a film having durability can be produced.

According to the sixty-seventh means, in a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having the different melting points are mixed, and are coated on the base material of the heating member electrostatically, and then, heating is carried out at a temperature lower than the melting point of the fluorocarbon resin particles having the highest melting point, so that a film is obtained. Thereby, it is possible to produce the surface layer of the heating member in the present configuration without changing a conventional fluorocarbon resin coating process, by means of powder adjustment (providing electrification characteristic).

According to the sixty-eighth means, in a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are coated on the base material of the heating member electrostatically so as to laminate them, and then, heating is carried out at a temperature lower than the melting point of the fluorocarbon resin particles having the highest melting point, so that a film is obtain. Thereby, it is possible to produce the surface layer of the heating member in the present configuration without changing a conventional fluorocarbon resin coating process, by means of powder adjustment (providing electrification characteristic).

According to the sixty-ninth means, in a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are mixed and thus coating liquid is produced, the coating liquid is coated on the base material of the heating member, and then, heating is carried out at a temperature lower than the melting point of the fluorocarbon resin particles having the highest melting point, so that film is obtained. Thereby, it is possible to produce the surface layer of the heating member in the present configuration without changing a conventional fluorocarbon resin coating process, by means of powder adjustment (improving dispersibility).

According to the seventieth means, in a method of producing the surface layer of the heating member in any one of the forty-eighth through sixtieth means characterized in that the metal material and the non-metal material are coated on at least fluorocarbon resin particles having the highest melting point from among the plurality of types of fluorocarbon resin particles having different melting points, said plurality of types of fluorocarbon resin particles having different melting points are mixed and thus coating liquids are produced, the coating liquids are coated on the base material of the heating member so as to laminate them, and then, heating is carried out at a temperature lower than the melting point of the fluorocarbon resin particles having the highest melting point, so that film is obtained. Thereby, it is possible to produce the surface layer of the heating member in the present configuration without changing a conventional fluorocarbon resin coating process, by means of powder adjustment (improving dispersibility).

According to the seventy-first means, in the method of producing the heating member surface layer in any one of the sixty-seventh through seventieth means, as one obtained from surface coating of the metal material and the non-metal material on the fluorocarbon resin particles, coated powder obtained from, upon mixing the metal material powder and the non-metal material in the fluorocarbon resin, mechanical pressure and shearing force being applied, and thus external heating or and heating by means friction being applied to mixed powder so that metal material powder and the non-metal material powder are fixed; or coated powder obtained from the metal material powder and the non-metal material powder being fixed to the fluorocarbon resin by impact force. Thereby, it is possible to easily cover the fluorocarbon resin with the metal material powder and the non-metal material powder in the method in which the metal material powder and the non-metal material powder are driven in the fluorocarbon resin by mechanical pressure or shearing force, or by impact force. With the use of the thus-obtained powder, a heat or electricity passage can be easily produced, and, even with a small adding amount thereof, the heat conductivity can be improved, or resistance control can be achieved. Further, since distribution between the fluorocarbon resin and the metal can be made uniform, a part in which releasability is degraded may not likely to occur.

According to the seventy-second means, in a fixing member for contacting a sheet-like recording material, i.e., a to-be-heated member, heating the same, and fixing a non-fixed image on the recording material, the heating member in any one of the forty-ninth through sixty-first means. Thereby, it is possible to obtain the fixing member providing the same advantage as that of any one of fifty-eighth through sixtieth means.

According to the seventy-third means, a heating device comprises exciting means, and a heating member including heating means applying electromagnetic induction heating of heating by generating eddy current in an electrically conductive layer by means of the exciting means, and, as the heating member, the heating member of the fifty-ninth or sixtieth means is applied. Thereby, the surface layer of the heating member acts as an electrically conductive layer, and an eddy current is generated in the electrically conductive layer, whereby heat is generated. Thereby, heat generation by means of electromagnetic induction heating is achieved, the surface temperature of the heating member can be rapidly raised via the thermal conductive layer, and heating efficiency can be improved.

Further, in a configuration in which an elastic layer or a heat insulating layer is provided on a surface of the base material of the heating member on which the surface layer is produced, heat generated from the surface layer is prevented from escaping to the side of the base material, and a to-be-heated member can be efficiently heated.

According to the seventy-fourth means, a heating device comprises two rotating bodies for sandwiching and conveying a sheet-like to-be-heated member and a heating means for heating the rotating bodies, and heats and presses the to-be-heated member, wherein said heating means comprises exciting means and a heating member including heating means applying electromagnetic induction heating of generating heat by generating eddy current in an electrically conductive layer by means of the exciting means, and either one or both of said two rotating bodies comprises the heating member of the fifty-ninth or sixtieth means. Thereby, heat generation can be carried out in the electrically conductive layer part, thus the surface temperature of the rotating bodies can be rapidly raised, and a to-be-heated member can be efficiently heated. Further, in a configuration in which an elastic layer or a heat insulating layer is provided on a surface of the base material of the heating member on which the surface layer is produced, heat generated from the surface layer is prevented from escaping to the side of the base material, and a to-be-heated member can be efficiently heated.

According to the seventy-fifth means, in the heating device of the seventy-fourth means, the two heating means are provided, and the two rotating bodies are heated by the two heating means, respectively. Thereby, a to-be-heated member can be heated from both sides efficiently.

According to the seventy-sixth means, in a fixing method in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, and as the fixing member, the fixing member of the seventy-second means is applied. Thereby, heating efficiency upon fixing can be improved while releasability is maintained.

According to the seventy-seventh means, in the fixing method in the seventy-sixth means, toner including wax is applied, and an image produced on a recording material is fixed. Thus, due to the wax in the toner, the releasability is further improved.

According to the seventy-eighth means, in a fixing method, the heating device of the seventy-third means is applied, and an image produced on a recording material is fixed with the use of toner including wax. Thereby, fixing can be carried out by electromagnetic induction heating, and, while releasability is maintained, heating efficiency upon fixing can be improved. Further, due to the wax in the toner, the releasability is further improved.

According to the seventy-ninth means, in a fixing method, the heating device of the seventy-fourth or seventy-fifth means is applied, one of the two rotating bodies is applied as the fixing member and the other is applied as the pressing member, a recording material, i.e., a to-be-heated member is sandwiched and conveyed with a part at which the fixing member and the pressing member are pressed by one another, and an image produced on the recording material with the use of toner including wax is fixed. Thereby, fixing can be carried out by electromagnetic induction heating, and, while releasability is maintained, heating efficiency upon fixing can be improved. Further, due to the wax in the toner, the releasability is further improved.

According to the eightieth means, in the fixing method in any one of the seventy-sixth, seventy-seventh and seventy-ninth means, releasing agent is coated on at least the fixing member of the fixing member and the pressing member. Thereby, due to the releasing agent, releasability between the toner and the fixing member can be further improved.

According to the eighty-first means, in a fixing device in which, a fixing member supported in such a manner that a circumferential surface thereof turns, and a pressing member to be pressed onto the fixing member are used, a recording material passing through a position at which the pressing member is pressed onto the fixing member is heated and pressed, and thus, a non-fixed image carried by the recording material is fixed, and as the fixing member, the fixing member of the seventy-second means is applied. Thereby, while releasability is maintained, heating efficiency upon fixing can be improved.

According to the eighty-second means, in the fixing device in the eighty-first means, toner including wax is applied, and an image produced on a recording material is fixed. Thereby, releasability further improves due to the wax in the toner.

According to the eighty-third means, in a fixing device, the heating device of the seventy-third means is applied, and an image produced on a sheet-like to-be-heated member is fixed with the use of toner including wax. Thereby, fixing can be carried out by electromagnetic induction heating, and, while releasability is maintained, heating efficiency upon fixing can be improved. Further, due to the wax in the toner, the releasability is further improved.

According to the eighty-fourth means, in a fixing device, the heating device of the seventy-forty or seventy-fifth means is applied, one of the two rotating bodies is applied as the fixing member and the other is applied as the pressing member, a recording material, i.e., a to-be-heated member is sandwiched and conveyed with a part at which the fixing member and the pressing member are pressed by one another, and an image produced on the recording material is fixed with the use of toner including wax. Thereby, fixing can be carried out by electromagnetic induction heating, and, while releasability is maintained, heating efficiency upon fixing can be improved. Further, due to the wax in the toner, the releasability is further improved.

According to the eighty-fifth means, in the fixing device in any one of the eighty-first, eighty-second, and eighty-fourth means, releasing agent is coated on at least the fixing member of the fixing member and the pressing member. Thereby, due to the releasing agent, releasability between the toner and the fixing member contacting the toner further improves.

According to the eighty-sixth means, in the fixing device in any one of the eighty-first, eighty-second, eighty-fourth and eighty-fifth means, a quotient obtained from dividing a pressing force F [kgf] of the fixing member and the pressing member against the recording material by an area S [$cm^2$] of a contact portion in which both are pressed by one another is equal to or more than 0.5 [$kgf/cm^2$]. In many cases fixing with toner depends on the pressure, and, in particular, image fixing performance improves as a result of the pressure equal to or more than 0.5 [$kgf/cm^2$].

According to the eighty-seventh means, in the fixing device in any one of the eighty-first, eighty-second, eighty-fourth, eighty-fifth and eighty-sixth means, a quotient obtained from dividing a pressing force F [kgf] of the fixing member and the pressing member against the recording material by an area S [$cm^2$] of a contact portion in which both are pressed by one another is equal to or less than 4.0 [$kgf/cm^2$]. In a condition of equal to or more than 4.0 [$kgf/cm^2$], wax of the toner or releasing agent such as silicon oil exits from the toner resin and roller releasing layer. In contrast thereto, on equal to or less than this pressure, the releasability can be maintained.

In the above-mentioned heating member (fixing member) concerning the present invention, the releasing layer is good thermal conductive layer, and thus, temperature lowering on the heating member (fixing member) surface occurring due to conventional low thermal conductivity fluorocarbon resin material can be reduced. Thereby, when it is applied as a fixing member of an image forming apparatus, paper feeding speed reduction, which is carried out upon surface temperature lowering in a conventional image forming apparatus upon successive paper feeding should not be carried out, and stable image production is achieved. Further, improvement of thermal conductivity may also be evaluated from measurement of cold offset temperature which is a lowest temperature of a fixing member at which non-fixed image can be fixed. According to the present invention, the heating efficiency upon fixing can be improved, a fixing member in which productivity of image forming can be improved can be provided, and a fixing device with the use thereof can be provided.

Further, in the heating member according to the present invention, the surface layer has the thermal conductive layer and the electrically conductive layer which is provided to the side of the base material with respect to the thermal conductive layer and generates heat as a result of generating an eddy current, and the thermal conductive layer also acts as a releasing layer. Thereby, it is possible to shorten a starting up time upon heating. Further, since silicon rubber or such which is used for image quality improvement commonly can be placed at a position rear with respect to the heat generating part (on the side of the base material). Therefore, a time lag for heating can be minimized. Furthermore, commonly, since fluorocarbon resin which is necessary for maintaining releasability has low thermal conductivity, the heating efficiency is degraded. However, according to the present invention, the releasing layer also acts as the thermal conductive layer. Accordingly, it is very advantageous.

According to the eighty-eighth means, in an image forming apparatus provided with an image forming part producing a toner image on a sheet-like recording material, and a fixing part fixing the toner image onto the recording material, such a fixing method is applied in the fixing part that, in the fixing part, the heating member (fixing member) is applied having the surface layer including the thermal conductive layer having high releasability and the electrically conductive layer which is provided to the side of the base material with respect to the thermal conductive layer and has an eddy current generated there and thus has heat generated therefrom. As a result, the image forming apparatus having high durability and high reliability, as well as superior energy efficiency can be provided.

According to the eighty-ninth means, in an image forming apparatus provided with an image forming part producing a toner image on a sheet-like recording material, and a fixing part fixing the toner image onto the recording material: such a fixing device is provided in the fixing part that, in the fixing part, the heating member (fixing member) is applied having the surface layer including the thermal conductive layer having high releasability and the electrically conductive layer which is provided to the side of the base material with respect to the thermal conductive layer and has an eddy current generated there and thus has heat generated therefrom. As a result, the image forming apparatus having high durability and high reliability, as well as superior energy efficiency can be provided.

According to the ninetieth means, as a result of good thermal conductive substance contacting successively, thermal conductivity which cannot be achieved from simply dispersed state can be obtained, and temperature lowering upon heating in the fixing member can be reduced. Further, since the good thermal conductive substance adding amount can be reduced, it is possible to reduce degradation of releasability to such a level that it can be substantially ignored.

According to the ninety-first means, upon producing the surface layer, the good thermal conductive substance having low melting point covers a surface of the good thermal conductive substance having shape anisotropy or adheres to the surface, diffusion can be controlled, and production of a thermal conductive path by means of the melting good thermal conducive substance having low melting point is accelerated. Thereby, thermal conductivity can be sufficiently improved.

According to the ninety-second means, when various thicknesses are required for the surface layer of the fixing member, a heat passage can be effectively produced merely by stacking the structure of spherical shells contacting successively.

According to the ninety-third means, by controlling a size and a distribution of the good thermal conductive substance, macroscopic surface energy in a state of sole fluorocarbon resin can be held, whereby toner's releasability can be ensured. This is because exposure of small good thermal conductive substance part does not affect macroscopic contact angle much.

According to the ninety-fourth means, glossiness improves due to the roller having a smooth surface since, for image quality, in particular for a solid image, a surface of the fixing member is transferred.

According to the ninety-fifth means, the relevant configuration can be produced without remarkably changing a conventional fluorocarbon resin coating process by means of powder adjustment (providing electrification characteristic).

According to the ninety-sixth means, it is possible to relatively easily cover the fluorocarbon resin by the metal powder by the method of driving the metal powder in and fixing the same to the fluorocarbon resin with mechanical pressure and shearing force, or impact force. With the use of the thus-obtained powder, a heat or electricity passage can be easily produced, and, thermal conductivity or electrical conductivity can be improved by a reduced metal adding amount. Further, since distribution of the fluorocarbon resin and metal can be made uniform, a part at which releasability is bad is hardly produced.

According to the ninety-seventh or ninety-eighth means, by means of the releasing agent, releasability between the toner and the fixing member contacting the toner improves.

According to the ninety-ninth means, in many cases fixing with toner depends on the pressure. In particular, by applying the pressure equal to or more than 0.5 [kgf/cm$^2$], image fixing performance improves.

According to the hundredth means, in a condition of equal to or more than 4.0 [kgf/cm$^2$], wax of the toner or releasing agent such as silicon oil exits from the toner resin and roller releasing layer. In contrast thereto, on equal to or less than this pressure, the releasability can be maintained.

According to the hundred first means, by applying the roller with the surface layer having high releasability and thermal conductivity, the image forming apparatus with high reliability and good energy efficiency can be provided.

According to the hundred second means, as a result of varistor powder connecting, electric characteristics not achievable from a simply dispersed state can be obtained, electric characteristics upon fixing with the fixing member is controlled, and thus, toner dust or such can be reduced. Further, a powder adding amount can be reduced, and thus, lowering of releasability can be reduced so as to be substantially ignored.

According to the hundred third means, as a result of varistor powder connecting, electric characteristics not achievable from a simply dispersed state can be obtained, electric characteristics upon fixing with the fixing member is controlled, and thus, toner dust or such can be reduced. Further, a powder adding amount can be reduced, and thus, lowering of releasability can be reduced so as to be substantially ignored.

According to the hundred fourth means, it is possible to relatively easily cover the fluorocarbon resin by the metal powder by the method of driving the metal powder in and fixing the same to the fluorocarbon resin with mechanical pressure and shearing force, or impact force. With the use of the thus-obtained powder, a heat or electricity passage can be easily produced, and, electrical characteristics can be improved by a reduced metal adding amount. Further, since distribution of the fluorocarbon resin and varistor powder can be made uniform, a part at which releasability is bad is hardly generated.

According to the hundred fifth means, by undergoing a process of heating to more than the melting point of fluorocarbon resin, the fluorocarbon resin mutually connects strongly, and thereby, a film with durability can be produced.

According to the hundred sixth means, even when various strengths or rigidities are required for the surface layer of the fixing member, the surface layer having good electric characteristics and meeting the requirements can be produced.

According to the hundred seventh means, more stable electric potential characteristics can be produced by means of adding of praseodymium or such.

According to the hundred eighth means, powder adjustment (providing electrification characteristic) is easy, the present configuration can be produced without remarkably changing the conventional fluorocarbon resin coating process, and productivity can be improved.

According to the hundred ninth means, powder adjustment (improving dispersibility) is easy, the present configuration can be produced without remarkably changing the conventional fluorocarbon resin coating process, and productivity can be improved.

According to the hundred tenth means, by controlling a size and a distribution of the good thermal conductive substance, macroscopic surface energy in s state of sole fluorocarbon resin can be held, whereby toner's releasability can be ensured. This is because exposure of small good thermal conductive substance part does not affect macroscopic contact angle much.

According to the hundred eleventh means, by controlling a size and a distribution of the powder of the particles having the varistor characteristics according to the present configuration including the hundred ninth means, macroscopic surface energy in s state of sole fluorocarbon resin can be held, whereby toner's releasability can be ensured. This is because exposure of small good thermal conductive substance part does not affect macroscopic contact angle much.

According to the hundred twelfth means, durability of the material remarkably degrades since the metal melted due to stress is destroyed at a temperature higher than the melting point.

According to the hundred thirteenth means, as to image quality, in particular, for a solid image, glossiness improves due to the roller with the smooth surface since the surface of the fixing member is transferred.

According to the hundred fourteenth or hundred fifteenth means, releasability improves due to the wax in the toner, According to the hundred sixteenth or hundred seventeenth means, releasability between the toner and the fixing member contacting the toner improves due to the releasing agent.

According to the hundred eighteenth means, in many cases fixing with toner depends on the pressure. In particular, by applying the pressure equal to or more than 0.5 [kgf/cm$^2$], image fixing performance improves.

According to the hundred nineteenth means, in a condition of equal to or more than 4.0 [kgf/cm$^2$], wax of the toner or releasing agent such as silicon oil exits from the toner resin and roller releasing layer. In contrast thereto, on equal to or less than this pressure, the releasability can be maintained.

According to the hundred twentieth means, by applying the roller with the surface layer having high releasability and high thermal conductivity, the image forming apparatus with high reliability and good energy efficiency can be provided.

According to the hundred twenty-first means, since the releasing layer part can be made to generate heat, the temperature a to-be-heated member can be rapidly raised. Further, by means of the configuration with the fluorocarbon resin, releasability and adherence can be ensured.

According to the hundred twenty-second means, since the releasing layer part can be made to generate heat, the surface temperature of the fixing roller can be rapidly raised. Further, by means of the configuration with the fluorocarbon resin, releasability can be ensured.

According to the hundred twenty-third means, since the metal plated layer is connected, a configuration in which an eddy current is made to flow due to electromagnetic induction can be achieved.

According to the hundred twenty-fourth means, metal plated layers can be mutually metallically bonded easily with low melting point metals. Thereby, an eddy current efficiently flows, and thus efficient heat generation can be achieved by means of induction heating.

According to the hundred twenty-fifth means, the releasing layer can be made to act as a heat generation lawyer, this can be applied as the surface layer, and therewith, efficient fixing can be achieved.

According to the hundred twenty-sixth means, including the configuration of the hundred twenty-seventh means, by controlling a size and a distribution of the metal, macroscopic surface energy in s state of sole fluorocarbon resin can be held in the metal of the present configuration, whereby toner's releasability can be ensured. This is because exposure of small metal part does not affect macroscopic contact angle much.

According to the hundred twenty-seventh means, by controlling a size and a distribution of the metal, macroscopic surface energy in a state of sole fluorocarbon resin can be held, whereby toner's releasability can be ensured. This is because exposure of small metal part does not affect macroscopic contact angle much.

According to the hundred twenty-eighth means, it is possible to produce the present configuration without changing a conventional fluorocarbon resin coating process, by means of powder adjustment.

According to the hundred twenty-ninth means, it is possible to produce the present configuration without changing a conventional fluorocarbon resin coating process, by means of powder adjustment (improving dispersibility).

According to the hundred thirtieth means, durability of the material remarkably degrades since the metal melted due to stress is destroyed at a temperature higher than the melting point.

According to the hundred thirty-first means, as to image quality, in particular, for a solid image, glossiness improves due to the roller with the smooth surface since the surface of the fixing member is transferred.

According to the hundred thirty-second means, since fixing on both sides can be carried out at once, printing productivity improves.

According to the hundred thirty-third or hundred thirty-fourth means, releasability improves due to the wax in the toner.

According to the hundred thirty-fifth or hundred thirty-sixth means, releasability between the toner and the fixing member contacting the toner improves due to the releasing agent.

According to the hundred thirty-seventh means, in many cases fixing with toner depends on the pressure. In particular, by applying the pressure equal to or more than 0.5 [kgf/cm$^2$], image fixing performance improves.

According to the hundred thirty-eighth means, in a condition of equal to or more than 4.0 [kgf/cm$^2$], wax of the toner or releasing agent such as silicon oil exits from the toner resin and roller releasing layer. In contrast thereto, on equal to or less than this pressure, the releasability can be maintained.

According to the hundred thirty-ninth means, by applying the roller with the surface layer having highly releasable heat-generation surface layer, the image forming apparatus with high reliability and good energy efficiency can be provided.

DESCRIPTION OF REFERENCE NUMERALS

1: photosensitive body; 2: charging roller; 3: optical scanning device; 4: developing device; 5: transfer roller; 6, 6A, 6B, 6C: fixing device (heating device); 7: cleaning device; 8: electricity removal device; 11, 11A, 11B, 11C: fixing roller (fixing member (heating member)); 12: magnetic flux generating coil (heating means); 13: pressing roller (pressing member); 14: halogen heater (heat generating means); 15: surface layer; 16: temperature detecting device; 17: base material (core metal); 18: heat insulating layer (or elastic layer); 19A, 19B: releasing agent coating member; 21: core; 30: Litz wire; 41: fluorocarbon resin; 41A: fluorocarbon resin having high melting point; 41B: fluorocarbon resin having low melting point; 42: successively contacting part; 43: fluorocarbon resin; 44: metal powder (or metal filler); 44*a*: metal material; 44*b*: non-metal material

BEST MODE FOR CARRYING OUT THE PRESENT INVENTION

Embodiments of a heating member, a fixing member, a heating device, a fixing device and an image forming apparatus will now be described with reference to figures.

Figure 1:
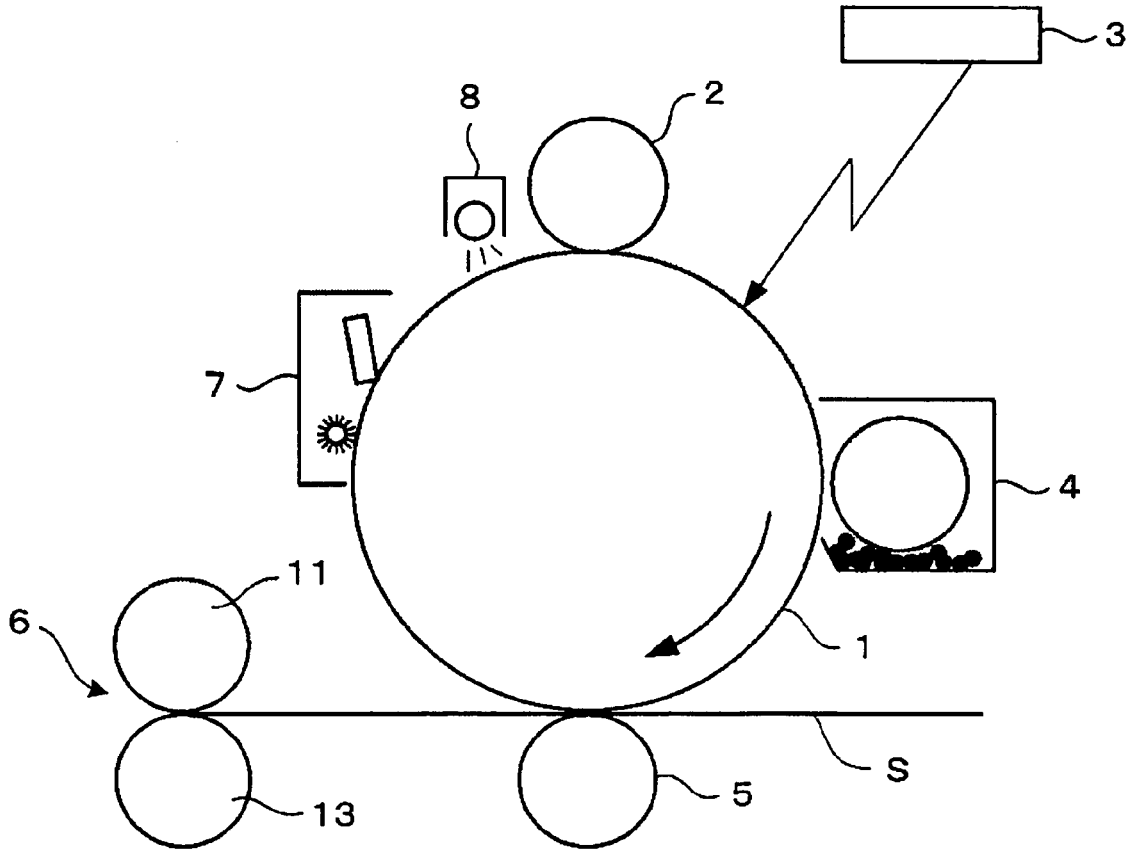
FIG. 1 is a general configuration diagram of an image forming apparatus showing one execution mode according to embodiments 1 through 7 of the present invention.

FIG. 1 shows a general configuration diagram showing one embodiment of an image forming apparatus according to the present invention. The image forming apparatus obtains an image on a sheet-like to-be-heated member (recording material such as recording paper, OHP sheet, a post card or such) by carrying out a well-known electrophotographic type image forming process and electrostatic transferring process; and has a photoconductive photosensitive body 1 acting as an image carrying body configured to have a cylindrical shape. Around the photosensitive body 1, a charging roller 2 as electric charging means, a developing device 4, a transfer roller 5, a cleaning device 6 and an electricity removal device 8 are disposed. Other than them, the image forming apparatus 3 has an optical scanning device 3 and a fixing device 6. As the electrical charging means, other than the charging rollers 2, a corona charger may be applied. Further, as the transferring means, other than the transfer roller 5, a transfer charger, a transfer belt or such may be applied.

The optical scanning device 3 includes a light source such as a semiconductor laser (LD) or such, an optical deflector and an imaging optical system; carries out exposure of the photosensitive surface by means of optical scanning between the charging roller 2 and the developing device 4; and forming an electrostatic latent image corresponding to image data. Instead of the optical scanning device 3, an optical writing device employing a light emitting diode (LED), a liquid crystal shutter array or such may be applied.

The developing device 4 uses a single-component developer including a toner or a two-component developer including a toner and a magnetic carrier, and develops the electrostatic latent image on the photosensitive body 1.

The cleaning device 7 cleans the photosensitive body of residual toner, paper dust or such by means of a cleaning blade, a cleaning brush or such.

The fixing device 6 includes a roller-shaped fixing member (fixing roller) 11 having heat generating means, and a roller-shaped pressing member (pressing roller) 13 being pressed on the fixing roller 11A; conveys a sheet-like to-be-heated member S with sandwiching it at a pressed contact part; and fixes a non-fixed image on the to-be-heated member. As the heat generating means, a halogen heater or an electric heater disposed inside of the fixing roller 11 may be applied, or, instead, according to an electromagnetic induction manner, the fixing roller itself is caused to act as the heat generating means.

When image forming is carried out in the image forming apparatus shown in FIG. 1, the photosensitive body 1 is rotated clockwise, and the surface thereof is uniformly charged by the charging roller 2. Then, according to image data of an original read by means of an original reading part not shown, or image data input from an external device (a personal computer, a word processor or such), or image data transmitted via a communication network, driving of the optical scanning device 3 is controlled, and the electrostatic latent image is formed on the surface of the photosensitive body 1 by means of the exposure by the optical scanning device 3. This electrostatic latent image is developed in an inverted manner by the toner in the developing device 4, and a toner image is formed on the surface of the photosensitive body 1. This toner image has the sheet-like to-be-heated member (for example, recording paper) S placed thereon, which to-be-heated member S is fed to a transfer part by means of a paper feeding mechanism not shown, in timing with a movement of the toner image to the transfer part on the photosensitive body 1; and, by a function of the transfer roller 5, the toner image is transferred to the recording paper S in an electrostatic manner. The toner image of the recording paper S on which the toner image is thus transferred is fixed by the fixing device 6, and then, the recording paper S is ejected to an ejecting part not shown outside of the apparatus. Residual toner or paper dust on the surface of the photosensitive body 1 from which the toner image is thus transferred to the recording paper S is removed by the cleaning device 7, and further, the electricity removing device 8 removes electricity from the surface of the photosensitive body 1.

Figure 2:
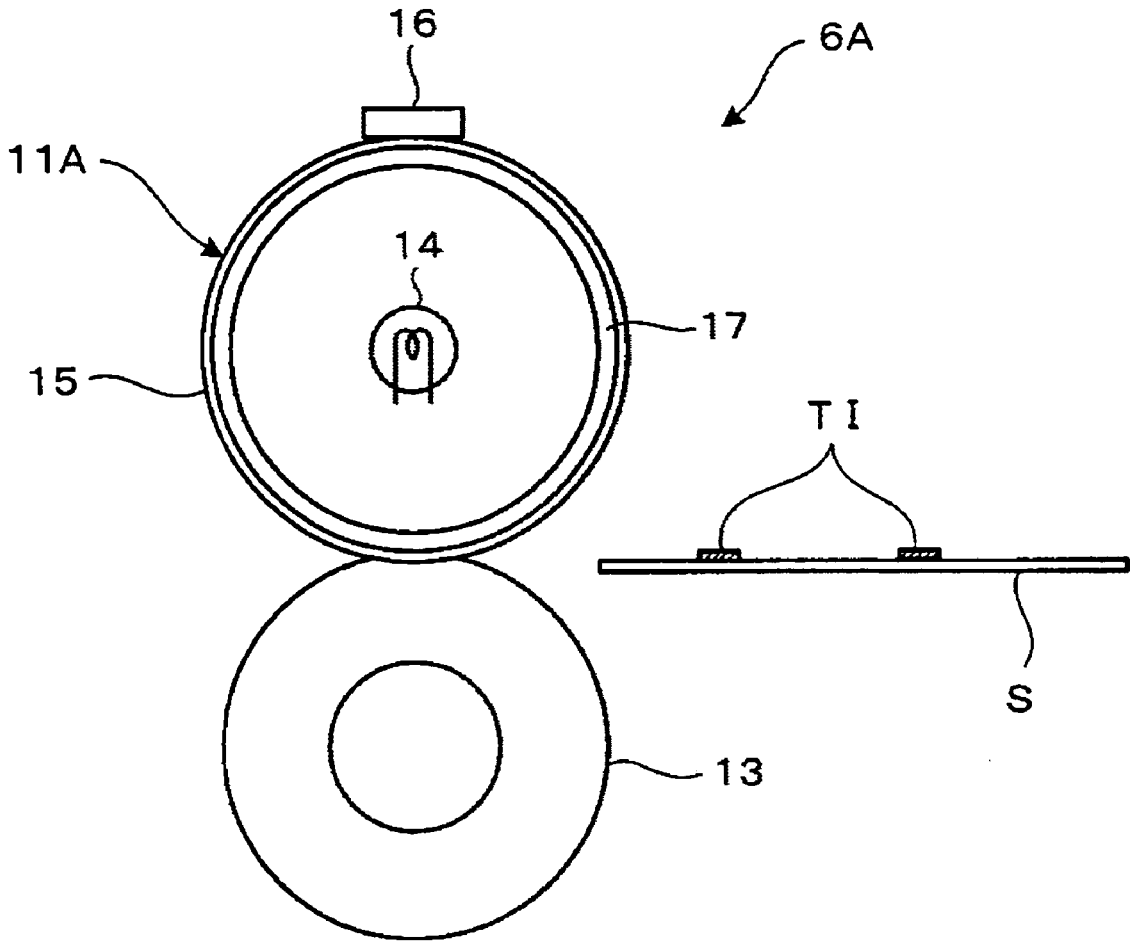
FIG. 2 is a general sectional diagram of a fixing device showing one execution mode according to embodiments 1 through 7 of the present invention.

Next, a configuration example of the fixing device 6 employed in the image forming apparatus shown in FIG. 1 is described. FIG. 2 is a general configuration diagram showing one embodiment of the fixing device employing the heating member (fixing member) according to the present invention. This fixing device 6A includes a roller-shaped fixing roller 11A, a pressing member (pressing roller) 13 pressed on the fixing roller 11A, heat generating means (for example, a halogen lamp) 14 disposed inside of a base material of the fixing roller 11A, and a temperature detecting device (for example, thermistor) 16 for detecting a temperature of a surface temperature of the fixing roller 11A. The fixing roller 11A pressed to the pressing roller 13 is rotated clockwise, and conveys a sheet-like recording material (for example, a recording paper) S having a non-fixed toner image thereon to be fixed, in a direction of an arrow with sandwiching it between the fixing roller 11A and the pressing roller 13. The halogen lamp 14 as heat generating means heats the fixing roller 11*a* from the inside, and a surface layer 15 is heated via the base material of the fixing roller 11A. The surface temperature of the fixing roller 11A is detected by the temperature detecting device 16, and the thus-detected temperature is fed back to a control part not shown, and the surface temperature of the fixing roller is controlled.

According to the present embodiment, the surface layer of the fixing roller 11A is produced on a surface of the fixing roller 11*a*, in which surface layer 15, material (for example, metal) having thermal conductivity is mixed into resin material (for example, fluorocarbon resin) having releasability, and a configuration is provided such that the material (for example, metal) having thermal conductivity successively contacts. The configuration of the surface layer 15 is described later. Alternatively, in another embodiment (FIGS. 23 through 43), the surface layer 15 is configured such that, in resin material (for example, fluorocarbon resin) having releasability, material (for example, metal material and non-metal materiel) having thermal conductivity is mixed, and the material (for example, metal material and non-metal material) contacts successively. The configuration of the surface layer is described later.

Figure 3:
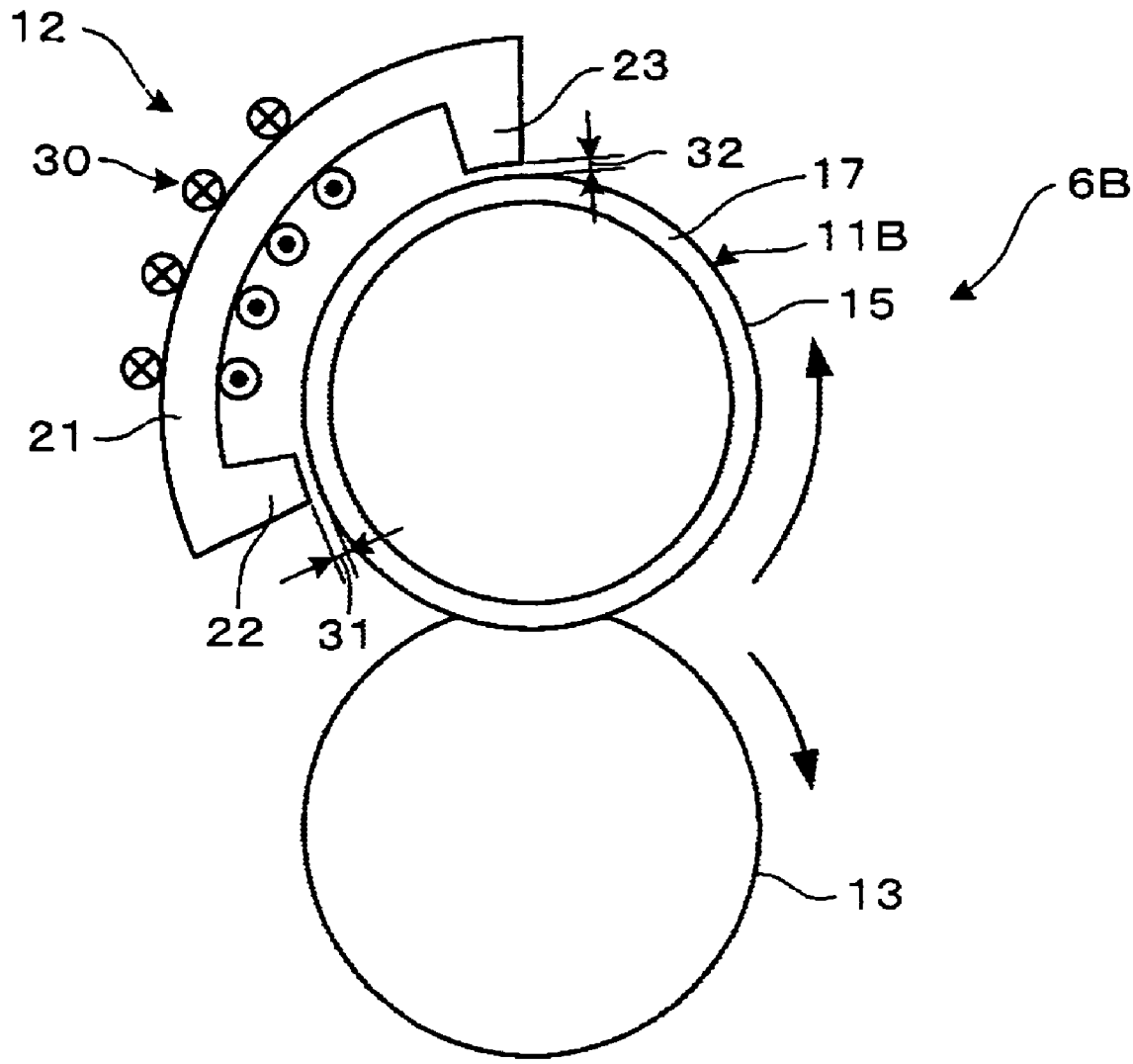
FIG. 3 is a general sectional diagram of a fixing device showing another execution mode according to embodiments 1 through 7 of the present invention.

FIG. 3 is a general configuration diagram showing an embodiment of the fixing device 6B made of a heating device in an electromagnetic induction heating manner employing a heating member according to the present invention. Further, FIG. 3 shows spatial relationship between two rotating bodies (for example, the fixing roller 11*a* and the pressing roller 13), and the heating means (magnetic flux generating coil) 12. In FIG. 3, the reference numeral 11B denotes the fixing roller, 13 denotes the pressing roller, 21 denotes a core of the magnetic flux generating coil 12, 30 denotes Litz wires of the magnetic flux generating coil 12, 32 and 32 denote gaps between projecting parts 22 and 23 of the core 21 and an external surface of the fixing roller 11B. In FIG. 3, for the purpose of easily understanding, dimensions of the respective parts are different from real ones. Further, sections of the Litz wires include only eight sections with omission of many thereof.

The magnetic flux generating coil 12 is disposed at a position as shown in FIG. 3, with respect to the fixing roller 11B. That is, the magnetic flux generating coil 12 is disposed to cause the projecting parts 22 and 23 of the core 21 to face the fixing roller 11*b* in such a manner that the core 21 covers an end of an eternal circumferential surface of the fixing roller 11B near to a nip part other than the nip part. Also, arrangement is made such that a separation between the projecting parts 22 and 23 of the core 21 and the external surface of the fixing roller 11B is fixed. The more the projecting parts 22 and 23 of the core 21 approach the external surface of the fixing roller 11A, the fixing roller 11A can be efficiently heated by means of electromagnetic induction heating. According to the present invention, the gap between the projecting parts 22 and 23 of the core 21 and the external surface of the fixing roller 11B is determined as 1 mm. A height of the projecting parts 22 and 23 of the core 21 is ensured so that a gap between the Litz wires 30 and the external surface of the fixing roller 11B is longer than the gap between the projecting parts 22 and 23 of the core 21 and the external surface of the fixing roller 11A. Thereby, when the gap between the projecting parts 22 and 23 of the core 21 and the external surface of the fixing roller 11B is ensured, the Litz wires 30 do not contact the external surface of the fixing roller 11B. Thus, the fixing roller B is not damaged. Accordingly, contact between the magnetic flux generating coil 12 and the fixing roller 11B can be easily avoided.

In the present embodiment, the surface layer 15 of the fixing roller 15B is produced on a surface of the fixing roller 11B, in which surface layer 15, in resin material (for example, fluorocarbon resin) having releasability, material (for example, a metal) having an electrical conductivity is mixed, and the material (for example, metal) having electrical conductivity contacts successively. The surface layer 15 functions as an electrically conductive layer (heat generating means). Alternatively, in another embodiment (FIGS. 23 through 43), in resin material (for example, fluorocarbon resin) having releasability, metal material having thermal conductivity and non-metal material having thermal conductivity are mixed. Further, a thermal conductive layer in which the metal material having thermal conductivity and non-metal material having thermal conductivity contact successively and an electrical conducive layer provided on the side of the base material with respect to this thermal conductive layer and being able to generate heat by generating an eddy current are provided. The electrically conductive layer acts as heat generating means. Accordingly, by means of electromagnetic induction of the magnetic flux generating coil 12, an eddy current is generated in the surface layer (electrically conductive layer) 15 of the fixing roller 11B, and thus, heat is generated. A configuration of the surface layer is described later.

In the example of FIG. 3, the magnetic flux generating coil 12 as heating means is provided only in the upper roller 11B. However, by configuring such that also the lower roller 13 has an electrically conductive layer the same as in the fixing roller 11, heating means (magnetic flux generating coil) may be provided, and thereby, (that is, as a result of magnetic flux generating coils being provided in the two rollers, respectively), the to-be-heated member (recording paper or such) can be heated from both sides.

Figure 4:
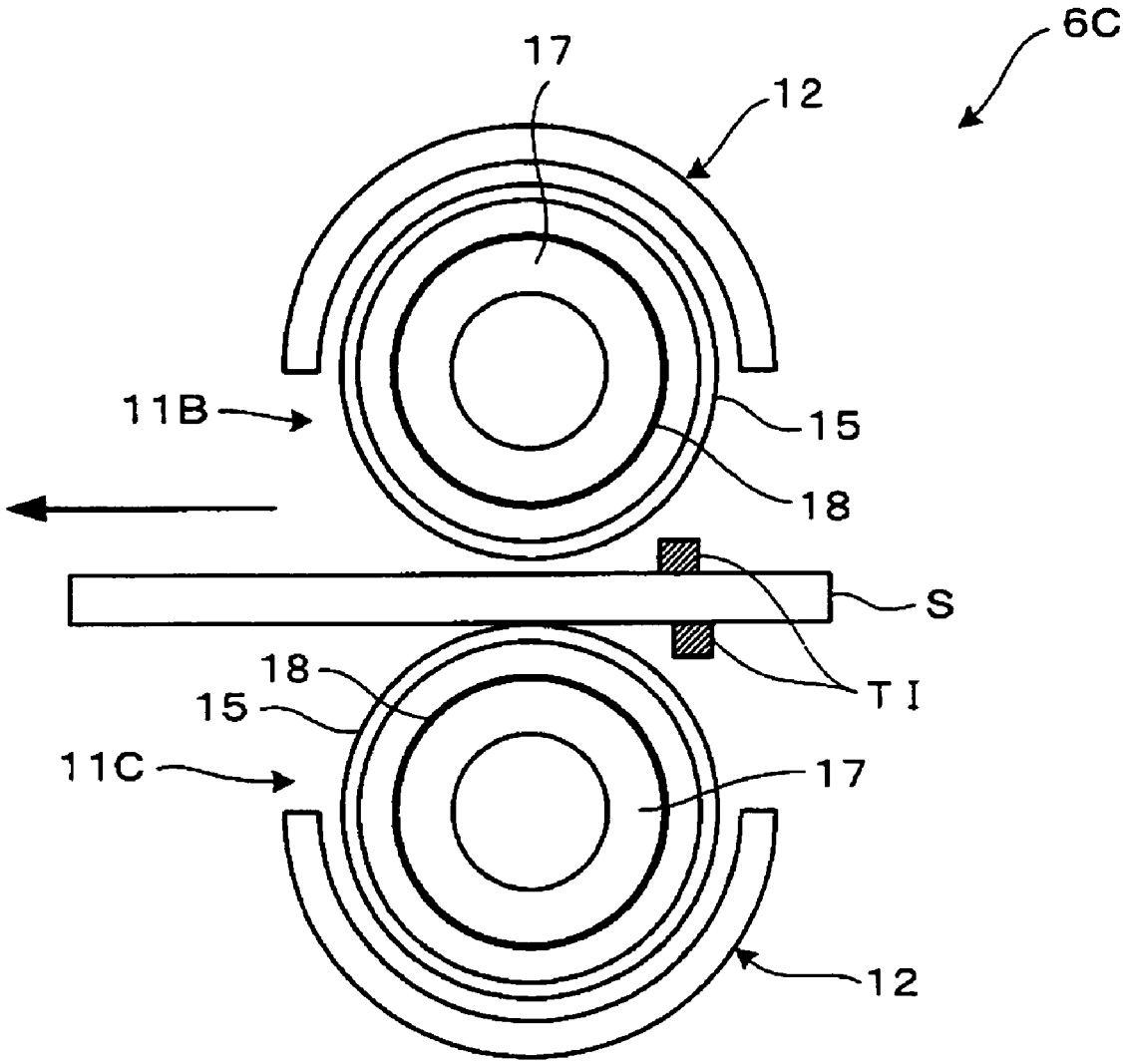
FIG. 4 is a general sectional diagram of a fixing device showing further another execution mode according to embodiments 1 through 7 of the present invention.

FIG. 4 shows one example thereof, and in a fixing device 6C, both two rotating bodies 11B and 11C are configured by heating members, and both the rotating bodies have heating means (magnetic flux generating coils) 12 in an electromagnetic induction heating type. That is, in the configuration of FIG. 4, the two rotating bodies 11B and 11C are fixing rollers (fixing members), and surface layers 15 of the fixing rollers 11B and 11C are formed on surfaces of the fixing rollers 11B and 11C. In the surface layers 15, in resin material (for example, fluorocarbon resin) having releasability, material (for example, a metal) having an electrical conductivity is mixed, and the material (for example, metal) having electrical conductivity contacts successively. The surface layer 15 functions as an electrically conductive layer (heat generating means). Alternatively, in another embodiment (FIGS. 23 through 43), in resin material (for example, fluorocarbon resin) having releasability, metal material having thermal conductivity and non-metal material having thermal conductivity are mixed. Further, a thermal conductive layer in which the metal material having thermal conductivity and non-metal material having thermal conductivity contact successively and an electrical conducive layer provided on the side of the base material with respect to this thermal conductive layer and being able to generate heat by generating an eddy current are provided. The electrically conductive layer acts as heat generating means. Accordingly, by means of electromagnetic induction of the magnetic flux generating coil 12, an eddy current is generated in the surface layers (electrically conductive layers) 15 of the two fixing rollers 11B and 11C, and thus, heat is generated there. Thus, non-fixed toner images TI formed on both sides of the recording paper S can be heated efficiently and fixed. Further, in the configuration of FIG. 4, in the two fixing rollers 11B and 11C, heat insulating layers (or elastic layers) 18 made of silicon rubber or such are provided between core metals (base materials) 17 and the surface layers 15, and therewith, heat generated in the surface layers 15 is prevented from escaping to the side of the core materials 17. Accordingly, starting up upon heating is rapidly carried out, and also, heating efficiency is remarkably improved. As to the surface layers and heat insulating layers (or elastic layer), description is made later.

Figure 5:
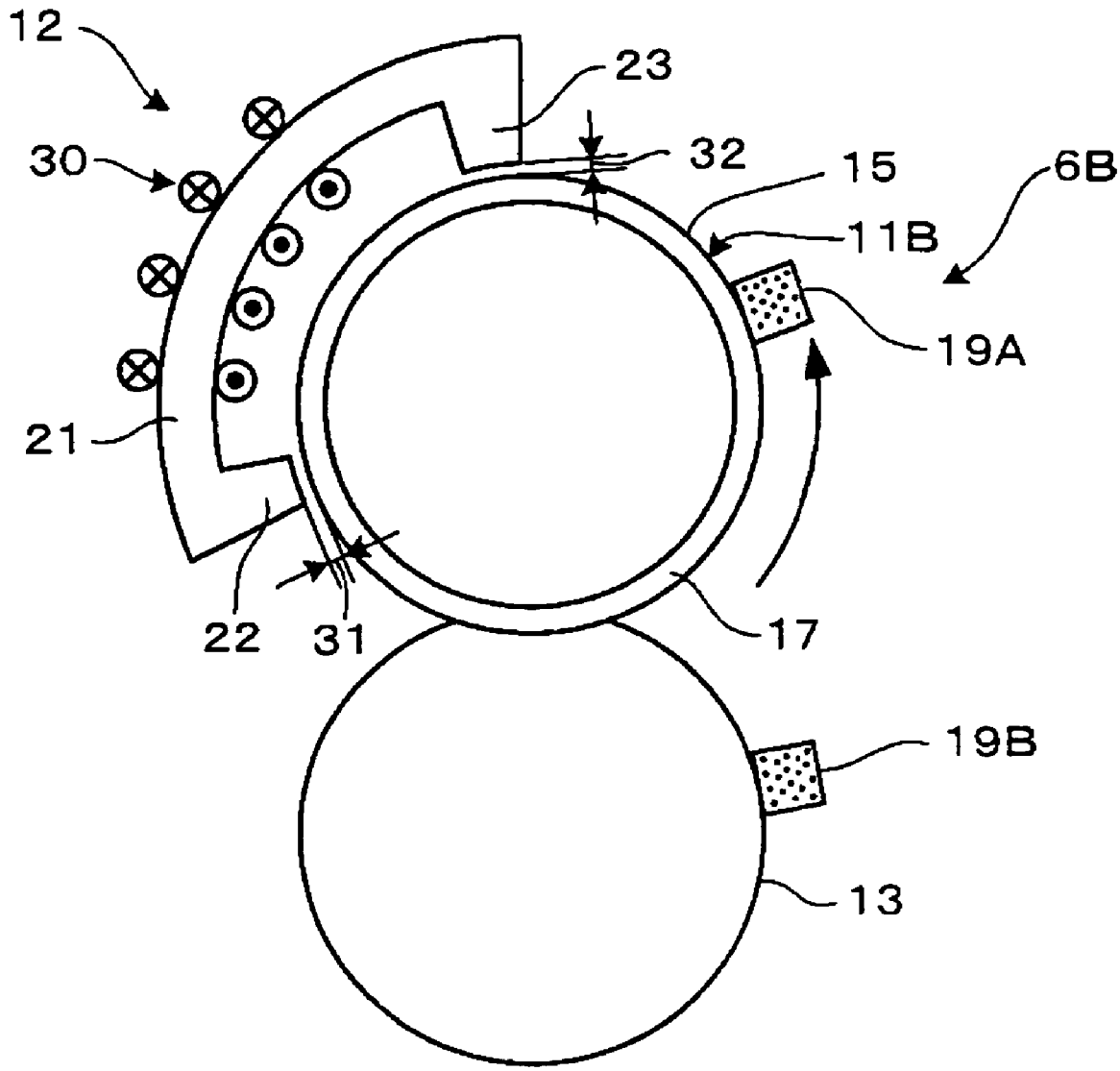
FIG. 5 is a general sectional diagram of a fixing device showing further another execution mode according to embodiments 1 through 7 of the present invention.

FIG. 5 shows a general configuration diagram showing another embodiment of a fixing means made of a heating device in an electromagnetic induction heating type employing a heating member according to the present invention. A configuration of this fixing device 6B is the same as that of FIG. 3. However, coating members 19A and 19B are provided to coat releasing agent (for example, silicon oil) on surfaces of the fixing roller 11B and pressing roller 13, respectively. In this fixing device, the coating members 19A and 19B coat releasing agent to the roller surfaces, and thus, releasability on the roller surfaces can be improved.

In FIG. 5, the releasing agent coating members are provided for both the fixing roller 11A and pressing roller 13. However, the same should be provided only at least for the fixing roller 11B. Further such releasing agent coating members may preferably be provided for the fixing roller 11A of the fixing device of FIG. 2, the fixing rollers 11B and 11C of the fixing device of FIG. 4.

Thus, the configuration examples of the image forming apparatus and the fixing device (heating device) employed in the image forming apparatus have been described. However, as the fixing member (heating member) of the fixing device according to the present invention is not limited to one of a roller shape, but a fixing member (fixing belt) having a shape of an endless belt may be applied. When the fixing belt is applied, a method in which a heating member (halogen heater or such) is provided in a roller or such supporting the fixing belt, a method in which a heating means such as a thermal head is made to contact a reverse side (a surface on the side of the base material) of the fixing belt, a method in which the fixing belt itself is heated by itself acting as heating means by means of electromagnetic induction heating manner, or such may be applied.

Thus, the present invention is characterized in a configuration of the surface layer of the fixing member (heating member) having a roller shape or an endless belt shape employed in the fixing device (heating device), and, while releasability of the surface layer of the fixing member (heating member) is maintained, thermal conductivity or electrical conductivity is improved, and heating efficiency is improved. A configuration of the surface layer of the fixing member (heating member) is described below.

Figure 6:
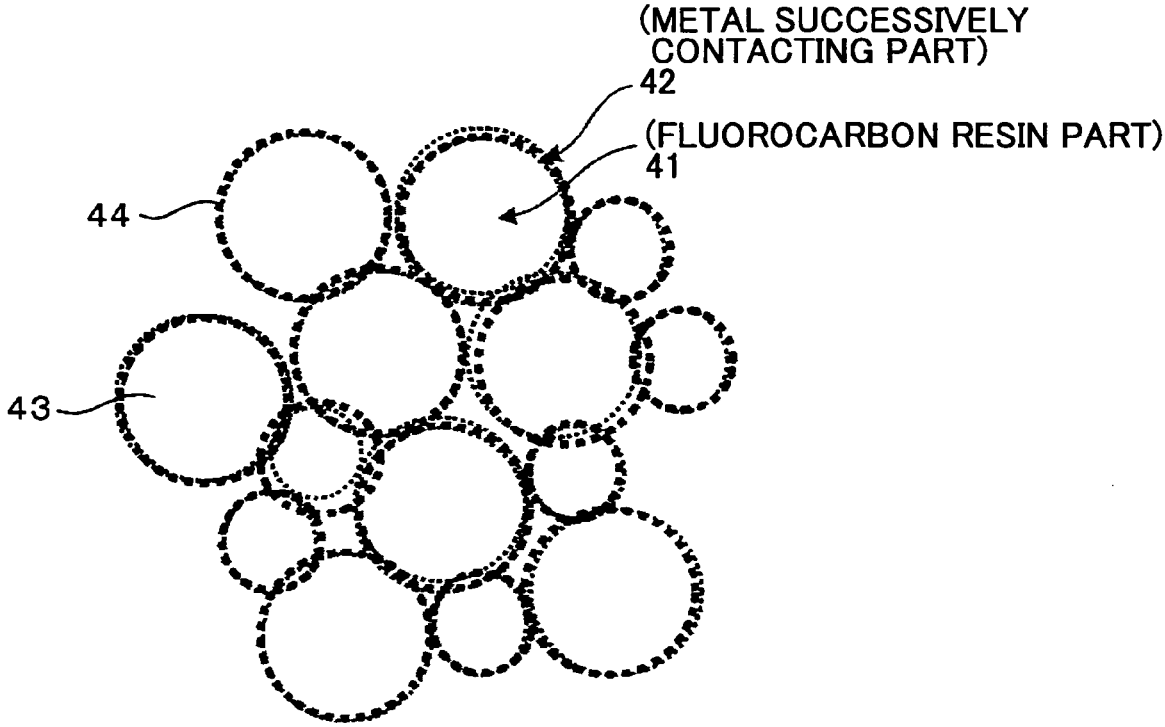
FIG. 6 is a diagram showing a configuration example of a surface layer of a heating member (fixing member) according to embodiments 1 through 7 of the present invention, and showing a sectional view in a direction along a surface of a part of the surface layer.
Figure 7:
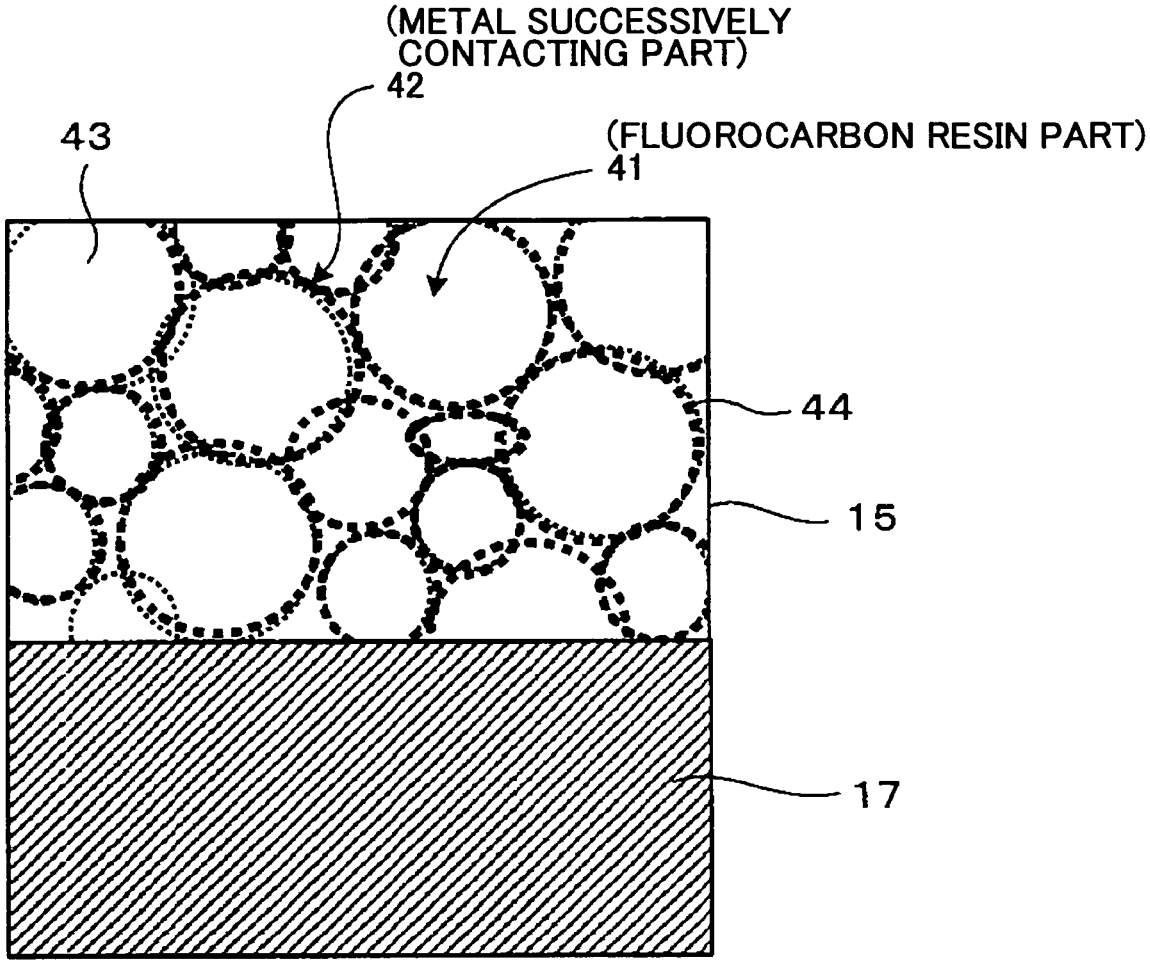
FIG. 7 is a diagram showing a configuration example of a surface layer of a heating member (fixing member) according to embodiments 1 through 7 of the present invention, and showing a sectional view in a direction perpendicular to the surface of the part of the surface layer.

FIG. 6 shows a configuration example of the surface layer 15 in the fixing member (heating member) according to embodiments 1 through 7, and shows a horizontal section (section along the surface) of a part of the surface layer. In this example, a state is shown in which a metal successively contacting part 42 is produced in which, around a fluorocarbon resin part 41 as a body material, metal (metal particles, metal fillers, or metal spherical shells) 44 contacts successively. The fluorocarbon resin part 41 occupies large area, and releasability is ensured. The metal successively contacting part 41 has on the order of 5% in area. However, since almost all the metal 44 contacts successively, contribution to thermal conductivity or electrical conductivity is large. Further, thermal conductivity or electrical conductivity in a horizontal direction is high. There, 'successively contacting' means a state in which more than two good thermal or electrically conductive particles (or good conductive fillers or spherical shells) contact. FIG. 7 shows a vertical section of a part of the surface layer 15. The same as the horizontal section, also metal successively contacting part continues from the surface to a base plate (base material) 17, and contributes to thermal conductivity or electrical conductivity.

It is noted that, different from carbon particles or such, metal particles or such described here do not provide conductivity unless they contacts positively. Further, they cannot substantially contribute to thermal conductivity or electrical conductivity unless a plurality thereof contact. Thus, since they contact successively, expression 'successively contacting' is applied (see the non-patent document 1).

As the fluorocarbon resin 43 applied in the surface layer 15 of the fixing member (heating member) according to the present invention, one produced by burning to have good melted state film forming characteristics and having relatively low melting point is preferably selected. Specifically, impalpable powder of low-molecular weight polytetrafluoroethylene (PTFE), tetrafluoroethylene-hexafluoropropylene copolymer (FEP) and tetrafluoroethylene-perfluoroalkylvinylether copolymer (PFA) may be cited. More specifically, as low-molecular weight polytetrafluoroethylene (PTFE) powder, LUBRON (registered trademark) L-5, L-2 (made by Daikin Industries, Ltd.), MP1100, 1200, 1300, TLP-10F-1 (made by DuPont-Mitsui Fluorochemicals, Co., Ltd.) is known. As tetrafluoroethylene-hexafluoropropylene copolymer (FEP) powder, 532-8000 (made by DUPONT) is known. As tetrafluoroethylene-perfluoroalkylvinylether copolymer (PFA), MP-10, MP102 (made by DUPONT-MITSUI FLUOROCHEMICALS, CO., LTD.) is known. Further, resin obtained from including, in the above-mentioned fluorocarbon resin, carbon family material (for example, carbon) may also be applied.

As the low melting point alloy, a metal or an alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family, (10) bismuth and (11) silver-bismuth family may be provided. As the metal particles or metal fillers, particles or filters of metal or alloy including at least any one of gold (Au), silver (Ag), copper (cu), lead (Pb), nickel (Ni), zinc (Zn), iron (Fe), aluminum (Al), magnesium (Mg), titanium (Ti), tin (Sn) and bismuth (Bi) may be applied. They may be used in a form of fillers of a spherical shape, a spherical shell shape or an acicular shape, or fibrous fillers, and metal powders are fixed on the peripheries of fluorocarbon resin.

Figure 8:
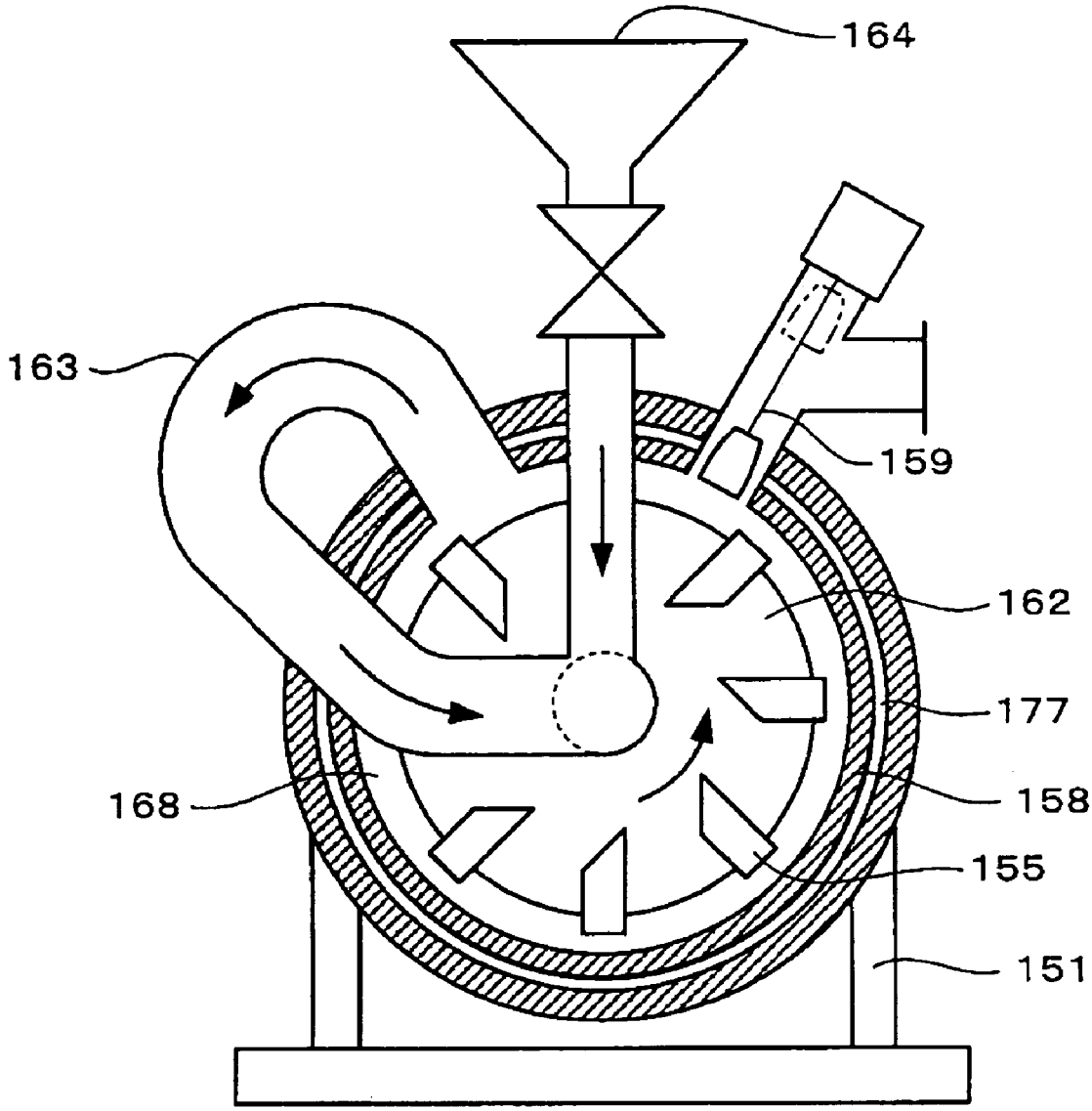
FIG. 8 is a general configuration diagram of a hybridization system applied as a device for fixing metal powder around fluorocarbon resin.

As an apparatus to fix the metal powders on the peripheries of fluorocarbon resin, an example of a hybridization system (made by Nara Machinery) is shown in FIG. 8. In the figure, reference numeral 8 denotes a body casing, 158 denotes a stator, 177 denotes a stator jacket, 163 denotes a cycle pipe, 159 denotes an ejection value, and 164 denotes a row material input shoot.

Powder particles and other micro solid particles provided from the row material input shoot 164 are subject to instantaneous impact action manly by a plurality of rotor blades 155 disposed in a rotation rotor 162 rotating at a high speed in an impact chamber 168, further scattered in the system with breakage of mutual aggregation of the powder particles or the other micro solid particles as a result of being hit by the peripheral stator 158, and simultaneously, the other micro solid particles are fixed to surfaces of the powder particles by electrostatic force, Van der Waals force or such, or, for a case of only the powder particles, chamfering or conglobating is carried out. This state progresses along with flying and impact of the particles. That is, along with an air flow generated by rotation of the rotor blades 155, the particles are treated as a result of passing through the recycle pipe 163 several times. Further, as a result of the particles being repeatedly subject to impact action from the rotor blades 155 and stator 158, the other micro solid particles are made to scatter and fixed uniformly on the surfaces or in the vicinity of the powder particles.

The surface layer 15 is produced solely by the thus-produced metal coated powders, or by the same which is mechanically mixed with powders produced by ordinary fluorocarbon resin being electrostatically coated on a base material 17 made by a metal member or such, or, a wet coating is produced in which the above-mentioned powders are dispersed in water solution and is coated on the base material 17, and then burned. Further, as a result of the above-mentioned powders being burned together with low melting point metal, the fillers successively contact together, and thus both strength and thermal conductivity can be improved. However, relationship between the low melting point metal and an actual operation temperature (temperature upon fixing and heating) should be taken into account.

Further, as a result of the above-mentioned powders being burned together with the low melting point metal, the fillers successively contact together and thus electrical conductivity can be improved, whereby an eddy current can be made to flow sufficiently, and thus, it can be applied as a heat generating member. Even when a ratio of the low melting point metal is small, it is possible to improve the electrical conductivity since probability of connection among the fillers is high depending on the duration thereof. According to the present invention, the low melting point metal also acts as a safeguard against burning due to abnormal overshooting of temperature of the heating device. That is, when metal becomes liquid, electrical characteristics rapidly change. Thereby, detection of impedance change in a magnetic flux generating circuit can be made possible. Also, for liquid metal, heat generating efficiency degrades since resistance value rapidly increases. Further, it is possible to produce an alloy of magnetic metal with non-magnetic metal and control the Curie temperature, so that heat generating efficiency may degrade at a temperature higher than a certain one.

Further, it is preferable that the low melting point metal amounts to 5 through 50 weight part with respect to the filler loading weight. Further, since the low melting point metal has low corrosion resistance in many cases, it is preferable that this is fewer than the filler. Further, in a fixing part of an image forming apparatus, an environment of steam from recording paper or such is applied. Therefore, it is preferable to avoid the amount more than necessary.

Figure 9:
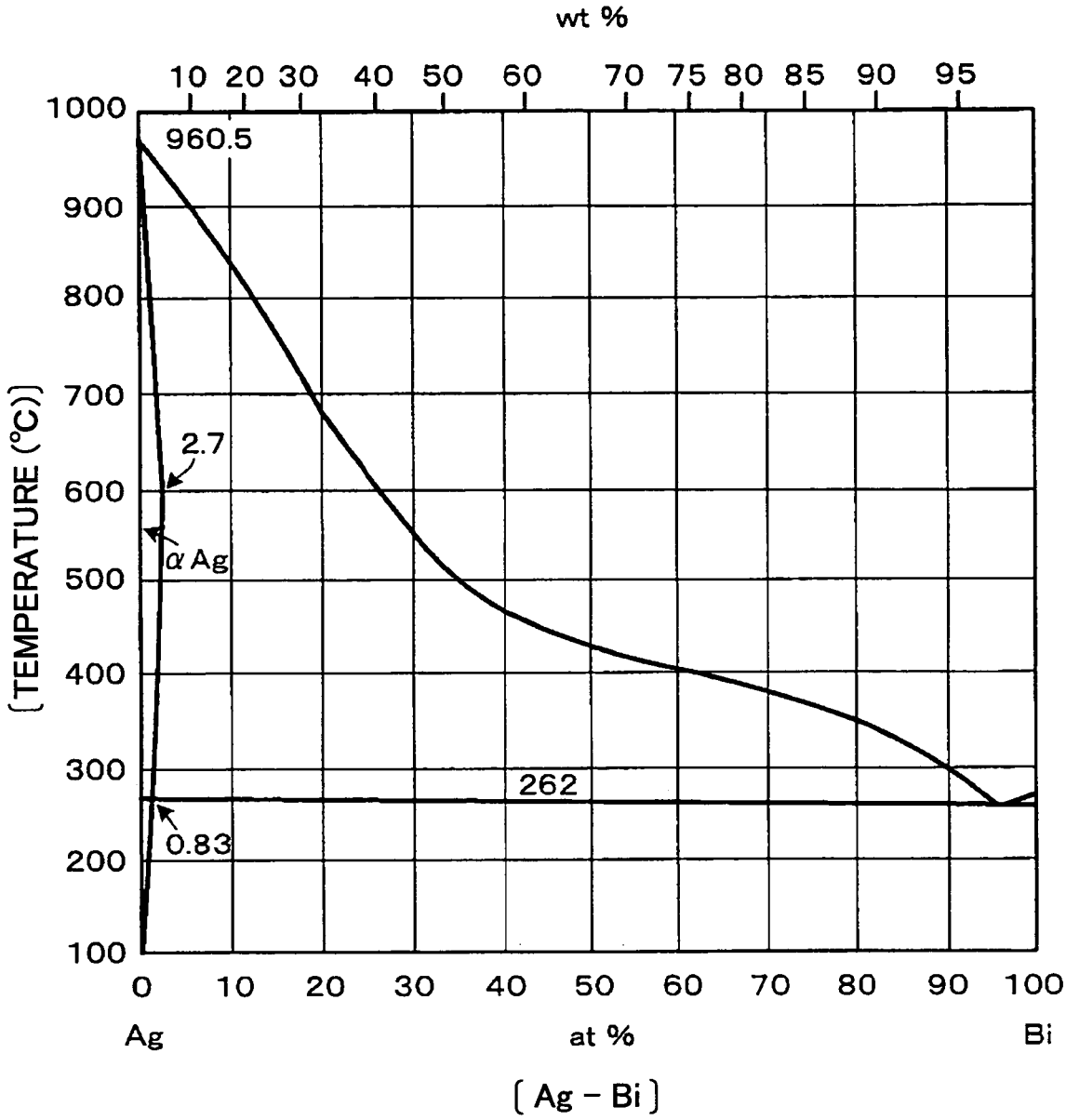
FIG. 9 is an Ag—Bi family constitution diagram.

As one example, a case where bismuth (Bi) is applied as the low melting point metal, and silver (Ag) is applied as the metal filler is described now with reference to a state diagram of FIG. 9. This is a state diagram called an eutectic type. In this example, a liquid phase occurs at a temperature more than the eutectic point upon burning (equal to or more than 300° C.) of fluorocarbon resin, and after that, silver is connected as a result of the temperature being made to be equal to or less than the eutectic point. In order to improve thermal conductivity or electrical conductivity which is the object of the present invention, it is advantageous that silver having the relevant characteristics is included more. For this purpose, bismuth has a function to connect it. Upon usage in an ordinary fixing device, a heating temperature is on the order of maximum 230° C., and thus, there is no problem in the operation.

Figure 10:
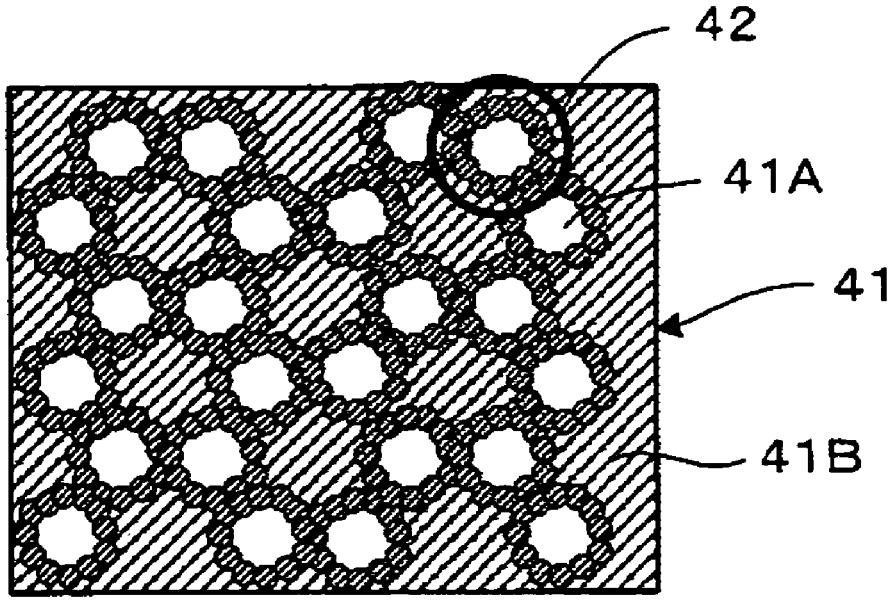
FIG. 10 is a diagram showing a configuration example of a surface layer of a heating member (fixing member) for a case where a plurality of types of fluorocarbon resins according to embodiments 1 through 7 of the present invention, and showing a sectional view in a direction along a surface of a part of the surface layer.
Figure 11:
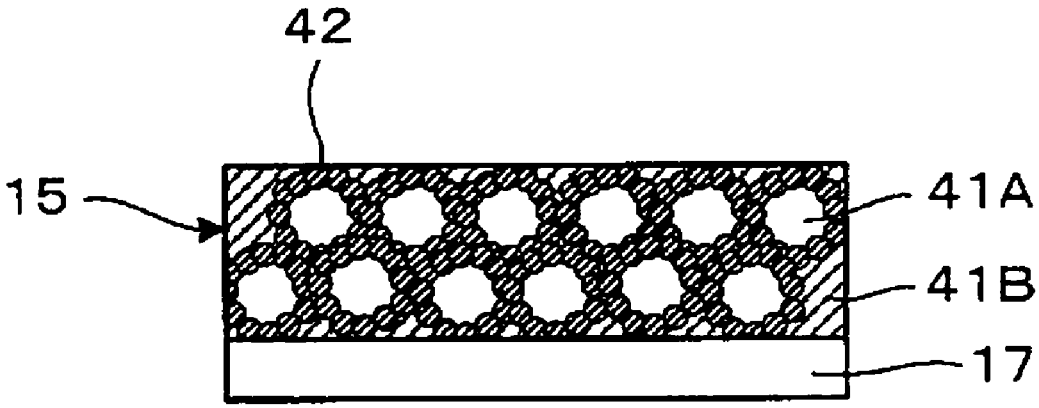
FIG. 11 is a diagram showing a configuration example of a surface layer of a heating member (fixing member) for a case where a plurality of types of fluorocarbon resins according to embodiments 1 through 7 of the present invention, and showing a sectional view in a direction perpendicular to the surface of the part of the surface layer.

FIGS. 6 and 7 show examples of the fluorocarbon resin part 41 in which fluorocarbon resin 43 is applied solely. However, it is possible to provide a configuration in which a plurality of types of fluorocarbon resins having different melting points are applied as the fluorocarbon resin, and at least fluorocarbon resin having the highest melting point is surrounded by the successively contacting metal. FIG. 10 shows a configuration example of a surface layer of a fixing member (heating member) for a case where a plurality of types of fluorocarbon resins is applied, and shows a horizontal section (section along the surface) of a part of the surface layer 15. In this example, a state is shown in which metal particles successively contact and form a metal successively contacting part 42 around a fluorocarbon resin 41A having the highest melting point, and around it, fluorocarbon resin 41B having lower melting point is filled with. The two types of fluorocarbon resin 41A and 41B occupy a wide area, and releasability is ensured. The metal successively contacting part 42 has an area on the order of 5%. However, since almost all thereof successively contact, contribution to thermal conductivity or electrical conductivity is large. Further, thermal conductivity or electrical conductivity in the horizontal direction is high. FIG. 11 shows a vertical section of a part of the surface layer 15. The same as the horizontal section, the metal successively contacting part 42 continues from the surface to the base material 17, and contributes to improvement of thermal conductivity.

For the surface layer of the fixing member (heating member) according to the present invention, fluorocarbon resin surrounded by metal successively contacting is heated and melted so that a film is produced. In the case where the surface layer includes a single type of fluorocarbon resin, successively contacting state of the metal successively contacting part is distorted since the fluorocarbon resin should be melted to flow so as to produce the surface layer having no pin-holes when the surface layer is produced, although metal successively contacts and surrounds the fluorocarbon resin before the heating. As a result, thermal conductivity improves, while variation in thermal conductivity among product lots increases.

In contrast thereto, when the fluorocarbon resin includes a plurality of types of fluorocarbon resins having different melting points, and, as shown in FIGS. 10 and 11, at least the fluorocarbon resin particles 41A having the highest melting point is surrounded by metal successively contacting, the successively contacting state of the metal successively contacting part 42 surrounding the fluorocarbon resin part 41A having the highest melting point can be prevented from being distorted while the other fluorocarbon resin part 41B having the lower melting point is melted and made to flow, when heating is carried out for such a temperature that the fluorocarbon resin having the highest melting point may not flow. Thereby, thermal conductivity or electrical conductivity can be improved, and also, variation in thermal conductivity or electrical conductivity among product lots can be reduced.

Fluorocarbon resin flows when it is heated for a temperature more than its melting point. However, flowability is low when the temperature is low. Accordingly, even when the melting point of the fluorocarbon resin 41A having the highest melting point is exceeded, such a temperature may be applied that flowability can be maintained in such a manner that the successively contacting state of the metal successively contacting part 42 may not be distorted.

Fluorocarbon resin applied in the surface layer in which such a plurality of types of fluorocarbon resins is combined is not particularly limited as long as it includes fluorine atoms in molecules. Specifically, polytetrafluoroethylene (PTFE) and a modification thereof, tetrafluoroethylene-perfluoroalkylvinylether copolymer (PFA), tetrafluoroethylene-ethylene copolymer (ETFE), tetrafluoroethylene-hexafluoropropylene copolymer (FEP), tetrafluoroethylene-vinyliden-fluoride copolymer (TFE/VdF), tetrafluoroethyrene-hexafluoropropylene-perfluoroalkylvilylether copolymer (EPA), polychlorotrifluoroethylene (PCTFE), chlorotrifluoroethylene-ethylene copolymer (ECTFE), chlorotrifluoroethylene-vinyliden-fluoride copolymer (CTFE/VdF), poly-vinyliden-fluoride (PVdF), poly-vinyl-fluoride (PVF), or such may be cited.

For example, as polytetrafluoroethylene (PTFE) powder, Teflon (registered trademark) 7A-J, 70-J (made by DuPont-Mitsui Fluorochemicals Co., Ltd.) is known. As tetrafluoroethylene-hexafluoropropylene copolymer (FEP) powder, 532-8000 (made by DuPont Co., Ltd.) is known. As tetrafluoroethylene-perfluoroalkylvinylether copolymer (PFA), MP-10, MP102 (made by DuPont-Mitsui Fluorochemicals Co., Ltd.), or MP103 (made by DuPont-Mitsui Fluorochemicals Co., Ltd.) is known. Further, resin in which carbon family material (for example, carbon) is included in these fluorocarbon resin may also be applied.

According to the present invention, a plurality of types of fluorocarbon resins having different melting points may be selected therefrom. Melting points of fluorocarbon resins are shown in Table 1 below:

TABLE 1

| FLUOROCARBON RESIN | MELTING POINT (° C.) |
|---|---|
| PTFE | 327 |
| PFA | 310 |
| FEP | 270 |
| ETFE | 260 |
| PCTFE | 210 |
| PVDF | 177 |

When a plurality of types of fluorocarbon resins having different melting temperatures are applied, the above-described metal powders are fixed at least to the periphery of fluorocarbon resin 41A having the highest melting point. As the metal to be fixed, the above-described low melting point metal or alloy, or fillers of the metal or alloy is applied. As an apparatus to fix it, a hybridization system (made by Nara Machinery) shown in FIG. 8 is applied. A method of producing metal coated powder is the same as that described above.

Figure 12:
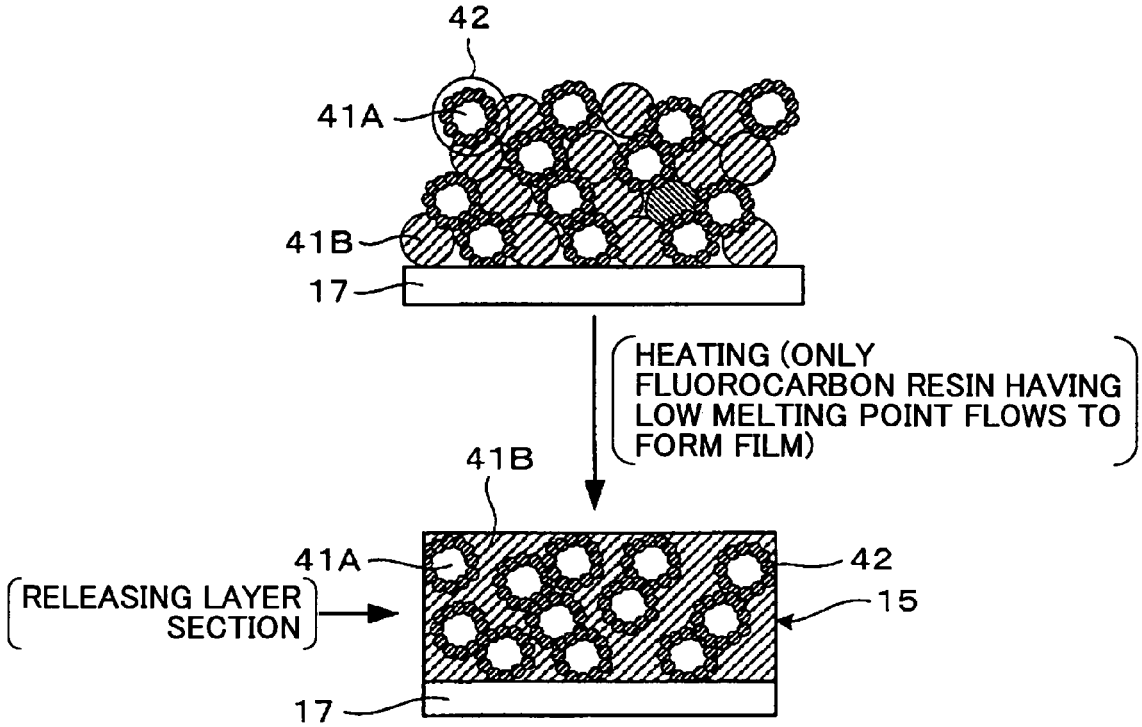
FIG. 12 is a diagram showing one example of a method of producing a surface layer of a heating member (fixing member) according to embodiments 1 through 7 of the present invention.

As shown in FIG. 12, one in which produced powder (powder produced as a result of metal successively contacting part 42 being produced around fluorocarbon resin 41A having highest melting point) is mixed with fluorocarbon resin 41B having lower melting temperature is coated in a form of electrostatic coating or wet coating, burning is carried out at a temperature lower than the melting point of the fluorocarbon resin 41A having the highest melting point, and the surface layer is produced.

Figure 13:
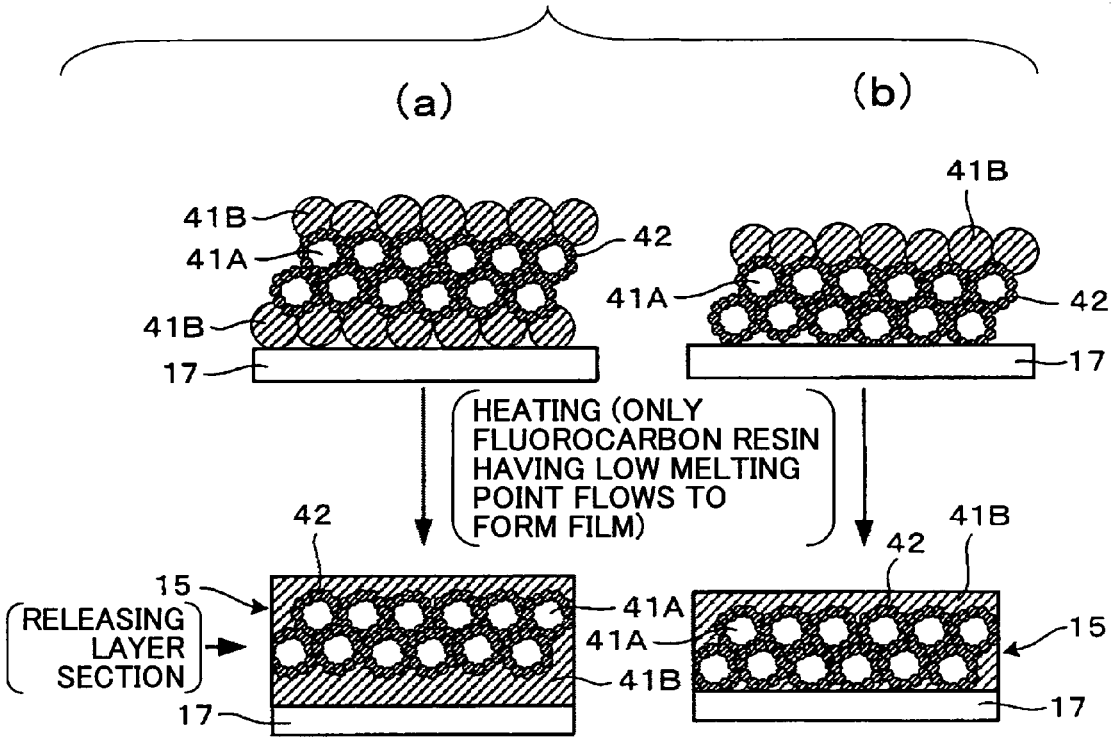
FIG. 13 is a diagram showing another example of a method of producing a surface layer of a heating member (fixing member) according to embodiments 1 through 7 of the present invention.

Alternatively, as shown in FIG. 13, (a) or (b), produced powder (powder in which metal successively contacting part 42 being produced around fluorocarbon resin 41A having the highest melting temperature) and fluorocarbon resin 41B having lower melting point are coated in such a manner that a plurality of layers are laminated, in a form of electrostatic coating or wet coating, burning is carried out at a temperature lower than the melting point of the fluorocarbon resin 41A having the highest melting point, and the surface layer 15 is produced. Thereby, thermal conductivity or electrical conductivity can be improved.

Figure 14:
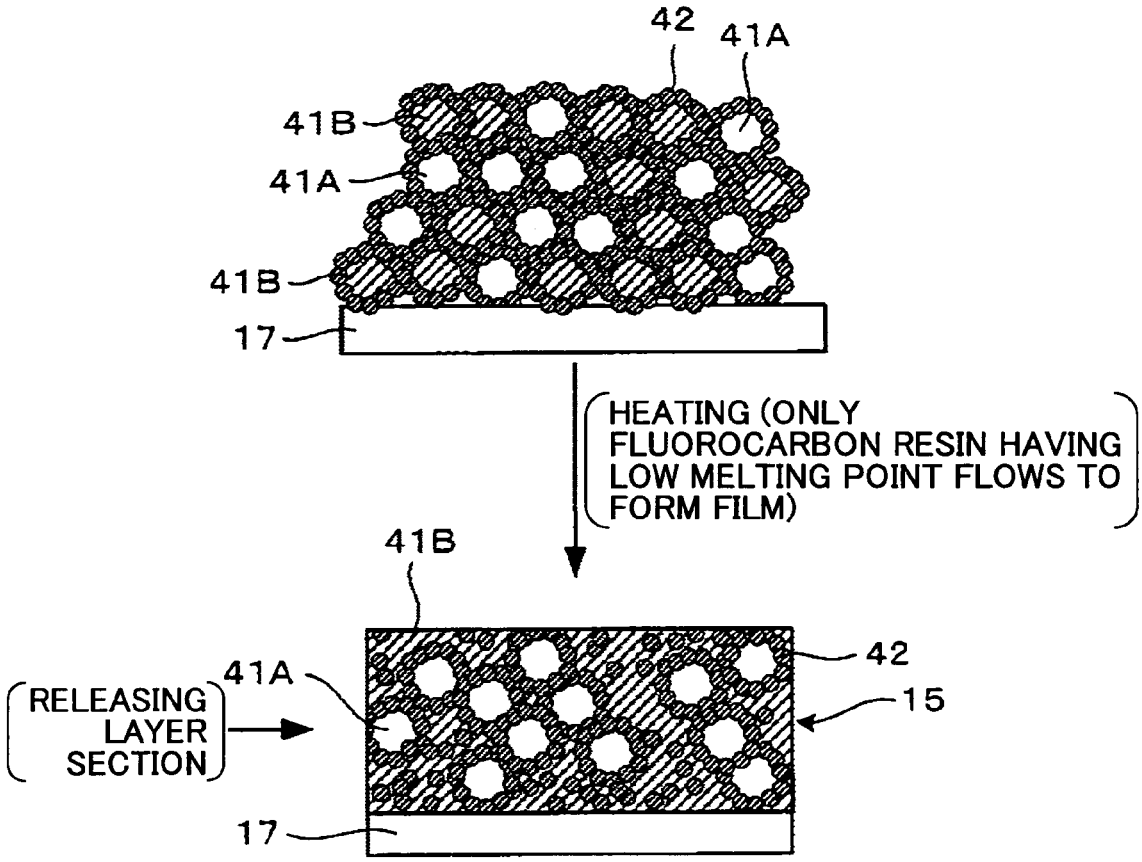
FIG. 14 is a diagram showing another example of a method of producing a surface layer of a heating member (fixing member) according to embodiments 1 through 7 of the present invention.
Figure 15:
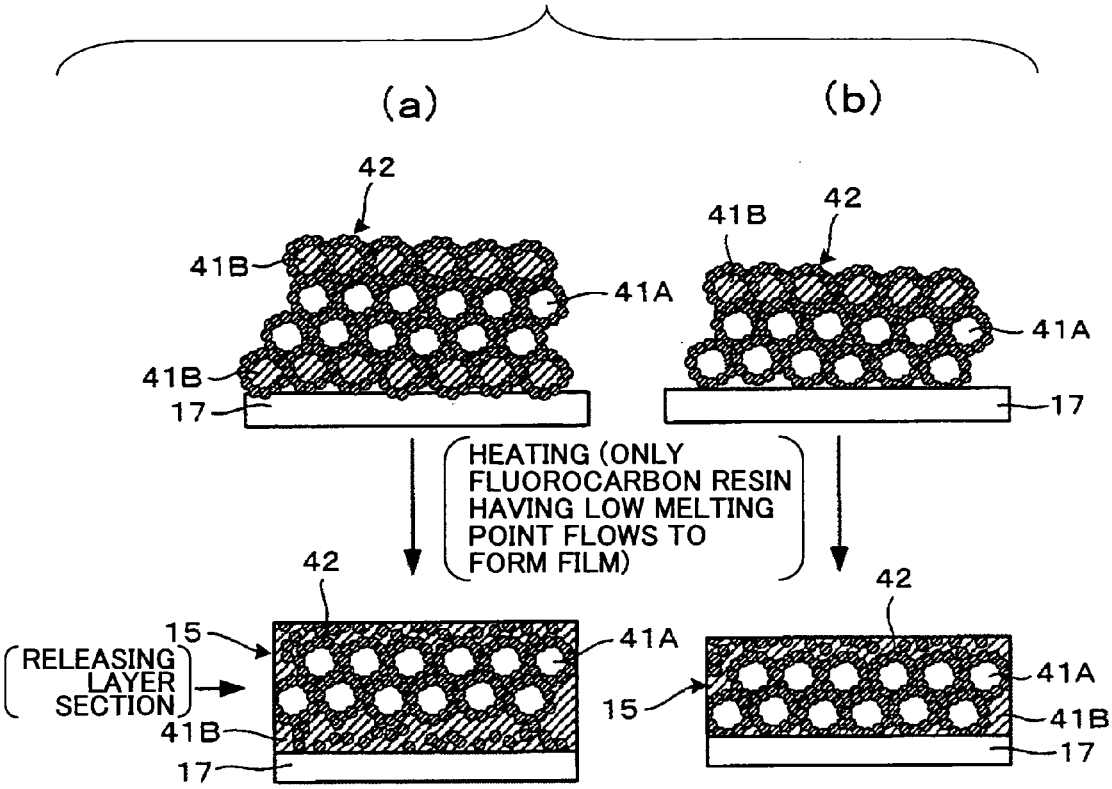
FIG. 15 is a diagram showing another example of a method of producing a surface layer of a heating member (fixing member) according to embodiments 1 through 7 of the present invention.

Further, of course, as shown in FIG. 14 or 15, metal powder may also be fixed to fluorocarbon resin 41B having lower melting point and metal successively contacting part 42 may be produced, which may then be mixed with the powder in which metal successively contacting part 42 is fixed to fluorocarbon resin 41A having the highest melting temperature and then, the thus-obtained one may be applied.

Figure 16:
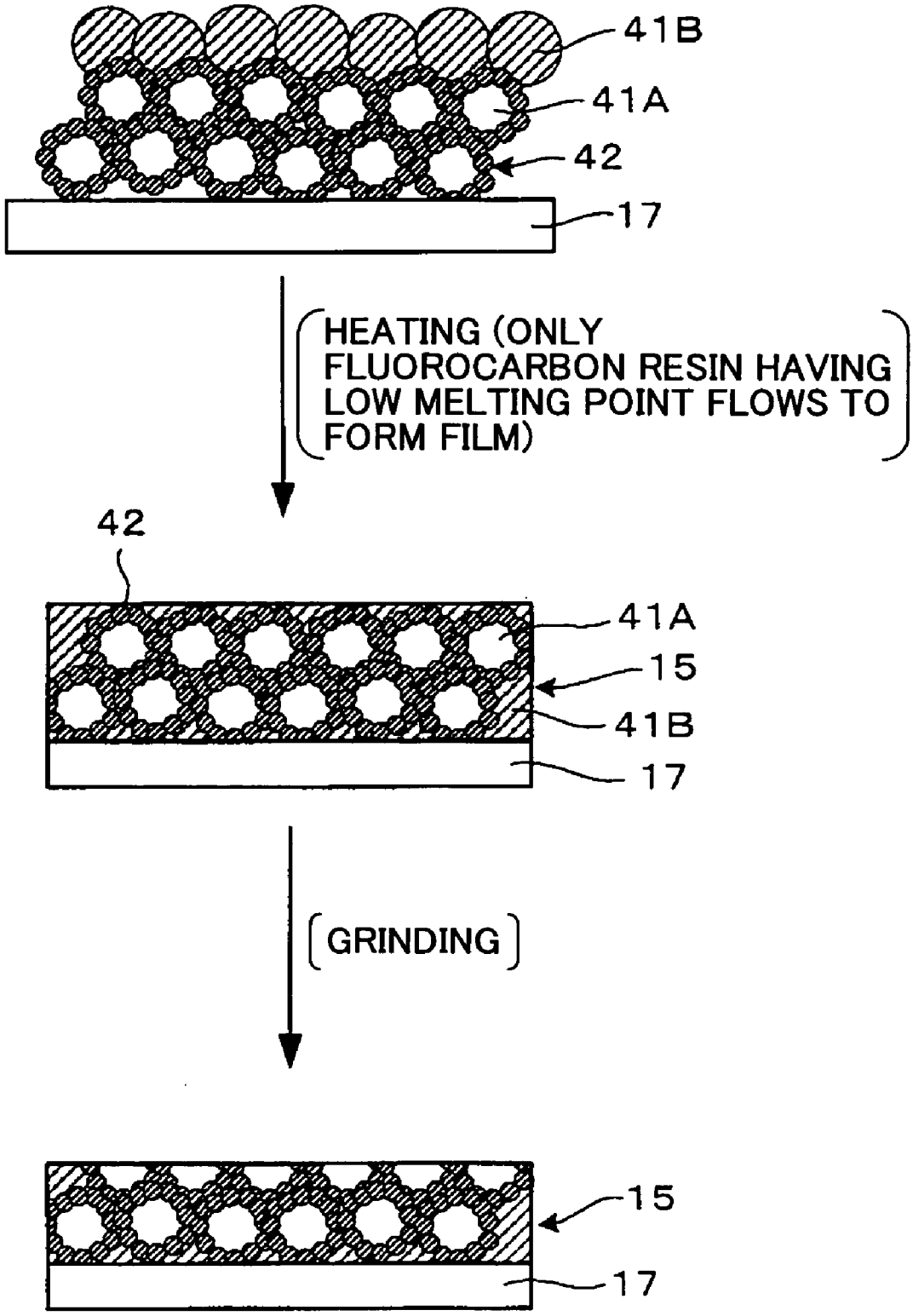
FIG. 16 is a diagram showing another example of a method of producing a surface layer of a heating member (fixing member) according to embodiments 1 through 7 of the present invention.

Further, when surface roughness of the surface layer 15 should have a predetermined value (for example, equal to or less than 5 μm in ten-point roughness Rz), the surface roughness can have the predetermined value as a result of grinding being carried out after the burning, as shown in FIG. 16.

Further, when a plurality of types of fluorocarbon resins are applied, fillers contact successively as a result of burning being carried out together with low melting point metal, and both characteristics, i.e., strength and thermal conductivity (or electrical conductivity) can be improved. In this occasion, the melting point of the low melting point metal should be lower than that of the fluorocarbon resin 41A having the highest melting point. For example, for a case where the fluorocarbon resin having the highest melting point is PTFE, tin (Sn) should be used as the low melting point metal.

There, the plurality of types of fluorocarbon resins may preferably selected from PTFE, PFA, FEP, ETFE and PCTFE having melting points equal to or more than 200° C., in terms of thermal stability of the surface layer at a time of operation thereof. Further, when PTFE is applied as the fluorocarbon resin 41A having the highest melting point, since melting viscosity is very large in comparison to other fluorocarbon resin, it hardly flow even the melting point is exceeded, and metal successively contacting state is not distorted. Thus, this is further preferable.

Figure 17:
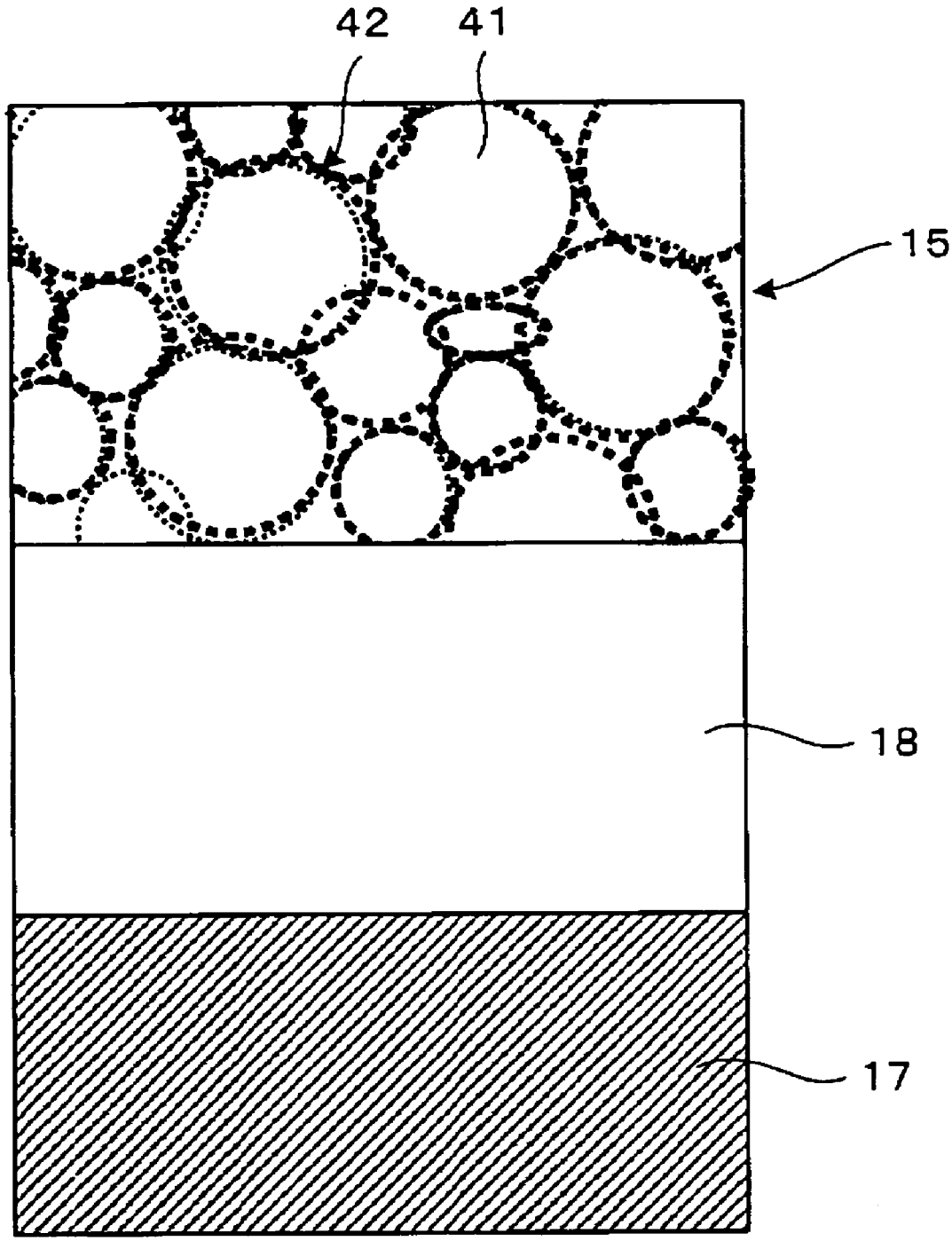
FIG. 17 is a diagram showing another configuration example of a surface layer of a heating member (fixing member) according to embodiments 1 through 7 of the present invention, and showing a sectional view in a direction along a surface of a part of the surface layer.
Figure 18:
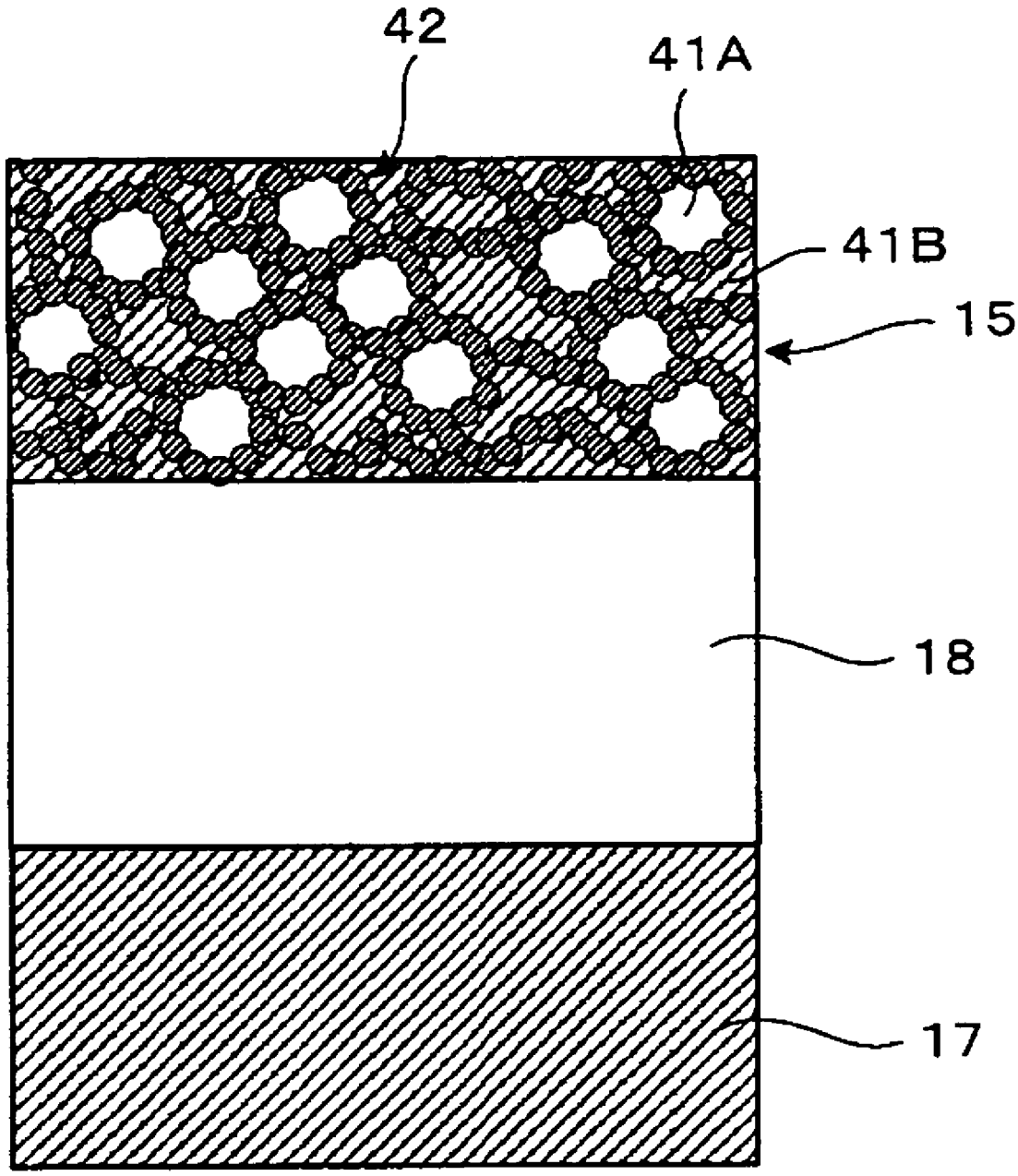
FIG. 18 is a diagram showing the other configuration example of a surface layer of a heating member (fixing member) according to embodiments 1 through 7 of the present invention, and showing a sectional view in a direction perpendicular to the surface of the part of the surface layer.

When a heating member (fixing member) according to the present invention is applied in a fixing device of an electromagnetic induction heating type as shown in FIGS. 3 through 5, a heat insulating layer (or elastic layer) 18 should be preferably provided between the surface layer 15 and the base material 17 for the purpose that heat generated by the surface layer 15 is prevented from escaping to the side of the base material 17. FIGS. 17 and 18 show this example, and shows a vertical section of a part of the surface layer. The example of FIG. 17 is an example in which, a heat insulating layer (or elastic layer) 18 made of silicon rubber is provided on a surface of the base material 17, and thereon, the surface layer 15 having the same configuration as that of FIGS. 6 and 7 is produced. The example of FIG. 18 is an example in which, a heat insulating layer (or elastic layer) 18 made of silicon rubber is provided on a surface of the base material 17, and thereon, the surface layer 15 having the same configuration as any one of those shown in FIGS. 10 through 16 is produced.

In the case of FIG. 17 or 18, when high frequency electromagnetic field is applied externally to the surface layer 15, an eddy current flows in the metal successively contacting part 42 which generates heat. At this time, since the surface layer 15 is thermally insulated by the heat insulating layer 18, rapid temperature increase can be carried out. Further, since also thermal continuation is provided in the horizontal direction, uniformization is carried out rapidly even when heat reduction occurs locally. Accordingly, the heating member (fixing member) in which starting up can be made rapidly, thermal uniformization is satisfactory, and heating efficiency is high can be obtained.

In the heating member (fixing member) according to the present invention, a contact angle of the surface layer 15 with respect to water is equal to or more than 80°. Thereby, wax adhering to the surface layer from toner is prevented from being repelled from the surface layer. Accordingly, offset of resin or such of toner otherwise occurring as a result of it contacting the surface layer, or winding of a recording material otherwise occurring as a result of the fixing member acting as a hot melt adhesive, is avoided.

When the contact angle with respect to water is less than 80°, excessive wetting occurs, adhesion preventing effect by means of wax is exceeded by adhesive force of toner resin itself rapidly increasing, the whole toner is transferred to the side of the surface layer, and thus, fixing failure occurs. Measurement of the contact angle according to the present invention was carried out in such a manner that a planar testing sample of the surface layer material of the heating member (fixing member) was produced, and measurement was carried out in a sessile drop method by means of CA-X type made by Kyowa Interface Science Co., Ltd. at a room temperature.

As a method of adjusting the contact angle with respect to water of the surface layer 15 of the heating member (fixing member) so that it falls in a range equal to or more than 80°, composition ratio between fluorocarbon resin and metal as materials of the surface layer 15 may be changed, and thus, the contact angle with respect to water may be controlled. In this case, the contact angle with respect to water can be controlled by a combination of types of the fluorocarbon resin and metal, a mixing method, and heating temperature.

Further, the metal part of the heating member (fixing member) surface layer 15 has a thickness of equal to or less than 50 μm in its section. Further, the metal part of the surface layer 15 has a maximum width part in its section equal to or less than 30 μm.

When the metal part of the surface layer is produced in such a manner that the maximum width part in its section is equal to or less than 30 μm, even if the metal part which is inferior in non-adherence property in comparison to that of the fluorocarbon resin is exposed on the surface, an area in which toner directly contacts the metal part is small. Therefore, this structure is advantageous for offset prevention.

Specific embodiments of the heating member (fixing member) and a producing method therefor according to the present invention are described below.

Embodiment 1

First, embodiments of the heating member (fixing member) 11A having the surface layer 15 having a configuration shown in FIGS. 6 and 7 used in the fixing device 6A configured as shown in FIG. 2 are described.

Embodiment 1-1

As a component of the surface layer, Ni powder (average particle diameter: 1.2 μm) was mixed into PFA powder (MP102 (made by DuPont-Mitsui Fluorochemicals Co., Ltd.), average particle diameterϕ: 20 μm) in an amount such that Ni is 10% in reduced volume, the thus-obtained one was input to a hybridization system configured as shown in FIG. 8 made by Nara Machinery, and Ni powder was fixed on PFA powder. A state in which Ni almost covered PFA powder was confirmed from observation by means of a scanning electron microscope (SEM). This powder was mixed with PFA powder (MP102 (DuPont-Mitsui Fluorochemicals Co., Ltd.), average particle diameter ϕ: 20 μm), was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 2 below, a relationship between a volume ratio of Ni fixed PFA powder:PFA powder, and a multiplying factor of thermal conductivity, is shown. There, the volume ratio is one obtained from a weight ratio and a specific gravity, and does not mean a volume ratio of the powder. Further, as a comparison example, a sheet was produced similarly as a result of Ni powder (average particle diameter: 1.2 μm) being mixed with PFA powder (MP102 (made by DuPont-Mitsui Fluorochemicals Co., Ltd.), average particle diameter ϕ: 20 μm) in such an amount that Ni is 5% in reduced volume with the use of a stirring apparatus KK-500 made by Kurabo Industries Ltd. A reason why Ni is 5% is that, in an electrostatic method, film forming cannot be carried out more than this. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

TABLE 2

| Ni FIXED PFA POWDER:PFA POWDER (VOLUME RATIO) | MULTIPLYING FACTOR OF THERMAL CONDUCTIVITY |
|---|---|
| 1:9 | 1.71 |
| 2:8 | 2.73 |
| 4:6 | 10.80 |
| 5:5 | 11.50 |
| 6:4 | 11.93 |
| 5% Ni - PFA FILM FOR COMPARISON | 2.30 |

Embodiment 1-2

The same as the embodiment 1-1, as a component of the surface layer, Ni powder (average particle diameter: 1.2 μm) was mixed into PFA powder (MP102 (made by DuPont-Mitsui Fluorochemicals Co., Ltd.), average particle diameterϕ: 20 μm) in an amount such that Ni is 10% in reduced volume, the thus-obtained one was input to a hybridization system configured as shown in FIG. 8 made by Nara Machinery, and Ni powder was fixed on PFA powder. Then, mixing was carried out according to a ratio of Table 3 below, coating was carried out on an aluminum tube to be the core metal (base material) 17 of the fixing roller in an electrostatic manner, the coated resin was melted at 380° C. and then cooled, grinding was carried out by means of corundum particles, thus one on which surface roughness was made equal to or less than 2 μm in ten-point average roughness (Rz) was produced, and thus, the fixing roller 11A was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. Toner of this MF4570 is toner with wax. 10000 sheets of black solid images were passed through the MF4570, and toner adhesion state on the roller was observed. The observation result is shown in Table 3 below. As shown in Table 3, no particularly large adhesion was observed, and nothing other than ordinary one occurred.

TABLE 3

| Ni FIXED PFA POWDER:PFA POWDER (VOLUME RATIO) | WATER CONTACT ANGLE | ADHERING TONER |
|---|---|---|
| 1:9 | 108° | NOTHING |
| 2:8 | 108° | NOTHING |
| 4:6 | 105° | NOTHING |
| 5:5 | 106° | NOTHING |
| 6:4 | 98° | NOTHING |
| 10:0 | 82° | NOTHING |

COMPARISON EXAMPLE

With respect to the above-mentioned embodiment 1-2, a comparison example in which toner adhesion occurs is shown below.

As fluorocarbon resin, PFA powder (MP102 (made by DuPont-Mitsui Fluorochemicals Co., Ltd.)) is applied, and, as heat resistant resin, poly(etheretherketone) (PEEK) powder (made by Victrex-MC Inc., PEEK 150XF) is applied, these powders are mixed in a predetermined weight ratio, and a mixture powder is produced. On the other hand, as a base material, for example, a core metal surface of a fixing roller made of aluminum having a diameter ϕ of 40 mm, and wall thickness of a fixing part is 1.5 mm is roughened through abrasive blasting.

Then, the above-mentioned mixture powder is electrostatically coated on the core metal of the aluminum made fixing roller, heating is carried out for 380° C. for 30 minutes, and rapid cooling is carried out by means of strong air blast outside of a heating furnace.

Surface roughness of a releasing layer may be large depending on a type of powder or a mixture ratio. When surface roughness should be made the same predetermined magnitude, this can be obtained from grinding by means of a tape grinding apparatus, for example. For example, when tape grinding is carried out with corundum #800, #1500, surface roughness could be made equal to or less than 2 μm. This fixing roller was loaded in a fixing part of a Ricoh's image forming apparatus MF4570, a non-fixed toner image produced by an image forming part having the same configuration as that of FIG. 1 was passed through a test machine (fixing device) having a configuration such as that shown in FIG. 2, and thus, fixing was carried out. Comparison examples by PFA:PEEK (weight ratio) obtained when 10000 sheets of black solid images were passed, and a toner adhesion state on the roller surface was observed, is shown in Table 4 below:

TABLE 4

| PFA:PEEK (VOLUME RATIO) | CONTACT ANGLE FOR PURE WATER | ADHERING TONER |
|---|---|---|
| 100:0 | 107° | NOTHING |
| 90:10 | 97° | NOTHING |
| 80:20 | 92° | NOTHING |
| 70:30 | 89° | NOTHING |
| 60:40 | 86° | NOTHING |
| 50:50 | 83° | NOTHING |
| 40:60 | 81° | TONER ADHERING TO ROLLER SURFACE |
| 30:70 | 79° | TONER ADHERING TO ROLLER SURFACE |
| 20:80 | 76° | TONER ADHERING TO ROLLER SURFACE |
| 15:85 | 75° | TONER ADHERING TO ROLLER SURFACE |

Embodiment 1-3

As a component of the surface layer, silver powder (average particle diameter: 1.2 μm) was mixed into PFA powder (MP102 (made by DuPont-Mitsui Fluorochemicals Co., Ltd.), average particle diameterϕ: 20 μm) in an amount such that silver is 10% in reduced volume, the thus-obtained one was input to a hybridization system configured as shown in FIG. 8 made by Nara Machinery, and Ni powder was fixed on PFA powder. A state in which silver almost covered PFA powder was confirmed from observation by means of SEM. This powder was mixed with PFA powder (MP102 (DuPont-Mitsui Fluorochemicals Co., Ltd.), average particle diameter ϕ: 20 μm), was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 5 below, a relationship between a volume ratio of silver fixed PFA powder:PFA powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

TABLE 5

| SILVER FIXED PFA POWDER:PFA POWDER (VOLUME RATIO) | MULTIPLYING FACTOR OF THERMAL CONDUCTIVITY |
|---|---|
| 1:9 | 2.25 |
| 2:8 | 3.16 |
| 4:6 | 12.19 |
| 5:5 | 12.41 |
| 6:4 | 12.46 |

Embodiment 1-4

The same as the embodiment 1-1, as a component of the surface layer, silver powder (average particle diameter: 1.2 μm) was mixed into PFA powder (MP102 (made by DuPont-Mitsui Fluorochemicals Co., Ltd.), average particle diameterϕ: 20 μm) in an amount such that silver is 10% in reduced volume, the thus-obtained one was input to a hybridization system configured as shown in FIG. 8 made by Nara Machinery, and silver powder was fixed on PFA powder. Then, mixing was carried out according to a ratio of Table 6 below, coating was carried out on an aluminum tube to be the core metal of the fixing roller in an electrostatic manner, the coated resin was melted at 380° C. and then cooled, grinding was carried out by means of corundum particles, surface roughness Rz made equal to or less than 2 μm was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed through the MF4570, and toner adhesion state on the roller was observed. The observation result is shown in Table 6 below. As shown in Table 6, no particularly large adhesion was observed, and nothing other than ordinary one occurred. Further, cold offset temperature and hot offset temperature which are those at which toner can be fixed were obtained as shown in Table 7, and therefrom it was seen that the cold offset temperature lowers and a fixing temperature range is widened. Thereby, it was seen that, even when temperature lowering occurs upon high speed paper passage, stable fixing can be carried out. Carbon 3% included PFA in Table 7 is a conventional one for comparison. Further, as a comparison example, a sheet was produced similarly as a result of silver powder (average particle diameter: 1.2 μm) being mixed with PFA powder (MP102 (made by DuPont-Mitsui Fluorochemicals Co., Ltd.), average particle diameter ϕ: 20 μm) in such an amount that silver is 5% in reduced volume with the use of a stirring apparatus KK-500 made by Kurabo Industries Ltd. A reason why Ni is 5% is that, in an electrostatic method, film forming cannot be carried out more than this.

TABLE 6

| SILVER FIXED PFA POWDER:PFA POWDER (VOLUME RATIO) | ADHERING TONER |
|---|---|
| 1:9 | NOTHING |
| 2:8 | NOTHING |
| 4:6 | NOTHING |

TABLE 6-continued

| SILVER FIXED PFA POWDER:PFA POWDER (VOLUME RATIO) | ADHERING TONER |
|---|---|
| 5:5 | NOTHING |
| 6:4 | NOTHING |

TABLE 7

| COMPARISON EXAMPLE BY SILVER FIXED PFA POWDER:PFA POWDER (VOLUME RATIO) | | |
|---|---|---|
| SILVER FIXED PFA POWDER:PFA POWDER (VOLUME RATIO) | COLD OFFSET TEMPERATURE | HOT OFFSET TEMPERATURE |
| 1:9 | 105° C. | 190° C. |
| 2:8 | 105° C. | 190° C. |
| 4:6 | 105° C. | 190° C. |
| 5:5 | 105° C. | 190° C. |
| 6:4 | 110° C. | 190° C. |
| CARBON 3% INCLUDED PFA FOR COMPARISON | 130° C. | 200° C. |
| 5% SILVER - PFA FILM FOR COMPARISON | 110° C. | 165° C. |

Embodiment 1-5

As a component of the surface layer, silver powder (average particle diameter: 1.2 μm) in a volume ratio of 5% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm) in reduced volume, the thus-obtained one was input to a hybridization system configured as shown in FIG. 8 made by Nara Machinery, and silver powder and Sn powder were fixed on PFA powder. Further, into wet fluorine coating EN700CL made by DuPont, the above-mentioned produced powder in which silver and Sn were fixed to PFA powder was mixed in a volume ratio of 50:50 calculated from specific gravities with respect to dry PFA weight, stirring and dispersion were carried out, then, spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed through the MF4570, and toner adhesion state on the roller was observed. As a result, no particularly large adhesion was observed, and nothing other than ordinary one occurred.

Embodiment 1-6

The same as the embodiment 1-1, as a component of the surface layer, Ni powder (average particle diameter: 1.2 μm) was mixed into PFA powder (MP102 (made by DuPont-Mitsui Fluorochemicals Co., Ltd.), average particle diameterϕ: 20 μm) in an amount such that Ni is 10% in reduced volume, the thus-obtained one was input to a hybridization system configured as shown in FIG. 8 made by Nara Machinery, and Ni powder was fixed on PFA powder. Then, coating was carried out on an aluminum tube to be the core metal of the fixing roller in an electrostatic manner, the coated resin was melted at 380° C. and then cooled, grinding was carried out by means of corundum particles, one having surface roughness (Rz) made equal to or less than 2 μm was produced, and thus, the fixing roller was produced. A final thickness of the surface layer is 40 μm. This roller was loaded in a fixing part of an image forming apparatus IMAGIO NEO 750 of Ricoh Co., Ltd. Toner of this IMAGIO NEO 750 is insufficient in releasability, and therefore, oil coating members immersed in silicon oil for coating silicon coil to the fixing roller is added. As non-fixed toner images produced with the use of an image forming part of this IMAGIO NEO 750, 10000 sheets of black solid images were passed through a test machine (fixing device) having a configuration as shown in FIG. 2, and fixing was repeated. Then, toner adhesion state on the roller was observed. As a result of the observation, no particularly large adhesion was observed, and nothing other than ordinary one occurred.

Embodiment 1-7

The same as the embodiment 1-1, as a component of the surface layer, scaly Ni powder (average thickness: 0.8 μm; average particle diameter: 50 μm) was mixed into PFA powder (MP102 (made by DuPont-Mitsui Fluorochemicals Co., Ltd.), average particle diameterϕ: 20 μm) in an amount such that Ni is 10% in reduced volume, the thus-obtained one was electrostatically coated on an aluminum tube to be the core metal of the fixing roller, the coated resin was melted at 380° C. and then cooled, grinding was carried out by means of corundum particles, one having surface roughness (Rz) made equal to or less than 2 μm was produced, and thus, the fixing roller was produced. A final thickness of the surface layer is 40 μm. This roller was loaded in a fixing part of an image forming apparatus MF4570 of Ricoh Co., Ltd, a non-fixed toner image produced with the use of an image forming part the same as that shown in FIG. 1 was fixed through a test machine (fixing device) having a configuration such as that shown in FIG. 2. Toner of the MF4570 is toner including wax. 10000 sheets of black solid images were passed through the MF4570. Then, when a toner adhesion state on the roller surface was observed, toner adhesion occurred on the order of 1000 sheets. According to the observation, toner adhered to a part in which Ni powder was exposed widely due to grinding. The same result was obtained for mica having the same size. However, for scaly Ni powder having an average diameter on the order of 30 μm, no toner adhesion appeared as a result up to 10000 sheets.

Embodiment 1-8

A roller was produced the same as the embodiment 1-2, surface roughness of which was 2 μm in Rz. A fixing test machine was produced in which this roller was applied in a fixing unit of an image forming apparatus MF4570 of Ricoh, Co., Ltd., and non-fixed images from MF4570 were passed therethrough with a pressing force changed. A testing result is shown in Table 8 below. As shown in Table 8, when the pressing force is equal to or less than 0.5 (kgf/cm$^2$), fixing performance was very bad, while, for the pressing force was equal to or more than 4.0 (kgf/cm$^2$), toner adhesion occurred on the fixing roller. The fixing performance was determined simply in such a manner that, when toner remarkably adhered to a cloth after the solid image after fixing was rubbed by the cloth, it was determined that the fixing was bad.

TABLE 8

COMPARISON EXAMPLE BY PRESSING FORCE

| PRESSING FORCE (kgf/cm$^2$) | ADHERING TONER AMOUNT | PAPER WINDING |
|---|---|---|
| 0.3 | NOTHING | NOTHING |
| 0.5 | NOTHING | NOTHING |
| 1.0 | NOTHING | NOTHING |
| 2.0 | SOME | NOTHING |
| 4.0 | VERY MUCH | FREQUENT JAM |

Embodiment 1-9

As a component of the surface layer, respective powders were produced in which, into Sn 80-silver 20 low melting point alloy powder (average particle diameter: 1.1 μm), respective metal powders of gold, silver, copper, lead, nickel, zinc, iron, aluminum, magnesium, titanium are mixed in equal volumes, respectively. In this mixing, a stirring machine KK-500 made by Kurabo Industries Ltd. was applied. The equal-volume mixed powder was mixed into PFA powder (low temperature burned type, average particle diameter ϕ 20 μm) by 10% in reduced volume, this was then input to a hybridization system of Nara Machinery Co., Ltd. such as that shown in FIG. 8, and thus, each equal-volume-mixed metal powder was fixed to PFA powder. A state was confirmed in observation by SEM in which each metal powder almost covered PFA powder. After that, the fixing rollers were produced, respectively, in the same manner as that of the embodiment 1-2. Each roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. Toner of this MF4570 is toner with wax. 10000 sheets of black solid images were passed through the MF4570, and toner adhesion state on the roller was observed. Table 9 shows the observation result. As shown in Table 9, no particularly large adhesion was observed, and nothing other than ordinary one occurred.

TABLE 9

| METAL:PFA POWDER (VOLUME RATIO: 10:90) | ADHERING TONER |
|---|---|
| GOLD | NOTHING |
| SILVER | NOTHING |
| COPPER | NOTHING |
| ZINC | NOTHING |
| NICKEL | NOTHING |
| IRON | NOTHING |
| ALUMINUM | NOTHING |
| MAGNESIUM | NOTHING |
| TITANIUM | NOTHING |

Table 10 below shows comparison examples obtained from cold offset temperature and hot offset temperature which correspond to a temperature range in which toner fixing can be carried out, for each metal:PFA powder (volume ratio). As seen from Table 10, the cold offset temperature lowered and the fixing temperature range was widened. Thereby, it is seen that stable fixing can be carried out even when temperature lowering occurs upon high speed paper passage. Table 10 also shows for only PFA powder (MP102 (DuPont-Mitsui Fluorochemicals Co., Ltd.), average particle diameter ϕ 20 μm) as a comparison example.

TABLE 10

COMPARISON EXAMPLE BY EACH METAL:PFA POWDER (VOLUME RATIO)

| EACH METAL:PFA POWDER (VOLUME RATIO: 10:90) | COLD OFFSET TEMPERATURE | HOT OFFSET TEMPERATURE |
|---|---|---|
| GOLD | 105° C. | 190° C. |
| SILVER | 105° C. | 190° C. |
| COPPER | 105° C. | 190° C. |
| ZINC | 105° C. | 190° C. |
| NICKEL | 110° C. | 190° C. |
| IRON | 110° C. | 190° C. |
| ALUMINUM | 105° C. | 190° C. |
| MAGNESIUM | 110° C. | 190° C. |
| TITANIUM | 110° C. | 190° C. |
| PFA (COMPARISON EXAMPLE) | 130° C. | 190° C. |

The same as the embodiment 1-4, as a component of the surface layer, silver powder (average particle diameter: 1.2 μm) was mixed into PFA powder (MP102 (made by DuPont-Mitsui Fluorochemicals Co., Ltd.), average particle diameterϕ: 20 μm) in an amount such that silver was 10% in reduced volume, the thus-obtained one was input to a hybridization system configured as shown in FIG. 8 made by Nara Machinery, and silver powder was fixed on PFA powder. Mixing was made with a ratio of 5:5, coating was carried out on an aluminum tube to be the core metal of the fixing roller in an electrostatic manner, the coated resin was melted at 380° C. and then cooled, grinding was carried out by means of corundum particles, surface roughness Rz made equal to or less than 2 μm; 3 μm; 5 μm; or 7 μm, was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller was observed. The observation result is shown in Table 11 below.

This fixing roller was loaded in a fixing part of an image forming apparatus MF4570 of Ricoh Co., Ltd., fixing was repeated for 10000 sheets of black solid images therethrough, and toner adhering amount on the roller surface and paper winding were observed. As a result, it was confirmed that there was an effect of a surface roughness of equal to or less than 5 μm in Rz. For one of 7 μm, jam occurred frequently in MF4570, and therefore, experiment was cancelled.

TABLE 11

COMPARISON EXAMPLE BY ROUGHNESS

| SURFACE ROUGHNESS Rz | ADHERING TONER AMOUNT | PAPER WINDING |
|---|---|---|
| 2 μm | NOTHING | NOTHING |
| 3 μm | NOTHING | NOTHING |
| 5 μm | SOME | NOTHING |
| 7 μm | VERY MUCH | FREQUENT JAM |

Embodiment 2

Next, embodiments of the heating member (fixing member) 11A having the surface layer 15 applying a plurality of types of fluorocarbon resins having deferent melting points as shown in FIGS. 10 through 16, used in the fixing device 6A configured as shown in FIG. 2 are described.

Embodiment 2-1

As a component of the surface layer, Ni powder (average particle diameter: 0.5 μm) was mixed into PTFE powder (7A-J (made by DuPont Co., Ltd.), average particle diameterϕ: 20 μm) in an amount such that Ni is 10% in reduced volume, the thus-obtained one was input to a hybridization system configured as shown in FIG. 8 made by Nara Machinery Co., Ltd., and Ni powder was fixed on PTFE powder. A state in which Ni almost covered PTFE powder was confirmed from observation by means of SEM. This powder was mixed with PFA powder (MP102 (DuPont-Mitsui Fluorochemicals Co., Ltd.)), having a melting point lower than that of PTFE, was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 12 below, a relationship between a volume ratio of Ni fixed PTFE powder: PFA powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

As a comparison example, Ni powder (average particle diameter: 0.5 μm) was mixed with PFA powder (MP102 (made by DuPont-Mitsui Fluorochemicals Co., Ltd)) in such an amount that Ni amounts to 10% in reduced volume, it was then input to a hybridization system of Nara Machinery Co., Ltd., and Ni powder was fixed to PFA powder. From observation by SEM, a state was confirmed that Ni almost covered PFA powder. This powder was mixed with PFA powder (MP102 (DuPont-Mitsui Fluorochemicals Co., Ltd.)) in a volume ratio of 6:4, it was coated on an aluminum substrate electrostatically, it was burned at 380° C., resin was melted and then cooled, it was pealed from the substrate, and a sample was produced.

Further, as another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ni powder (average particle diameter 0.5 μm) was mixed into this powder in an ordinary stirring manner for an amount of 5% of Ni in reduced volume, and a sheet was produced similarly. The reason why Ni amounts to 5% is that, in an electrostatic coating, a film forming cannot be carried out more than it.

TABLE 12

| Ni FIXED PTFE POWDER:PFA POWDER (VOLUME RATIO) | MULTIPLYING FACTOR OF THERMAL CONDUCTIVITY |
|---|---|
| 1:9 | 1.71 |
| 2:8 | 2.72 |
| 4:6 | 10.80 |
| 5:5 | 11.50 |
| 6:4 | 12.03 |
| Ni FIXED PFA POWDER:PFA POWDER = 6:4 FOR COMPARISON | 11.93 |
| 5% Ni MIXTURE - PTFE/PFA FILM FOR COMPARISON | 2.30 |

Embodiment 2-2

As a component of the surface layer, Ni powder (average particle diameter: 0.5 μm) was mixed into PFA powder (MP102 (made by DuPont-Mitsui Fluorochemicals Co., Ltd.)) in an amount such that Ni amounts to 10% in reduced volume, the thus-obtained one was input to a hybridization system configured as shown in FIG. 8 made by Nara Machinery Co., Ltd., and Ni powder was fixed on PFA powder. A state in which Ni almost covered PFA powder was confirmed from observation by means of SEM. This powder was mixed with FEP powder (532-8110 (made by DuPont Co., Ltd.)) having a melting point lower than that of PFA, was coated on an aluminum substrate in an electrostatic manner, burning was carried out at 300° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 13 below, a relationship between a volume ratio of Ni fixed PFA powder:FEP powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of FEP, and shows a multiple of thermal conductivity with respect to the thermal conductivity of FEP.

As a comparison example, Ni powder (average particle diameter: 0.5 μm) was mixed with FEP powder (532-8110 (made by DuPont Co., Ltd)) in such an amount that Ni amounts to 10% in reduced volume, it was then input to a hybridization system of Nara Machinery Co., Ltd., and Ni powder was fixed to FEP powder. From observation by SEM, a state was confirmed that Ni almost covered FEP powder. This powder was mixed with FEP powder (532-8110 (made by DuPont Co., Ltd.)) in a volume ratio of 6:4, it was coated on an aluminum substrate electrostatically, it was burned at 300° C., resin was melted and then cooled, it was pealed from the substrate, and a sample was produced.

Further, as another comparison example, FEP powder (532-8110 (made by DuPont Co., Ltd.)) was mixed into PFA powder (MP102 (made by DuPont-Mitsui Fluorochemicals Co., Ltd)) in an ordinary stirring manner, further Ni powder (average particle diameter 0.5 μm) was mixed into this powder in an ordinary stirring manner for an amount of 5% of Ni in reduced volume, and a sheet was produced similarly. The reason why Ni amounts to 5% is that, in an electrostatic coating, a film forming cannot be carried out more than it.

TABLE 13

| Ni FIXED PFA POWDER:FEP POWDER (VOLUME RATIO) | MULTIPLYING FACTOR OF THERMAL CONDUCTIVITY |
|---|---|
| 1:9 | 1.71 |
| 2:8 | 2.73 |
| 4:6 | 10.80 |
| 5:5 | 11.50 |
| 6:4 | 12.03 |
| Ni FIXED PFA POWDER:FEP POWDER = 6:4 FOR COMPARISON | 11.93 |
| 5% Ni MIXTURE - PFA/FEP FILM FOR COMPARISON | 2.30 |

Embodiment 2-3

The same as the embodiment 2-1, as a component of the surface layer, Ni powder (average particle diameter: 0.5 μm) was mixed into PTFE powder (7A-J (made by DuPont Co., Ltd.)) in an amount such that Ni amounts to 10% in reduced volume, the thus-obtained one was input to a hybridization system configured as shown in FIG. 8 made by Nara Machinery, and Ni powder was fixed on PTFE powder. Then, mixing was carried out according to a ratio of the table below with PFA powder (MP102 (DuPont-Mitsui Fluorochemicals Co., Ltd.)), coating was carried out on an aluminum tube to be the core metal (base material) of the fixing roller in an electrostatic manner, the coated resin was melted at 380° C. and then cooled, grinding was carried out by means of corundum particles, surface roughness made equal to or less than 2 μm in ten point average roughness (Rz) was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed through the MF4570, and toner adhesion state on the roller surface was observed. The observation result is shown in Table 14 below. As shown in Table 14, no particularly large adhesion was observed, and nothing other than ordinary one occurred.

TABLE 14

| Ni FIXED PTFE POWDER:PFA POWDER (VOLUME RATIO) | WATER CONTACT ANGLE | ADHERING TONER |
|---|---|---|
| 1:9 | 108° | NOTHING |
| 2:8 | 108° | NOTHING |
| 4:6 | 105° | NOTHING |
| 5:5 | 106° | NOTHING |
| 6:4 | 98° | NOTHING |
| 10:0 | 82° | NOTHING |

Embodiment 2-4

As a component of the surface layer, silver powder (average particle diameter: 0.5 μm) was mixed into PTFE powder (7A-J (made by DuPont Co., Ltd.)) in an amount such that silver amounts to 10% in reduced volume, the thus-obtained one was input to a hybridization system configured as shown in FIG. 8 made by Nara Machinery Co., Ltd., and silver powder was fixed on PTFE powder. A state in which silver almost covered PTFE powder was confirmed from observation by means of SEM. This powder was mixed with PFA powder (MP102 (made by DuPont-Mitsui Fluorochemicals Co., Ltd.)) having a melting point lower than that of PTFE, was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 15 below, a relationship between a volume ratio of silver fixed PTFE powder:PFA powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

As a comparison example, silver powder (average particle diameter: 0.5 μm) was mixed with PFA powder (MP102 (made by DuPont-Mitsui Fluorochemicals, Co., Ltd)) in such an amount that silver amounts to 10% in reduced volume, it was then input to a hybridization system of Nara Machinery Co., Ltd., and silver powder was fixed to PFA powder. From observation by SEM, a state was confirmed that silver almost covered PFA powder. This powder was mixed with PFA powder (MP102 (made by DuPont-Mitsui Fluorochemicals, Co., Ltd.)) in a volume ratio of 6:4, it was coated on an aluminum substrate electrostatically, it was burned at 380° C., resin was melted and then cooled, it was pealed from the substrate, and a sample was produced.

Further, as another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further silver powder (average particle diameter 0.5 μm) was mixed into this powder in an ordinary stirring manner for an amount of 5% of silver in reduced volume, and a sheet was produced similarly. The reason why silver amounts to 5% is that, in an electrostatic coating, a film forming cannot be carried out more than it.

TABLE 15

| SILVER FIXED PTFE POWDER:PFA POWDER (VOLUME RATIO) | MULTIPLYING FACTOR OF THERMAL CONDUCTIVITY |
|---|---|
| 1:9 | 2.25 |
| 2:8 | 3.16 |
| 4:6 | 12.19 |
| 5:5 | 12.41 |
| 6:4 | 14.81 |
| SILVER FIXED PFA POWDER:PFA POWDER = 6:4 FOR COMPARISON | 12.46 |
| 5% SILVER MIXTURE - PTFE/PFA FILM FOR COMPARISON | 2.73 |

Embodiment 2-5

The same as the embodiment 2-1, silver powder (average particle diameter: 0.5 μm) was mixed into PTFE powder (7A-J (made by DuPont Co., Ltd.)) in an amount such that silver is 10% in reduced volume, the thus-obtained one was input to a hybridization system configured as shown in FIG. 8 made by Nara Machinery, and silver powder was fixed on PFA powder. Then, mixing was carried out according to a ratio of the table below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in Rz was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller surface was observed. The observation result is shown in Table 16 below. As shown in Table 16, no particularly large adhesion was observed, and nothing other than ordinary one occurred. Further, cold offset temperature and hot offset temperature, i.e., a range in which toner can be fixed were obtained as shown in Table 17, and therefrom it was seen that the cold offset temperature lowers and a fixing temperature range is widened. Thereby, it was seen that, even when temperature lowering occurs upon high speed paper passage, stable fixing can be carried out. Carbon 3% included PFA in Table 17 is a conventional one for comparison.

Further, as a comparison example, PFA powder (MP102 (DuPont-Mitsui Fluorochemicals, Co., Ltd.) was mixed into PTFE powder (7A-J (made by DuPont Co., Ltd.)) in an ordinary stirring manner, and, into this powder, Ag powder (average particle diameter: 0.5 μm) was mixed in such an amount that Ag amounts to 5% in reduced volume in an ordinary stirring manner, and the fixing roller was provided similarly. A reason why Ag amounts to 5% is that, in an electrostatic method, film forming cannot be carried out more than this.

TABLE 16

| SILVER FIXED PFA POWDER:PFA POWDER (VOLUME RATIO) | ADHERING TONER |
|---|---|
| 1:9 | NOTHING |
| 2:8 | NOTHING |
| 4:6 | NOTHING |
| 5:5 | NOTHING |
| 6:4 | NOTHING |

TABLE 17

| SILVER FIXED PTFE POWDER:PFA POWDER (VOLUME RATIO) | COLD OFFSET TEMPERATURE | HOT OFFSET TEMPERATURE |
|---|---|---|
| 1:9 | 105° C. | 190° C. |
| 2:8 | 105° C. | 190° C. |
| 4:6 | 105° C. | 190° C. |
| 5:5 | 105° C. | 190° C. |
| 6:4 | 110° C. | 190° C. |
| CARBON 3% INCLUDED PFA FOR COMPARISON | 130° C. | 200° C. |
| 5% SILVER - PTFE/PFA FILM FOR COMPARISON | 110° C. | 165° C. |

Embodiment 2-6

As a component of the surface layer, silver powder (average particle diameter: 0.5 μm) in a volume ratio of 5% and Sn powder (average particle diameter: 15.8 μm) in a volume ratio of 2% were mixed into PTFE powder (7A-J (made by DuPont Co., Ltd.)) in reduced volume, the thus-obtained one was input to a hybridization system configured as shown in FIG. 8 made by Nara Machinery, and silver powder and Sn powder were fixed on PTFE powder. Further, into wet fluorine coating (EN700CL) made by DuPont, with respect to dry PFA weight, the above-mentioned produced powder in which silver and Sn were fixed to PTFE powder was mixed in a volume ratio of 50:50 calculated from specific gravities, stirring and dispersion were carried out, then, spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller surface was observed. As a result, no particularly large adhesion was observed, and nothing other than ordinary one occurred.

Embodiment 3

Next, embodiments of the heating member (fixing member) 11A having the surface layer 15 including, in a metal phase, bismuth or bismuth family material, used in the fixing device 6A configured as shown in FIG. 2 are described.

Embodiment 3-1

As a component of the surface layer, silver powder (average practice diameter: 0.4 μm) and bismuth powder (average particle diameter: 0.8 μm) were mixed into PFA powder (MP102 (made by DuPont-Mitsui Fluorochemicals Co., Ltd.), average particle diameterϕ: 20 μm) together in amounts such that silver amounts to 4.5 vol % and bismuth amounts to 0.5 vol % in reduced volume, the thus-obtained one was input to a hybridization system configured as shown in FIG. 8 made by Nara Machinery Co., Ltd., and, as (silver+bismuth) powder, it was fixed on PFA powder. A state in which (silver+bismuth) almost covered PFA powder was confirmed from observation by means of SEM. This (silver+bismuth) fixed powder was mixed with PFA powder (MP102 (DuPont-Mitsui Fluorochemicals Co., Ltd.), average particle diameter ϕ: 20 μm) in a volume ratio shown in Table 18 below, it was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 18 below, a relationship between a volume ratio of (silver+bismuth) fixed PFA powder:PFA powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

Further, as a comparison example, silver powder (average particle diameter: 1.2 μm) was mixed with PFA powder (MP102 (made by DuPont-Mitsui Fluorochemicals Co., Ltd)) in such an amount that silver amounts to 5% in reduced volume with the use of a stirring apparatus KK-500 made by Kurabo Industries Ltd., it was burned in the same way, and a sheet was produced. The reason why silver amounts to 5% is that, in an electrostatic coating, a film forming cannot be carried out more than it.

TABLE 18

| (SILVER + BISMUTH) FIXED PFA POWDER:PFA POWDER (VOLUME RATIO) | MULTIPLYING FACTOR OF THERMAL CONDUCTIVITY |
|---|---|
| 1:9 | 0.80 |
| 2:8 | 2.30 |
| 4:6 | 11.02 |
| 5:5 | 11.34 |
| 6:4 | 12.30 |
| 5% SILVER - PFA FILM FOR COMPARISON | 0.96 |

Embodiment 3-2

The same as the embodiment 3-1, (silver+bismuth) powder was mixed into PFA powder (MP102 (made by DuPont-Mitsui Fluorochemicals Co., Ltd.), average particle diameter ϕ 20 μm) in amounts such that silver amounts to 4.5 vol % and bismuth amounts to 0.5 vol % in reduced volume, and (silver+bismuth) powder was fixed to PFA powder. This powder was mixed with PFA powder (MP102 (DuPont-Mitsui Fluorochemicals Co., Ltd.), average particle diameter ϕ 20 μm) in a volume ratio shown in Table 19 and Table 20 below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in ten point average roughness (Rz) was produced, and thus, the fixing roller was produced. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller surface was observed. Then, no particularly large adhesion was observed, and nothing other than ordinary one occurred. Further, when cold offset temperature and hot offset temperature, i.e., a range in which toner can be fixed were obtained, it was seen that the cold offset temperature lowers and a fixing temperature range is widened. Thereby, it was seen that, even when temperature lowering occurs upon high speed paper passage, stable fixing can be carried out. Carbon 3% included PFA in Table 19 is a conventional one for comparison. Further, as a comparison example, silver powder (average particle diameter: 1.2 μm) was mixed with PFA powder (MP102 (made by DuPont-Mitsui Fluorochemicals Co., Ltd.), average particle diameter ϕ 20 μm) in such an amount that silver amounts to 5 vol % in reduced volume with the use of a stirring apparatus KK-500 made by Kurabo Industries Ltd., and the fixing roller was provided similarly. At the same time, a sample was produced on a flat plate from the same material, and water contact angle was measured. In section observation of all the metal parts, the thickness was equal to or less than 50 μm.

TABLE 19

| COMPARISON EXAMPLE BY (SILVER + BISMUTH) PFA POWDER:PFA POWDER (VOLUME RATIO) | | |
|---|---|---|
| (SILVER + BISMUTH) PFA POWDER:PFA POWDER (VOLUME RATIO) | COLD OFFSET TEMPERATURE | HOT OFFSET TEMPERATURE |
| 1:9 | 125° C. | EQUAL TO OR HIGHER THAN 250° C. |
| 2:8 | 125° C. | EQUAL TO OR HIGHER THAN 250° C. |
| 4:6 | 115° C. | EQUAL TO OR HIGHER THAN 250° C. |
| 5:5 | 105° C. | EQUAL TO OR HIGHER THAN 250° C. |
| 6:4 | 105° C. | EQUAL TO OR HIGHER THAN 250° C. |
| 10:0 | 105° C. | EQUAL TO OR HIGHER THAN 250° C. |
| CARBON 3% INCLUDED PFA FOR COMPARISON | 130° C. | EQUAL TO OR HIGHER THAN 250° C. |
| 5% SILVER - PFA FILM FOR COMPARISON | 125° C. | 165° C. |

TABLE 20

| (SILVER + BISMUTH) FIXED PFA POWDER:PFA POWDER (VOLUME RATIO) | WATER CONTACT ANGLE |
|---|---|
| 1:9 | 108° |
| 2:8 | 108° |
| 4:6 | 105° |
| 5:5 | 106° |
| 6:4 | 98° |
| 10:0 | 82° |

Embodiment 3-3

As a component of the surface layer, Ni powder (average practice diameter: 0.4 μm) and bismuth powder (average particle diameter: 0.8 μm) were mixed into PFA powder (MP102 (made by DuPont-Mitsui Fluorochemicals Co., Ltd.), average particle diameterϕ: 20 μm) together in amounts such that Ni amounts to 4.5 vol % and bismuth amounts to 0.5 vol % in reduced volume, the thus-obtained one was input to a hybridization system configured as shown in FIG. 8 made by Nara Machinery Co., Ltd., and, as (Ni+bismuth) powder, it was fixed on PFA powder. A state in which (Ni+bismuth) almost covered PFA powder was confirmed from observation by means of SEM. This (Ni+bismuth) fixed powder was mixed with PFA powder (MP102 (DuPont-Mitsui Fluorochemicals Co., Ltd.), average particle diameter ϕ: 20 μm) in a volume ratio shown in Table 21 below, it was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. In Table 21 below, a relationship between a volume ratio of (Ni+bismuth) fixed PFA powder:PFA powder, and a multiplying factor of thermal conductivity, is shown. There, the volume ratio is one obtained from a weight ratio and a specific gravity, and does not mean a volume ratio of the powder. The multiplying factor of thermal conductivity is one obtained from thermal conductivity obtained from the above-mentioned measurement and calculation being divided by measurement value of thermal conductivity of PFA, and shows a multiple of thermal conductivity with respect to the thermal conductivity of PFA.

Further, as a comparison example, silver (average particle diameter: 1.2 μm) was mixed with PFA powder (MP102 (made by DuPont-Mitsui Fluorochemicals Co., Ltd), average particle diameter ϕ 20 μm) in such an amount that Ni amounts to 5% in reduced volume with the use of a stirring apparatus KK-500 made by Kurabo Industries Ltd., it was burned in the same way, and a sheet was produced. The reason why Ni amounts to 5% is that, in an electrostatic coating, a film forming cannot be carried out more than it.

TABLE 21

| (Ni + BISMUTH) FIXED PFA POWDER:PFA POWDER (VOLUME RATIO) | MULTIPLYING FACTOR OF THERMAL CONDUCTIVITY |
|---|---|
| 1:9 | 0.80 |
| 2:8 | 2.30 |
| 4:6 | 8.34 |
| 5:5 | 8.87 |
| 6:4 | 9.20 |
| 5% Ni - PFA FILM FOR COMPARISON | 2.30 |

Embodiment 3-4

The same as the embodiment 3-3, (Ni+bismuth) powder was mixed into PFA powder (MP102 (made by DuPont-Mitsui Fluorochemicals Co., Ltd.), average particle diameter ϕ 20 μm) in amounts such that Ni amounts to 4.5 vol % and bismuth amounts to 0.5 vol % in reduced volume, and (Ni+bismuth) fixed PFA powder was produced. This powder was mixed with PFA powder (MP102 (DuPont-Mitsui Fluorochemicals Co., Ltd.), average particle diameter ϕ 20 μm) in a volume ratio shown in Table 22 and Table 23 below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in Rz was produced, and thus, the fixing roller was produced. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller surface was observed. As a result, no particularly large adhesion was observed, and nothing other than ordinary one occurred. Further, when cold offset temperature and hot offset temperature, i.e., a range in which toner can be fixed were obtained, it was seen that the cold offset temperature lowered and a fixing temperature range was widened. Thereby, it is seen that, even when temperature lowering occurs upon high speed paper passage, stable fixing can be carried out. Carbon 3% included PFA in Table 22 is a conventional one for comparison. Further, as a comparison example, Ni powder (average particle diameter: 1.2 μm) was mixed with PFA powder (MP102 (made by DuPont-Mitsui Fluorochemicals Co., Ltd.), average particle diameter ϕ 20 μm) in such an amount that Ni amounts to 5 vol % in reduced volume with the use of a stirring apparatus KK-500 made by Kurabo Industries Ltd., and the fixing roller was provided similarly. At the same time, a sample was produced on a flat plate from the same material, and water contact angle was measured.

TABLE 22

COMPARISON EXAMPLE BY (Ni + BISMUTH) PFA POWDER:PFA POWDER (VOLUME RATIO)

| (Ni + BISMUTH) PFA POWDER:PFA POWDER (VOLUME RATIO) | COLD OFFSET TEMPERATURE | HOT OFFSET TEMPERATURE |
|---|---|---|
| 1:9 | 130° C. | EQUAL TO OR HIGHER THAN 250° C. |
| 2:8 | 130° C. | EQUAL TO OR HIGHER THAN 250° C. |
| 4:6 | 130° C. | EQUAL TO OR HIGHER THAN 250° C. |
| 5:5 | 125° C. | EQUAL TO OR HIGHER THAN 250° C. |
| 6:4 | 115° C. | EQUAL TO OR HIGHER THAN 250° C. |
| 10:0 | 105° C. | EQUAL TO OR HIGHER THAN 250° C. |
| CARBON 3% INCLUDED PFA FOR COMPARISON | 130° C. | EQUAL TO OR HIGHER THAN 250° C. |
| 5% Ni - PFA FILM FOR COMPARISON | 130° C. | 165° C. |

TABLE 23

| (Ni + BISMUTH) FIXED PFA POWDER:PFA POWDER (VOLUME RATIO) | WATER CONTACT ANGLE |
|---|---|
| 1:9 | 108° |
| 2:8 | 108° |
| 4:6 | 107° |
| 5:5 | 106° |
| 6:4 | 98° |
| 10:0 | 84° |

Embodiment 3-5

As a component of the surface layer, into wet fluorine coating (EN700CL) made by DuPont Co., Ltd., with respect to dry PFA weight, silver powder (average particle diameter: 1.2 μm) in a volume ratio of 5% and Bi powder (average particle diameter: 2.8 μm) in a volume ratio of 2% were mixed, stirring and dispersion were carried out thereon, then spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 1 was fixed through a test machine (fixing device) having a configuration as shown in FIG. 2. 10000 sheets of black solid images were passed, and toner adhesion state on the roller surface was observed. As a result, no particularly large adhesion was observed, and nothing other than ordinary one occurred.

Embodiment 4

Next, embodiments of the heating member (fixing member) 11B applied in the fixing device (heating device) 6B in the electromagnetic induction heating type configured as shown in FIG. 3 are described.

Embodiment 4-1

Figure 19:
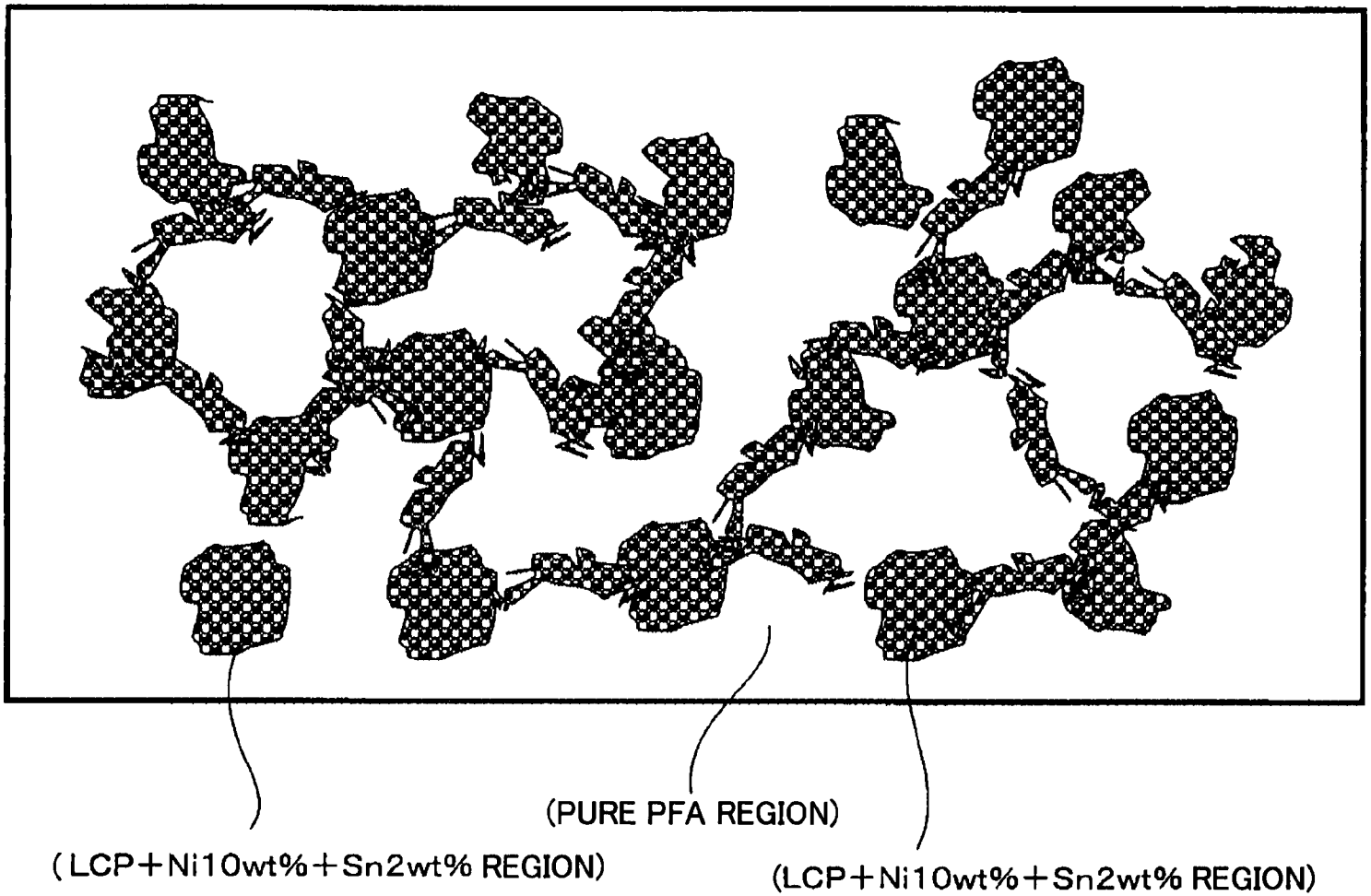
FIG. 19 is a diagram of a sketch of a magnified view of a part of a surface of a sample of an electrically conductive layer shown in embodiment 4.

As a component material of the surface layer also acting as an electrically conductive layer, Ni powder (average particle diameter 2.5 μm, apparent density 0.8 g/cm$^2$) 10 wt % and Sn powder (average particle diameter 15.8 μm, apparent density 0.7 g/cm$^2$) 2 wt %, in reduced weight, were mixed into liquid crystal high polymer (LCP). Next, heating and mixing were carried out, cooling was carried, after that re-powdering was carried out, and thus, powder in average particle diameter 12 μm was obtained. This metal included LCP powder and PFA powder were mixed, compression in ordinary pressure was carried out, after that a state of a thickness on the order of 2 mm was obtained. Burning at 380° C. was carried out, resin was melted and then cooled, and thus, a sample was produced. A mixture weight ratio between the metal included LCP powder and PFA powder was 2:8. The surface layer (electrically conductive layer) was made by the metal included LCP powder and PFA powder. FIG. 19 shows a sketch of a magnified view of a part of a surface of this sample.

In this sample, transparent PFA was applied, and thereby, details could be observed by means of an optical microscope. The LCP parts successively contacted mutually, and thus, when the sample was subject to electromagnetic induction heating testing on an electromagnetic range for cooking, it generated heat on the electromagnetic range satisfactorily.

Embodiment 4-2

Figure 20:
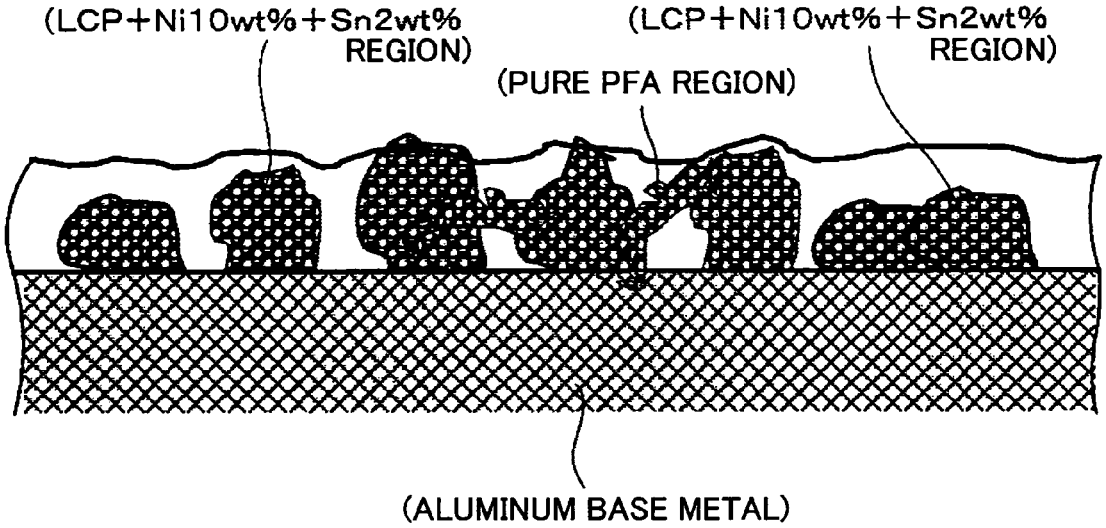
FIG. 20 is a diagram of a sectional view of the sample of the electrically conductive layer shown in FIG. 19.

The same as the embodiment 4-1, as a component material of the electrically conductive layer, Ni powder (average particle diameter 2.5 μm, apparent density 0.8 g/cm$^2$) 10 wt % and Sn powder (average particle diameter 15.8 μm, apparent density 0.7 g/cm$^2$) 2 wt % were mixed into LCP. Next, heating and mixing were carried out, cooling was carried, after that re-powdering was carried out, and thus, powder in average particle diameter 12 μm was obtained. This metal included LCP powder and PFA powder were mixed, electrostatically coating was made on an aluminum tube to be a core metal of the fixing roller with this mixed powder, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the outermost surface layer equal to or less than 2 μm in ten point average roughness (Rz) was produced. FIG. 19 shows a surface of this electrically conductive layer. Since the PFA was transparent, all could be seen when viewed from the top. FIG. 20 shows a sectional view of the surface layer (electrically conductive layer) of FIG. 19. The metal included LCP adheres to an aluminum base metal, and the PFA covers to contact them.

This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 4-3

Figure 21:
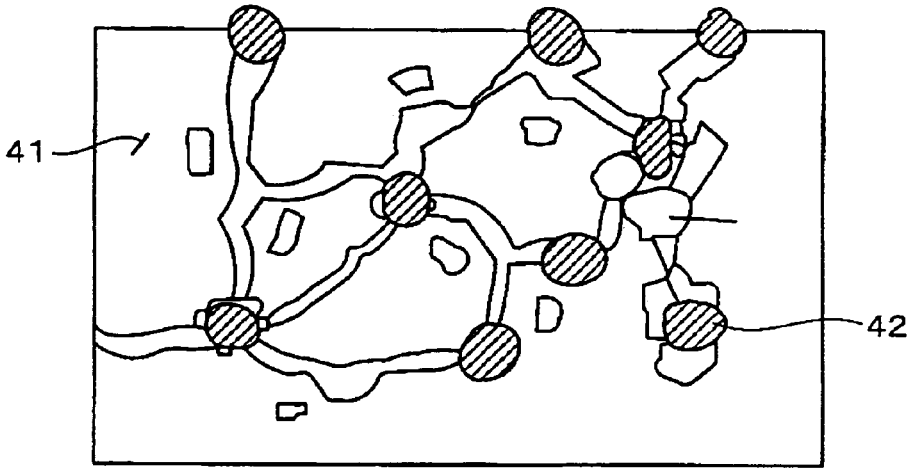
FIG. 21 is a diagram schematically showing a section of a component of the electrically conductive layer shown in embodiment 4 after burning.

As a component of the surface layer (electrically conductive layer), into wet fluorine coating (EN700CL) made by DuPont Co., Ltd., with respect to dry PFA weight, Ni powder (average particle diameter: 2.5 μm, apparent density 0.8 g/cm$^2$) 10 wt % and Sn powder (average particle diameter: 15.8 μm, apparent density 0.7 g/cm$^2$) 2 wt % were mixed, stirring was carried out to produce coating liquid, after that spray coating was carried out on an aluminum tube to be a core metal of a fixing roller, the coated resin was melted at 380° C. and then cooled, after that grinding was carried out, and the fixing roller was obtained. A final thickness of the surface layer (electrically conductive layer) was 50 μm. This roller was ground with corundum particles having different particle diameters, and thus, one having surface roughness of the outermost surface layer equal to or less than 2 μm in ten point average roughness (Rz) was produced. FIG. 21 shows a schematic view of this material after burning. In this material, filler Ni is bonded by low-melting-point metal Sn-3.5 Ag or Sn, and thus, a metal successively contacting part 42 is produced. Thereby, electrical conductivity can be ensured with a small amount of filler. Further, even when a base phase has insulating properties, thermal conductivity and electrical conductivity can be ensured. In this embodiment, fluorocarbon resin 41 is applied as the base phase, and thus, releasability can be ensured.

This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 4-4

As a component of the surface layer (electrically conductive layer), PFA powder (average particle diameter 40 μm) made by DuPont Co., Ltd., Ni powder (average particle diameter: 2.5 μm, apparent density 0.8 g/cm$^2$) and tin-3.5 silver powder (average particle diameter: 10.5 μm, apparent density 0.8 g/cm$^2$) were input to a mechanical fusion system AMS made by Hosokawa Co., Ltd., and thus one in which powder of Ni and tin-3.5 silver adhered to PFA powder was obtained. Ni amounted to 10 wt %, and tin-3.5 silver amounted to 3 wt %. This was coated to an aluminum tube to be a core metal of a fixing roller, the coated resin was melted at 380° C. and then cooled, after that grinding was carried out, and thus, the fixing roller was obtained. A final thickness of the surface layer (electrically conductive layer) was 50 μm. This roller was ground with corundum particles having different particle diameters, and thus, one having surface roughness on the outermost surface layer equal to or less than 2 μm in ten point average roughness (Rz) was produced.

This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 5

Next, embodiments of a heating member (fixing member) configured as shown in FIGS. 6 and 7, applied in a fixing device (heating device) in an electromagnetic induction heating type configured as shown in any one of FIGS. 3 through 5 are described.

Embodiment 5-1

As a component material of the surface layer (electrically conductive layer), Ni powder (average particle diameter 0.3 μm) and Sn powder (average particle diameter 2.4 μm) were mixed into PFA powder (MP102 (made by DuPont-Mitsui Fluorochemicals Co., Ltd.), average particle diameter ϕ20 μm), in such amounts as 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PFA powder (this is referred to as powder 1). A state in which the metal powder almost covered the PFA powder was confirmed from observation by means of SEM. This powder was coated on an aluminum substrate in an electrostatic manner, burning was carried out at 380° C., resin was melted and then cooled, the coating was pealed from the substrate, and a sample was produced. From this sample, a sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated)), electromagnetic wave was generated, and water temperature rise was measured. Further, a Ni foil having the same size as that of the above-mentioned sample sheet with a thickness of 30 μm was applied, measurement was carried out in the same conditions, and thus, a difference from the sample was compared. Specifically, a time required for raising from a room temperature for +30° C. was compared. As a result, in the configuration of the present embodiment, heating was achieved by a time which is 1.2 times a time required for heating the Ni foil of the thickness of 30 μm. That is, as a result of Ni and Sn being mixed into PFA and being made to contact successively, heat generating performance equivalent to a sole metal could be obtained with maintaining releasability.

Embodiment 5-2

The powder 1 of the embodiment 5-1 was electrostatically coated on an aluminum tube to be a core metal of the fixing roller, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the surface layer equal to or less than 2 μm in ten point average roughness (Rz) was produced. A state of a surface at this time is such as that shown in FIG. 6. Since the PFA was transparent, all could be seen when view from the top. FIG. 7 shows a sectional view of the surface layer. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. Toner of this MF4570 was one including wax. When the toner from which the wax was removed was produced, a non-fixed image was produced by cascade development, and it was passed through the testing machine, paper winding occurred due to toner adhesion for the first sheet.

The above-mentioned testing machine was applied, 10000 black solid images were passed therethrough with the toner including the wax, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 5-3

As a component of the surface layer (electrically conductive layer), into wet fluorine coating (EN700CL) made by DuPont Co., Ltd., with respect to dry PFA weight, the powder (powder 1) in which Ni powder and Sn powder were fixed to PFA powder in the embodiment 5-1 was mixed by 70%, stirring was carried out, after that spray coating was carried out on an aluminum tube to be a core metal of a fixing roller, the coated resin was melted at 380° C. and then cooled, after that grinding was carried out, and the fixing roller was obtained. A final thickness of the surface layer (electrically conductive layer) was 50 μm. This roller was ground with corundum particles having different particle diameters, and thus, one having surface roughness equal to or less than 2 μm in ten point average roughness (Rz) was produced. A sectional structure of this material after burning is the same as that of FIG. 7. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 10 seconds were required (a rated output was 800 W for both cases).

Embodiment 5-4

As a component material of the surface layer (electrically conductive layer), Ag powder (average particle diameter 0.3 μm) was mixed into PFA powder (MP102 (made by DuPont-Mitsui Fluorochemicals Co., Ltd.), average particle diameter ϕ 20 μm), to an amount of 10% in reduced volume, the thus-obtained one was input to a hybridization system configured as shown in FIG. 8 made by Nara Machinery Co., Ltd., and thus, Ag powder was fixed to PFA powder (this is referred to as powder 2). A state in which the metal powder almost covered the PFA powder was confirmed from observation by means of SEM. This powder 2 was coated on an aluminum substrate in an electrostatic manner, burning was carried out at 380° C., resin was melted and then cooled, the coating was pealed from the substrate, and a sample was produced. From this sample, a sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated)), electromagnetic wave was generated, and water temperature increase was measured. Further, a Ag foil having the same size as that of the above-mentioned sample sheet with a thickness of 30 μm was applied, measurement was carried out in the same conditions, and thus, sample difference was compared. Specifically, a time required for raising from a room temperature for +30° C. was compared. As a result, in the configuration of the present embodiment, heating was achieved by a time which is 1.3 times a time required for heating the Ag foil of the thickness of 30 μm. That is, as a result of Ag being mixed into PFA and being made to contact successively, heat generating performance equivalent to a sole metal could be obtained with maintaining releasability.

Embodiment 5-5

The powder 2 of the embodiment 5-2 was electrostatically coated on an aluminum tube to be a core metal of the fixing roller, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the surface layer equal to or less than 2 μm in ten point average roughness (Rz) was produced. Its surface was the same as the embodiment 5-2. Since the PFA was transparent, all could be seen when viewed from the top. FIG. 7 shows a sectional view of the surface layer. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. 10000 black solid images were passed with toner including wax, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 15 seconds were required (a rated output was 800 W for both cases).

Embodiment 5-6

As a component of the surface layer (electrically conductive layer), into wet fluorine coating (EN700CL) made by DuPont Co., Ltd., with respect to dry PFA weight, the powder (powder 2) in which Ag powder was fixed to PFA powder in the embodiment 5-4 was mixed by 70%, stirring was carried out, after that spray coating was carried out on an aluminum tube to be a core metal of a fixing roller, the coated resin was melted at 380° C. and then cooled, after that grinding was carried out, and the fixing roller was obtained. A final thickness of the surface layer (electrically conductive layer) was 50 μm. This roller was ground with corundum particles having different particle diameters, and thus, one having surface roughness equal to or less than 2 μm in Rz was produced. A sectional structure of this material after burning is the same as that of FIG. 7. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 9 seconds were required (a rated output was 800 W for both cases).

Embodiment 5-7

As a component of the surface layer (electrically conductive layer), Ag powder (average particle diameter 0.3 μm) was mixed into PFA powder (in a low temperature burned type, average particle diameter ϕ 20 μm) to an amount of 10 vol % in reduced volume, this was then input to a hybridization system of Nara Machinery Co., Ltd. such as that shown in FIG. 8, and thus Ag powder was fixed to PFA powder (this is referred to as powder 3). With observation by means of SEM, a state was confirmed that the metal powder almost covered the PFA powder. Then, this powder 3 was electrostatically coated on a silicon rubber layer on an aluminum tube having the silicon rubber with a thickness of 300 μm, burning at 340° C. was carried out, after that cooing was carried out, and thus, the fixing roller was obtained. A thickness of the surface layer (PFA part) was 50 μm. This was ground by means of corundum particles having different particle diameters, and one having surface roughness of the surface layer equal to or less than 2 μm in Rz was produced. A structure of a surface of this is the same as that of FIG. 6. Since the PFA was transparent, all could be seen when viewed from the top. A sectional structure of the fixing roller is such as that shown in FIG. 17, in which a heat insulating layer (or elastic layer) 18 made by silicon rubber is provided between the surface layer 15 and the core metal (base material) 17.

This fixing roller was applied in a fixing device of a commercially available color copier, a silicon-oil-less configuration was made, a non-fixed image produced by an image forming apparatus was fixed, by means of an electromagnetic induction heating testing machine (fixing device) such as that configured as shown in FIG. 3. 10000 color solid images were passed, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 15 seconds were required (a rated output was 800 W for both cases). Further, according to the present embodiment, since the heat generating layer is provided on an outermost surface, a starting up time the same as that of a monochrome machine can be achieved.

Embodiment 5-8

As a component of the surface layer (electrically conductive layer), respective powders was produced in each of which, into tin 80-silver 20 low-melting-point alloy powder (average particle diameter 1.1 μm), metal powder (average particle diameter 1.5 μm) of each of gold, silver, copper, lead, nickel, zinc, iron, aluminum, magnesium and titanium was mixed in equal volume. The equal volume mixed powder was mixed into PFA powder (in a low-temperature burned type, average particle diameter ϕ 20 μm) to amount to 10% in reduced volume, this was input to a hybridization system of Nara Machinery Co., Ltd., and thus each equal volume mixed metal powder was fixed to the PFA powder (referred to as powder A). With observation by means of SEM, it was confirmed that each metal powder almost covered the PFA powder. After that, the same as the embodiment 5-7, the fixing rollers were produced respectively. These fixing rollers were loaded in a testing machine (fixing device) for electromagnetic induction heating in a configuration such as that shown in FIG. 3, and heating test was carried out. As a result, times required for a surface temperature to reach 180° C. for respective metals included were 15±1 seconds for gold; 15±1 seconds for silver; 15±1 seconds for copper; 30±1 seconds for lead; 20±1 seconds for nickel; 25±1 seconds for zinc; 30±1 seconds for iron; 26±1 seconds for aluminum; 21±1 seconds for magnesium; and 23±1 seconds for titanium. For internal heating by an ordinary halogen heater as a comparison example, 50 seconds were required for a surface temperature of a roller to reach 180° C.

Embodiment 5-9

As a component of the surface layer (electrically conductive layer), the powder in which each metal powder (powder A) of the embodiment 5-8 almost covered PFA powder was mixed into wet fluorine coating (EN700CL) of DuPont Co., Ltd. to amount to 70% with respect to dry PFA weight, stirring was carried out, then spray coating thereof was carried out on an aluminum tube to be a core metal of a fixing roller, on which silicon rubber layer was attached, further in overlaying manner, this was burned at 340° C. to be melted and then cooled, and thus the fixing roller was produced. After that, the same as the embodiment 5-8, these fixing rollers were loaded in a testing machine (fixing device) for electromagnetic induction heating in a configuration such as that shown in FIG. 3, heating test was carried out, and thus, evaluation was carried out. As a result, times required for a surface temperature to reach 180° C. for respective metals included were 23±1 seconds for gold; 25±1 seconds for silver; 28±1 seconds for copper; 40±1 seconds for lead; 30±1 seconds for nickel; 35±1 seconds for zinc; 40±1 seconds for iron; 32±1 seconds for aluminum; 32±1 seconds for magnesium; and 34±1 seconds for titanium. For internal heating by an ordinary halogen heater as a comparison example, 50 seconds were required for a surface temperature of a roller to reach 180° C.

Embodiment 5-10

As a component of the surface layer (electrically conductive layer), into PFA powder (MP102 (DuPont-Mitsui Fluorochemicals Co., Ltd.), average particle diameter 20 μm), Ni powder (average particle diameter: 0.3 μm) and Sn powder (average particle diameter: 2.4 μm) were mixed to amount to 10 vol % for Ni and 5 vol % for Sn, this was input to a hybridization system of Nara Cooperation Co., Ltd. shown in FIG. 8, and thus, Ni and Sn were fixed to PFA powder. Next, mixing was carried out in a volume ratio according to Table 24 blow, this was then electrostatically coated on a an aluminum tube to be a core metal of a fixing roller, the coated resin was melted at 380° C. and then cooled, after that grinding was carried out with corundum particles, surface roughness thereof was made equal to or less than 2 μm in Rz, and the fixing roller was produced. A final thickness of the surface layer was 40 μm. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. 10000 black solid images were passed, and a toner adhesion state on the roller surface was observed. As a result, no particularly large toner adhesion was observed, and there was nothing different from an ordinary one.

TABLE 24

| Ni + Sn FIXED PFA POWDER:PFA POWDER (VOLUME RATIO) | WATER CONTACT ANGLE | ADHERING TONER |
|---|---|---|
| 1:9 | 108° | NOTHING |
| 2:8 | 108° | NOTHING |
| 4:6 | 105° | NOTHING |
| 5:5 | 106° | NOTHING |
| 6:4 | 98° | NOTHING |
| 10:0 | 82° | NOTHING |

Comparison Example in which Toner Adhesion Occurs

Mixed powder is produced as a result of, PFA powder (MP102 (DuPont-Mitsui Fluorochemicals Co., Ltd.)) as fluorocarbon resin and PEEK powder (made by Victrex-MC Inc., PEEK 150XF) as heat resistant resin being mixed in a predetermined weight ratio. On the other hand, as a base material, for example, a core metal surface of a fixing roller made of aluminum having a diameter ϕ of 40 mm, and wall thickness of a fixing part of 1.5 mm is roughened through abrasive blasting treatment. Then, the above-mentioned mixture powder is electrostatically coated on the core metal of the fixing roller made of aluminum, heating is carried out for 380° C. for 30 minutes, and rapid cooling is carried out by means of strong air blast outside of a heating furnace. Surface roughness of the releasing layer may be large depending on a type of powder or a mixture ratio. When surface roughness should be made the same predetermined amount, this can be obtained from grinding by means of a tape grinding apparatus, for example. For example, when tape grinding is carried out with corundum #800, #1500, surface roughness can be made equal to or less than 2 μm.

This fixing roller was loaded in a fixing part of a Ricoh's image forming apparatus MF4570, a non-fixed toner image produced by an image forming part having the same configuration as that of FIG. 1 was passed through a test machine (fixing device) having a configuration such as that shown in FIG. 3, and thus, fixing was carried out. 10000 sheets of black solid images were passed, and a toner adhesion state on the roller surface was observed. A result thereof is shown in Table 25 below:

TABLE 25

COMPARISON EXAMPLE BY PFA:PEEK (WEIGHT RATIO)

| PFA:PEEK (WEIGHT RATIO) | CONTACT ANGLE FOR PURE WATER | ADHERING TONER |
|---|---|---|
| 100:0 | 107° | NOTHING |
| 90:10 | 97° | NOTHING |
| 80:20 | 92° | NOTHING |
| 70:30 | 89° | NOTHING |
| 60:40 | 86° | NOTHING |
| 50:50 | 83° | NOTHING |
| 40:60 | 81° | TONER ADHERING TO ROLLER SURFACE |

TABLE 25-continued

| COMPARISON EXAMPLE BY PFA:PEEK (WEIGHT RATIO) | | |
|---|---|---|
| PFA:PEEK (WEIGHT RATIO) | CONTACT ANGLE FOR PURE WATER | ADHERING TONER |
| 30:70 | 79° | TONER ADHERING TO ROLLER SURFACE |
| 20:80 | 76° | TONER ADHERING TO ROLLER SURFACE |
| 15:85 | 75° | TONER ADHERING TO ROLLER SURFACE |

Embodiment 5-11

In the above-mentioned embodiments 5-2 through 5-10, examples are shown, in which the fixing roller 11B according to the embodiment 5 was loaded in the fixing device 6B shown in FIG. 3, and testing was made. However, this can be applied in the same in the fixing device 6C shown in FIG. 4 in which the two sets of heating means 12 were provided. By applying the fixing rollers of the embodiment 5 as the two rollers of top and bottom, both sides of the recording paper S can be heated at the same time. Accordingly, in this configuration, heating can be efficiently made from both sides of the recording paper S, and also, non-fixed toner images attached to both sides of the recording paper can be fixed at the same time.

Embodiment 5-12

As a component of the surface layer (electrically conductive layer), the powder 1 of the embodiment 5-1 was electrostatically coated on an aluminum tube to be a core metal of the fixing roller, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the surface layer equal to or less than 2 μm in Rz was produced. A state of its surface at this time is the same as that shown in FIG. 6. Since the PFA was transparent, all could be seen when viewed from the top. A sectional structure of this fixing roller is the same as that shown in FIG. 7. This fixing roller was applied in a fixing part of an image forming apparatus IMAGIO 750 of Ricoh Co., Ltd., a non-fixed image produced by the image forming apparatus was fixed, by means of an electromagnetic induction heating testing machine (fixing device) such as that configured as shown in FIG. 5. Since toner of IMAGIO 750 has insufficient releasability, oil coating member 19A immersed in silicon coil is added at least to the fixing roller 11B of the testing machine. Other than the adding of the oil coating members 19A and 19B, the basic configuration of the fixing device shown in FIG. 5 is the same as that of FIG. 3. Fixing was made with the use of this fixing device, 10000 black solid images were passed, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 5-13

The fixing roller was produced the same as the embodiment 5-2, and one having surface roughness of 2 μm in Rz was produced. An evaluation result of fixing performance obtained when this fixing roller was loaded in the testing machine for electromagnetic induction heating such as that shown in FIG. 3 is shown in Table 26 below.

With a quotient obtained from dividing a pressing force F [kgf] for recording material by an area S [$cm^2$] of a contact part at which the fixing roller 11B and the pressing roller 13 contact and are pressed mutually in a value equal to or less than 0.5 [$kgf/cm^2$], fixing performance was very bad. Further, toner adhesion to the fixing roller appeared in a range equal to or more than 4.0 [$kgf/cm^2$]. The fixing performance was judged simply so that one in which toner adhered to a cloth which was used to rub the solid image after the fixing was determined as insufficient fixing.

From the evaluation, it is seen that a quotient obtained from dividing a pressing force F [kgf] for recording material by an area S [$cm^2$] of a contact part at which the fixing roller 11B and the pressing roller 13 contact and are pressed mutually is preferable in a range equal to or more than 0.5 [$kgf/cm^2$] and also equal to or less than 4.0 [$kgf/cm^2$].

TABLE 26

| COMPARISON EXAMPLE BY PRESSING FORCE | | |
|---|---|---|
| PRESSING FORCE ($kgf/cm^2$) | ADHERING TONER AMOUNT | PAPER WINDING |
| 0.3 | NOTHING | NOTHING |
| 0.5 | NOTHING | NOTHING |
| 1.0 | NOTHING | NOTHING |
| 2.0 | SOME | NOTHING |
| 4.0 | VERY MUCH | FREQUENT JAM |

Embodiment 6

Next, embodiments of a heating member (fixing member) having a surface layer configured with the use of a plurality of types of fluorocarbon resins having different melting points as shown in FIGS. 10 through 16, applied in a fixing device (heating device) in an electromagnetic induction heating type configured as shown in any one of FIG. 3 through 5 are described.

Embodiment 6-1

(a) As a component material of the surface layer (electrically conductive layer), Ni powder (average particle diameter 0.5 μm) and Sn powder (average particle diameter 1.0 μm) were mixed into PTFE powder (7A-J (made by DuPont Co., Ltd)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PTFE powder. A state in which Ni and Sn almost covered the PTFE powder was confirmed from observation by means of SEM. This powder was coated on an aluminum substrate (base material 17) in an electrostatic manner, burning was carried out at 380° C. as shown in FIG. 14, top figure, resin was melted and then cooled, the coating was pealed from the substrate, and a sample was produced. A sectional view of the sample of this surface layer 15 is shown in FIG. 14, bottom figure, schematically. (b) As a comparison example, Ni powder (average particle diameter 0.5 μm) and Sn powder (average particle diameter 1.0 μm) were mixed into PFA powder (MP102 (made by DuPont-Mitsui Fluorochemicals Co., Ltd.)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PFA powder. A state in which Ni and Sn almost covered the PFA powder was confirmed from observation by means of SEM. This powder was coated on an aluminum substrate in an electrostatic manner, burning was carried out at 380° C. as shown in FIG. 14, top figure, resin was melted and then cooled, the coating was pealed from the substrate, and a sample for comparison was produced. (c) As another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ni powder (average particle diameter 0.5 μm) was mixed into this powder for an amount of 3% in reduced volume, as well as Sn powder (average particle diameter 1.0 μm) was mixed into this powder for an amount of 2% in reduced volume, in an ordinary stirring manner, and a sheet was produced similarly. The reason why Ni amounts to 3% and Sn amounts to 2% is that, in an electrostatic coating, a film forming cannot be carried out more than it.

Thus, each sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, difference from the Ni foil with thickness of 30 μm and size of 50 mm by 50 mm was compared. Specifically, a time required for raising from a room temperature for +30° C. was compared.

In the configuration example of (a), heating was achieved by a time which is 1.5 times a time required for heating the Ni foil of the thickness of 30 μm.

In contrast thereto, in the configuration example of (b), only a time which is 1.2 times a time required for heating the Ni foil was required.

In the configuration example of (c), water temperature rise could not be detected.

Embodiment 6-2

(a) As a component material of the surface layer (electrically conductive layer), Ni powder (average particle diameter 0.5 μm) and Sn powder (average particle diameter 1.0 μm) were mixed into PTFE powder (7A-J (made by DuPont Co., Ltd.)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PTFE powder. A state in which Ni and Sn almost covered the PTFE powder was confirmed from observation by means of SEM. Further, Ni powder (average particle diameter 0.5 μm) and Sn powder (average particle diameter 1.0 μm) were mixed into PFA powder (MP102 (DuPont-Mitsui Fluorochemicals Co., Ltd.)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PFA powder. A state in which Ni and Sn almost covered the PFA powder was confirmed from observation by means of SEM.

Next, as shown in FIG. 15(*a*), top figure, first the PFA powder covered by Ni and Sn (fluorocarbon resin having low melting point 41B) was electrostatically coated on an aluminum substrate (base material 17), and next, further thereon, the PTFE powder covered by Ni and Sn (fluorocarbon resin having high melting point 41A) was electrostatically coated. Finally the PFA powder covered by Ni and Sn (fluorocarbon resin having low melting point 41B) was again electrostatically coated. Thus, they were laminated. After that burning was carried out at 380° C., the fluorocarbon resin having low melting point was melted and then cooled, the coating was pealed from the substrate, and a sample was produced. A sectional view of the sample of this surface layer 15 is shown in FIG. 15(*a*), bottom figure, schematically. (b) As a comparison example, Ni powder (average particle diameter 0.5 μm) and Sn powder (average particle diameter 1.0 μm) were mixed into PFA powder (MP102 (made by DuPont-Mitsui Fluorochemicals Co., Ltd.)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PFA powder. A state in which Ni and Sn almost covered the PFA powder was confirmed from observation by means of SEM. This powder was coated on an aluminum substrate in an electrostatic manner, burning was carried out at 380° C., the resin was melted and then cooled, the coating was pealed from the substrate, and a sample for comparison was produced. (c) As another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ni powder (average particle diameter 0.5 μm) was mixed into this powder for an amount of 3% in reduced volume, as well as Sn powder (average particle diameter 1 μm) was mixed into this powder for an amount of 2% in reduced volume, in an ordinary stirring manner, and a sheet was produced similarly. The reason why Ni amounts to 3% and Sn amounts to 2% is that, in an electrostatic coating, a film forming cannot be carried out more than it.

Thus, each sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, a difference from the Ni foil with thickness of 30 μm and size of 50 mm by 50 mm was compared. Specifically, a time required for raising from a room temperature for +30° C. was compared.

In the configuration example of (a), heating was achieved by a time which is 1.5 times a time required for heating the Ni foil of the thickness of 30 μm.

In contrast thereto, in the configuration example of (b), only a time which is 1.2 times a time required for heating the Ni foil was required.

In the configuration example of (c), water temperature rise could not be detected.

Embodiment 6-3

(a) As a component material of the surface layer (electrically conductive layer), Ni powder (average particle diameter 0.5 μm) and Sn powder (average particle diameter 1.0 μm) were mixed into PFA powder (MP102 (made by DuPont-Mitsui Fluorochemicals Co., Ltd)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to PFA powder. A state in which Ni and Sn almost covered the PFA powder was confirmed from observation by means of SEM. This powder was mixed with FEP powder (532-8110 (made by DuPont Co., Ltd.)) to which Ni powder and Sn powder had been fixed in the same manner, this is then coated on an aluminum substrate in an electrostatic manner, burning was carried out at 300° C. as shown in FIG. 14, top figure, resin was melted and then cooled, the coating was pealed from the substrate, and a sample of the surface layer 15 was produced. A sectional view of the sample of this surface layer 15 is shown in FIG. 14, bottom figure, schematically. (b) As a comparison example, Ni powder (average particle diameter 0.5 μm) and Sn powder (average particle diameter 1.0 μm) were mixed into FEP powder (532-8110 (made by DuPont Co., Ltd.)), to amount to 10 vol % of Ni and 2 vol % of Sn in reduced volume, the thus-obtained one was input to a hybridization system configured as shown in FIG. 8 made by Nara Machinery Co., Ltd., and thus, Ni powder and Sn powder were fixed to FEP powder. A state in which Ni and Sn almost covered the FEP powder was confirmed from observation by means of SEM. This powder was coated on an aluminum substrate in an electrostatic manner, burning was carried out at 300° C., resin was melted and then cooled, the coating was pealed from the substrate, and a sample for comparison was produced. (c) As another comparison example, to PFA powder (MP102 (made by DuPont-Mitsui Fluorochemicals Co., Ltd)), FEP powder (532-8110 (made by DuPont Co., Ltd.)) was mixed in an ordinary stirring manner, further Ni powder (average particle diameter 0.5 μm) was mixed into this powder for an amount of 3% in reduced volume, as well as Sn powder (average particle diameter 1.0 μm) was mixed into this powder for an amount of 2% in reduced volume, in an ordinary stirring manner, and a sheet was produced similarly. The reason why Ni amounts to 3% and Sn amounts to 2% is that, in an electrostatic coating, a film forming cannot be carried out more than it.

Thus, each sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, difference from the Ni foil with thickness of 30 μm and size of 50 mm by 50 mm was compared. Specifically, a time required for raising from a room temperature for +30° C. was compared.

In the configuration example of (a), heating was achieved by a time which is 1.5 times a time required for heating the Ni foil of the thickness of 30 μm.

In contrast thereto, in the configuration example of (b), only a time which is 1.2 times a time required for heating the Ni foil was required.

In the configuration example of (c), water temperature rise could not be detected.

Embodiment 6-4

The powder of (a) of the embodiment 6-1 was electrostatically coated on an aluminum tube to be a core metal (base material) of the fixing roller, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the surface layer equal to or less than 2 μm in ten point average roughness (Rz) was produced. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 4 seconds were required (a rated output was 800 W for both cases).

Further, as a result of releasing agent being coated to the releasing layer 15 (surface layer) of the fixing roller 11B in the present embodiment with the use of oil coating member 19A as shown in FIG. 5, oil component is held by a heat-resistant resin part, thus an offset preventing coated layer can provide non-adhesive characteristics for a long period stably. As a result, even after additional 10000 sheets of black solid images were passed and a toner adhesion state on the roller surface was observed, no particularly large adhesion was found, and no particular difference from an ordinary one occurred.

Embodiment 6-5

(a) As a component material of the surface layer (electrically conductive layer), Ag powder (average particle diameter 0.5 μm) was mixed into PTFE powder (7A-J (made by DuPont Co., Ltd)), to amount to 10 vol % of Ag in reduced volume, the thus-obtained one was input to a hybridization system configured as shown in FIG. 8 made by Nara Machinery Co., Ltd., and thus, Ag powder was fixed to PTFE powder. A state in which Ag almost covered the PTFE powder was confirmed from observation by means of SEM. This powder was mixed with PFA powder (MP102 (made by DuPont-Mitsui Fluorochemicals Co., Ltd.)) to which Ag powder had been fixed in the same manner, this is then coated on an aluminum substrate (base material 17) in an electrostatic manner as shown in FIG. 14, top figure, burning was carried out at 380° C., resin was melted and then cooled, the coating was pealed from the substrate, and a sample of the surface layer was produced. A sectional view of the sample of this surface layer 15 is shown in FIG. 14, bottom figure, schematically. (b) As a comparison example, Ag powder (average particle diameter 0.5 μm) was mixed into PFA powder (MP102 (made by DuPont-Mitsui Fluorochemicals Co., Ltd.)), to amount to 10 vol % of Ag in reduced volume, the thus-obtained one was input to a hybridization system configured as shown in FIG. 8 made by Nara Machinery Co., Ltd., and thus, Ag powder was fixed to PFA powder. A state in which silver almost covered the PFA powder was confirmed from observation by means of SEM. This powder was coated on an aluminum substrate in an electrostatic manner, burning was carried out at 380° C., resin was melted and then cooled, the coating was pealed from the substrate, and a sample for comparison was produced. (c) As another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ag powder (average particle diameter 0.5 μm) was mixed into this powder for an amount of 5% in reduced volume in an ordinary stirring manner, and a sheet was produced similarly. The reason why Ag amounts to 5% is that, in an electrostatic coating, a film forming cannot be carried out more than it.

Thus, each sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, an Ag foil having the same size as that of the above-mentioned sample sheet with a thickness of 30 μm was applied, measurement was carried out in the same conditions, and thus, difference from the Ni foil with thickness of 30 μm and size of 50 mm by 50 mm was compared. Specifically, a time required for raising from a room temperature for +30° C. was compared.

In the configuration example of (a), heating was achieved by a time which is 1.3 times a time required for heating the Ag foil.

In contrast thereto, in the configuration example of (b), only a time which is 1.1 times a time required for heating the Ag foil was required.

In the configuration example of (c), water temperature rise could not be detected.

Embodiment 6-6

(a) As a component material of the surface layer (electrically conductive layer), Ag powder (average particle diameter 0.5 μm) was mixed into PTFE powder (7A-J (made by DuPont Co., Ltd)), to amount to 10 vol % of Ag in reduced volume, the thus-obtained one was input to a hybridization system configured as shown in FIG. 8 made by Nara Machinery Co., Ltd., and thus, Ag powder was fixed to PTFE powder. A state in which Ag almost covered the PTFE powder was confirmed from observation by means of SEM. Further, Ag powder (average particle diameter 0.5 μm) was mixed into PFA powder (MP102 (made by DuPont-Mitsui Fluorochemicals Co., Ltd)), to amount to 10 vol % of Ag in reduced volume, the thus-obtained one was input to a hybridization system configured as shown in FIG. 8 made by Nara Machinery Co., Ltd., and thus, Ag powder was fixed to PFA powder. A state in which Ag almost covered the PFA powder was confirmed from observation by means of SEM.

Next, as shown in FIG. 15(*a*), top figure, first the Ag covered PFA powder (low-melting-point fluorocarbon resin 41B) was electrostatically coated on an aluminum substrate (substrate 17); next further thereon the Ag covered PTFE powder (high-melting-point fluorocarbon resin 41A) was electrostatically coated; and finally the Ag covered PFA powder (low-melting-point fluorocarbon resin 41B) was again electrostatically coated so that they were laminated, after that burning was carried out at 380° C., the low-melting-point resin was melted and then cooled, the coating was pealed from the substrate, and a sample of the surface layer was produced. A sectional view of the sample of this surface layer 15 is shown in FIG. 15(*a*), bottom figure, schematically. (b) As a comparison example, Ag powder (average particle diameter 0.5 μm) was mixed into PFA powder (MP102 (made by DuPont-Mitsui Fluorochemicals Co., Ltd.)), to amount to 10 vol % of Ag in reduced volume, the thus-obtained one was input to a hybridization system configured as shown in FIG. 8 made by Nara Machinery Co., Ltd., and thus, Ag powder was fixed to PFA powder. A state in which silver almost covered the PFA powder was confirmed from observation by means of SEM. This powder was coated on an aluminum substrate in an electrostatic manner, burning was carried out at 380° C., resin was melted and then cooled, the coating was pealed from the substrate, and a sample for comparison was produced. (c) As another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ag powder (average particle diameter 0.5 μm) was mixed into this powder for an amount of 5% in reduced volume in an ordinary stirring manner, and a sheet was produced similarly. The reason why Ag amounts to 5% is that, in an electrostatic coating, a film forming cannot be carried out more than it.

Thus, each sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, an Ag foil having the same size as that of the above-mentioned sample sheet with a thickness of 30 μm was applied, measurement was carried out in the same conditions, and thus, difference from the Ag foil with thickness of 30 μm and size of 50 mm by 50 mm was compared. Specifically, a time required for raising from a room temperature for +30° C. was compared.

In the configuration example of (a), heating was achieved by a time which is 1.3 times a time required for heating the Ag foil.

In contrast thereto, in the configuration example of (b), only a time which is 1.1 times a time required for heating the Ag foil was required.

In the configuration example of (c), water temperature rise could not be detected.

Embodiment 6-7

The powder of (a) of the embodiment 6-5 was electrostatically coated on an aluminum tube to be a core metal (base material) of the fixing roller, the coated resin was melted at 380° C. and then cooled, after that grinding was carried out, and the fixing roller was obtained. A final thickness of the surface layer (electrically conductive layer) was 50 μm. This was ground by means of corundum particles having different particle diameters, and one having surface roughness of the surface layer equal to or less than 2 μm in Rz was produced. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 14 seconds were required (a rated output was 800 W for both cases).

Embodiment 6-8

First as shown in FIG. 13 (a), top figure, wet fluorine coating (EN700CL) made by DuPont Co., Ltd. was coated to an aluminum tube to be a core metal (substrate 17) of a fixing roller by a spray manner. Next, further thereon, a coating, which is produced as a result of the powder of the embodiment 6-1 (a) in which Ni powder and Sn powder were fixed to PTFE powder being mixed to amount to 70% with respect to dry PFA weight into the above-mentioned wet fluorine coating (EN700CL) and stirring being carried out, was coated by a spray manner. Finally, the above-mentioned wet fluorine coating (EN700CL) was coated in a spray manner, so that they were laminated. After that the coated resin was melted at 380° C. and then cooled, after that grinding was carried out, and the fixing roller was obtained. A final thickness of the surface layer (electrically conductive layer) was 50 μm. A schematic sectional view of the surface layer of this fixing roller is shown in FIG. 13(*a*), bottom figure.

This roller was ground with corundum particles having different particle diameters, and thus, one having surface roughness equal to or less than 2 μm in Rz was produced. This fixing roller was applied in a fixing device of an image forming apparatus MF4570 of Ricoh Co., Ltd., a non-fixed image produced by an image forming apparatus in a configuration the same as that shown in FIG. 1 was fixed, by means of an electromagnetic induction heating testing machine (fixing device) such as that configured as shown in FIG. 3. After 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 11 seconds were required (a rated output was 800 W for both cases).

Embodiment 6-9

As a component of the surface layer (electrically conductive layer), Ag powder (average particle diameter 0.5 μm) was mixed into PTFE powder (7A-J (made by DuPont Co., Ltd.)) to an amount of 10 vol % in reduced volume, this was then input to a hybridization system of Nara Machinery Co., Ltd. such as that shown in FIG. 8, and thus Ag powder was fixed to PTFE powder. With observation by means of SEM, a state was confirmed that Ag almost covered the PTFE powder. This powder was mixed into PFA powder (MP102 (made by DuPont-Mitsui Fluorochemicals Co., Ltd.)) to which Ag powder had been fixed in the same manner. Next, with the use of an aluminum tube to be a core metal (base material) of the fixing roller having a silicon rubber with a thickness of 300 μm provided thereon, the above-mentioned mixed powder was electrostatically coated in a overlaying manner on the silicon rubber layer of the aluminum tube, burning at 340° C. was carried out, after that cooling was carried out, and thus, the fixing roller was obtained. A thickness of the surface layer (electrically conductive layer) was 50 μm. This was ground by means of corundum particles having different particle diameters, and one having surface roughness of the surface layer equal to or less than 2 μm in Rz was produced. A layer structure of this fixing roller in section is shown in FIG. 18.

This fixing roller was applied in a fixing device of a commercially available color copier, a silicon oil less configuration was made, a non-fixed image produced by an image forming apparatus was fixed, by means of an electromagnetic induction heating testing machine (fixing device) such as that configured as shown in FIG. 3. 10000 color solid images were passed, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 13 seconds were required (a rated output was 800 W for both cases). Further, according to the present embodiment, since the heat generating layer is provided on an outermost surface, a starting up time the same as that of a monochrome machine can be achieved.

Embodiment 7

As shown in the embodiments 1 through 6 above, in the heating member (fixing member) according to the present invention, the surface layer is provided in which metal is mixed into the fluorocarbon resin having releasability, and, as the metal contacts successively to form a metal successively contacting part, thermal conductively or electrical conductivity can be improved while releasability is maintained. As the metal to be mixed into the fluorocarbon resin, a combination of metal (or alloy) which is good thermal or electrical conductor, and which has a melting point higher than the fluorocarbon resin and low-melting-point metal (or low-melting-point alloy) is preferable. Further, by applying fluorocarbon resin in which carbon family materiel is included as the fluorocarbon resin, thermal conductivity or durability of the surface layer can be further improved.

Figure 22:
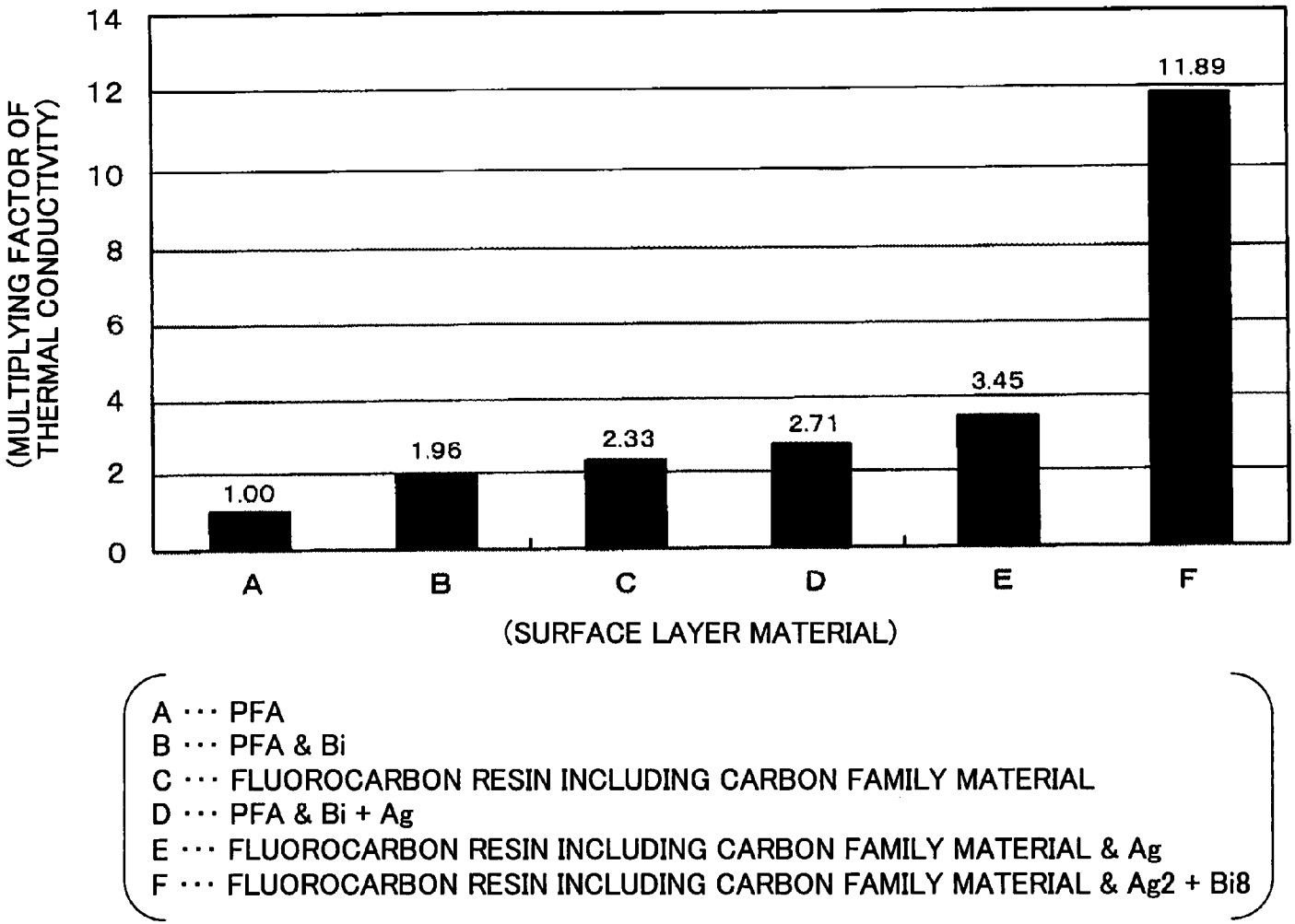
FIG. 22 is a diagram showing multiplying factor of thermal conductivity of material of a surface layer with respect to thermal conductivity of PFA.

In FIG. 22, with respect to (A) thermal conductivity of PFA which is fluorocarbon resin, (B) one in which Bi which is low-melting-point metal is mixed into PFA; (C) fluorocarbon resin in which carbon family material is included; (D) one in which Bi and Ag are mixed into PFA; (E) one in which Ag is mixed into fluorocarbon resin in which carbon family material is included; and (F) one in which Ag 2% and Bi 8% are mixed into fluorocarbon resin in which carbon family material is included, were produced, and thermal conductivities thereof were compared. Expression is made by multiplying factors with respect to thermal conductivity of PFA.

In FIG. 22, thermal conductivity is better 1.4 times in (D) in which Bi and Ag are mixed into PFA than that of (B) in which Bi is solely mixed into PFA. Thus, thermal conductivity can be improved by applying a combination of good thermal or electrical conductor, Ag (melting point 961.9° C.) having a melting point higher than that of PFA (310° C.) and low-melting-point metal Bi. This is because, it can be considered that, when a surface layer in which fluorocarbon resin and metal are fixed is burned, since only low-melting-point metal Bi is not easy to be wet and to spread to the fluorocarbon resin autonomously, a configuration in which, Ag having high meting point than that of PFA acts as a base point, and Bi connect it, is advantageous for heat (electricity) path production. That is, since low-melting-point metal such as Bi or such can connect between high-melting-point metal such as Ag, it is possible to provide the surface layer having a superior heat (electricity) passing efficiency and thus, meeting the requirements.

Further, as is seen from FIG. 22, thermal conductivity can be further improved by applying fluorocarbon resin in which carbon family material is included. In particular, one in which a combination of Bi and Ag is mixed into fluorocarbon resin including carbon family materiel provides thermal conductivity 11.89 times that of PFA. Accordingly, in the above-described embodiments, by applying fluorocarbon resin including carbon family material as the fluorocarbon resin forming the surface layer, thermal conductivity in the surface layer can be further improved.

As described above, in the heating member (fixing member) according to the first through seventh embodiments of the present invention, since the releasing layer acts as good thermal conductive layer, it is possible to reduce temperature lowering on the heating member (fixing member) surface occurring in the conventional fluorocarbon resin having low thermal conductivity. Thereby, when this is applied in a fixing device of an image forming apparatus, paper passing speed reduction which is carried out upon surface temperature lowering in a conventional image forming apparatus should not be carried out, when continuous paper passing is carried out. Thus, stable image forming is made possible. Further, improvement in thermal conductivity can also be evaluated from measurement of cold offset temperature indicating whether or not fixing of non-fixed image can be carried out even when temperature of the fixing member lowers. According to the present invention, heating efficiency upon fixing can be improved, a fixing member by which productivity in image forming can be improved can be provided, and a fixing device employing it can be provided.

Further, in the heating member (fixing member) according to the first through seventh embodiments of the present invention, the releasing layer of the surface layer can also act as a heat generating layer (electrically conductive layer) of electromagnetic induction heating, and thus, a staring-up time upon heating can be remarkably reduced. Further, since silicon rubber layer or such commonly applied for improving image quality can be disposed to the rear side (on the side of the base material) than the heat generating layer, time lag for heating can be minimized. Further, fluorocarbon resin which is necessary for providing releasability results in degradation in heating efficiency since it has a low thermal conductivity, in a common configuration. However, according to the present invention, since the releasing layer also acts as heat generating layer (electrically conductive layer), electrical conductivity is provided to the surface layer without losing releasability, and this can be applied in electromagnetic induction heating. Thus, this configuration is very advantageous. Accordingly, a heating device applying the heating member according to the present invention can be preferably applied in a fixing device of an image forming apparatus such as a copier, a printer, a plotter, a facsimile or such, and an image forming apparatus having high reliability and high energy efficiency can be achieved.

Next, configurations of eighth through thirteenth embodiments of the present invention are described. FIGS. 23 through 27 show configurations of eighth through thirteenth embodiments of the present invention, and correspond to FIGS. 1 through 5 applied for the description of the above-described first through seventh embodiments. Respective components of these figures have similar configurations and functions as those shown in FIGS. 1 through 5, the same reference numerals are given to the corresponding components, and description thereof is omitted.

Figure 28:
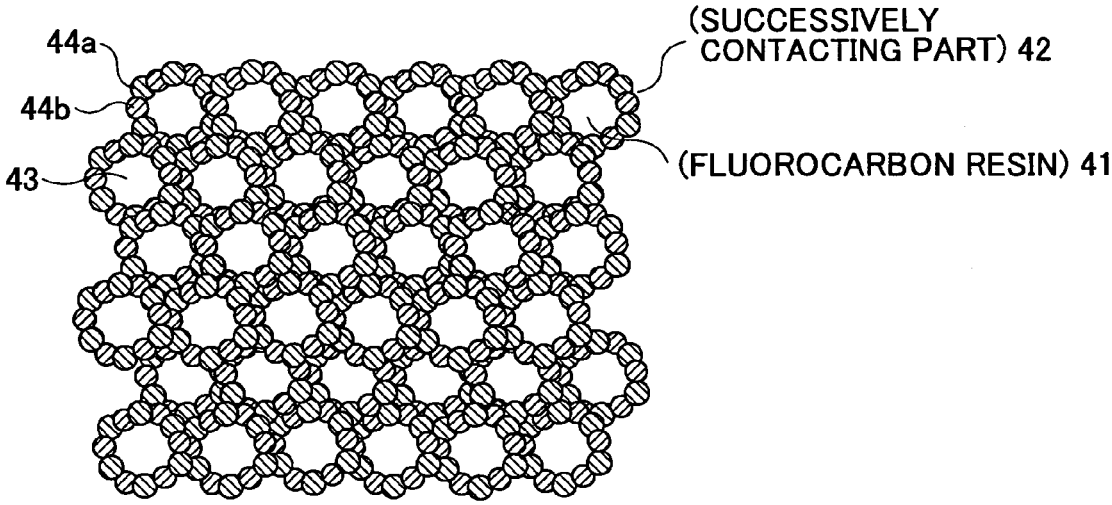
FIG. 28 is a diagram showing a configuration example of a surface layer of a heating member (fixing member) according to embodiments 8 through 13 of the present invention, and showing a sectional view in a direction along a surface of a part of the surface layer.
Figure 29:
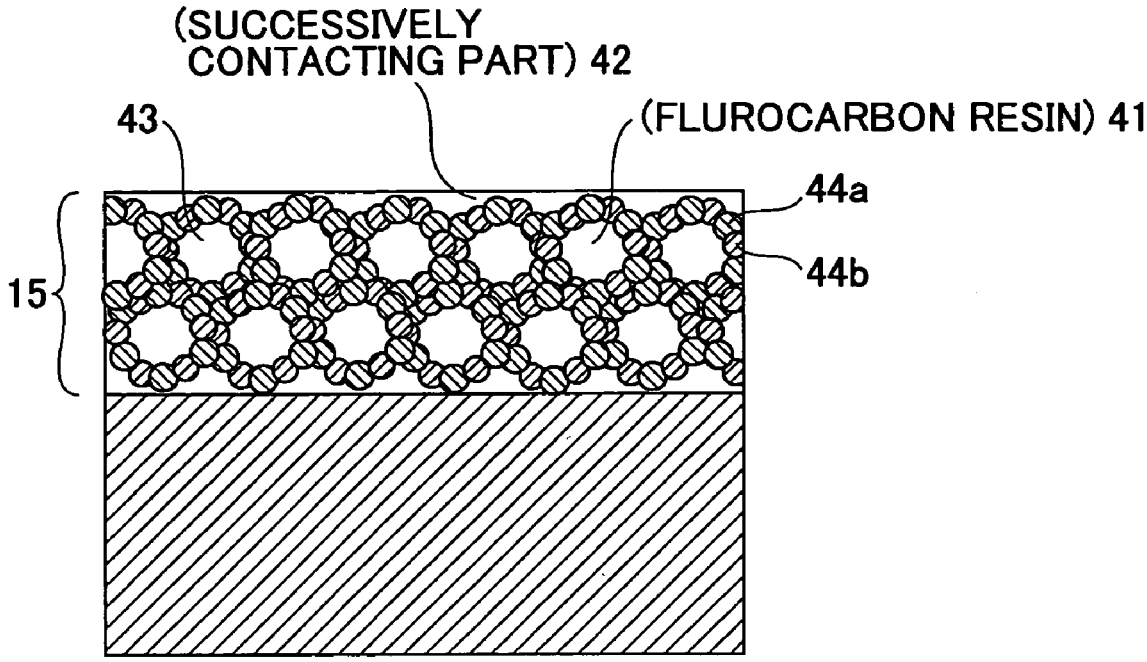
FIG. 29 is a diagram showing a configuration example of a surface layer of a heating member (fixing member) according to embodiments 8 through 13 of the present invention, and showing a sectional view in a direction perpendicular to the surface of the part of the surface layer.

FIG. 28 shows a configuration example of the surface layer 15 in th fixing member (heating member) according to the embodiments 8 through 13, and shows a horizontal section (section along the surface) of a part of the surface layer 15. In this example, a state is shown in which a successively contacting part 42 is produced in which, around a fluorocarbon resin part 41 as a body material, metal material 44*a* and non-metal material 44*b* (metal particles and ceramic particles; metal fillers and ceramic fillers, or metal spherical shells and non-metal spherical shells or such) contact successively. The fluorocarbon resin part 41 occupies a large area, and releasability is ensured. The successively contacting part 41 has on the order of 5% in area. However, since almost all the metal material 44*a* and non-metal material 44*b* contact successively, contribution to thermal conductivity or electrical conductivity is large. Further, thermal conductivity or electrical conductivity in a horizontal direction is high. There, 'successively contacting' means a state in which more than two good thermal or electrically conductive particles (or good conductive fillers or spherical shells) contact. FIG. 29 shows a vertical section of a part of the surface layer 15. The same as the horizontal section, also successively contacting part continues from the surface to a base plate (base material) 17, and contributes to improvement of thermal conductivity or electrical conductivity.

It is noted that, different from carbon particles or such, metal particles, non-metal particles or such described here do not provide electrical conductivity unless they contact positively. Further, they cannot substantially contribute to thermal conductivity or electrical conductivity unless a plurality thereof contact. Thus, since they contact successively, expression 'successively contacting' is applied (see the non-patent document 1).

As fluorocarbon resin 43 applied in the surface layer 15 of the fixing member (heating member) according to the present invention, one produced by burning to have good melted state film forming characteristics and having relatively low melting point are preferably selected. Specifically, impalpable powder of low-molecular weight polytetrafluoroethylene (PTFE), tetrafluoroethylene-hexafluoropropylene copolymer (FEP) and tetrafluoroethylene-perfluoroalkylvinylether copolymer (PFA) may be cited. More specifically, as low-molecular weight polytetrafluoroethylene (PTFE) powder, LUBRON (registered trademark) L-5, L-2 (made by Daikin Industries, Ltd.), MP1100, 1200, 1300, TLP-10F-1 (made by DuPont-Mitsui Fluorochemicals Co., Ltd.) is known. As tetrafluoroethylene-hexafluoropropylene copolymer (FEP) powder, 532-8000 (made by DuPont, Co., Ltd.) is known. As tetrafluoroethylene-perfluoroalkylvinylether copolymer (PFA), MP-10, MP102 (made by DuPont-Mitsui Fluorochemicals Co., Ltd.) is known. Further, resin obtained from including, in the above-mentioned fluorocarbon resin, carbon family material (for example, carbon) may also be applied.

As a low melting point alloy, a metal or an alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family and (10) bismuth may be provided. As the metal particles or metal fillers, particles or filters of metal or alloy including at least any one of gold (Au), silver (Ag), copper (Cu), lead (Pb), nickel (Ni), zinc (Zn), iron (Fe), aluminum (Al), magnesium (Mg), titanium (Ti), tin (Sn) and bismuth (Bi) may be applied. They may be used in a form of fillers of a spherical shape, spherical shell shape or acicular shape, or fibrous fillers, and the metal powders are fixed on the peripheries of fluorocarbon resin.

As an apparatus to fix the metal material powders or non-metal material powders on the peripheries of fluorocarbon resin, an example of a hybridization system (made by Nara Machinery) is shown in FIG. 8. In the figure, reference numeral 151 denotes a body casing, 158 denotes a stator, 177 denotes a stator jacket, 163 denotes a cycle pipe, 159 denotes an ejection value, 164 denotes a row material input shoot.

Power particles and other micro solid particles provide from the row material input shoot 164 are subject to instantaneous impact action manly by a plurality of rotor blades 155 disposed in a rotation rotor 162 rotating at a high speed in an impact chamber 168, further scatter in the system with breakage of mutual aggregation of the powder particles or the other micro solid particles as a result of being hit by the peripheral stator 158, and simultaneously, the other micro solid particles are fixed to surfaces of the powder particles by electrostatic force, Van der Waals force or such, or, for a case of only the powder particles, chamfering or conglobating is carried out. This state progresses along with flying and impact of the particles. That is, along with an air flow generated by rotation of the rotor blades 155, the particles are treated as a result of passing through th recycle pipe 163 several times. Further, as a result of the particles being repeatedly subject to impact action from the rotor blades 155 and stator 158, the other macro solid particles are made to scatter and fixed uniformly on the surfaces or in the vicinity of the powder particles.

The surface layer 15 is produced solely from the thus-produced coated powders, or as a result of from the same mechanically mixed with powders produced by ordinary fluorocarbon resin being electrostatically coated on a base material 17 made by metal member or such, or, as a result of wet coating in which the above-mentioned powders are dispersed in water solution being coated on the base material 17, and being then burned. Further, as a result of the above-mentioned powders being burned together with low melting point metal, the fillers successively contact together, and thus both strength and thermal conductivity can be improved. However, relationship between the low melting point metal and an actual operation temperature (temperature upon fixing and heating) should be taken into account.

Further, as a result of the above-mentioned powders being burned together with the low melting point metal, the fillers successively contact together and thus electrical conductivity can be improved, whereby an eddy current can be made to flow sufficiently, and thus, it can be applied as a heat generating member. Even when a ratio of the low melting point metal is small, it is possible to improve the electrical conductivity since probability of connection among the filler is high depending on the duration thereof. According to the present invention, the low melting point metal also acts as a safeguard against burning due to abnormal overshooting of temperature of the heating device. That is, when metal becomes liquid, electrical characteristics rapidly change. Thereby, detection by impedance change in a magnetic flux generating circuit can be made possible. Also, for liquid metal, heat generating efficiency degrades since resistance value rapidly increases. Further, it is possible to produce an alloy of magnetic metal into non-magnetic metal and control the Curie temperature, so that heat generating efficiency degrades at a temperature higher than a certain one.

Further, it is preferable that the low melting point metal amounts to 5 through 50 weight part with respect to the filler's loading weight. Further, since the low melting point metal has low corrosion resistance in many cases, it is preferable that it is fewer than the filler. Further, in a fixing part of an image forming apparatus, an environment of steam from recording paper or such is applied. Therefore, it is preferable to avoid an amount more than necessary.

Figure 31:
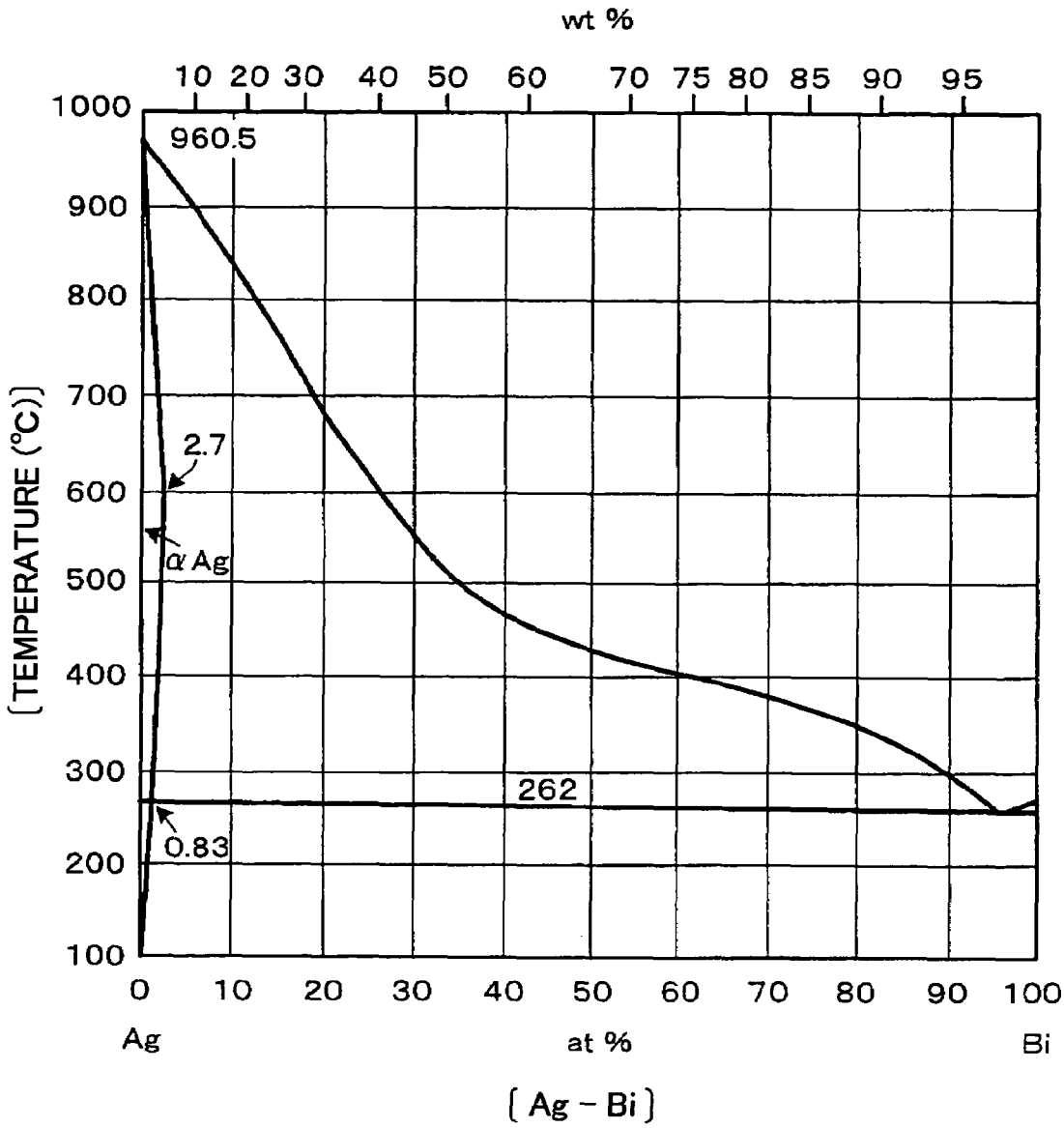
FIG. 31 is an Ag—Bi family constitution diagram.

As one example, a case where bismuth (Bi) is applied as the low melting point metal, and silver (Ag) is applied as the metal filler is described now with reference to a state diagram of FIG. 31. This is a state diagram called a eutectic type. In this example, a liquid phase occurs at a temperature more than the eutectic point upon calicination (equal to or more than 300° C.) of fluorocarbon resin, and after that, silver is connected as a result of the temperature being made to be equal to or less than the eutectic point. In order to improve thermal conductivity or electrical conductivity which is the object of the present invention, it is advantageous that silver having the relevant characteristics is included more. For this purpose, bismuth has a function to connect it. Upon usage in an ordinary fixing device, a heating temperature is on the order of maximum 230° C., and thus, there is no problem in the usage.

Figure 32:
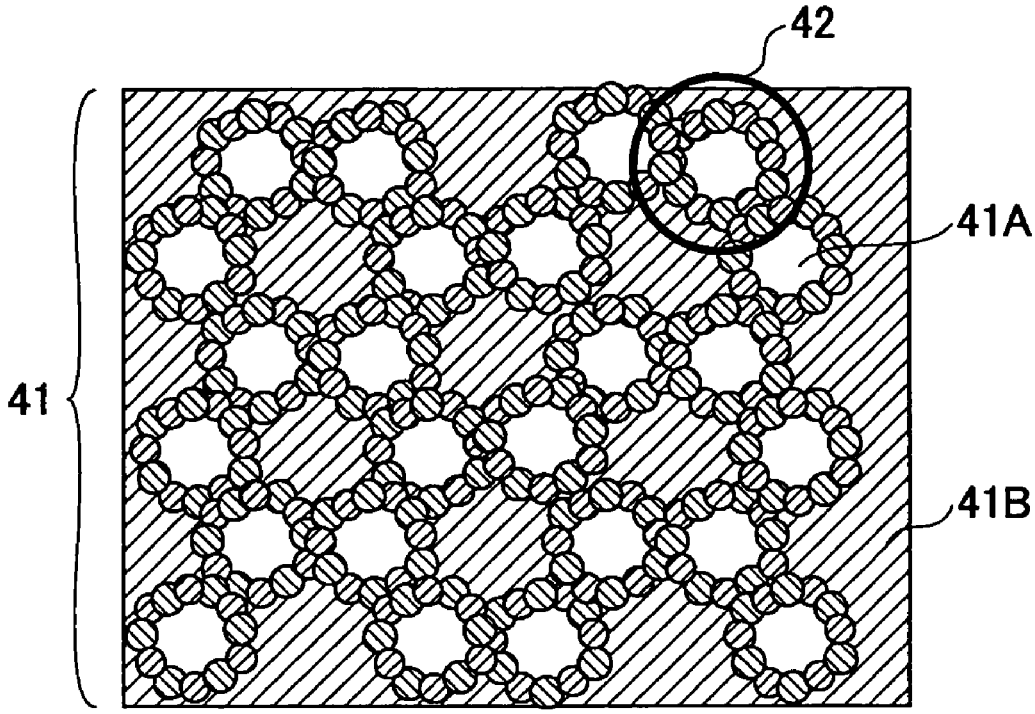
FIG. 32 is a diagram showing a configuration example of a surface layer of a heating member (fixing member) for a case where a plurality of types of fluorocarbon resins according to embodiments 8 through 13 of the present invention, and showing a sectional view in a direction along a surface of a part of the surface layer.
Figure 33:
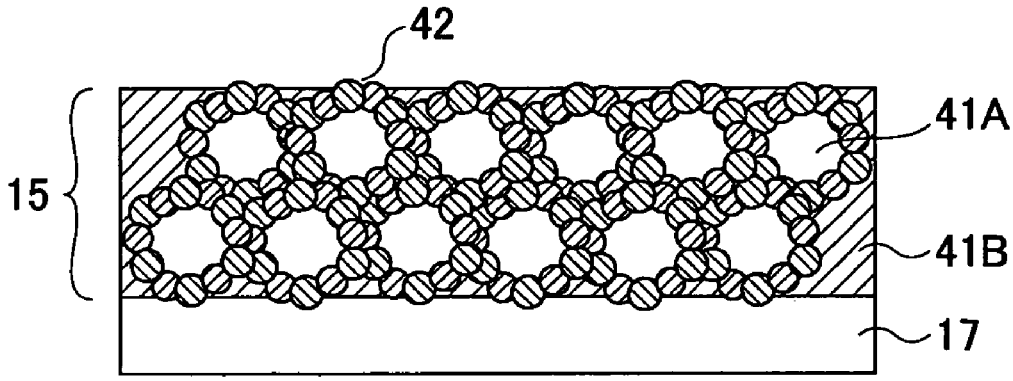
FIG. 33 is a diagram showing a configuration example of a surface layer of a heating member (fixing member) for a case where a plurality of types of fluorocarbon resins according to embodiments 8 through 13 of the present invention, and showing a sectional view in a direction perpendicular to the surface of the part of the surface layer.

FIGS. 28 and 29 show examples of the fluorocarbon resin part 41 in which fluorocarbon resin 43 is applied solely. However, it is possible to provided a configuration in which a plurality of types of fluorocarbon resins having different melting points are applied as the fluorocarbon resin, and at least fluorocarbon resin having the highest melting point is surrounded by successively contacting metal material and non-metal material. FIG. 32 shows a configuration example of a surface layer of a fixing member (heating member) for a case where a plurality of types of fluorocarbon resins is applied, and shows a horizontal section (section along the surface) of a part of the surface layer 15. In this example, a state is shown in which metal particles and non-metal particles successively contact and form a successively contacting part 42 around a fluorocarbon resin 41A having the highest melting point, and around it, fluorocarbon resin 41B having lower melting point is filled with. The two types of fluorocarbon resins 41A and 41B occupy a wide area, and releasability is ensured. The successively contacting part 42 has an area on the order of 5%. However, since almost all thereof successively contact, contribution to thermal conductivity or electrical conductivity is large. Further, thermal conductivity or electrical conductivity in the horizontal direction is high. FIG. 33 shows a vertical section of a part of the surface layer 15. The same as the horizontal section, the successively contacting part 42 continues from the surface to the base material 17, and contributes to improvement of thermal conductivity.

For the surface layer of the fixing member (heating member) according to the present invention, fluorocarbon resin surrounded by metal material and non-metal material successively contacting is heated and melted so that a film is produced. In the case where the surface layer includes a single type of fluorocarbon resin, successively contacting state of the metal successively contacting part is distorted since the fluorocarbon resin should be melted to flow so as to produce the surface layer having no pin-holes when the surface layer is produced although metal material and non-metal material successively contact and surround the fluorocarbon resin before heating. As a result, thermal conductivity improves, while variation in thermal conductivity among product lots increases.

In contrast thereto, when the fluorocarbon resin includes a plurality of types of fluorocarbon resins having different melting points, and, as shown in FIGS. 32 and 33, at least the fluorocarbon resin particles 41A having the highest melting point is surrounded by metal material and non-metal material successively contacting, the successively contacting state of the successively contacting part 42 surrounding the fluorocarbon resin part 41A having the highest melting point can be prevented from being distorted as a result of the other fluorocarbon resin part 41B having the lower melting point being melted and made to flow, when heating is carried out for a temperature at which the fluorocarbon resin having the highest melting point is not made to flow. Thereby, thermal conductivity or electrical conductivity can be improved, and also, variation in thermal conductivity or electrical conductivity among product lots can be reduced.

Fluorocarbon resin flows when it is heated for a temperature more than its melting point. However, flowability is low when the temperature is low. Accordingly, even when the melting point of the fluorocarbon resin 41A having the highest melting point is exceeded, the temperature at which flowability can be maintained on the order such that the successively contacting state of the successively contacting part 42 is not distorted may be applied.

Fluorocarbon resin applied in the surface layer in which such a plurality of types of fluorocarbon resins is combined is not particularly limited as long as it includes fluorine atoms in molecules. Specifically, polytetrafluoroethylene (PTFE) and modification thereof, tetrafluoroethylene-perfluoroalkylvinylether copolymer (PFA), tetrafluoroethylene-ethylene copolymer (ETFE), tetrafluoroethylene-hexafluoropropylene copolymer (FEP), tetrafluoroethylene-vinyliden-fluoride copolymer (TFE/VdF), tetrafluoroethyrene-hexafluororopropylene-perfluoroalkylvilylether copolymer (EPA), polychlorotrifluoroethylene (PCTFE), chlorotrifluoroethylene-ethylene copolymer (ECTFE), chlorotrifluoroethylene-vinyliden-fluoride copolymer (CTFE/VdF), poly-vinyliden-fluoride (PVdF), poly-vinyl-fluoride (PVF), or such may be cited. For example, as polytetrafluoroethylene (PTFE) powder, Teflon (registered trademark) 7A-J, 70-J (made by DuPont-Mitsui Fluorochemicals Co., Ltd.) is known. As tetrafluoroethylene-hexafluoropropylene copolymer (FEP) powder, 532-8000 (made by DuPont Co., Ltd.) is known. As tetrafluoroethylene-perfluoroalkylvinylether copolymer (PFA), MP-10, MP102 (made by DuPont-Mitsui Fluorochemicals Co., Ltd.), or MP103 (made by DuPont-Mitsui Fluorochemicals Co., Ltd.) is known. Further, resin in which carbon family material (for example, carbon) is included in these fluorocarbon resin may be applied.

According to the present invention, a plurality of types of fluorocarbon resins having different melting points may be selected therefrom appropriately. Melting points of the fluorocarbon resins are shown in Table 27 below:

TABLE 27

| FLUOROCARBON RESIN | MELTING POINT (° C.) |
|---|---|
| PTFE | 327 |
| PFA | 310 |
| FEP | 270 |
| ETFE | 260 |
| PCTFE | 210 |
| PVDF | 177 |

Figure 30:
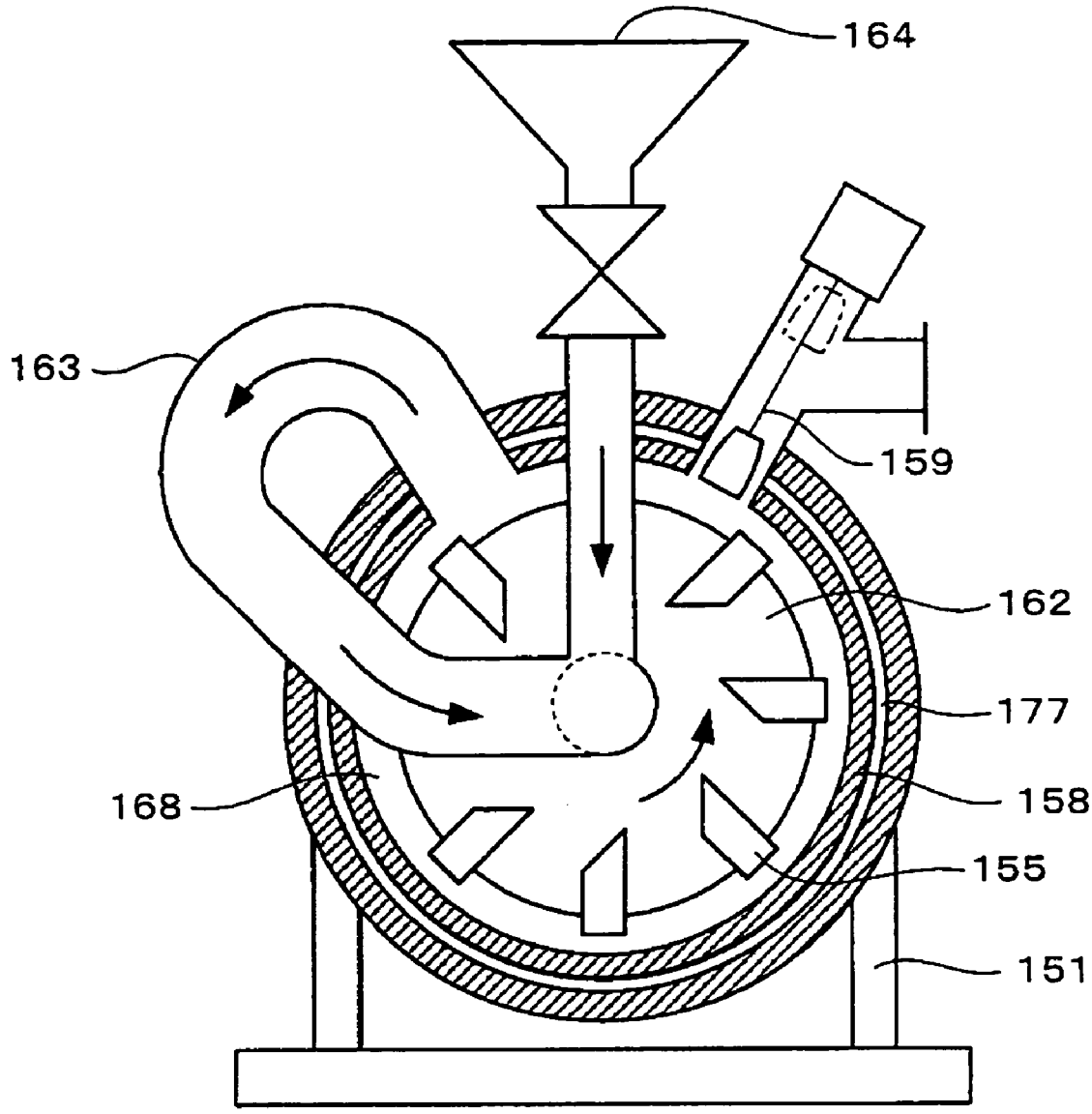
FIG. 30 is a general configuration diagram of a hybridization system applied as a device for fixing metal powder around fluorocarbon resin.

When a plurality of types of fluorocarbon resins having different melting temperatures, the above-described metal material powders and non-metal material powders are fixed at least to the peripheries of fluorocarbon resin 41A having the highest melting point. As the metal material and non-metal material to be fixed, the above-described low melting point metal or alloy, or fillers of the metal, alloy or ceramic is applied. As an apparatus to fix it, a hybridization system (made by Nara Machinery) shown in FIG. 30 is applied. A method of producing coated powder is the same as that described above.

Figure 34:
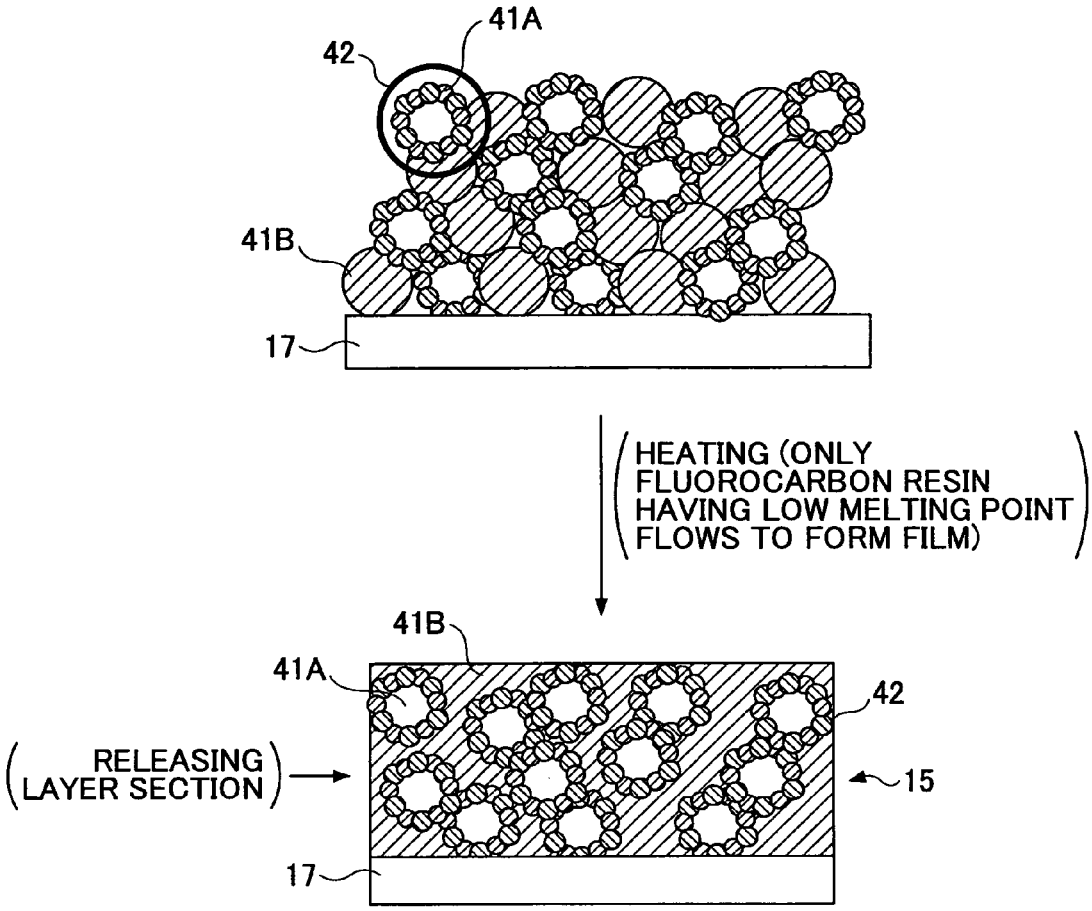
FIG. 34 is a diagram showing one example of a method of producing a surface layer of a heating member (fixing member) according to embodiments 8 through 13 of the present invention.

As shown in FIG. 34, one in which produced powder (powder produced as a result of successively contacting part 42 being produced around fluorocarbon resin 41A having highest melting point) is mixed with fluorocarbon resin 41B having lower melting temperature is coated in a form of electrostatic coating or wet coating, burning is carried out at a temperature lower than th melting point of the fluorocarbon resin 41A having the highest melting point, and the surface layer is produced.

Figure 35:
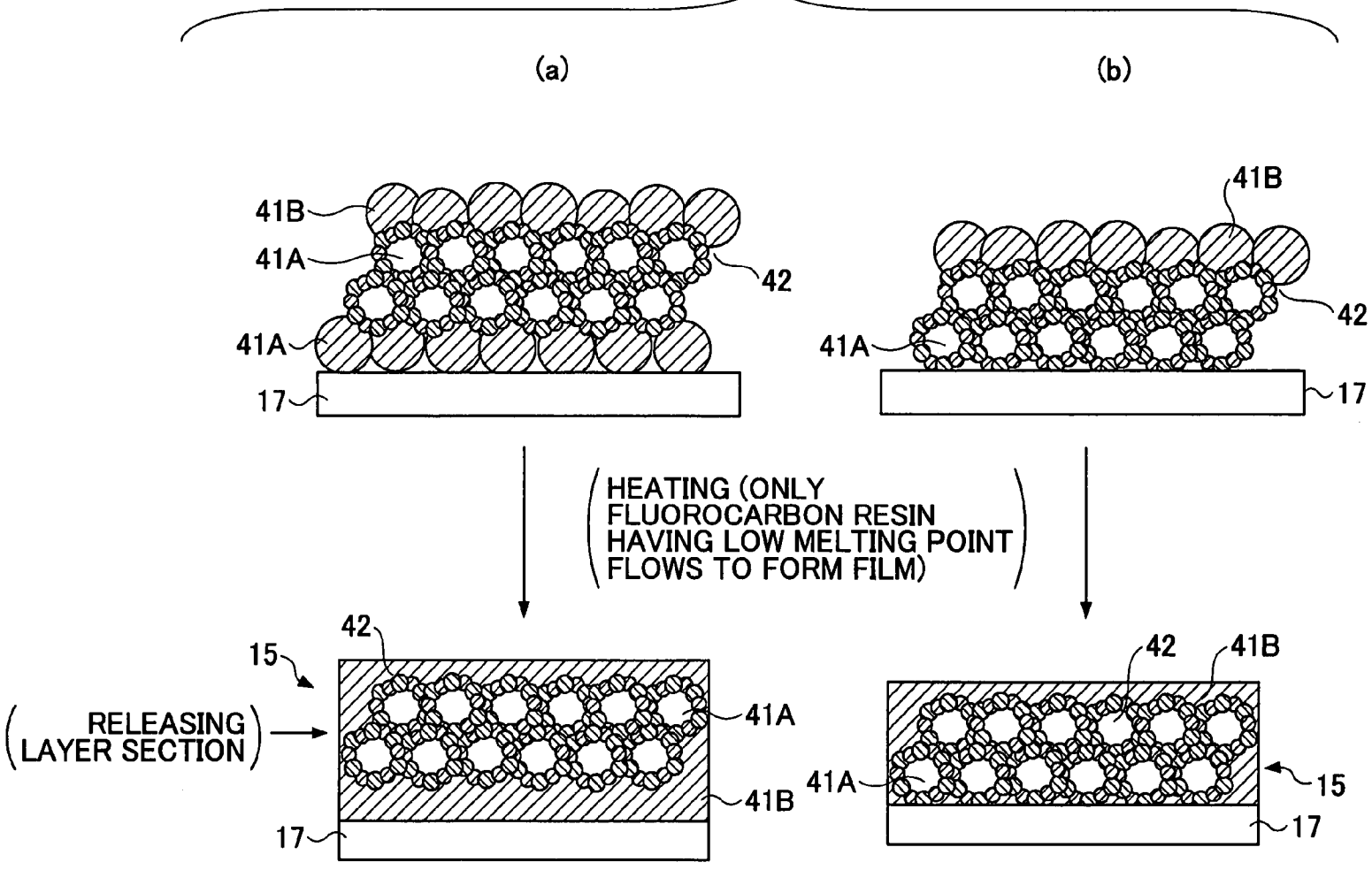
FIG. 35 is a diagram showing another example of a method of producing a surface layer of a heating member (fixing member) according to embodiments 8 through 13 of the present invention.

Alternatively, as shown in FIG. 35, (a) or (b), produced powder (powder in which successively contacting part 42 being produced around fluorocarbon resin 41A having the highest melting temperature) and fluorocarbon resin 41B having lower melting point are coated in such a manner that a plurality of layers are laminated, in a form of electrostatic coating or wet coating, burning is carried out at a temperature lower than th melting point of the fluorocarbon resin 41A having the highest melting point, and the surface layer 15 is produced. Thereby, thermal conductivity or electrical conductivity can be improved.

Figure 36:
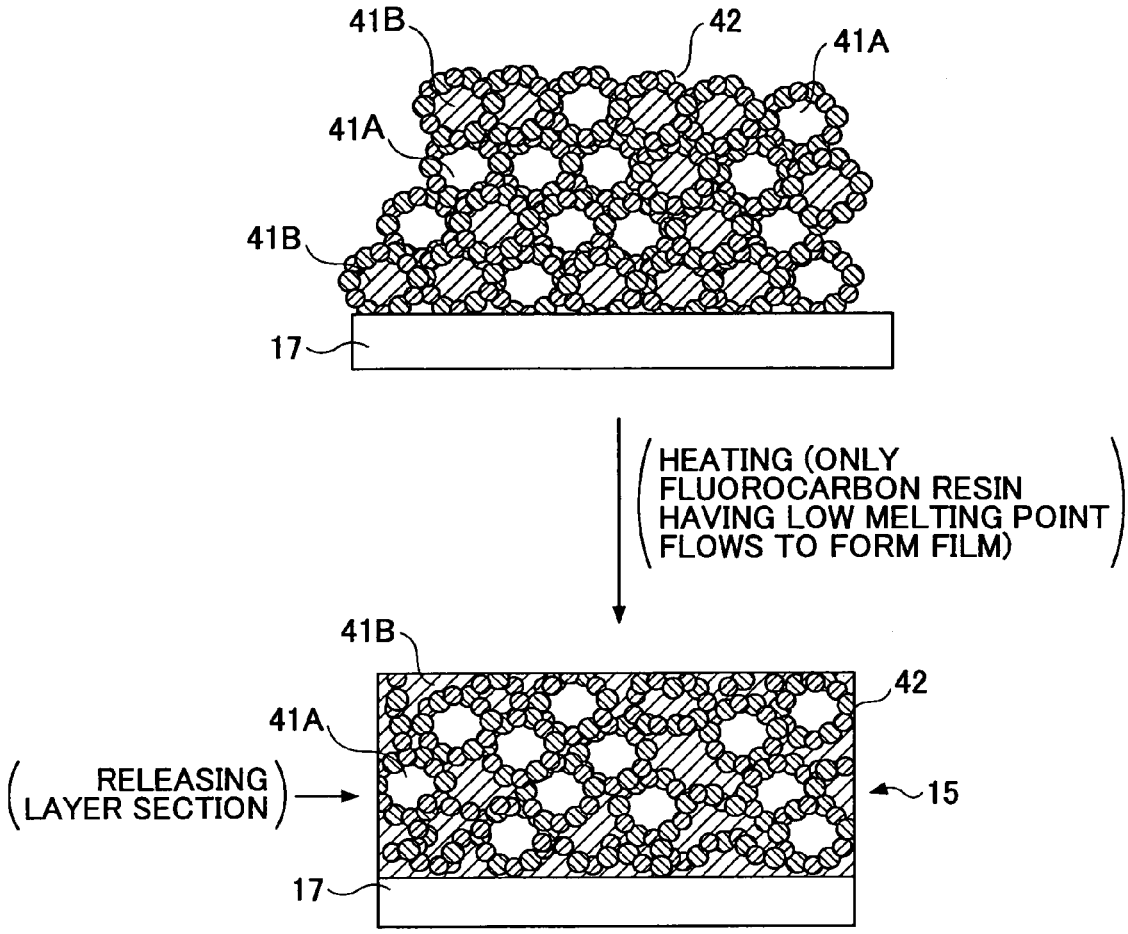
FIG. 36 is a diagram showing another example of a method of producing a surface layer of a heating member (fixing member) according to embodiments 8 through 13 of the present invention.
Figure 37:
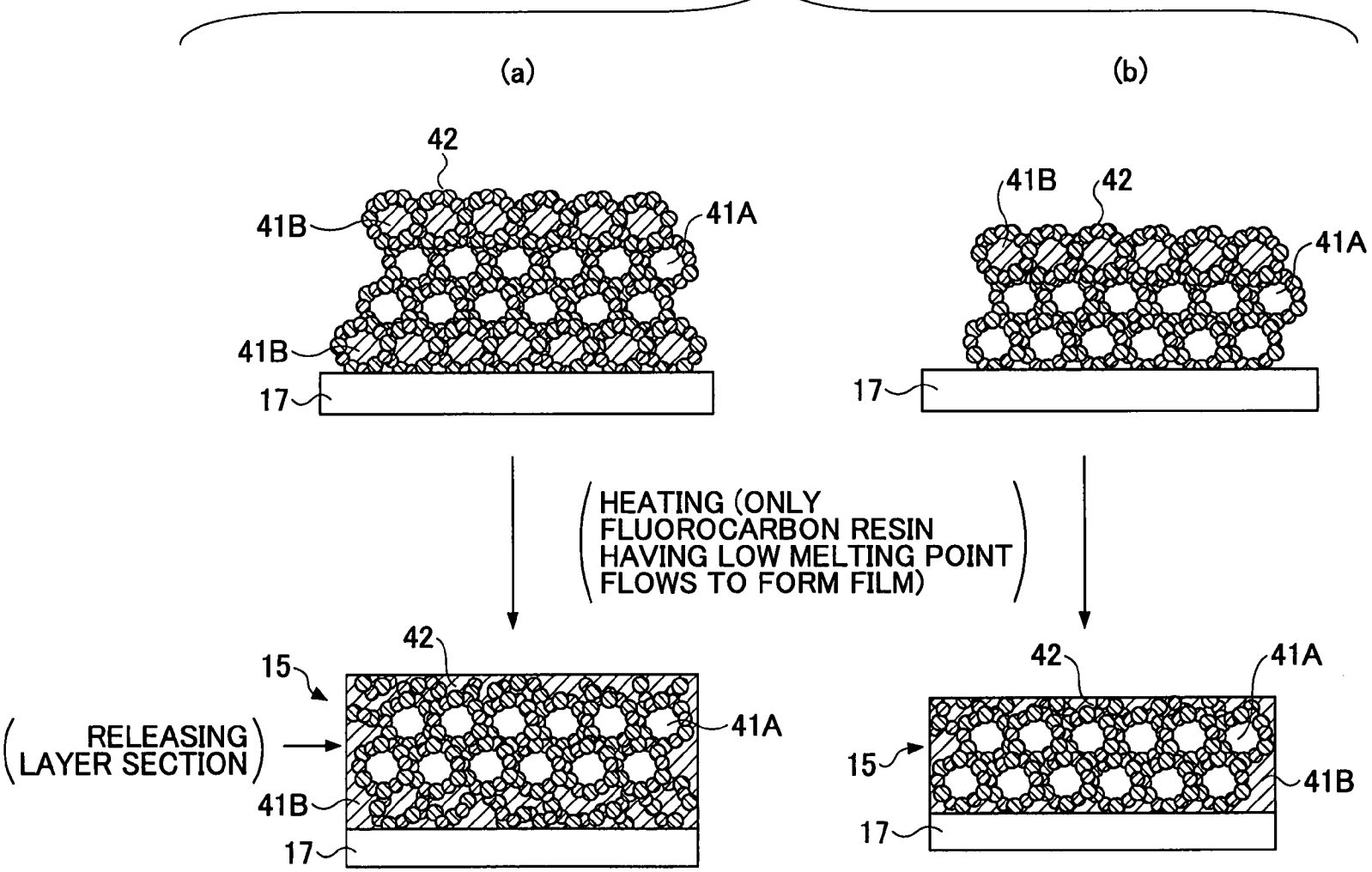
FIG. 37 is a diagram showing another example of a method of producing a surface layer of a heating member (fixing member) according to embodiments 8 through 13 of the present invention.

Further, of course, as shown in FIG. 36 or 37, metal material powder and non-metal material may also be fixed to fluorocarbon resin 41B having lower melting point and the successively contacting part 42 may be produced, which is then mixed with powder in which the successively contacting part 42 is fixed to fluorocarbon resin 41A having the highest melting temperature and then, the thus-obtained one may be applied.

Figure 38:
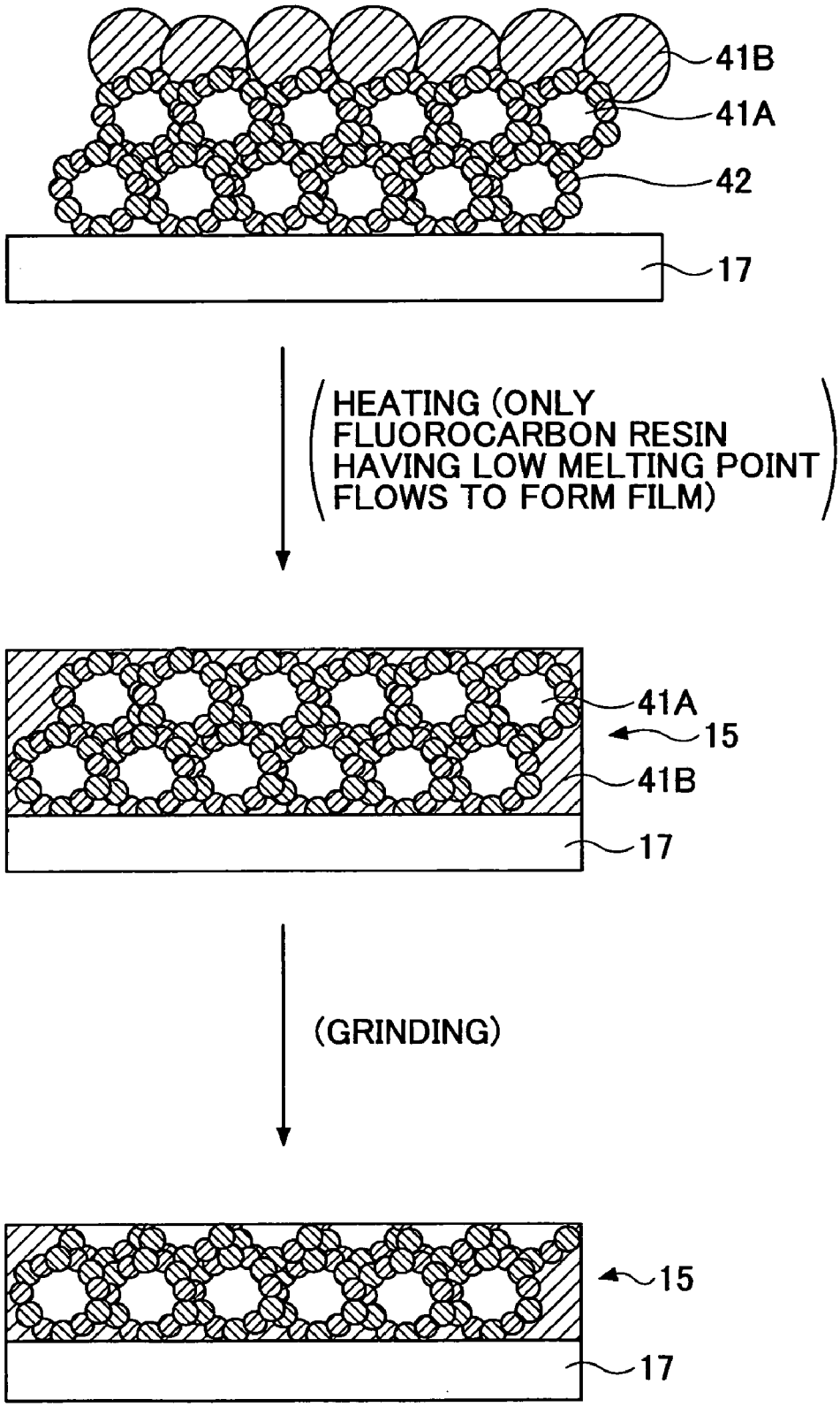
FIG. 38 is a diagram showing another example of a method of producing a surface layer of a heating member (fixing member) according to embodiments 8 through 13 of the present invention.

Further, when surface roughness of the surface layer 15 should have a predetermined value (for example, equal to or less than 5 μm in ten-point roughness Rz), the surface roughness can have the predetermined value as a result of grinding being carried out after the burning, as shown in FIG. 38.

Further, when a plurality of types of fluorocarbon resins are applied, fillers contact successively as a result of burning being carried out together with low melting point metal, and both characteristics, i.e., strength and thermal conductivity (or electrical conductivity) can be improved. In this occasion, the melting point of the low melting point metal should be lower than that of the fluorocarbon resin 41A having the highest melting point. For example, for a case where the fluorocarbon resin having the highest melting point is PTFE, tin (Sn) should be used as the low melting point metal.

There, the plurality of types of fluorocarbon resins may be preferably selected from PTFEP, PFA, FEP, ETFE and PCTFE having melting points equal to or more than 200° C., in terms of thermal stability of the surface layer at a time of usage thereof. Further, when PTFE is applied as the fluorocarbon resin 41A having the highest melting point, since melting viscosity is very large in comparison to other fluorocarbon resin, it hardly flow even the melting point is exceeded, and metal successively contacting state is not distorted. Thus, this is further preferable.

Figure 25:
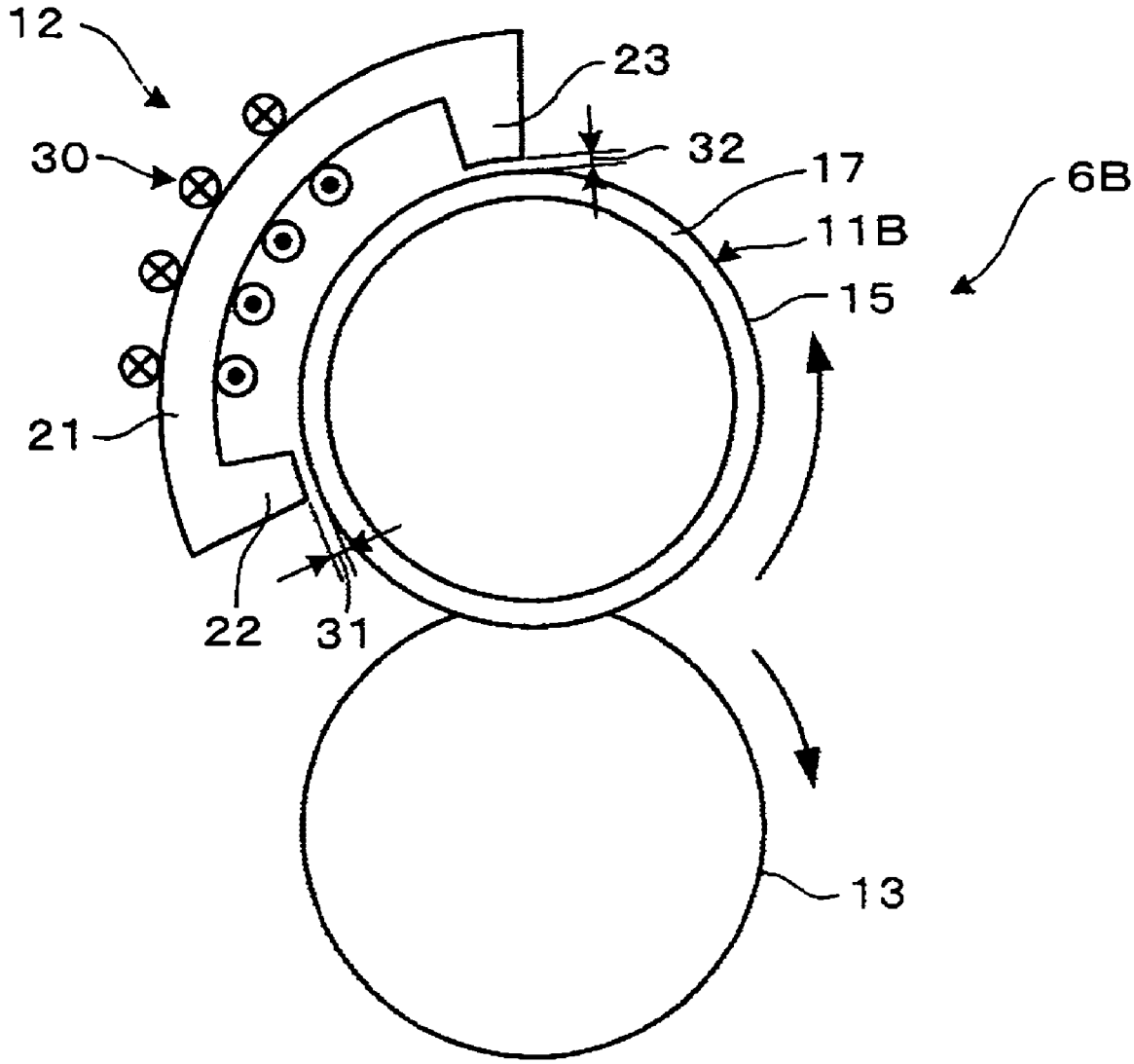
FIG. 25 is a general sectional diagram of a fixing device showing another execution mode according to embodiments 8 through 13 of the present invention.
Figure 26:
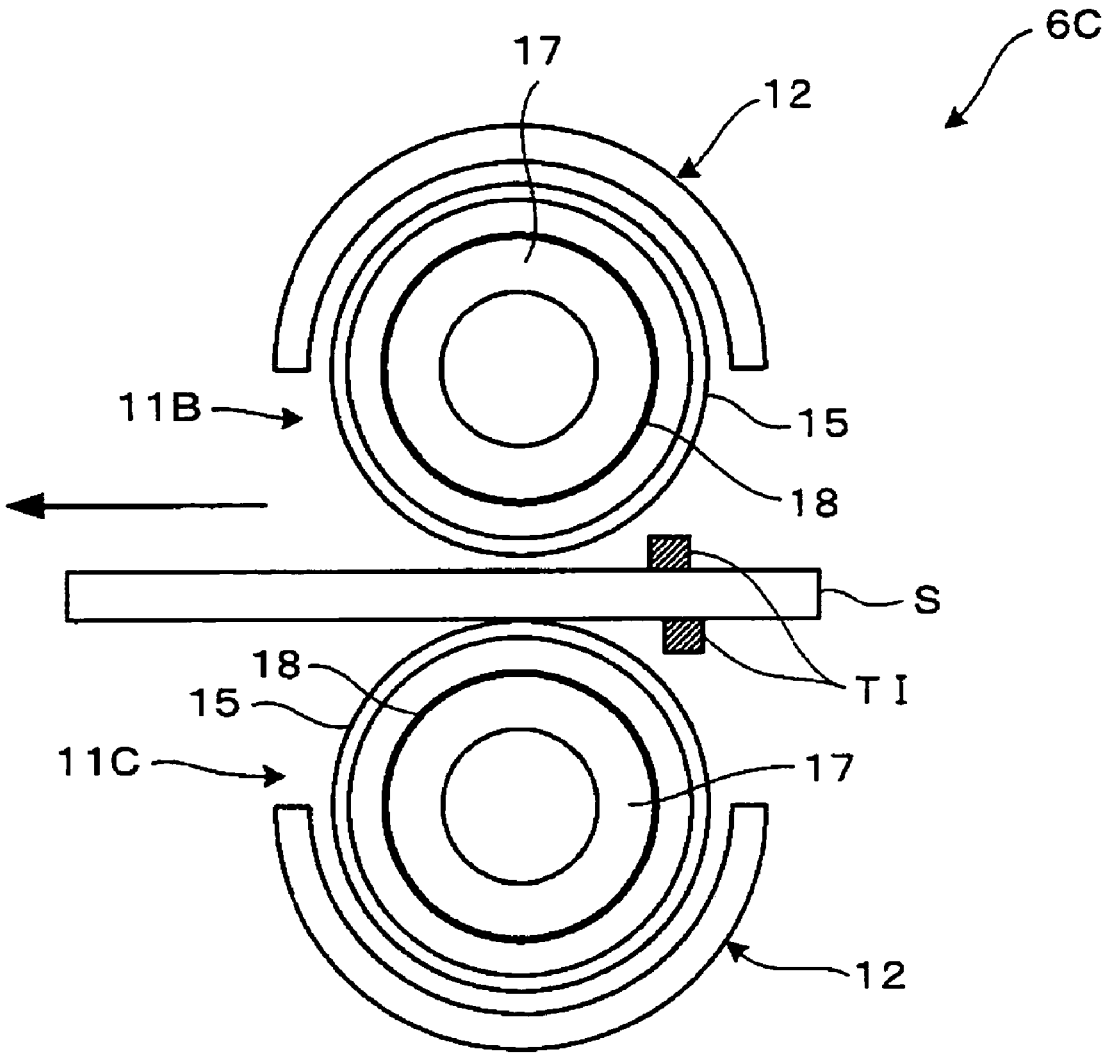
FIG. 26 is a general sectional diagram of a fixing device showing further another execution mode according to embodiments 8 through 13 of the present invention.
Figure 27:
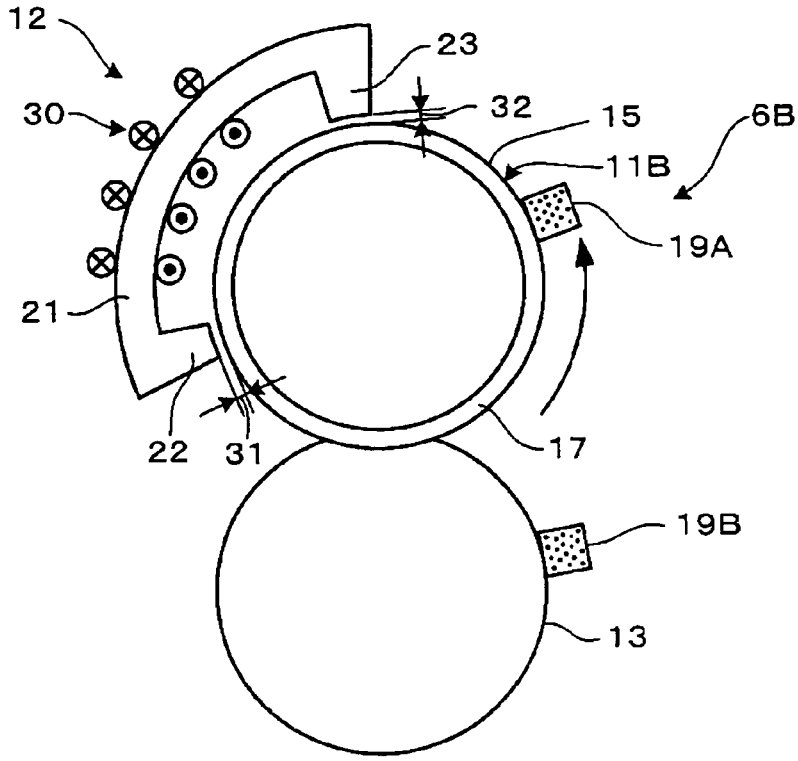
FIG. 27 is a general sectional diagram of a fixing device showing further another execution mode according to embodiments 8 through 13 of the present invention.
Figure 39:
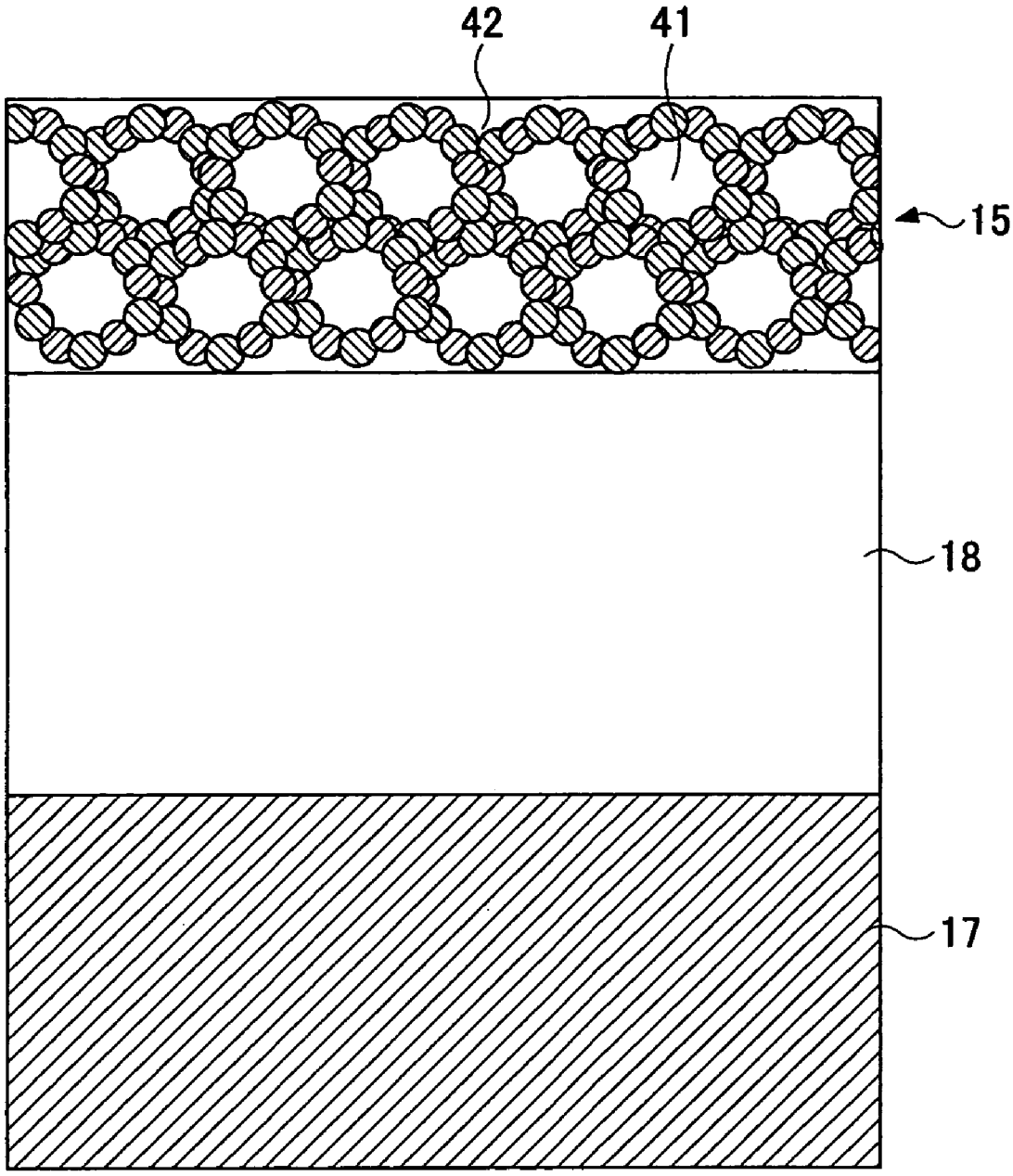
FIG. 39 is a diagram showing a configuration example of a heating member (fixing member) according to embodiments 8 through 13 of the present invention, and showing a sectional view in a direction perpendicular to the surface.
Figure 40:
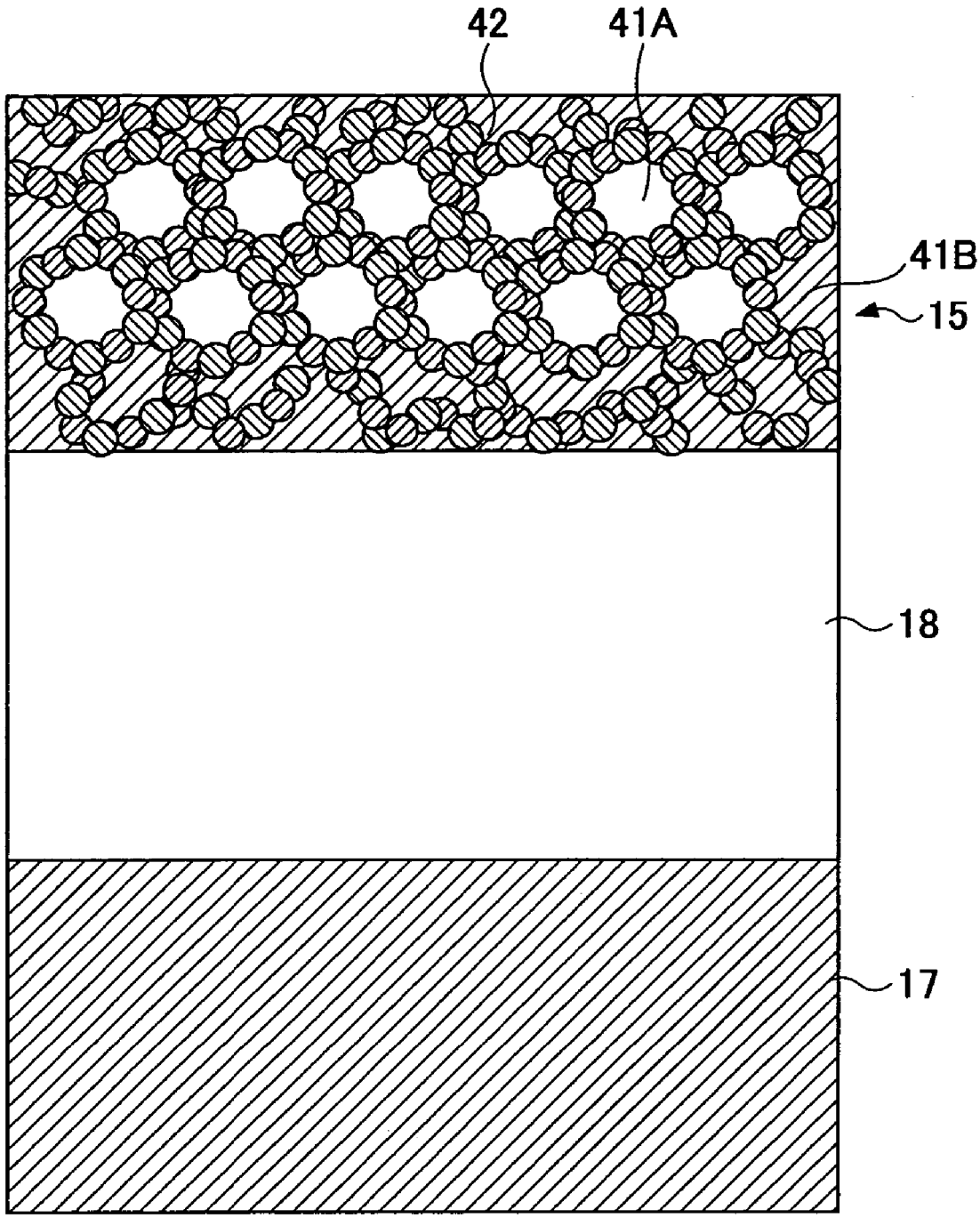
FIG. 40 is a diagram showing another configuration example of a heating member (fixing member) according to embodiments 8 through 13 of the present invention, and showing a sectional view in a direction perpendicular to the surface.

When a heating member (fixing member) according to the present invention is applied in a fixing device of an electromagnetic induction heating type as shown in FIGS. 25 through 27, a heat insulating layer (or elastic layer) 18 should be preferably provided between the surface layer 15 and the base material 17 for the purpose that heat generated by the surface layer 15 is prevented from escaping to the side of the base material 17. FIGS. 39 and 40 show this example, and show a vertical section of a part of the surface layer. The example of FIG. 39 is an example in which, a heat insulating layer (or elastic layer) 18 made of silicon rubber is provided on a surface of the base material 17, and thereon, the surface layer 15 having the same configuration as that of FIGS. 28 and 29. The example of FIG. 40 is an example in which, a heat insulating layer (or elastic layer) 18 made of silicon rubber is provided on a surface of the base material 17, and thereon, the surface layer 15 having the same configuration as any one of those shown in FIGS. 32 through 38.

In the case of FIG. 39 or 40, when high frequency electromagnetic field is applied externally to the surface layer 15, an eddy current flows in the electrically conductive layer 42 of the surface layer 15 which generates heat. At this time, since the surface layer 15 is thermally insulated by the heat insulating layer 18, rapid temperature increase can be carried out. Further, since also thermal continuation is provided in the horizontal direction, uniformization is carried out rapidly even when heat reduction occurs locally. Accordingly, the heating member (fixing member) in which starting up can be made rapidly, thermal uniformization is satisfactory, and heating efficiency is high can be obtained.

In the heating member (fixing member) according to the present invention, a contact angle of the surface layer 15 with respect to water is equal to or more than 80°. Thereby, wax adhering to the surface layer from toner is prevented from being repelled on the surface layer. Accordingly, offset of resin or such of toner otherwise occurring as a result of it contacting the surface layer, or winding of a recording material otherwise occurring as a result of the fixing member acting as a hot melt adhesive, is avoided.

When the contact angle with respect to water is less than 80°, excessive wetting occurs, adhesion preventing effect by means of wax is exceeded by adhesive force of tone resin itself rapidly increasing, the whole toner is transferred to the side of the surface layer, and thus, fixing failure occurs. Measurement of the contact angle according to the present invention was carried out in such a manner that a planar testing sample of the surface layer material of the heating member (fixing member) was produced, and measurement was carried out in a sessile drop method by means of CA-X type made by Kyowa Interface Science Co., Ltd. at a room temperature.

As a method of adjusting the contact angle with respect to water of the surface layer 15 of the heating member (fixing member) so that it falls in a range equal to or more than 80°, composition ratio between fluorocarbon resin and metal as materials of the surface layer 15 may be changed, and thus, the contact angle with respect to water may be controlled. In this case, the contact angle with respect to water can be controlled by a combination of types of the fluorocarbon resin and metal, a mixing method, and heating temperature.

Further, the metal material and non-metal material part of the heating member (fixing member) surface layer 15 has a thickness of equal to or less than 50 μm in its section. Further, the metal material and non-metal material part of the surface layer 15 has a maximum width part in its section equal to or less than 30 μm.

When the metal material and non-metal material part of the surface layer is produced in such a manner that the maximum width part in its section is equal to or less than 30 μm, even if the metal material part and non-metal material part which is inferior in non-adherence property in comparison to that of the fluorocarbon resin is exposed on the surface, an area in which toner directly contacts the metal part is small. Therefore, this structure is advantageous for offset prevention.

Specific embodiments of the heating member (fixing member) and a producing method therefor according to the present invention are described below.

Embodiment 8

Figure 24:
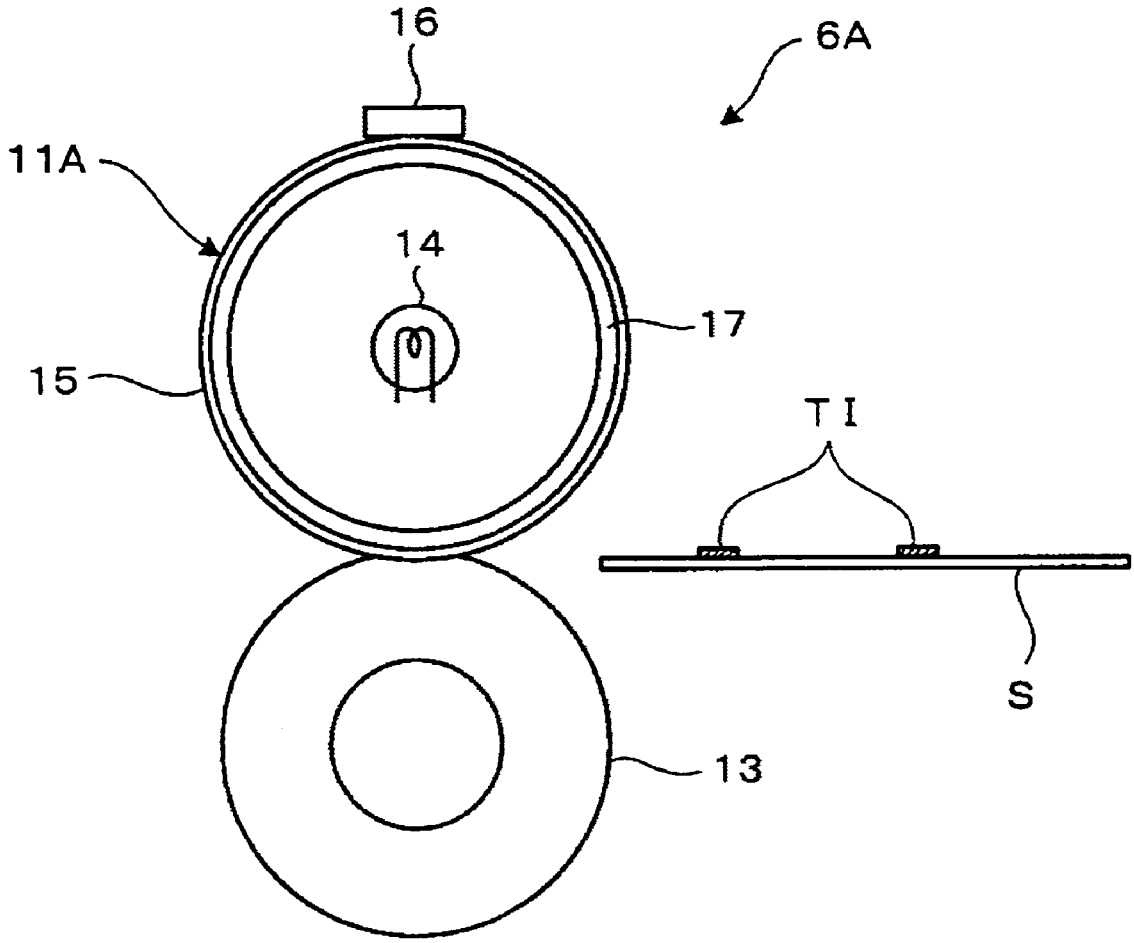
FIG. 24 is a general sectional diagram of a fixing device showing one execution mode according to embodiments 8 through 13 of the present invention.

First, embodiments of the heating member (fixing member) 11A having the surface layer 15 having a configuration shown in FIGS. 28 and 29 used in the fixing device 6A configured as shown in FIG. 24 are described.

Embodiment 8-1

As a component of the surface layer, Ni powder (average particle diameter: 0.5 μm) and silicon carbide (average particle diameter 0.5 μm) was mixed into PFA powder (MP102 (made by DuPont-Mitsui Fluorochemicals Co., Ltd.), average particle diameterϕ: 20 μm) in amounts such that Ni is 5% and silicon carbide is 5% in reduced volume, the thus-obtained one was input to a hybridization system configured as shown in FIG. 30 made by Nara Machinery, and (Ni+silicon carbide) powder was fixed on PFA powder. A state in which (Ni+carbide) powder almost covered PFA powder was confirmed from observation by means of a scanning electron microscope (SEM). This powder was mixed with PFA powder (MP102 (DuPont-Mitsui Fluorochemicals Co., Ltd.), average particle diameter ϕ: 20 μm), was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 28 below, a relationship between a volume ratio of (Ni+silicon carbide) fixed PFA powder:PFA powder, a multiplying factor of thermal conductivity, and surface resistance is shown. There, the volume ratio is one obtained from a weight ratio and a specific gravity, and does not mean a volume ratio in powder. Further, as a comparison example, a sheet was produced similarly as a result of Ni powder (average particle diameter: 0.5 μm) and silicon carbide powder (average particle diameter: 0.5 μm) being mixed with PFA powder (MP102 (made by DuPont-Mitsui Fluorochemicals Co., Ltd.), average particle diameter ϕ: 20 μm) in such an amount that Ni is 2.5% and silicon carbide is 2.5% in reduced volume with the use of a stirring apparatus KK-500 made by Kurabo Industries Ltd. A reason why Ni is 2.5% and silicon carbide is 2.5% is that, in an electrostatic method, film forming cannot be carried out more than this. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

TABLE 28

| (Ni + SILICON CARBIDE) FIXED PFA POWDER:PFA POWDER (VOLUME RATIO) | MULTIPLYING FACTOR OF THERMAL CONDUCTIVITY | SURFACE RESISTANCE (Ω/□) |
|---|---|---|
| 1:9 | 1.71 | $1 \times 10^{10}$ |
| 2:8 | 2.73 | $5 \times 10^{9}$ |
| 4:6 | 10.80 | $1 \times 10^{8}$ |
| 5:5 | 11.50 | $5 \times 10^{7}$ |
| 6:4 | 11.93 | $2 \times 10^{7}$ |
| 2.5% Ni + 2.5% SILICON CARBIDE MIXTURE - PFA FILM FOR COMPARISON | 2.30 | $5 \times 10^{9}$ |

Embodiment 8-2

The same as the embodiment 8-1, as a component of the surface layer, Ni powder (average particle diameter: 0.5 μm) and silicon carbide powder (average particle diameter: 0.5 μm) were mixed into PFA powder (MP102 (made by DuPont-Mitsui Fluorochemicals Co., Ltd.), average particle diameterϕ: 20 μm) in amounts such that Ni is 5% and silicon carbide is 5% in reduced volume, the thus-obtained one was input to a hybridization system configured as shown in FIG. 30 made by Nara Machinery, and (Ni+silicon carbide) powder was fixed on PFA powder. Then, mixing was carried out according to a ratio of Tables 29 and 30 below, coating was carried out on an aluminum tube to be the core metal (base material) 17 of the fixing roller in an electrostatic manner, the coated resin was melted at 380° C. and then cooled, grinding was carried out by means of corundum particles, thus one on which surface roughness was made equal to or less than 2 μm in ten-point average roughness (Rz) was produced, and thus, the fixing roller 11A was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. Toner of this MF4570 is toner with wax. 10000 sheets of black solid images were passed through the MF4570, and toner adhesion state on the roller was observed. The observation result is shown in Table 29 below. As shown in Tables 29 and 30, no particularly large adhesion was observed, and nothing other than ordinary one occurred.

TABLE 29

| (Ni + SILICON CARBIDE) FIXED PFA POWDER:PFA POWDER (VOLUME RATIO) | WATER CONTACT ANGLE | ADHERING TONER | ELECTROSTATIC OFFSET |
|---|---|---|---|
| 1:9 | 108° | NOTHING | NOTHING |
| 2:8 | 108° | NOTHING | NOTHING |

TABLE 29-continued

| (Ni + SILICON CARBIDE) FIXED PFA POWDER:PFA POWDER (VOLUME RATIO) | WATER CONTACT ANGLE | ADHERING TONER | ELECTROSTATIC OFFSET |
|---|---|---|---|
| 4:6 | 105° | NOTHING | NOTHING |
| 5:5 | 106° | NOTHING | NOTHING |
| 6:4 | 98° | NOTHING | NOTHING |
| 10:0 | 82° | NOTHING | NOTHING |

Comparison Example 1-1

As a comparison example, Table 30 shows a result of a case where Ni powder (average particle diameter 0.5 μm) was mixed to amount to 10% of Ni in reduced volume, this was input to a hybridization system of Nara Machinery Co., Ltd., Ni was fixed to PFA powder, and the fixing roller was produced, similarly.

TABLE 30

| Ni FIXED PFA POWDER:PFA POWDER (VOLUME RATIO) | WATER CONTACT ANGLE | ADHERING TONER | ELECTROSTATIC OFFSET |
|---|---|---|---|
| 1:9 | 108° | NOTHING | NOTHING |
| 2:8 | 108° | NOTHING | NOTHING |
| 4:6 | 105° | NOTHING | TRANSFER CHARGE LEAK |
| 5:5 | 106° | NOTHING | TRANSFER CHARGE LEAK |
| 6:4 | 98° | NOTHING | TRANSFER CHARGE LEAK |
| 10:0 | 82° | NOTHING | TRANSFER CHARGE LEAK |

Comparison Example 1-2

With respect to the above-mentioned embodiment 8-2, a comparison example in which toner adhesion occurs is shown below.

As fluorocarbon resin, PFA powder (MP102 (made by DuPont-Mitsui Fluorochemicals Co., Ltd.)) is applied, and, as heat resistant resin, poly(etheretherketone) (PEEK) powder (made by Victrex-MC Inc., PEEK 150XF) is applied. These powders are mixed in a predetermined weight ratio, and a mixture powder is produced. On the other hand, as a base material, for example, a core metal surface of a fixing roller made of aluminum having a diameter ϕ of 40 mm, and wall thickness of a fixing part is 1.5 mm is roughened through abrasive blasting treatment.

Then, the above-mentioned mixture powder is electrostatically coated on the core metal of the aluminum made fixing roller, heating is carried out for 380° C., and rapid cooling is carried out by means of strong air blast outside of a heating furnace.

Surface roughness of a releasing layer may be large depending on a type of powder or a mixture ratio. When surface roughness should be made the same predetermined magnitude, this can be obtained from grinding by means of a tape grinding apparatus, for example. For example, when tape grinding is carried out with corundum #800, #1500, surface roughness could be made equal to or less than 2 μm. This fixing roller was loaded in a fixing part of a Ricoh's image forming apparatus MF4570, a non-fixed toner image produced by an image forming part having the same configuration as that of FIG. 23 was passed through a test machine (fixing device) having a configuration such as that shown in FIG. 24, and thus, fixing was carried out. Comparison examples by PFA:PEEK (weight ratio) obtained when 10000 sheets of black solid images were passed, and a toner adhesion state on the roller surface was observed are shown in Table 31 below:

TABLE 31

| PFA:PEEK (WEIGHT RATIO) | CONTACT ANGLE FOR PURE WATER | ADHERING TONER | ELECTROSTATIC OFFSET |
|---|---|---|---|
| 100:0 | 107° | NOTHING | WHOLE AREA AND PEELING BOTH OCCUR |
| 90:10 | 97° | NOTHING | WHOLE AREA AND PEELING BOTH OCCUR |
| 80:20 | 92° | NOTHING | WHOLE AREA AND PEELING BOTH OCCUR |
| 70:30 | 89° | NOTHING | WHOLE AREA AND PEELING BOTH OCCUR |
| 60:40 | 86° | NOTHING | WHOLE AREA AND PEELING BOTH OCCUR |
| 50:50 | 83° | NOTHING | WHOLE AREA AND PEELING BOTH OCCUR |
| 40:60 | 81° | TONER ADHERING TO ROLLER SURFACE | WHOLE AREA AND PEELING BOTH OCCUR |
| 30:70 | 79° | TONER ADHERING TO ROLLER SURFACE | WHOLE AREA AND PEELING BOTH OCCUR |
| 20:80 | 76° | TONER ADHERING TO ROLLER SURFACE | WHOLE AREA AND PEELING BOTH OCCUR |
| 15:85 | 75° | TONER ADHERING TO ROLLER SURFACE | WHOLE AREA AND PEELING BOTH OCCUR |

Embodiment 8-3

As a component of the surface layer, silver powder (average particle diameter: 0.5 μm) and alumina powder (average particle diameter: 0.5 μm) were mixed into PFA powder (MP102 (made by DuPont-Mitsui Fluorochemicals Co., Ltd.), average particle diameterϕ: 20 μm) in amounts such that silver is 5% and alumina is 5% in reduced volume, the thus-obtained one was input to a hybridization system configured as shown in FIG. 30 made by Nara Machinery, and (silver+alumina) powder was fixed on PFA powder. A state in which (silver+alumina) powder almost covered PFA powder was confirmed from observation by means of SEM. This powder was mixed with PFA powder (MP102 (DuPont-Mitsui Fluorochemicals Co., Ltd.), average particle diameter ϕ: 20 μm), was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 32 below, a relationship between a volume ratio of (silver+alumina) fixed PFA powder:PFA powder, a multiplying factor of thermal conductivity, and surface resistance is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

TABLE 32

| (SILVER + ALUMINA) FIXED PFA POWDER:PFA POWDER (VOLUME RATIO) | MULTIPLYING FACTOR OF THERMAL CONDUCTIVITY | SURFACE RESISTANCE (Ω/□) |
|---|---|---|
| 1:9 | 2.25 | $1 \times 10^9$ |
| 2:8 | 3.16 | $4 \times 10^8$ |
| 4:6 | 12.19 | $1 \times 10^7$ |
| 5:5 | 12.41 | $4 \times 10^6$ |
| 6:4 | 14.81 | $2 \times 10^6$ |

Embodiment 8-4

The same as the embodiment 8-1, as a component of the surface layer, silver powder (average particle diameter: 0.5 μm) and alumina powder (average particle diameter: 0.5 μm) were mixed into PFA powder (MP102 (made by DuPont-Mitsui Fluorochemicals Co., Ltd.), average particle diameterϕ: 20 μm) in amounts such that silver is 5% and alumina is 5% in reduced volume, the thus-obtained one was input to a hybridization system configured as shown in FIG. 30 made by Nara Machinery, and (silver+alumina) powder was fixed on PFA powder. Then, mixing was carried out according to a ratio of Tables 33, 34 below, coating was carried out on an aluminum tube to be the core metal (base material) 17 of the fixing roller in an electrostatic manner, the coated resin was melted at 380° C. and then cooled, grinding was carried out by means of corundum particles, surface roughness Rz made equal to or less than 2 μm was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. Toner of this MF4570 is toner with wax. 10000 sheets of black solid images were passed, and toner adhesion state on the roller and occurrence of electrostatic offset were observed. The observation result is shown in Table 33 below. As shown in Table 33, no particularly large adhesion was observed, and nothing other than ordinary one occurred.

As a comparison example, silver powder (average particle diameter: 1.2 μm) was mixed with PFA powder (MP102 (made by DuPont-Mitsui Fluorochemicals Co., Ltd.), average particle diameter ϕ: 20 μm) in such an amount that silver is 10% in reduced volume, this was input to a hybridization system of Nara Machinery Co., Ltd. such as that shown in FIG. 30, and silver powder was fixed to PFA powder. Next, mixing was carried out according to a ratio of Tables 33 and 34 below, this was electrostatically coated on an aluminum substrate, burning was carried out at 380° C., resin was melted and then cooled, grinding was carried out with the use of corundum particles, one with surface roughness of equal to or less than 2 μm in Rz was produced, and thus, the fixing roller was obtained. Table 34 shows a result for this case.

Further, cold offset temperature and hot offset temperature which are those at which toner can be fixed were obtained as shown in Table 35, and therefrom it was seen that the cold offset temperature lowers and a fixing temperature range is widened. Thereby, it was seen that, even when temperature lowering occurs upon high speed paper passage, stable fixing can be carried out. Carbon 3% included PFA in Table 35 is a conventional one for comparison. Further, as a comparison example, a sheet was produced similarly as a result of silver powder (average particle diameter: 0.5 μm) and alumina powder (average particle diameter: 0.5 μm) being mixed with PFA powder (MP102 (made by DuPont-Mitsui Fluorochemicals Co., Ltd.), average particle diameter ϕ: 20 μm) in such amounts that silver is 2.5% and alumina is 2.5% in reduced volume with the use of a stirring apparatus KK-500 made by Kurabo Industries Ltd. A reason why silver is 2.5% and alumina is 2.5% is that, in an electrostatic method, film forming cannot be carried out more than this.

TABLE 33

| (SILVER + ALUMINA) FIXED PFA POWDER:PFA POWDER (VOLUME RATIO) | ADHERING TONER | ELECTROSTATIC OFFSET |
|---|---|---|
| 1:9 | NOTHING | NOTHING |
| 2:8 | NOTHING | NOTHING |
| 4:6 | NOTHING | NOTHING |
| 5:5 | NOTHING | NOTHING |
| 6:4 | NOTHING | NOTHING |

TABLE 34

| SILVER FIXED PFA POWDER:PFA POWDER (VOLUME RATIO) | ADHERING TONER | ELECTROSTATIC OFFSET |
|---|---|---|
| 1:9 | NOTHING | NOTHING |
| 2:8 | NOTHING | NOTHING |
| 4:6 | NOTHING | TRANSFER CHARGE LEAK |
| 5:5 | NOTHING | TRANSFER CHARGE LEAK |
| 6:4 | NOTHING | TRANSFER CHARGE LEAK |

TABLE 35

| COMPARISON EXAMPLE BY (SILVER + ALUMINA) PFA POWDER:PFA POWDER (VOLUME RATIO) | | |
|---|---|---|
| (SILVER + ALUMINA) PFA POWDER:PFA POWDER (VOLUME RATIO) | COLD OFFSET TEMPERATURE | HOT OFFSET TEMPERATURE |
| 1:9 | 105° C. | 190° C. |
| 2:8 | 105° C. | 190° C. |
| 4:6 | 105° C. | 190° C. |
| 5:5 | 105° C. | 190° C. |
| 6:4 | 110° C. | 190° C. |

TABLE 35-continued

| COMPARISON EXAMPLE BY (SILVER + ALUMINA) PFA POWDER:PFA POWDER (VOLUME RATIO) | | |
|---|---|---|
| (SILVER + ALUMINA) PFA POWDER:PFA POWDER (VOLUME RATIO) | COLD OFFSET TEMPERATURE | HOT OFFSET TEMPERATURE |
| CARBON 3% INCLUDED PFA FOR COMPARISON | 130° C. | 200° C. |
| 2.5% SILVER + 2.5% ALUMINA - PFA FILM FOR COMPARISON | 110° C. | 165° C. |

Embodiment 8-5

As a component of the surface layer, silver powder (average particle diameter: 0.5 μm) in a volume ratio of 2%, alumina powder (average particle diameter: 0.5 μm) in a volume ratio of 3% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm) in reduced volume, the thus-obtained one was input to a hybridization system configured as shown in FIG. 30 made by Nara Machinery, and (silver+alumina+Sn) powder was fixed on PFA powder. Further, into wet fluorine coating EN700CL made by DuPont, the above-mentioned produced (silver+alumina+Sn) powder fixed to PFA powder was mixed in a volume ratio of 50:50 calculated from specific gravities with respect to dry PFA weight, stirring and dispersion were carried out, then, spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller and occurrence of electrostatic offset were observed. As a result, no particularly large adhesion was observed, and nothing other than ordinary one occurred.

As a comparison example, silver powder (average particle diameter: 1.2 μm) in a volume ratio of 5% and Sn powder (average particle diameter: 15.8 μm) in a volume ratio of 2% were mixed into PFA powder (MP102 (made by DuPont-Mitsui Fluorochemicals Co., Ltd.), average particle diameters: 12 μm) in reduced volume, the thus-obtained one was input to a hybridization system configured as shown in FIG. 30 made by Nara Machinery, and silver powder and Sn powder were fixed on PFA powder. Further, into wet fluorine coating EN700CL made by DuPont, the above-mentioned produced powder to which silver and Sn were thus fixed was mixed in a volume ratio of 50:50 calculated from specific gravities with respect to dry PFA weight, stirring and dispersion were carried out, then, spray coating was carried out on an aluminum tube to be a core metal of a fixing roller, the coated resin was melted at 380° C. and then cooled, after that grinding was carried out, and the fixing roller was obtained. Therefor, the same evaluation was made. As a result, no toner adhesion occurred. However, electrostatic offset by means of transfer charge leakage occurred.

Embodiment 8-6

The same as the embodiment 8-1, as a component of the surface layer, Ni powder (average particle diameter: 0.5 μm) and silicon carbide powder (average particle diameter: 0.5 μm) were mixed into PFA powder (MP102 (made by DuPont-Mitsui Fluorochemicals Co., Ltd.), average particle diameterϕ: 20 μm) in amounts such that Ni is 5% and silicon carbide is 5% in reduced volume, the thus-obtained one was input to a hybridization system configured as shown in FIG. 30 made by Nara Machinery, and (Ni+silicon carbide) powder was fixed on PFA powder. Then, coating was carried out on an aluminum tube to be the core metal of the fixing roller in an electrostatic manner, the coated resin was melted at 380° C. and then cooled, grinding was carried out by means of corundum particles, one having surface roughness (Rz) made equal to or less than 2 μm was produced, and thus, the fixing roller was produced. A final thickness of the surface layer is 40 μm. This roller was loaded in a fixing part of an image forming apparatus IMAGIO NEO 750 of Ricoh Co., Ltd. Toner of this IMAGIO NEO 750 is insufficient in releasability, and therefore, oil coating members immersed in silicon oil for coating silicon coil to the fixing roller is added. As non-fixed toner images produced with the use of an image forming part of this IMAGIO NEO 750, 10000 sheets of black solid images were passed through a test machine (fixing device) having a configuration as shown in FIG. 24, and fixing was repeated. Then, toner adhesion state on the roller was observed. As a result of the observation, no particularly large adhesion and occurrence of electrostatic offset were observed, and nothing other than ordinary one occurred.

Embodiment 8-7

The same as the embodiment 8-1, as a component of the surface layer, scaly Ni powder (thickness average: 0.8 μm; diameter average: 50 μm) and silicon carbide (average particle diameter: 0.5 μm) were mixed into PFA powder (MP102 (made by DuPont-Mitsui Fluorochemicals Co., Ltd.), average particle diameterϕ: 20 μm) in amounts such that Ni is 5% and silicon carbide is 5% in reduced volume, the thus-obtained one was electrostatically coated on an aluminum tube to be the core metal of the fixing roller, the coated resin was melted at 380° C. and then cooled, grinding was carried out by means of corundum particles, one having surface roughness (Rz) made equal to or less than 2 μm was produced, and thus, the fixing roller was produced. A final thickness of the surface layer is 40 μm. This roller was loaded in a fixing part of an image forming apparatus MF4570 of Ricoh Co., Ltd, a non-fixed toner image produced with the use of an image forming part the same as that shown in FIG. 23 was fixed through a test machine (fixing device) having a configuration such as that shown in FIG. 24. Toner of the MF4570 is toner including wax. 10000 sheets of black solid images were passed through the MF4570. Then, when a toner adhesion state on the roller surface was observed, toner adhesion occurred on the order of 1000 sheets. According to the observation, toner adhered to a part in which Ni powder was exposed widely due to grinding. The same result was obtained for mica having the same size. However, for scaly Ni powder having an average diameter on the order of 30 μm, no toner adhesion appeared as a result of carrying out up to 10000 sheets.

Embodiment 8-8

A roller was produced the same as in the embodiment 8-2, and surface roughness of which was 2 μm in Rz. A fixing test machine was produced in which this roller was applied in a fixing unit of an image forming apparatus MF4570 of Ricoh, Co., Ltd., and non-fixed images of MF4570 were passed with a pressing force changed. A testing result is shown in Table 36 below. As shown in Table 36, when the pressing force is equal to or less than 0.5 (kgf/cm$^2$), fixing performance was very bad, while, when the pressing force was equal to or more than 4.0 (kgf/cm$^2$), toner adhesion occurred on the fixing roller. The fixing performance was determined simply in such a manner that, when toner remarkably adhered to a cloth after the solid image after fixing was rubbed by the cloth, it was determined that the fixing was bad.

TABLE 36

COMPARISON EXAMPLE BY PRESSING FORCE

| PRESSING FORCE (kgf/cm$^2$) | ADHERING TONER AMOUNT | PAPER WINDING |
|---|---|---|
| 0.3 | NOTHING | NOTHING |
| 0.5 | NOTHING | NOTHING |
| 1.0 | NOTHING | NOTHING |
| 2.0 | SOME | NOTHING |
| 4.0 | VERY MUCH | FREQUENT JAM |

Embodiment 8-9

As a component of the surface layer, respective powders were produced in which, into tin 80-silver 20 low melting point alloy powder (average particle diameter: 1.1 μm), respective metal powders of gold, silver, copper, lead, nickel, zinc, iron, aluminum, magnesium and titanium (average particle diameter 1.5 μm each), and aluminum nitride (average particle diameter 0.5 μm) were mixed in a ratio of 25:25:50, respectively. In this mixing, a stirring machine KK-500 made by Kurabo Industries Ltd. was applied. This equal-volume mixed powder was mixed into PFA powder (low temperature burned type, average particle diameter ϕ 20 μm) by 10% in reduced volume, this is then input to a hybridization system of Nara Machinery Co., Ltd. such as that shown in FIG. 30, and thus, each equal-volume-mixed metal powder was fixed to PFA powder. A state was confirmed in observation by SEM in which each powder almost covered PFA powder. After that, the fixing rollers were produced the same as in the embodiment 8-2, respectively. Each roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. Toner of this MF4570 is toner with wax. 10000 sheets of black solid images were passed through the MF4570, and toner adhesion state on the roller and occurrence of electrostatic offset were observed. Table 37 shows the observation result. As shown in Table 37, no particularly large adhesion was observed, and nothing other than ordinary one occurred.

TABLE 37

| METAL COMPONENT | ADHERING TONER | ELECTROSTATIC OFFSET |
|---|---|---|
| GOLD | NOTHING | NOTHING |
| SILVER | NOTHING | NOTHING |
| COPPER | NOTHING | NOTHING |

TABLE 37-continued

| METAL COMPONENT | ADHERING TONER | ELECTROSTATIC OFFSET |
|---|---|---|
| ZINC | NOTHING | NOTHING |
| NICKEL | NOTHING | NOTHING |
| IRON | NOTHING | NOTHING |
| ALUMINUM | NOTHING | NOTHING |
| MAGNESIUM | NOTHING | NOTHING |
| TITANIUM | NOTHING | NOTHING |

Next, Table 38 below shows comparison examples obtained from cold offset temperature and hot offset temperature which are a temperature range in which toner fixing can be carried out, for each metal: PFA powder (volume ratio). As can be seen from Table 38, the cold offset temperature lowered and the fixing temperature range was widened. Thereby, it is seen that stable fixing can be carried out even when temperature lowering occurs upon high speed paper passage. Table 38 also shows for only PFA powder (MP102 (DuPont-Mitsui Fluorochemicals Co., Ltd.), average particle diameter ϕ 20 μm) as a comparison example.

TABLE 38

COMPARISON EXAMPLE BY EACH METAL:PFA POWDER (VOLUME RATIO)

| METAL COMPONENT COLD OFFSET | TEMPERATURE HOT OFFSET | TEMPERATURE |
|---|---|---|
| GOLD | 105° C. | 190° C. |
| SILVER | 105° C. | 190° C. |
| COPPER | 105° C. | 190° C. |
| ZINC | 105° C. | 190° C. |
| NICKEL | 110° C. | 190° C. |
| IRON | 110° C. | 190° C. |
| ALUMINUM | 105° C. | 190° C. |
| MAGNESIUM | 110° C. | 190° C. |
| TITANIUM | 110° C. | 190° C. |
| ONLY PFA (COMPARISON EXAMPLE) | 130° C. | 190° C. |

Embodiment 8-10

The same as the embodiment 8-4, as a component of the surface layer, silver powder (average particle diameter: 0.5 μm) and alumina (average particle diameter: 0.5 μm) were mixed into PFA powder (MP102 (made by DuPont-Mitsui Fluorochemicals Co., Ltd.), average particle diameterϕ: 20 μm) in amounts such that silver is 5% and alumina is 5% in reduced volume, the thus-obtained one was input to a hybridization system configured as shown in FIG. 30 made by Nara Machinery, and (silver+alumina) powder was fixed on PFA powder. Mixing was made with PFA powder in a ratio of 5:5, coating was carried out on an aluminum tube to be the core metal of the fixing roller in an electrostatic manner, and the coated resin was melted at 380° C. and then cooled. Then, grinding was carried out by means of corundum particles, those of surface roughness Rz made equal to or less than 2 μm; 3 μm; 5 μm; and 7 μm, were produced, and thus, the fixing rollers were produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller and occurrence of electrostatic offset were observed. The observation result is shown in Table 39 below.

This fixing roller was loaded in a fixing part of an image forming apparatus MF4570 of Ricoh Co., Ltd., fixing was repeated for 10000 sheets of black solid images, and toner adhering amount on the roller surface and paper winding were observed. As a result, it was confirmed that there was an effect for a surface roughness of equal to or less than 5 μm in Rz. For one of 7 μm, jam occurred frequently in MF4570, and therefore, experiment was cancelled.

TABLE 39

COMPARISON BY ROUGHNESS

| SURFACE ROUGHNESS Rz | ADHERING TONER AMOUNT | PAPER WINDING | ELECTROSTATIC OFFSET |
|---|---|---|---|
| 2 μm | NOTHING | NOTHING | NOTHING |
| 3 μm | NOTHING | NOTHING | NOTHING |
| 5 μm | SOME | NOTHING | NOTHING |
| 7 μM | VERY MUCH | FREQUENT JAM | NOTHING |

Embodiment 9

Next, embodiments of the heating member (fixing member) 11A having the surface layer 15 applying a plurality of types of fluorocarbon resins having deferent melting points as shown in FIGS. 32 through 38, used in the fixing device 6A configured as shown in FIG. 24, are described.

Embodiment 9-1

As a component of the surface layer, Ni powder (average particle diameter: 0.5 μm) and silicon carbide (average particle diameter: 0.5 μm) were mixed into PTFE powder (7A-J (made by DuPont Co., Ltd.)) in amounts such that Ni is 5% and silicon carbide is 5% in reduced volume, the thus-obtained one was input to a hybridization system configured as shown in FIG. 30 made by Nara Machinery Co., Ltd., and (Ni+silicon carbide) powder was fixed on PTFE powder. A state in which (Ni+silicon carbide) powder almost covered PTFE powder was confirmed from observation by means of SEM. This powder was mixed with PFA powder (MP102 (DuPont-Mitsui Fluorochemicals Co., Ltd.)), i.e., fluorocarbon resin having a melting point lower than that of PTFE, was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 40 below, a relationship between a volume ratio of Ni fixed PTFE powder:PFA powder, a multiplying factor of thermal conductivity, and surface resistance is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

As a comparison example, Ni powder (average particle diameter: 0.5 μm) and silicon carbide (average particle diameter: 0.5 μm) were mixed with PFA powder (MP102 (made by DuPont-Mitsui Fluorochemicals Co., Ltd)) in such amounts that Ni is to 5% and silicon carbide is 5% in reduced volume, it was then input to a hybridization system of Nara Machinery Co., Ltd., and (Ni+silicon carbide) powder was fixed to PFA powder. From observation by SEM, a state was confirmed that (Ni+silicon carbide) powder almost covered PFA powder. This powder was mixed with PFA powder (MP102 (DuPont-Mitsui Fluorochemicals Co., Ltd.)) in a volume ratio of 6:4, it was coated on an aluminum substrate electrostatically, it was burned at 380° C., resin was melted and then cooled, it was pealed from the substrate, and a sample was produced.

Further, as another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further Ni powder (average particle diameter 0.5 μm) and silicon carbide (average particle diameter: 0.5 μm) were mixed into this powder in an ordinary stirring manner for amounts of 2.5% of Ni and 2.5% of silicon carbide in reduced volume, and a sheet was produced similarly. The reason why Ni amounts to 2.5% and silicon carbide amounts to 2.5% is that, in an electrostatic coating, a film forming cannot be carried out more than it.

TABLE 40

| (Ni + SILICON CARBIDE) FIXED PTFE POWDER:PFA POWDER (VOLUME RATIO) | MULTIPLYING FACTOR OF THERMAL CONDUCTIVITY | SURFACE RESISTANCE (Ω/□) |
|---|---|---|
| 1:9 | 1.71 | $1 \times 10^{10}$ |
| 2:8 | 2.72 | $5 \times 10^{9}$ |
| 4:6 | 10.80 | $1 \times 10^{8}$ |
| 5:5 | 11.50 | $5 \times 10^{7}$ |
| 6:4 | 12.03 | $1 \times 10^{7}$ |
| (Ni + SILICON CARBIDE) FIXED PFA POWDER:PFA POWDER = 6:4 FOR COMPARISON | 11.93 | $2 \times 10^{7}$ |
| 2.5% Ni + 2.5% SILICON CARBIDE MIXTURE - PTFE/PFA FILM FOR COMPARISON | 2.30 | $5 \times 10^{9}$ |

Embodiment 9-2

As a component of the surface layer, Ni powder (average particle diameter: 0.5 μm) and silicon carbide (average particle diameter: 0.5 μm) were mixed into PFA powder (MP102 (made by DuPont-Mitsui Fluorochemicals Co., Ltd.)) in amounts such that Ni amounts to 5% and silicon carbide amounts to 5% in reduced volume, the thus-obtained one was input to a hybridization system configured as shown in FIG. 30 made by Nara Machinery Co., Ltd., and (Ni+silicon carbide) powder was fixed on PFA powder. A state in which (Ni+silicon carbide) powder almost covered PFA powder was confirmed from observation by means of SEM. This powder was mixed with FEP powder (532-8110 (made by DuPont Co., Ltd.)), i.e., fluorocarbon resin having a melting point lower than that of PFA, was coated on an aluminum substrate in an electrostatic manner, burning was carried out at 300° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 41 below, a relationship between a volume ratio of Ni fixed PFA powder:FEP powder, and a multiplying factor of thermal conductivity, is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by measurement value of thermal conductivity of FEP, and shows a multiple of thermal conductivity with respect to the thermal conductivity of FEP.

As a comparison example, Ni powder (average particle diameter: 0.5 μm) and silicon carbide (average particle diameter: 0.5 μm) were mixed with FEP powder (532-8110 (made by DuPont Co., Ltd)) in such an amount that Ni amounts to 5% and silicon carbide amounts to 5% in reduced volume, it was then input to a hybridization system of Nara Machinery Co., Ltd. configured as shown in FIG. 30, and (Ni+silicon carbide) powder was fixed to FEP powder. From observation by SEM, a state was confirmed that (Ni+silicon carbide) almost covered FEP powder. This powder was mixed with FEP powder (532-8110 (made by DuPont Co., Ltd.)) in a volume ratio of 6:4, it was coated on an aluminum substrate electrostatically, it was burned at 300° C., resin was melted and then cooled, it was pealed from the substrate, and a sample was produced.

Further, as another comparison example, FEP powder (532-8110 (made by DuPont Co., Ltd.)) was mixed into PFA powder (MP102 (made by DuPont-Mitsui Fluorochemicals Co., Ltd)) in an ordinary stirring manner, further Ni powder (average particle diameter 0.5 μm) and silicon carbide (average particle diameter: 0.5 μm) were mixed into this powder in an ordinary stirring manner for amounts of 2.5% of Ni and 2.5% of silicon carbide in reduced volume, and a sheet was produced similarly. The reason why Ni amounts to 2.5% and silicon carbide amounts to 2.5% is that, in an electrostatic coating, a film forming cannot be carried out more than it.

TABLE 41

| (Ni + SILICON CARBIDE) FIXED PFA POWDER:FEP POWDER (VOLUME RATIO) | MULTIPLYING FACTOR OF THERMAL CONDUCTIVITY | SURFACE RESISTANCE (Ω/□) |
|---|---|---|
| 1:9 | 1.71 | $1 \times 10^{10}$ |
| 2:8 | 2.73 | $5 \times 10^{9}$ |
| 4:6 | 10.80 | $1 \times 10^{8}$ |
| 5:5 | 11.50 | $5 \times 10^{7}$ |
| 6:4 | 12.03 | $1 \times 10^{7}$ |
| (Ni + SILICON CARBIDE) FIXED PFA POWDER:FEP POWDER = 6:4 FOR COMPARISON | 11.93 | $2 \times 10^{7}$ |
| 2.5% Ni + 2.5% SILICON CARBIDE MIXTURE - PFA/FEP FILM FOR COMPARISON | 2.30 | $5 \times 10^{9}$ |

Embodiment 9-3

The same as the embodiment 9-1, Ni powder (average particle diameter: 0.5 μm) and silicon carbide (average particle diameter: 0.5 μm) were mixed into PTFE powder (7A-J (made by DuPont Co., Ltd.)) in amounts such that Ni amounts to 5% and silicon carbide amounts to 5% in reduced volume, the thus-obtained one was input to a hybridization system configured as shown in FIG. 30 made by Nara Machinery, and (Ni+silicon carbide) powder was fixed on PTFE powder. Then, mixing was carried out according to a ratio of the table below with PFA powder (MP102 (DuPont-Mitsui Fluorochemicals Co., Ltd.)), coating was carried out on an aluminum tube to be the core metal (base material) of the fixing roller in an electrostatic manner, the coated resin was melted at 380° C. and then cooled, grinding was carried out by means of corundum particles, surface roughness made equal to or less than 2 μm in ten point average roughness (Rz) was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface and occurrence of electrostatic offset were observed. The observation result is shown in Table 42 below. As shown in Table 42, no particularly large adhesion was observed, and nothing other than ordinary one occurred.

TABLE 42

| (Ni + SILICON CARBIDE) FIXED PTFE POWDER:PFA POWDER (VOLUME RATIO) | WATER CONTACT ANGLE | ADHERING TONER | ELECTROSTATIC OFFSET |
|---|---|---|---|
| 1:9 | 108° | NOTHING | NOTHING |
| 2:8 | 108° | NOTHING | NOTHING |
| 4:6 | 105° | NOTHING | NOTHING |
| 5:5 | 106° | NOTHING | NOTHING |
| 6:4 | 98° | NOTHING | NOTHING |
| 10:0 | 82° | NOTHING | NOTHING |

As a comparison example, Ni powder (average particle diameter: 0.5 μm) was mixed with PTFE powder (7A-J (made by DuPont Co., Ltd.) in such an amount that Ni is 10% in reduced volume, this was input to a hybridization system of Nara Machinery Co., Ltd. such as that shown in FIG. 30, and Ni powder was fixed to PTFE powder. Next, mixing was carried out with PFA powder MP102 (made by DuPont-Mitsui Fluorochemicals, Co., Ltd.)) according to a ratio of the table below, this was electrostatically coated on an aluminum substrate, burning was carried out at 380° C., resin was melted and then cooled, grinding was carried out with the use of corundum particles, one with surface roughness of equal to or less than 2 μm in Rz was produced, and thus, the fixing roller was obtained. Table 43 shows a result for this case.

TABLE 43

| Ni FIXED PTFE POWDER:PFA POWDER (VOLUME RATIO) | WATER CONTACT ANGLE | ADHERING TONER | ELECTROSTATIC OFFSET |
|---|---|---|---|
| 1:9 | 108° | NOTHING | NOTHING |
| 2:8 | 108° | NOTHING | NOTHING |
| 4:6 | 105° | NOTHING | TRANSFER CHARGE LEAK |
| 5:5 | 106° | NOTHING | TRANSFER CHARGE LEAK |
| 6:4 | 98° | NOTHING | TRANSFER CHARGE LEAK |
| 10:0 | 82° | NOTHING | TRANSFER CHARGE LEAK |

Embodiment 9-4

As a component of the surface layer, silver powder (average particle diameter: 0.5 μm) and alumina (average particle diameter: 0.5 μm) were mixed into PTFE powder (7A-J (made by DuPont Co., Ltd.)) in amounts such that silver amounts to 5% and alumina amounts to 5% in reduced volume, the thus-obtained one was input to a hybridization system configured as shown in FIG. 30 made by Nara Machinery Co., Ltd., and (silver+alumina) powder was fixed on PTFE powder. A state in which (silver+alumina) powder almost covered PTFE powder was confirmed from observation by means of SEM. This powder was mixed with PFA powder (MP102 (made by DuPont-Mitsui Fluorochemicals Co., Ltd.)), i.e., fluorocarbon resin having a melting point lower than that of PTFE, was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 44 below, a relationship between a volume ratio of (silver+alumina) fixed PTFE powder:PFA powder, a multiplying factor of thermal conductivity, and surface resistance is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

As a comparison example, silver powder (average particle diameter: 0.5 μm) and alumina (average particle diameter: 0.5 μm) were mixed with PFA powder (MP102 (made by DuPont-Mitsui Fluorochemicals, Co., Ltd)) in such an amount that silver amounts to 5% and alumina amounts to 5% in reduced volume, it was then input to a hybridization system of Nara Machinery Co., Ltd. configured as shown in FIG. 30, and (silver+alumina) powder was fixed to PFA powder. From observation by SEM, a state was confirmed that (silver+alumina) powder almost covered PFA powder. This powder was mixed with PFA powder (MP102 (made by DuPont-Mitsui Fluorochemicals, Co., Ltd.)) in a volume ratio of 6:4, it was coated on an aluminum substrate electrostatically, it was burned at 380° C., resin was melted and then cooled, it was pealed from the substrate, and a sample was produced.

Further, as another comparison example, PFA powder (MP102 (made by DuPont-Mitsui Fluorochemicals Co., Ltd)) was mixed into PTFE powder (7A-J (made by DuPont Co., Ltd.)) in an ordinary stirring manner, further silver powder (average particle diameter 0.5 μm) and alumina (average particle diameter 0.5 μm) were mixed into this powder in an ordinary stirring manner for amounts of 2.5% of silver and 2.5% of alumina in reduced volume, and a sheet was produced similarly. The reason why silver amounts to 2.5% and alumina amounts to 2.5% is that, in an electrostatic coating, a film forming cannot be carried out more than it.

TABLE 44

| (SILVER + ALUMINA) FIXED PTFE POWDER:PFA POWDER (VOLUME RATIO) | MULTIPLYING FACTOR OF THERMAL CONDUCTIVITY | SURFACE RESISTANCE (Ω/□) |
|---|---|---|
| 1:9 | 2.25 | $1 \times 10^9$ |
| 2:8 | 3.16 | $4 \times 10^8$ |
| 4:6 | 12.19 | $1 \times 10^7$ |
| 5:5 | 12.41 | $4 \times 10^6$ |
| 6:4 | 16.32 | $1 \times 10^6$ |
| (SILVER + ALUMINA) FIXED PFA POWDER:PFA POWDER = 6:4 FOR COMPARISON | 14.81 | $2 \times 10^6$ |
| 2.5% SILVER + 2.5% ALUMINA MIXTURE - PTFE/PFA FILM FOR COMPARISON | 2.73 | $7 \times 10^8$ |

Embodiment 9-5

The same as the embodiment 9-1, silver powder (average particle diameter: 0.5 μm) and alumina (average particle diameter: 0.5 μm) were mixed into PTFE powder (7A-J (made by DuPont Co., Ltd.)) in amounts such that silver is 5% and alumina is 5% in reduced volume, the thus-obtained one was input to a hybridization system configured as shown in FIG. 30 made by Nara Machinery, and (silver+alumina) powder was fixed on PFA powder. Then, mixing was carried out with PFA powder (MP102 (made by DuPont-Mitsui Fluorochemicals, Co., Ltd.)) according to a ratio of the table below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in Rz was produced, and thus, the fixing roller was produced. A final thickness of the surface layer is 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface and occurrence of electrostatic offset were observed. The observation result is shown in Table 45 below. As shown in Table 45, no particularly large adhesion was observed, and nothing other than ordinary one occurred.

As a comparison example, silver powder (average particle diameter: 0.5 μm) was mixed into PTFE powder (7A-J (made by DuPont Co., Ltd.)) in an amount such that silver is 10% in reduced volume, the thus-obtained one was input to a hybridization system configured as shown in FIG. 30 made by Nara Machinery, and silver powder was fixed on PFA powder. Then, mixing was carried out with PFA powder (MP102 (made by DuPont-Mitsui Fluorochemicals, Co., Ltd.)) according to a ratio of the table below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in Rz was produced, and thus, the fixing roller was produced. For this case, a result is shown in Table 46.

Further, cold offset temperature and hot offset temperature, i.e., a range in which toner can be fixed were obtained as shown in Table 47, and therefrom it was seen that the cold offset temperature lowers and a fixing temperature range is widened. Thereby, it was seen that, even when temperature lowering occurs upon high speed paper passage, stable fixing can be carried out. Carbon 3% included PFA in Table 47 is a conventional one for comparison.

Further, as a comparison example, PFA powder (MP102 (made by DuPont-Mitsui Fluorochemicals Co., Ltd.)) was mixed with PTFE powder (7A-J (made by DuPont Co., Ltd.)) in an ordinary stirring manner, then, to this powder, silver powder (average particle diameter: 0.5 μm) and alumina (average particle diameter: 0.5 μm) are mixed in stirring manner to amounts to 2.5% of silver and 2.5% of alumina in reduced volume, thus, the fixing roller was provided similarly. A reason why silver amounts to 2.5% and alumina amounts to 2.5% is that, in an electrostatic method, film forming cannot be carried out more than this.

TABLE 45

| (SILVER + ALUMINA) FIXED PFA POWDER:PFA POWDER (VOLUME RATIO) | ADHERING TONER | ELECTROSTATIC OFFSET |
|---|---|---|
| 1:9 | NOTHING | NOTHING |
| 2:8 | NOTHING | NOTHING |
| 4:6 | NOTHING | NOTHING |
| 5:5 | NOTHING | NOTHING |
| 6:4 | NOTHING | NOTHING |

TABLE 46

| SILVER FIXED PFA POWDER:PFA POWDER (VOLUME RATIO) | ADHERING TONER | ELECTROSTATIC OFFSET |
|---|---|---|
| 1:9 | NOTHING | NOTHING |
| 2:8 | NOTHING | NOTHING |
| 4:6 | NOTHING | TRANSFER CHARGE LEAK |
| 5:5 | NOTHING | TRANSFER CHARGE LEAK |
| 6:4 | NOTHING | TRANSFER CHARGE LEAK |

TABLE 47

| (SILVER + ALUMINA) PTFE POWDER:PFA POWDER (VOLUME RATIO) | COLD OFFSET TEMPERATURE | HOT OFFSET TEMPERATURE |
|---|---|---|
| 1:9 | 105° C. | 190° C. |
| 2:8 | 105° C. | 190° C. |
| 4:6 | 105° C. | 190° C. |
| 5:5 | 105° C. | 190° C. |
| 6:4 | 110° C. | 190° C. |
| CARBON 3% INCLUDED PFA FOR COMPARISON | 130° C. | 200° C. |
| 2.5% SILVER + 2.5% ALUMINA - PTFE/PFA FILM FOR COMPARISON | 110° C. | 165° C. |

Embodiment 9-6

As a component of the surface layer, silver powder (average particle diameter: 0.5 μm) in a volume ratio of 2%, alumina (average particle diameter: 0.5 μm) in a volume ratio of 3% and Sn powder (average particle diameter: 15.8 μm) in a volume ratio of 2% were mixed into PTFE powder (7A-J (made by DuPont Co., Ltd.)) in reduced volume, the thus-obtained one was input to a hybridization system configured as shown in FIG. 30 made by Nara Machinery, and silver powder and Sn powder were fixed on PTFE powder. Further, with respect to dry PFA weight, into wet fluorine coating (EN700CL) made by DuPont Co., Ltd., the above-mentioned produced powder in which (silver+alumina+Sn) powder was fixed to PTFE powder was mixed in a volume ratio of 50:50 calculated from specific gravities, stirring and dispersion were carried out, then, spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface and occurrence of electrostatic offset were observed. As a result, no particularly large adhesion was observed, and nothing other than ordinary one occurred.

As a comparison example, silver powder (average particle diameter: 0.5 μm) in a volume ratio of 5% and Sn powder (average particle diameter: 15.8 μm) in a volume ratio of 2% were mixed into PTFE powder (7A-J (made by DuPont Co., Ltd.)) in reduced volume, the thus-obtained one was input to a hybridization system configured as shown in FIG. 30 made by Nara Machinery, and silver powder and Sn powder were fixed on PTFE powder. Further, with respect to dry PFA weight, into wet fluorine coating (EN700CL) made by DuPont Co., Ltd., the above-mentioned produced powder in which silver and Sn were thus fixed to PTFE powder was mixed in a volume ratio of 50:50 calculated from specific gravities, stirring and dispersion were carried out, then, spray coating was carried out on an aluminum tube to be a core metal of a fixing roller, the coated resin was melted at 380° C. and then cooled, after that grinding was carried out, and the fixing roller was obtained. For this case, the same evaluation was made. As a result, no toner adhesion occurred. However, electrostatic offset due to transfer charge leakage occurred.

Embodiment 10

Next, embodiments of the heating member (fixing member) 11A having the surface layer 15 including, in a metal phase, bismuth or bismuth family material, used in the fixing device 6A configured as shown in FIG. 24 are described. [Embodiment 10-1] As a component of the surface layer, silver powder (average practice diameter: 0.5 μm) 2% in reduced volume ratio, alumina (average particle diameter: 0.5 μm) 2.5% in reduced volume ratio, and bismuth powder (average particle diameter: 0.8 μm) 0.5% in reduced volume ratio, were mixed into PFA powder (MP102 (made by DuPont-Mitsui Fluorochemicals Co., Ltd.), average particle diameterϕ: 20 μm) together, the thus-obtained one was input to a hybridization system configured as shown in FIG. 30 made by Nara Machinery Co., Ltd., and, as (silver+alumina+bismuth) powder, it was fixed on PFA powder. A state in which (silver+alumina+bismuth) almost covered PFA powder was confirmed from observation by means of SEM. This (silver+alumina+bismuth) fixed powder was mixed with PFA powder (MP102 (DuPont-Mitsui Fluorochemicals Co., Ltd.), average particle diameterϕ: 20 μm) in a volume ratio shown in Table 48 below, it was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 48 below, a relationship between a volume ratio of (silver+alumina+bismuth) fixed PFA powder:PFA powder, a multiplying factor of thermal conductivity and surface resistance, is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

Further, as a comparison example, silver powder (average particle diameter: 0.5 μm) and alumina (average particle diameter: 0.5 μm) were mixed with PFA powder (MP102 (made by DuPont-Mitsui Fluorochemicals Co., Ltd)) in such amounts that silver amounts to 2.5% and alumina amounts to 2.5% in reduced volume with the use of a stirring apparatus KK-500 made by Kurabo Industries Ltd., it was burned in the same way, and a sheet was produced. The reason why silver amounts to 2.5% and alumina amounts to 2.5% is that, in an electrostatic coating, a film forming cannot be carried out more than it.

TABLE 48

| (SILVER + ALUMINA + BISMUTH) FIXED PFA POWDER:PFA POWDER (VOLUME RATIO) | MULTIPLYING FACTOR OF THERMAL CONDUCTIVITY | SURFACE RESISTANCE (Ω/□) |
|---|---|---|
| 1:9 | 0.80 | $4 \times 10^{10}$ |
| 2:8 | 2.30 | $1 \times 10^{9}$ |
| 4:6 | 11.02 | $4 \times 10^{8}$ |
| 5:5 | 11.34 | $1 \times 10^{7}$ |
| 6:4 | 12.30 | $4 \times 10^{6}$ |
| 2.5% SILVER + 2.5% ALUMINA - PFA FILM FOR COMPARISON | 0.96 | $2 \times 10^{9}$ |

Embodiment 10-2

The same as the embodiment 10-1, as a component of the surface layer, silver powder (average particle diameter 0.5 μm) 2% in reduced volume ratio, alumina (average particle diameter 0.5 μm) 2.5% in reduced volume and bismuth powder (average particle diameter 0.8 μm) 0.5% in reduced volume were mixed into PFA powder (MP102 (made by DuPont-Mitsui Fluorochemicals Co., Ltd.) average particle diameter ϕ 20 μm), and (silver+alumina+bismuth) fixed PFA powder was obtained. This powder was mixed with PFA powder (MP102 (DuPont-Mitsui Fluorochemicals Co., Ltd.), average particle diameter ϕ 20 μm) in a volume ratio shown in Table 49 and Table 50 below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in ten point average roughness (Rz) was produced, and thus, the fixing roller was produced. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface was observed. Then, no particularly large adhesion was observed, and nothing other than ordinary one occurred. Further, when cold offset temperature and hot offset temperature, i.e., a range in which toner can be fixed were obtained, it was seen that the cold offset temperature lowers and a fixing temperature range is widened. Thereby, it was seen that, even when temperature lowering occurs upon high speed paper passage, stable fixing can be carried out. Carbon 3% included PFA in Table 49 is a conventional one for comparison. Further, as a comparison example, silver powder (average particle diameter: 0.5 μm) and alumina (average particle diameter; 0.5 μm) were mixed with PFA powder (MP102 (made by DuPont-Mitsui Fluorochemicals Co., Ltd.), average particle diameter: 20 μm) in such amounts that silver amounts to 2.5% in reduced volume and alumina amounts to 2.5% in reduced volume with the use of a stirring apparatus KK-500 made by Kurabo Industries Ltd., and the fixing roller was provided similarly. At the same time, a sample was produced on a flat plate from the same material, and water contact angle was measured. In section observation of all the metal parts, the thickness was equal to or less than 50 μm.

TABLE 49

| COMPARISON EXAMPLE BY (SILVER + BISMUTH) PFA POWDER:PFA POWDER (VOLUME RATIO) | | |
|---|---|---|
| (SILVER + ALUMINA + BISMUTH) PFA POWDER:PFA POWDER (VOLUME RATIO) | COLD OFFSET TEMPERATURE | HOT OFFSET TEMPERATURE |
| 1:9 | 125° C. | EQUAL TO OR HIGHER THAN 250° C. |
| 2:8 | 125° C. | EQUAL TO OR HIGHER THAN 250° C. |
| 4:6 | 115° C. | EQUAL TO OR HIGHER THAN 250° C. |
| 5:5 | 105° C. | EQUAL TO OR HIGHER THAN 250° C. |
| 6:4 | 105° C. | EQUAL TO OR HIGHER THAN 250° C. |
| 10:0 | 105° C. | EQUAL TO OR HIGHER THAN 250° C. |
| CARBON 3% INCLUDED PFA FOR COMPARISON | 130° C. | EQUAL TO OR HIGHER THAN 250° C. |
| 2.5% SILVER + 2.5% ALUMINA - PFA FILM FOR COMPARISON | 125° C. | 165° C. |

TABLE 50

| (SILVER + ALUMINA + BISMUTH) FIXED PFA POWDER:PFA POWDER (VOLUME RATIO) | WATER CONTACT ANGLE |
|---|---|
| 1:9 | 108° |
| 2:8 | 108° |
| 4:6 | 105° |
| 5:5 | 106° |
| 6:4 | 98° |
| 10:0 | 82° |

Embodiment 10-3

As a component of the surface layer, Ni powder (average practice diameter: 0.5 μm), silicon carbide (average particle diameter: 0.5 μm) and bismuth powder (average particle diameter: 0.8 μm) were mixed into PFA powder (MP102 (made by DuPont-Mitsui Fluorochemicals Co., Ltd.), average particle diameterϕ: 20 μm) together in amounts such that Ni amounts to 2%, silicon carbide amounts to 2.5% and bismuth amounts to 0.5% in reduced volume, the thus-obtained one was input to a hybridization system configured as shown in FIG. 30 made by Nara Machinery Co., Ltd., and, as (Ni+silicon carbide+bismuth) powder, it was fixed on PFA powder. A state in which (Ni+silicon carbide+bismuth) almost covered PFA powder was confirmed from observation by means of SEM. This (Ni+silicon carbide+bismuth) fixed powder was mixed with PFA powder (MP102 (DuPont-Mitsui Fluorochemicals Co., Ltd.), average particle diameter ϕ: 20 μm) in a volume ratio shown in Table 51 below, it was coated on an aluminum substrate in an electrostatic manner, burning was carried out at 380° C., resin was melted and then cooled, the coating was pealed from the substrate, and a sample was produced. Thus, a sheet having a thickness of 100 μm was produced, and thermal diffusivity was measured according to a laser flash method. Then, together with volume specific heat measured separately, thermal conductivity was calculated. Further, with the use of a high resistance meter 'Hiresta' made by Mitsubishi-Yuka Co., Ltd., surface resistance with application of 10 V was measured. In Table 51 below, a relationship between a volume ratio of (Ni+silicon carbide+bismuth) fixed PFA powder:PFA powder, a multiplying factor of thermal conductivity and surface resistance, is shown. There, the volume ratio is one obtained from a weight ratio and a specific gravity, and does not mean a volume ratio in powder. The multiplying factor of thermal conductivity is one obtained from thermal conductivity obtained from the above-mentioned measurement and calculation being divided by the thermal conductivity of PFA, and shows a multiple of thermal conductivity with respect to the thermal conductivity of PFA.

Further, as a comparison example, Ni powder (average particle diameter: 0.5 μm) and silicon carbide (average particle diameter: 0.5 μm) were mixed with PFA powder (MP102 (made by DuPont-Mitsui Fluorochemicals Co., Ltd), average particle diameter: 20 μm) in such amounts that Ni amounts to 2.5% and selection carbide amounts to 2.5% in reduced volume with the use of a stirring apparatus KK-500 made by Kurabo Industries Ltd., it was burned in the same way, and a sheet was produced. The reason why Ni (average particle diameter 0.5 μm) amounts to 2.5% and silicon carbide (average particle diameter 0.5 μm) amounts to 2.5% is that, in an electrostatic coating, a film forming cannot be carried out more than it.

TABLE 51

| (Ni + SILICON CARBIDE + BISMUTH) FIXED PFA POWDER:PFA POWDER (VOLUME RATIO) | MULTIPLYING FACTOR OF THERMAL CONDUCTIVITY |
|---|---|
| 1:9 | 2.05 |
| 2:8 | 3.01 |
| 4:6 | 10.59 |
| 5:5 | 11.38 |
| 6:4 | 13.42 |
| 2.5% Ni + 2.5% SILICON CARBIDE MIXTURE - PFA FILM FOR COMPARISON | 2.30 |

Embodiment 10-4

The same as the embodiment 10-3, as a component of the surface layer, Ni powder (average particle diameter: 0.5 μm) and silicon carbide (average particle diameter: 0.5 μm) and bismuth powder (average particle diameter: 0.8 μm) were mixed into PFA powder (MP102 (made by DuPont-Mitsui Fluorochemicals Co., Ltd.), average particle diameter ϕ 20 μm) in amounts such that Ni amounts to 2%, silicon carbide amounts to 2.5% and bismuth amounts to 0.5% in reduced volume, and (Ni+silicon carbide+bismuth) fixed PFA powder was produced. This powder was mixed with PFA powder (MP102 (DuPont-Mitsui Fluorochemicals Co., Ltd.), average particle diameter ϕ 20 μm) in a volume ratio shown in Table 52 and Table 53 below, coating was carried out on an aluminum tube to be the core metal of the fixing roller in an electrostatic manner, the coated resin was melted at 380° C. and then cooled, grinding was carried out by means of corundum particles, surface roughness made equal to or less than 2 μm in Rz was produced, and thus, the fixing roller was produced. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface was observed. As a result, no particularly large adhesion was observed, and nothing other than ordinary one occurred. Further, when cold offset temperature and hot offset temperature, i.e., a range in which toner can be fixed were obtained, it was seen that the cold offset temperature lowered and a fixing temperature range was widened. Thereby, it is seen that, even when temperature lowering occurs upon high speed paper passage, stable fixing can be carried out. Carbon 3% included PFA in Table 52 is a conventional one for comparison. Further, as a comparison example, Ni powder (average particle diameter: 1.2 μm), Ni powder (average particle diameter: 0.5 μm) and silicon carbide (average particle diameter: 0.5 μm) were mixed with PFA powder (MP102 (made by DuPont-Mitsui Fluorochemicals Co., Ltd.), average particle diameter ϕ 20 μm) in such amounts that Ni amounts to 2.5% and silicon carbide amounts to 2.5% in reduced volume with the use of a stirring apparatus KK-500 made by Kurabo Industries Ltd., and the fixing roller was provided similarly. At the same time, a sample was produced on a flat plate from the same material, and water contact angle was measured.

TABLE 52

| COMPARISON EXAMPLE BY (Ni + SILICON CARBIDE + BISMUTH) PFA POWDER:PFA POWDER (VOLUME RATIO) | | |
|---|---|---|
| (Ni + SILICON CARBIDE + BISMUTH) PFA POWDER:PFA POWDER (VOLUME RATIO) | COLD OFFSET TEMPERATURE | HOT OFFSET TEMPERATURE |
| 1:9 | 130° C. | EQUAL TO OR HIGHER THAN 250° C. |
| 2:8 | 130° C. | EQUAL TO OR HIGHER THAN 250° C. |
| 4:6 | 130° C. | EQUAL TO OR HIGHER THAN 250° C. |
| 5:5 | 125° C. | EQUAL TO OR HIGHER THAN 250° C. |
| 6:4 | 115° C. | EQUAL TO OR HIGHER THAN 250° C. |
| 10:0 | 105° C. | EQUAL TO OR HIGHER THAN 250° C. |
| CARBON 3% INCLUDED PFA FOR COMPARISON | 130° C. | EQUAL TO OR HIGHER THAN 250° C. |
| 5% Ni - PFA FILM FOR COMPARISON | 130° C. | 165° C. |

TABLE 53

| (Ni + SILICON CARBIDE + BISMUTH) FIXED PFA POWDER:PFA POWDER (VOLUME RATIO) | WATER CONTACT ANGLE |
|---|---|
| 1:9 | 108° |
| 2:8 | 108° |
| 4:6 | 107° |
| 5:5 | 106° |
| 6:4 | 98° |
| 10:0 | 82° |

Embodiment 10-5

As a component of the surface layer, into wet fluorine coating (EN700CL) made by DuPont Co., Ltd., with respect to dry PFA weight, silver powder (average particle diameter: 0.5 μm) in a volume ratio of 2%, alumina (average particle diameter: 0.5 μm) in a volume ratio of 2.5% and bismuth powder (average particle diameter: 0.8 μm) in a volume ratio of 0.5% were mixed, stirring and dispersion were carried out thereon, then spray coating was carried out on an aluminum tube to be a core metal of a fixing roller, the coated resin was melted at 380° C. and then cooled, after that grinding was carried out, and the fixing roller was obtained. A final thickness of the surface layer was 40 μm. This roller was loaded in a fixing part of an image forming apparatus MF4570 of Ricoh Co., Ltd., and a non-fixed toner image produced with the use of an image forming part having a configuration the same as that shown in FIG. 23 was fixed through a test machine (fixing device) having a configuration as shown in FIG. 24. 10000 sheets of black solid images were passed, and toner adhesion state on the roller surface was observed. As a result, no particularly large adhesion was observed, and nothing other than ordinary one occurred.

Embodiment 11

Next, embodiments of the heating member (fixing member) 11B applied in the fixing device (heating device) 6B in the electromagnetic induction heating type configured as shown in FIG. 25 are described.

Embodiment 11-1

As an electrically conductive layer component material, Ni powder (average particle diameter 2.5 μm, apparent density 0.8 g/cm$^2$) 10 wt % and Sn powder (average particle diameter 15.8 μm, apparent density 0.7 g/cm$^2$) 2 wt %, in reduced weight, were mixed into liquid crystal high polymer (LCP). Next, heating and mixing were carried out, cooling was carried out, after that re-powdering was carried out again, and thus, powder in average particle diameter 12 μm was obtained. This metal included LCP powder and PFA powder were mixed, compression in ordinary pressure was carried out, after that a state of a thickness on the order of 2 mm was obtained. Burning at 380° C. was carried out, resin was melted and then cooled, and thus, a sample was produced. A mixture weight ratio between the metal included LCP powder and PFA powder was 2:8. The surface layer (electrically conductive layer) was made by the metal included LCP powder and PFA powder. Further, thereover, a thermal conductive layer was produced the same as in the embodiment 8-1 in a volume ratio of (Ni+silicon carbide) fixed PFA powder:PFA powder=5:5. The LCP part mutually contacts successively, and, when the sample was subject to an electromagnetic induction heating test in a state in which it was placed on an electromagnetic range for cooking, it generated heat satisfactorily on the electromagnetic range.

Embodiment 11-2

Figure 41:
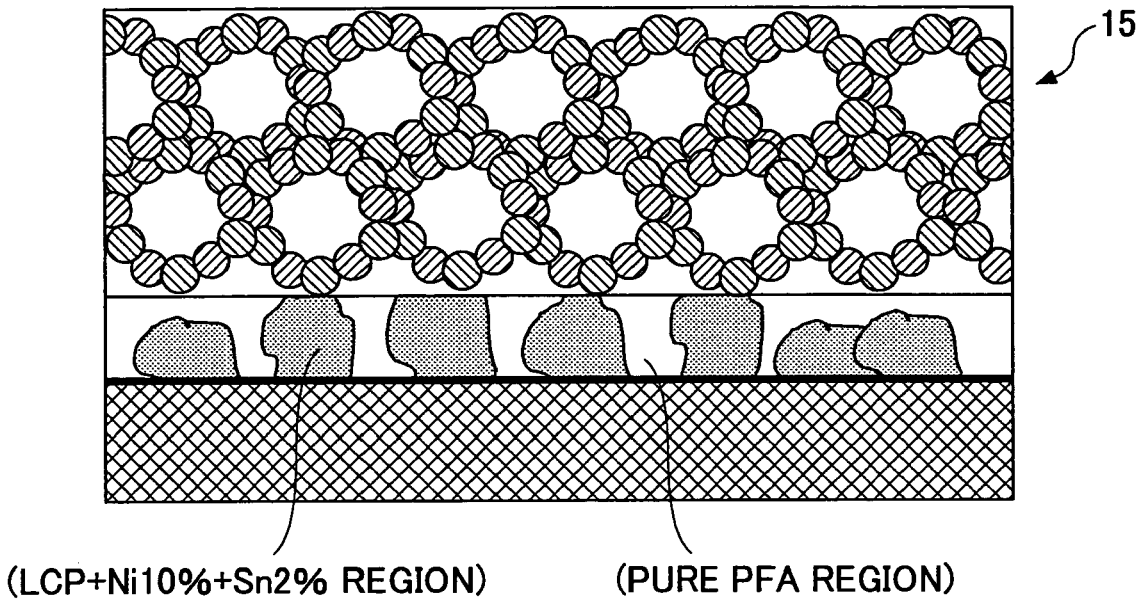
FIG. 41 is a sectional view of an electrically conductive layer.

The same as the embodiment 11-1, as a component material of the electrically conductive layer, Ni powder (average particle diameter 2.5 μm, apparent density 0.8 g/cm$^2$) 10 wt % and Sn powder (average particle diameter 15.8 μm, apparent density 0.7 g/cm$^2$) 2 wt %, in reduced weight, were mixed into LCP. Next, heating and mixing were carried out, cooling was carried, after that re-powdering was carried out, and thus, powder in average particle diameter 12 μm was obtained. This metal included LCP powder and PFA powder were mixed, electrostatically coating was made on an aluminum tube to be a core metal of the fixing roller with this mixed powder. Further, thereover, mixing was made the same as in the embodiment 8-2 in a volume ratio of (Ni+silicon carbide) fixed PFA powder:PFA powder=5:5 and this was electrostatically coated on the aluminum tube to be the core metal (base material) 17 of the fixing roller, the coated resin was melted at 380° C. and then cooled, after that grinding was carried out, and the fixing roller was obtained. A final thickness of the surface layer was 100 μm. This was ground by means of corundum particles having different particle diameters, and one having surface roughness of the surface layer equal to or less than 2 μm in ten point average roughness (Rz) was produced. FIG. 41 shows a surface of this electrically conductive layer. The metal included LCP adhered to the aluminum base material, and, PFA was placed thereon to contact there.

Figure 23:
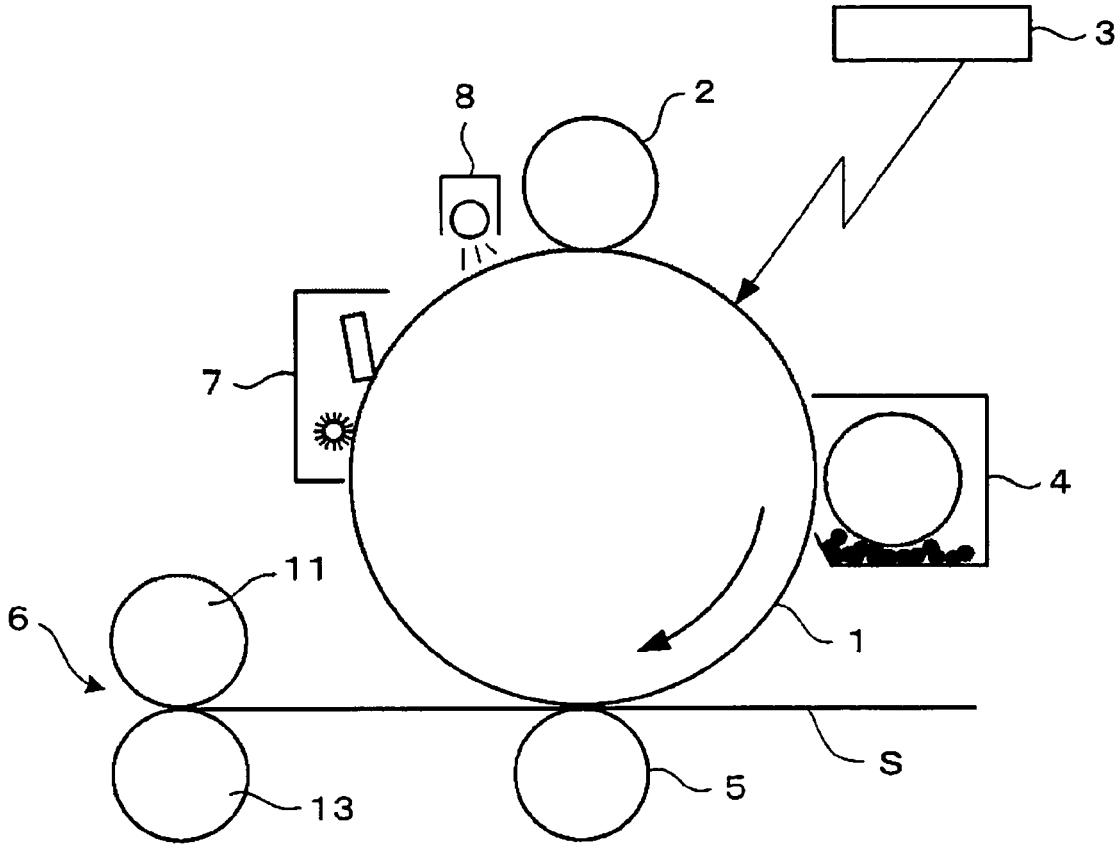
FIG. 23 is a general configuration diagram of an image forming apparatus showing one execution mode according to embodiments 8 through 13 of the present invention.

This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 11-3

Figure 42:
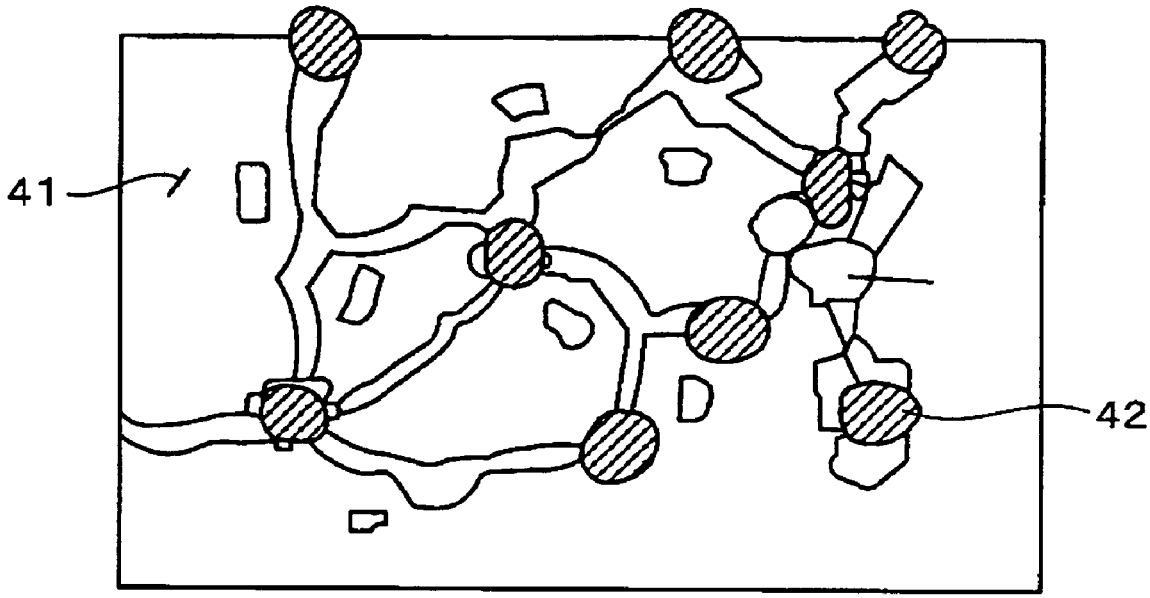
FIG. 42 is a diagram of schematically showing a section of a component of the electrically conductive layer shown in embodiment 11 after burning.

As a component material of electrically conductive layer, into wet fluorine coating (EN700CL) made by DuPont Co., Ltd., with respect to dry PFA weight, Ni powder (average particle diameter: 2.5 μm, apparent density 0.8 g/cm$^2$) 10 wt % and Sn powder (average particle diameter: 15.8 μm, apparent density 0.7 g/cm$^2$) 2 wt % were mixed, stirring was carried out to produce coating liquid, after that spray coating was carried out on an aluminum tube to be a core metal of a fixing roller. Further, silver powder (average particle diameter: 0.5 μm) in a volume ratio of 2%, alumina (average particle diameter: 0.5 μm) in a volume ratio of 3% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm), in reduced volume, the same as in the embodiment 8-5, this was input to hybridization system made by Nara Machinery Co., Ltd. configured as shown in FIG. 30, (silver+alumina+Sn) powder was fixed on PFA powder. Further, into wet fluorine coating (EN700CL) made by DuPont Co., Ltd., with respect to dry PFA weight, the thus-produced powder in which (silver+alumina+Sn) powder was thus fixed to PFA powder was mixed in a volume ratio of 50:50 calculated from specific gravities, and stirring and dispersion were carried out. Then, spray coating was carried out therewith further on the above-mentioned aluminum tube over the coating, the coated resin was melted at 380° C. and then cooled, after that grinding was carried out, and the fixing roller was obtained. A final thickness of the surface layer (electrically conductive layer) was 100 μm. This roller was ground with corundum particles having different particle diameters, and thus, one having surface roughness equal to or less than 2 μm in ten point average roughness (Rz) was produced. FIG. 42 shows a schematically view of this material after undergoing burning. In this material, fillers Ni are bonded by low-melting-point metal Sn-3.5 Ag, or Sn, and thus, a metal successively contacting part 42 is produced. Thereby, electrical conductivity can be ensured with a small amount of fillers.

This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 11-4

As a component material of electrically conductive layer), PFA powder (average particle diameter 40 μm) made by DuPont Co., Ltd., Ni powder (average particle diameter: 2.5 μm, apparent density 0.8 g/cm$^2$) and tin-3.5 silver powder (average particle diameter: 10.5 μm, apparent density 0.8 g/cm$^2$) were input to a mechanical fusion system AMS made by Hosokawa Co., Ltd., and thus one in which powder of Ni and tin-3.5 silver adhered to PFA powder was obtained. Ni amounted to 10 wt %, and tin-3.5 silver amounted to 3 wt %. This was coated to an aluminum tube to be a core metal of a fixing roller. Further, thereover, mixing was made the same as in the embodiment 8-2 in a volume ratio of (Ni+silicon carbide) fixed PFA powder:PFA powder=5:5, this was electrostatically coated further on the aluminum tube to be the core metal (base material) 17 of the fixing roller over the coating, the coated resin was melted at 380° C. and then cooled, after that grinding was carried out, and thus, the fixing roller was obtained. A final thickness of the surface layer (electrically conductive layer) was 100 μm. This roller was ground with corundum particles having different particle diameters, and thus, one having surface roughness on the surface equal to or less than 2 μm in ten point average roughness (Rz) was produced.

This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 12

Next, embodiments of a heating member (fixing member) having the surface layer 15 configured as shown in FIGS. 28 and 29, applied in a fixing device (heating device) in an electromagnetic induction heating type configured as shown in any one of FIGS. 25 through 27 are described.

Embodiment 12-1

As a component material of electrically conductive layer, Ni powder (average particle diameter 0.3 μm) and Sn powder (average particle diameter 2.4 μm) were mixed into PFA powder (MP102 (made by DuPont-Mitsui Fluorochemicals Co., Ltd.), average particle diameter ϕ 20 μm), to amounts of 10 vol % of Ni and 2 vol % of Sn in reduced volume, the thus-obtained one was input to a hybridization system configured as shown in FIG. 30 made by Nara Machinery Co., Ltd., and thus, Ni powder and Sn powder were fixed to PFA powder (this is referred to as powder 1). A state in which the metal powder almost covered the PFA powder was confirmed from observation by means of SEM. This powder 1 was coated on an aluminum substrate in an electrostatic manner. Further, thereover, mixing was made the same as in the embodiment 8-2 in a volume ratio of (Ni+silicon carbide) fixed PFA powder:PFA powder=5:5, this was electrostatically coated, burning was carried out at 380° C., resin was melted and then cooled, the coating was pealed from the substrate, and a sample was produced. From this sample, a sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on an general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, difference from the sample was compared. Specifically, a time required for raising from a room temperature for +30° C. was compared. As a result, in the configuration of the present embodiment, heating was achieved by a time which is 1.2 times a time required for heating the Ni foil of the thickness of 30 μm. That is, as a result of Ni and Sn being mixed into PFA and being made to contact successively, heat generating performance equivalent to a sole metal could be obtained with maintaining releasability.

Embodiment 12-2

The surface layer the same as the embodiment 12-1 was formed on a core metal (base material) of the fixing roller, after that grinding was carried out, and the fixing roller was obtained. A final thickness of the surface layer was 100 μm. This was ground by means of corundum particles having different particle diameters, and one having surface roughness of the surface layer equal to or less than 2 μm in ten point average roughness (Rz) was produced. A state of a surface at this time is such as that shown in FIG. 28. Since the PFA was transparent, all could be seen when viewed from the top. FIG. 29 shows a sectional view of the surface layer. This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. Toner of this MF4570 was one including wax. When the toner from which the wax was removed was produced, a non-fixed image was produced by cascade development, and it was passed through the testing machine, paper winding occurred due to toner adhesion for the first sheet.

The above-mentioned testing machine was applied, 10000 black solid images were passed with ordinary toner including wax, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 5 seconds were required (a rated output was 800 W for both cases).

Embodiment 12-3

As a component of electrically conductive layer, into wet fluorine coating (EN700CL) made by DuPont Co., Ltd., with respect to dry PFA weight, Ni powder (average particle diameter: 2.5 μm, apparent density 0.8 g/cm$^2$) 10 wt % and Sn powder (average particle diameter: 15.8 μm, apparent density 0.7 g/cm$^2$) 2 wt % were mixed, stirring was carried out, after that spray coating was carried out on an aluminum tube to be a core metal of a fixing roller. Further, as the same as the embodiment 8-5, silver powder (average particle diameter: 0.5 μm) in a volume ratio of 2%, alumina (average particle diameter: 0.5 μm) in a volume ratio of 3% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm) in reduced volume, this was input to hybridization system made by Nara Machinery Co., Ltd. configured as shown in FIG. 30, (silver+alumina+Sn) powder was fixed on PFA powder. Further, into wet fluorine coating (EN700CL) made by DuPont Co., Ltd., with respect to dry PFA weight, the thus-produced powder in which (silver+alumina+Sn) powder was thus fixed to PFA powder was mixed in a volume ratio of 50:50 calculated from specific gravities, and stirring and dispersion were carried out. Then, spray coating therewith was carried out further on the above-mentioned aluminum tube to be the core metal (base material) of the fixing roller over the coating, the coated resin was melted at 380° C. and then cooled, after that grinding was carried out, and the fixing roller was obtained. A final thickness of the surface layer was 100 μm. This roller was ground with corundum particles having different particle diameters, and thus, one having surface roughness equal to or less than 2 μm in Rz was produced. A sectional structure of this material after burning is the same as that of FIG. 29. This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 10 seconds were required (a rated output was 800 W for both cases).

Embodiment 12-4

As a component material of electrically conductive layer, Ag powder (average particle diameter 0.3 μm) was mixed into PFA powder (MP102 (made by DuPont-Mitsui Fluorochemicals Co., Ltd.), average particle diameter ϕ 20 μm), to an amount of 10% in reduced volume, the thus-obtained one was input to a hybridization system configured as shown in FIG. 30 made by Nara Machinery Co., Ltd., and thus, Ag powder was fixed to PFA powder (this is referred to as powder 2). A state in which the metal powder almost covered the PFA powder was confirmed from observation by means of SEM. This powder 2 was coated on an aluminum substrate in an electrostatic manner. Further, silver powder (average particle diameter: 0.5 μm) and alumina (average particle diameter: 0.5 μm) were mixed into PFA powder (MP102 (made by DuPont-Mitsui Fluorochemicals Co., Ltd.), average particle diameterϕ: 20 μm) to amount to 5% of silver and 5% of alumina in reduced volume the same as in the embodiment 8-4, this was input to hybridization system made by Nara Machinery Co., Ltd. configured as shown in FIG. 30, and (silver+alumina) powder was fixed on PFA powder. The thus-obtained powder was electrostatically coated further on the above-mentioned aluminum substrate over the coating, burning was carried out at 380° C., resin was melted and then cooled, the coating was pealed from the substrate, and a sample was produced. From this sample, a sheet with a thickness of 30 μm, and a size of 50 mm by 100 mm (70 μm of releasing layer and 30 μm of electrically conductive layer) was produced, was then fixed to an inside bottom surface of a dish made by Pyrex (registered trademark) by means of polyimide tape, after that pure water 100 ml was poured in the dish. This was placed on an general-purpose electromagnetic range (IH cooker: KZ-PH1 made by National (an empty pan detecting system was deactivated), electromagnetic wave was generated, and water temperature increase was measured. Further, a Ag foil having the same size as that of the above-mentioned sample sheet with a thickness of 30 μm was applied, measurement was carried out in the same conditions, and thus, sample difference was compared. Specifically, a time required for raising from a room temperature for +30° C. was compared. As a result, in the configuration of the present embodiment, heating was achieved by a time which is 1.3 times a time required for heating the Ag foil of the thickness of 30 μm.

Embodiment 12-5

The surface layer of the embodiment 12-4 was formed on an aluminum tube to be a core metal of the fixing roller, after that grinding was carried out, and thus, the fixing roller was obtained. A final thickness of the surface layer was 100 μm. This was ground by means of corundum particles having different particle diameters, and one having surface roughness of the surface layer equal to or less than 2 μm in Rz was produced. A state of a surface at this time is such as that of the embodiment 12-2. This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. 10000 black solid images were passed, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 15 seconds were required (a rated output was 800 W for both cases).

Embodiment 12-6

As a component of the surface layer (electrically conductive layer), into wet fluorine coating (EN700CL) made by DuPont Co., Ltd., with respect to dry PFA weight, the powder (powder 2) in which Ag powder was fixed to PFA powder in the embodiment 12-4 was mixed by 70%, stirring was carried out, after that spray coating was carried out on an aluminum tube to be a core metal of a fixing roller. Further, silver powder (average particle diameter: 0.5 μm) in a volume ratio of 2%, alumina (average particle diameter: 0.5 μm) in a volume ratio of 3% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm) in reduced volume the same as in the embodiment 8-5, this was input to hybridization system made by Nara Machinery Co., Ltd. configured as shown in FIG. 30, and (silver+alumina+Sn) powder was fixed on PFA powder. Further, into wet fluorine coating (EN700CL) made by DuPont Co., Ltd., with respect to dry PFA weight, the thus-produced powder in which (silver+alumina+Sn) powder was thus fixed to PFA powder was mixed in a volume ratio of 50:50 calculated from specific gravities, and stirring and dispersion were carried out. Then, this was coated further on the above-mentioned aluminum tube to be the core metal (base material) of the fixing roller in a spray manner over the coating, the coated resin was melted at 380° C. and then cooled, after that grinding was carried out, and the fixing roller was obtained. A final thickness of the surface layer (electrically conductive layer) was 100 μm. This roller was ground with corundum particles having different particle diameters, and thus, one having surface roughness equal to or less than 2 μm in Rz was produced. A sectional structure of this material after burning is the same as that of FIG. 29. This fixing roller was applied in a fixing device of an image forming apparatus MF4570 of Ricoh Co., Ltd., a non-fixed image produced by an image forming apparatus in a configuration the same as that shown in FIG. 23 was fixed, by means of an electromagnetic induction heating testing machine (fixing device) such as that configured as shown in FIG. 25. After fixing was repeated while 10000 black solid images were passed, a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 9 seconds were required (a rated output was 800 W for both cases).

Embodiment 12-7

As a component of the surface layer (electrically conductive layer), Ag powder (average particle diameter 0.3 μm) was mixed into PFA powder (in a low temperature burned type, average particle diameter ϕ 20 μm) to an amount of 10 vol % in reduced volume, this was then input to a hybridization system of Nara Machinery Co., Ltd. such as that shown in FIG. 30, and thus Ag powder was fixed to PFA powder (this is referred to as powder 3). With observation by means of SEM, a state was confirmed that the metal powder almost covered the PFA powder. Then, this powder 3 was electrostatically coated on a silicon rubber layer on an aluminum tube having the silicon rubber with a thickness of 300 μm. Further, silver powder (average particle diameter: 0.5 μm) and alumina (average particle diameter: 0.5 μm) were mixed into PFA powder (MP102 (made by DuPont-Mitsui Fluorochemicals Co., Ltd.), average particle diameterϕ: 20 μm) to amount to 5% of silver and 5% of alumina in reduced volume the same as in the embodiment 8-4, this was input to hybridization system made by Nara Machinery Co., Ltd. configured as shown in FIG. 30, and (silver+alumina) powder was fixed on PFA powder. This was electrostatically coated further on the above-mentioned aluminum tube over the coating, burning at 340° C. was carried out, after that cooling was carried out, and thus, the fixing roller was obtained. A thickness of the surface layer (PFA part) was 100 μm (70 μm of releasing layer and 30 μm of electrically conductive layer). This was ground by means of corundum particles having different particle diameters, and one having surface roughness of the surface layer equal to or less than 2 μm in Rz was produced. A state of a surface at this time is such as that shown in FIG. 28. A sectional view of the fixing roller is the same as that of 39, in which a heat insulating layer (or elastic layer) 18 made by silicon rubber is provided between the surface layer 15 and the core metal (base material) 17.

This fixing roller was applied in a fixing device of a commercially available color copier, a silicon oil less configuration was made, a non-fixed image produced by an image forming apparatus was fixed, by means of an electromagnetic induction heating testing machine (fixing device) such as that configured as shown in FIG. 25. 10000 color solid images were passed therethrough, and a toner adhesion state on the roller surface was observed. As a result, no particularly large toner adhesion was observed, and there was nothing different from an ordinary one. Further, the core metal (base material) applied this time was such that a thickness of the tube of the fixing roller was as thick as 1.5 mm, and thus, 50 seconds are required for the roller surface temperature to reach 180° C. by means of an ordinary internal heating by means of a halogen heater. However, with the fixing roller in electromagnetic induction heating type in the present embodiment, the order of 15 seconds were required (a rated output was 800 W for both cases). Further, according to the present embodiment, since the heat generating layer is provided on an outermost surface, a starting up time the same as that of a monochrome machine can be achieved.

Embodiment 12-8

As a component of the surface layer (electrically conductive layer), respective powders was produced in each of which, to tin 80-silver 20 low-melting-point alloy powder (average particle diameter 1.1 μm), metal powder (average particle diameter 1.5 μm) of each of gold, silver, copper, lead, nickel, zinc, iron, aluminum, magnesium and titanium was mixed in equal volume. The equal volume mixed powder was mixed into PFA powder (in a low-temperature burned type, average particle diameter ϕ 20 μm) to amount to 10% in reduced volume, this was input to a hybridization system of Nara Machinery Co., Ltd., and thus each equal volume mixed metal powder was fixed to the PFA powder (referred to as powder A). With observation by means of SEM, it was confirmed that each metal powder almost covered the PFA powder. After that, the same as the embodiment 12-7, the fixing roller was produced each. These fixing rollers were loaded in a testing machine (fixing device) for electromagnetic induction heating in a configuration such as that shown in FIG. 25, and heating test was carried out. As a result, a time required for a surface temperature to reach 180° C. for each included metal was 15±1 seconds for gold; 15±1 seconds for silver; 15±1 seconds for copper; 30±1 seconds for lead; 20±1 seconds for nickel; 25±1 seconds for zinc; 30±1 seconds for iron; 26±1 seconds for aluminum; 21±1 seconds for magnesium; and 23±1 seconds for titanium. For internal heating by a common halogen heater as a comparison example, 50 seconds were required for a surface temperature of a roller to reach 180° C.

Embodiment 12-9

As a component of the surface layer (electrically conductive layer), powder in which each metal powder (powder A) of the embodiment 12-8 almost covered PFA powder was mixed into wet fluorine coating (EN700CL) of DuPont Co., Ltd. to amount to 70% with respect to dry PFA weight, stirring was carried out, then spray coating thereof was carried out on an aluminum tube to be a core metal of a fixing roller, on which silicon rubber layer of 300 μm in thickness had been attached, in overlaying manner. Further, silver powder (average particle diameter: 0.5 μm) in a volume ratio of 2%, alumina (average particle diameter: 0.5 μm) in a volume ratio of 3% and Sn powder (average particle diameter: 15.8 μm) in a volume ratio of 2% were mixed into PFA powder (MP102 (made by DuPont-Mitsui Fluorochemicals Co., Ltd.), average particle diameterϕ: 12 μm) in reduced volume the same as in the embodiment 8-5, this was input to hybridization system made by Nara Machinery Co., Ltd. configured as shown in FIG. 30, (silver+alumina+Sn) powder was fixed on PFA powder. Further, into wet fluorine coating (EN700CL) made by DuPont Co., Ltd., with respect to dry PFA weight, the thus-produced powder in which (silver+alumina+Sn) powder was thus fixed to PFA powder was mixed in a volume ratio of 50:50 calculated from specific gravities, and stirring and dispersion were carried out. This was coated further on the above-mentioned aluminum tube over the coating in spray manner, this was burned at 340° C. to be melted and then cooled, and thus the fixing roller was produced. After that, the same as the embodiment 12-8, these fixing rollers were loaded in a testing machine (fixing device) for electromagnetic induction heating in a configuration such as that shown in FIG. 25, heating test was carried out, and thus, evaluation was carried out. As a result, a time required for a surface temperature to reach 180° C. for each included metal was 23±1 seconds for gold; 25±1 seconds for silver; 28±1 seconds for copper; 40±1 seconds for lead; 30±1 seconds for nickel; 35±1 seconds for zinc; 40±1 seconds for iron; 32±1 seconds for aluminum; 32±1 seconds for magnesium; and 34±1 seconds for titanium. For internal heating by a common halogen heater as a comparison example, 50 seconds were required for a surface temperature of a roller to reach 180° C.

Embodiment 12-10

In the above-mentioned embodiments 12-2 through 12-9, examples are shown, in which the fixing roller 11B according to the embodiment 12 was loaded in the fixing device 6B shown in FIG. 25, and testing was made. However, this can be applied in the same in the fixing device 6C shown in FIG. 26 in which the two sets of heating means 12 were produced. By applying the fixing rollers of the embodiment 12 as the two rollers of top and bottom, both sides of the recording paper S can be heated at the same time. Accordingly, in this configuration, heating can be efficiently made from both sides of the recording paper S, and also, non-fixed toner images attached to both sides of the recording paper can be fixed at the same time.

Embodiment 13

As shown in the embodiments 8 through 12 above, in the heating member (fixing member) according to the present invention, the surface layer is provided in which at least one type of thermal conducive metal material and at least one type of thermal conducive non-metal martial are mixed into the fluorocarbon resin having releasability, and, as the thermal conductive metal material and thermal conductive non-metal material contact successively, thermal conductively or resistance controllability can be improved while releasability is maintained. As the metal to be mixed into the fluorocarbon resin, a combination of metal (or alloy) which is good thermal or electrical conductor, and has a melting point higher than the fluorocarbon resin, and low-melting-point metal (or low-melting-point alloy), is preferable. Further, by applying fluorocarbon resin in which carbon family materiel is included, as the fluorocarbon resin, thermal conductivity or durability of the surface layer can be further improved.

Figure 43:
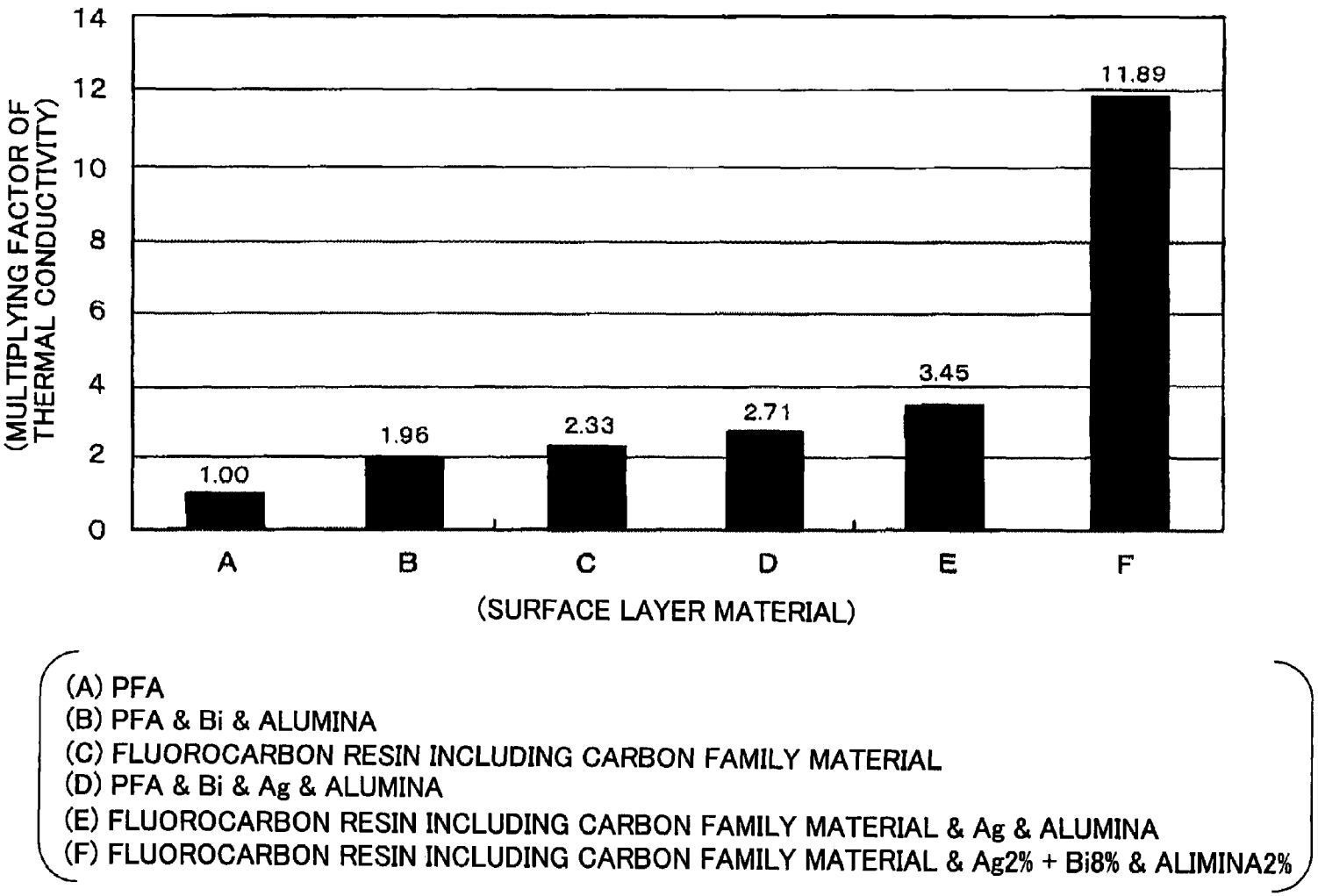
FIG. 43 is a diagram showing multiplying factor of thermal conductivity of material of a surface layer with respect to thermal conductivity of PFA.

In FIG. 43, for (A) thermal conductivity of PFA which is fluorocarbon resin, (B) one in which Bi which is low-melting-point metal and alumina is mixed in PFA; (C) fluorocarbon resin in which carbon family material is included; (D) one in which Bi, Ag and alumina are mixed into PFA; (E) one in which Ag and alumina is mixed into fluorocarbon resin in which carbon family material is included; and (F) one in which Ag 2%, Bi 8% and alumina 2% are mixed into fluorocarbon resin in which carbon family material is included, are produced, and thermal conductivities thereof are compared. Expression is made by multiplying factors with respect to thermal conductivity of PFA.

In FIG. 43, thermal conductivity is better 1.4 times in (D) in which Bi, Ag and alumina are mixed into PFA than that of (B) in which Bi and alumina are mixed into PFA. Thus, thermal conductivity can be improved by applying a combination of Ag (melting point 961.9° C.) having a melting point higher than that of PFA (310° C.) which is a good thermal or electrical conductor, alumina (melting point 2053° C.) and low-melting-point metal Bi (melting point 271° C.). This is because, it can be considered that, when a surface layer in which fluorocarbon resin and metal are fixed is burned, although only low-melting-point metal Bi is not easy to be wet and to spread to the fluorocarbon resin autonomously, a configuration in which, Ag and alumina having high meting points than that of PFA acts as a base point, and Bi connect them, is advantageous for heat (electricity) path production. That is, since low-melting-point metal such as Bi or such can connect between high-melting-point metal such as Ag, and alumina, it is possible to provide the surface layer having a superior heat (electricity) passing efficiency and thus, meeting the requirements.

Further, as is seen from FIG. 43, thermal conductivity can be further improved by applying fluorocarbon resin in which carbon family material is included. In particular, one in which a combination of Bi, Ag and alumina is mixed into fluorocarbon resin including carbon family materiel provided thermal conductivity 11.89 times that of PFA. Accordingly, in the above-described embodiments, by applying fluorocarbon resin including carbon family material as fluorocarbon resin forming the surface layer, thermal conductivity in the surface layer can be further improved.

As described above, in the heating member (fixing member) according to the eighth through thirteenth embodiments of the present invention, since the releasing layer acts as good thermal conductive layer, it is possible to reduce temperature lowering on the heating member (fixing member) surface occurring in the conventional fluorocarbon resin having low thermal conductivity. Thereby, when this is applied in a fixing device of an image forming apparatus, paper passing speed reduction which is carried out upon surface temperature lowering in a conventional image forming apparatus should not be carried out, when continuous paper passing is carried out. Thus, stable image forming is made possible. Further, improvement in thermal conductivity can also be evaluated from measurement of cold offset temperature indicating whether or not fixing of non-fixed image can be carried out even when temperature of the fixing member is lowered. According to the present invention, heating efficiency upon fixing can be improved, a fixing member by which productivity in image forming can be improved can be provided, and a fixing device employing it can be provided.

Further, in the heating member (fixing member) according to the first through seventh embodiments of the present invention, the releasing layer of the surface layer can also act as a heat generating layer (electrically conductive layer) of electromagnetic induction heating, and thus, a staring-up time upon heating can be remarkably reduced. Further, since silicon rubber layer or such commonly applied for improving image quality can be disposed to the rear side (on the side of the base material) than the heat generating layer, time lag for heating can be minimized. Further, fluorocarbon resin which is necessary for providing releasability results in degradation in heating efficiency since it has a low thermal conductivity, in a common configuration. However, according to the present invention, since the releasing layer also acts as heat generating layer (electrically conductive layer), electrical conductivity is provided to the surface layer without losing releasability, and this can be applied in electromagnetic induction heating. Thus, this configuration is vary advantageous. Accordingly, a heating device applying the heating member according to the present invention can be preferably applied in a fizzing device of an image forming apparatus such as a copier, a printer, a plotter, a facsimile or such, and an image forming apparatus having high reliability and high energy efficiency can be achieved.

Below, embodiments 14 through 22 are described.

Figure 44:
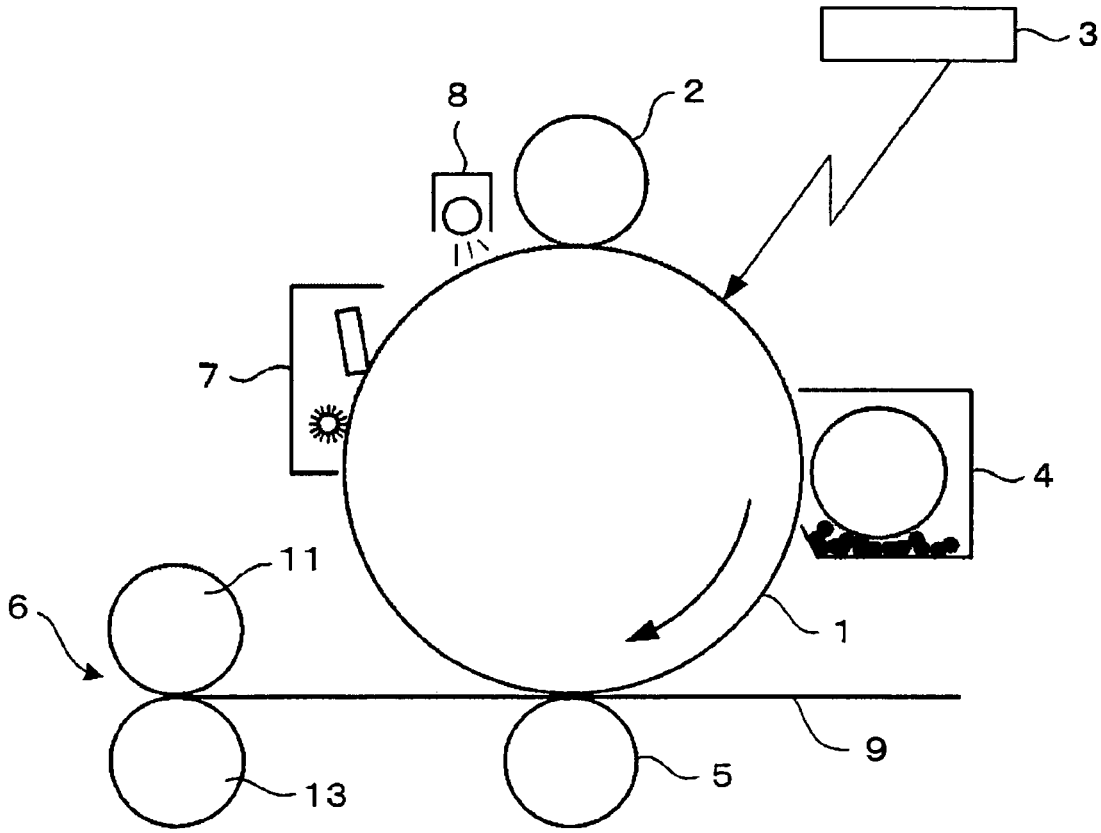
FIG. 44 is a diagram illustrating an image forming apparatus according to the present invention concerning embodiments 14 through 22

FIG. 44 shows one embodiment of an image forming apparatus according to the embodiments 14 through 22. The image forming apparatus obtains an image by carrying out well-known electrophotographic process, and has a photosensitive body 1 produced to have a cylindrical shape as an image carrying body. Around the photosensitive body 1, a charging roller 2 as charging means, a developing device 4, a transfer roller 5, a cleaning device 7 and an electricity removing device 8 are provided. Other than them, the image forming apparatus has an optical scanning device 3 and a fixing device 6. As the charging means, a corona charger may be used. The optical scanning device carries out exposure by optical scanning between the charging roller and the developing device.

When image forming is carried out, the photosensitive body 1 is rotated counterclockwise of FIG. 44, a surface thereof is uniformly charged by the charging roller 2, after that an electrostatic latent image is formed on the surface of the photosensitive body 1 by means of exposure of the optical scanning device 3. This electrostatic latent image is developed in an inverting manner by the developing device 4, and a toner image is formed on the surface of the photosensitive body 1. This toner image is overlaid by a recording medium overlaid therewith which is fed from a not-shown paper feeding device to a transfer part in timing in which the toner image on the photosensitive body 1 moves to the transfer position. By a function of the transfer roller 5, the toner image is transferred to the recording medium. The recording medium on which the toner image is thus transferred has then the toner image fixed by the fixing device 6, after that the recording medium is ejected to the outside of the apparatus. After the toner image is thus transferred, residual toner or paper dust on the surface of the photosensitive body 1 is cleaned by the cleaning device 7, and after that, electricity on the photosensitive body 1 is removed by the electricity removing device 8.

Figure 45:
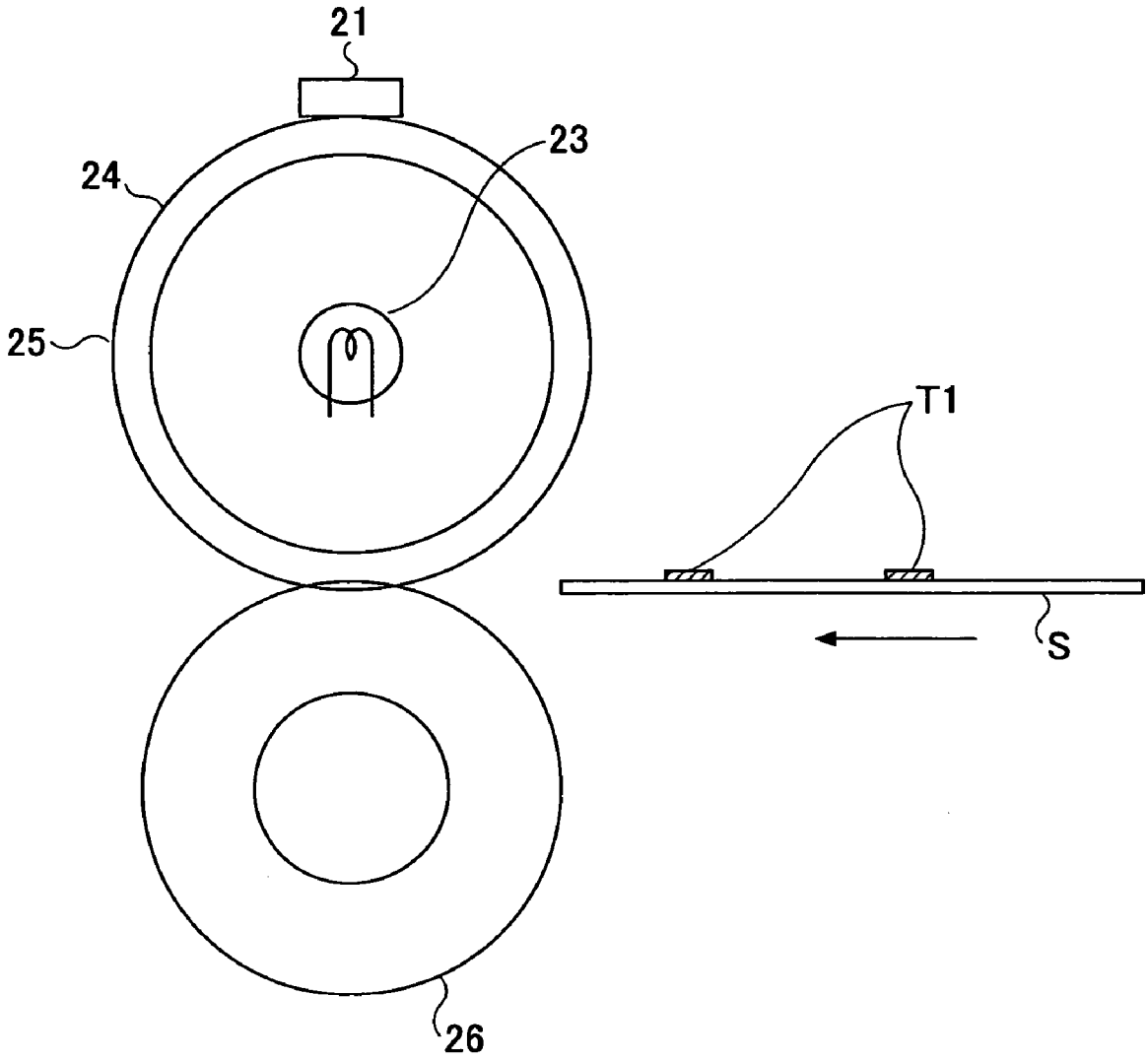
FIG. 45 shows an outline of fixing part shown in FIG. 44.
Figure 46:
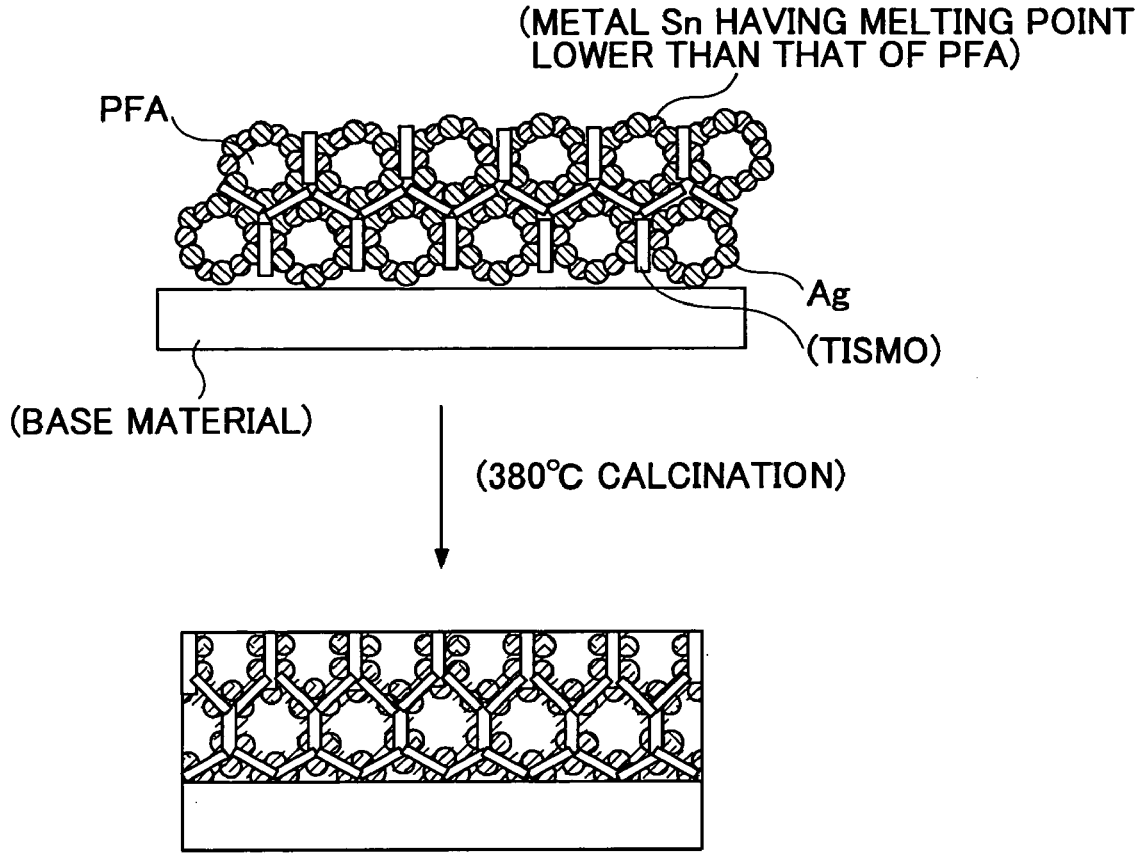
FIG. 46 illustrates a surface layer of a fixing roller shown in FIG. 45.

FIG. 45 shows a general view of a fixing part. 21 denote a temperature detecting device, TI denotes a non-fixed toner image, S denotes a recording sheet. 23 denotes a halogen heater, 24 denotes a fixing roller, 25 denotes a surface layer of the fixing roller 24, and 26 denotes a pressing roller. The fixing device is shown. The fixing roller 24 contacting the pressing roller in a pressing manner is rotated clockwise, and thus, the recording sheet S having the toner image TI to be fixed is conveyed therewith therebetween in a sandwiched and pressed manner in a direction of an arrow. The halogen heater 23 heats from the inside of the fixing roller. A surface temperature of the fixing roller 24 is detected by the temperature detector 21. The surface layer 25 according to the present invention is produced on a surface of the fixing roller 24. The present invention concerning the embodiments 14 through 22 mainly relates to the surface layer 25. FIG. 46 shows a configuration example of the surface layer 25 of the fixing roller 24 according to the embodiments 14 through 22. FIG. 46 shows a sectional view of a part of the surface layer 25. Fluorocarbon resin occupies a wide area, and ensure releasability. A thermal conductor successively contacting part almost contact, and thus, contribute to thermal conductivity greatly. Successively contacting means a state in which more than three thermal conductor particles contact. The successively contacting part continues from the surface to a substrate, and contributes to improvement of thermal conductivity.

According to the present invention concerning the embodiments 14 through 22, a good thermal conductor includes at least one type of good thermal conductor having melting point lower than that of fluorocarbon resin, includes at least one type of good thermal conductor having a melting point higher than that of the fluorocarbon resin and having shape anisotropy, and the thermal good conductor having shape anisotropy is surrounded by the good thermal conductor having the melting point lower than the fluorocarbon resin. Thereby, upon production of the surface layer, th good thermal conductor having the low melting point (for example, low melting point metal Bi, Sn or such) covers or adheres to the good thermal conductor having shape anisotropy, thus diffusion is controlled, and production of thermal conductive path by means of the low melting point good thermal conductor is accelerated. Thereby, thermal conductivity can be sufficiently improved.

Good thermal conductor having shape anisotropy according to the present invention concerning the embodiments 14 through 22 means good thermal conductor having an aspect ratio (average major axis/average minor axis) is equal to or more than 10, and the average major axis is equal to or less than a thickness of the surface layer.

In contrast thereto, for a case where only granular good thermal conductor having no shape anisotropy contacts successively, even when the good thermal conductor contacts successively and surrounds a fluorocarbon resin particle, successive contacting is disturbed upon production of the surface layer since melting and flowing of the fluorocarbon resin should be carried out to produce the surface layer having no pin-holes. Thereby, even thermal conductivity improves, movement of thermal conductivity may become insufficient depending on the degree of disturbance. The same condition also occurs for a case where granular low melting point good thermal conductor is applied as a part or all of the good thermal conductor.

It is noted that, from among good thermal conductors mainly described for the present invention concerning the embodiments 14 through 22, metal particles do not provide electrical conductivity unless it positively contact, different from carbon particles or such. Further, contribution to thermal conductivity cannot substantially be achieved unless a plurality thereof contact. This is the reason why a state of successively contacting is referred to as successive contacting. See Mounting Technology for Electrically Conductive Resin, CMC Co., Ltd., page 46 (2000).

As the fluorocarbon resin of the releasing layer, any one may be applied as long as it includes fluorocarbon atoms in molecules, and it is not particularly limited.

Specifically, polytetrafluoroethylene (PTFE) and modification thereof, tetrafluoroethylene-perfluoroalkylvinylether copolymer (PFA), tetrafluoroethylene-ethylene copolymer (ETFE), tetrafluoroethylene-hexafluoropropylene copolymer (FEP), tetrafluoroethylene-vinyliden-fluoride copolymer (TFE/VdF), tetrafluoroethyrene-hexafluororopropylene-perfluoroalkylvilylether copolymer (EPA), polychlorotrifluoroethylene (PCTFE), chlorotrifluoroethylene-ethylene copolymer (ECTFE), chlorotrifluoroethylene-vinyliden-fluoride copolymer (CTFE/VdF), poly-vinyliden-fluoride (PVdF), poly-vinyl-fluoride (PVF), or such may be cited.

For example, as polytetrafluoroethylene (PTFE) powder, Teflon (registered trademark) 7A-J, 70-J (made by DuPont-Mitsui Fluorochemicals Co., Ltd.) is known. As tetrafluoroethylene-hexafluoropropylene copolymer (FEP) powder, 532-8000 (made by DuPont Co., Ltd.) is known. As tetrafluoroethylene-perfluoroalkylvinylether copolymer (PFA), MP-10, MP102, MP103, MP300 or such (made by DuPont-Mitsui Fluorochemicals Co., Ltd.) is known.

Further, in order to give abrasion proof characteristics, carbon black or graphite may be previously filled with in fluorocarbon resin.

As the good thermal conductor, metal, ceramic or such may be applied. These may be applied also in a combined manner.

As the metal filler, for example, filler of alloy including at least any one of gold, silver, copper, lead, nickel, zinc, iron, aluminum, magnesium and titanium.

As the ceramic filler, for example, silica, alumina, titanium oxide, boron nitride, magnesia, aluminum nitride, silicon carbide, boron carbide, titanium carbide or such may be applied.

As the good thermal conductor having a melting point lower than fluorocarbon resin, a low melting point alloy may be cited, and as the low melting point alloy, for example, a metal alloy of any one of (1) tin-silver family, (2) tin-copper family, (3) tin-zinc family, (4) tin-silver-copper family, (5) tin-silver-bismuth family, (6) tin-silver-copper-bismuth family, (7) tin family, (8) tin, (9) bismuth family, (10) bismuth and (11) silver-bismuth family may be provided. As metal particles or metal fillers, particles or filters of metal or alloy including at least any one of gold (Au), silver (Ag), copper (cu), lead (Pb), nickel (Ni), zinc (Zn), iron (Fe), aluminum (Al), magnesium (Mg), titanium (Ti), tin (Sn) and bismuth (Bi), or such, may be applied.

As the good thermal conductor having shape anisotropy in the present invention concerning the embodiments 14 through 22, good thermal conductor having an aspect ratio (average major axis/average minor axis) equal to or more than 10, and having a major axis equal to or less than a thickness of the surface layer is applied. As the good thermal conductor having shape anisotropy according to the present invention, for example, well-known ones, such as, one shaped like plates or scales: mica, talc, glass flake, metal flake, or such; one shaped like fibers: glass fiber, carbon fiber, boron fiber, metal fiber, ceramic fiber; acicular shape one: metal whisker, ceramic whisker; three-dimensionally radial one: zinc oxide whisker shaped like tetrapod, or such, may be applied. Other good thermal conductor having shape anisotropy may be applied appropriately. These may be used solely in a single type or in a combination together.

A method of manufacturing a complex powder including fluorocarbon resin and good thermal conductor applied for producing the surface layer is described next. Specifically, the following method may be applied.

Figure 47:
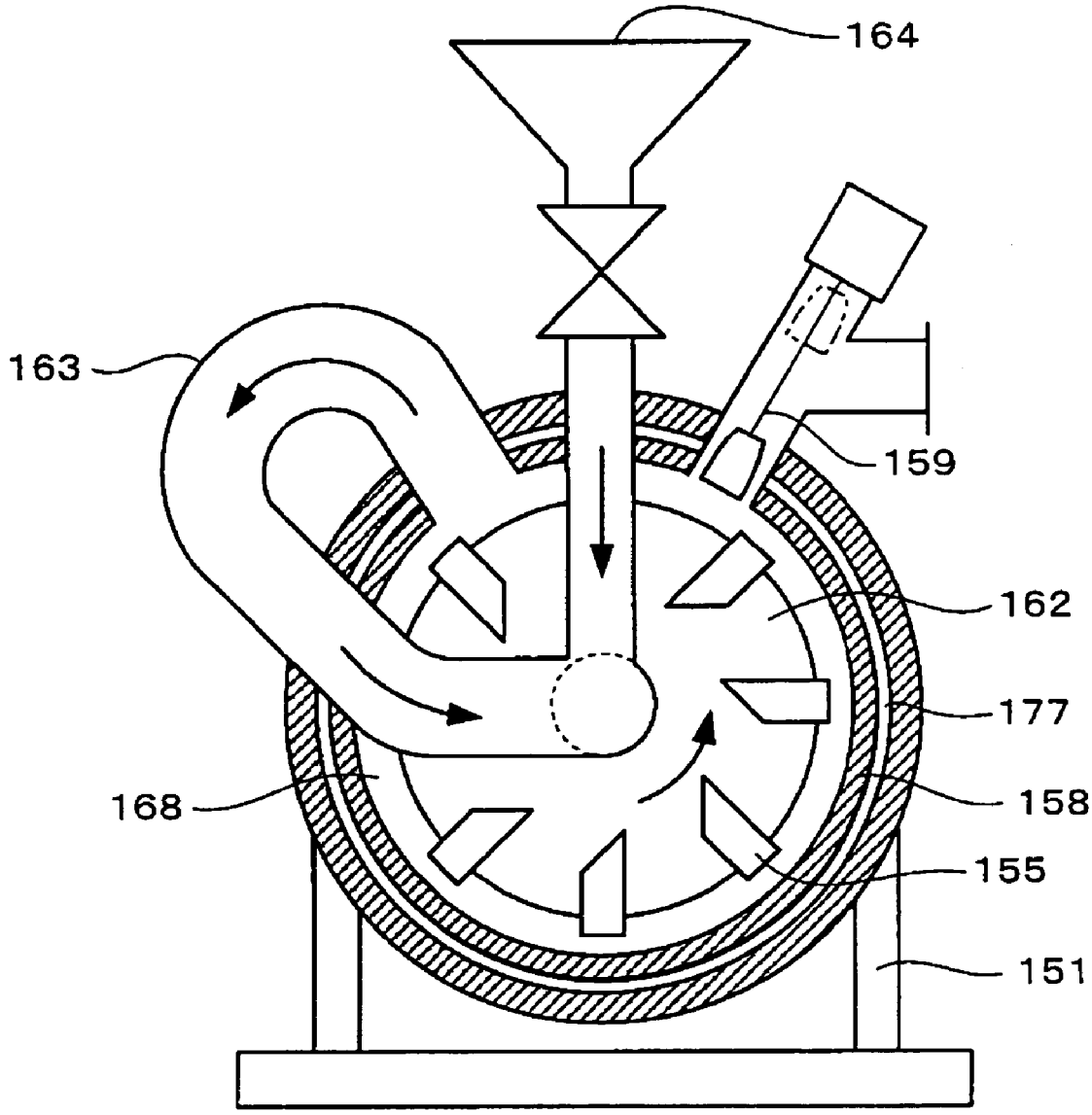
FIG. 47 is a general configuration diagram of a hybridization system.

On the periphery of a fluorocarbon resin particle, low melting point good thermal conductor particles having a melting point lower than that of the fluorocarbon resin and more minimal than the fluorocarbon resin particle are fixed. As an apparatus for fixing, a hybridization system (Nara Machinery Co., Ltd.) is shown in FIG. 47. 151 denotes a body casing, 158 denotes a stator, 177 denotes a stator jacket, 163 denotes a recycle valve, 159 denotes an ejection valve, and 164 denotes a row material input shooter.

In this apparatus, good thermal conductor particles including fluorocarbon resin particles and metal powders having a melting point lower than the fluorocarbon resin provided from the row material input shoot 164 are subject to instantaneous impact action manly by a plurality of rotor blades 155 disposed in a rotation rotor 162 rotating at a high speed in an impact chamber 168, further scatter in the system with breakage of mutual aggregation of fluorocarbon resin particles or good thermal conductor particles including metal powders having a melting point lower than the fluorocarbon resin as a result of being hit by the peripheral stator 158, and simultaneously, the good thermal conductor particles including metal powders having a melting point lower than the fluorocarbon resin are fixed to surfaces of the fluorocarbon resin particles by electrostatic force, Van der Waals force or such, or, for a case of only the fluorocarbon resin particles, chamfering or conglobating of particles is carried out. This state progresses along with flying and impact of the particles. That is, along with an air flow generated by rotation of the rotor blades 155, the particles are treated as a result of passing through the recycle pipe 163 several times. Further, as a result of the particles being repeatedly subject to impact action from the rotor blades 155 and stator 158, the good thermal conductor particles including metal powders having a melting point lower than the fluorocarbon resin are made to scatter and fixed uniformly on the surfaces or in the vicinity of the fluorocarbon resin particles.

After that, simple mixing is carried out between good thermal conductor having a melting point higher than that of the fluorocarbon resin and having shape anisotropy and the thus-produced powder For a case where good thermal conductor having shape anisotropy is metal, or the good thermal conductor is other than metal, when a surface of good thermal conductor having shape anisotropy is coated by metal, it becomes easier to cause the metal having a melting point lower than that of fluorocarbon resin to surround it.

As the good thermal conductor coated by metal, as commercially available one, there is 'Super Dentall SD-100' (made by Otsuka Chemical Co., Ltd., silver coated electrically conductive potassium titanate fiber) or such.

Further, for example, it can be produced by well-known elecroless plating method as shown below. For example, for a case where Ni plating is carried out on tetrapod like zinc oxide whisker, a Pd layer is formed on the zinc oxide whisker as a result of the zinc oxide whisker being immersed in palladium chloride zinc acetate solution, and further, Ni plating layer is produced as a result of elecroless plating method being applied. As the tetrapod like zinc oxide whisker, Panatetra (made by Matsushita Electric Industries Co., Ltd.) may be applied. As the elecroless plating liquid, Top-chemi-alloy 66 (pH 6.5) (made by Okuno Chemical Industries Co., Ltd.) or such may be applied.

Further, for example, for a case where copper plating is carried out on tetrapod like zinc oxide whisker, catalyst producing process is carried out as a pre-processing for improving elecroless copper plating reaction characteristics (Cu separating reaction) on surfaces of zinc oxide whiskers. This catalyst producing process is carried out in such a manner that zinc oxide whiskers are immersed in palladium chloride solution, and catalytic coating is produced on the surfaces as a result of part of zinc oxide whiskers being displaced by palladium ions. After the catalyst producing process is carried out, zinc oxide whiskers are sufficiently cleaned by water. Next, a copper plating layer is produced as a result of elecroless plating being carried out on the surfaces of zinc oxide whiskers on which catalyst coating is produced. This elecroless plating process is carried out in such a manner that zinc oxide whiskers are immersed in elecroless copper plating bath appropriately prepared. For the elecroless copper plating bath, for example, copper sulfate solution prepared in an appropriate composition is applied. After the completion of elecroless plating, annealing processing is carried out in an N2 atmosphere furnace if necessary. The annealing processing temperature is preferably on the order of 300 through 500° C.

For example, when silver plating is carried out on tetrapod like zinc oxide whiskers, this may be achieved by preparing by well-known elecroless plating for example. At this time, it is preferable to carry out well-known surface roughening processing, sensitiveness processing and activation processing on zinc oxide whiskers before plating in order to obtain high quality elecroless plating coating. This pre-processing is achieved by, for example, degreasing cleaning zinc oxide whiskers if necessary with natural detergent, immersing for predetermined duration in surface roughening solution (for example, HF solution) so as to carry out surface roughening. Then, after rinsing, well-known sensitiveness processing is carried out (for example, with the use of a product name S-1 made by Pure Chemical Laboratories). Next, after rinsing, well-known activation processing is carried out (for example, with the use of a product name P-1 made by Pure Chemical Laboratories). Then, on the zinc oxide whiskers on which the pre-processing was thus carried out, plating processing is carried out in elecroless Ag plating liquid: product name: S-700, S-800 or S-900 made by Pure Chemical Laboratories, and thus, metal coating is produced on the surfaces for a predetermined thickness.

Further, according to a method other than a plating method, in a method disclosed by Japanese Patent No. 2909744, reduced pressure heating processing is carried out on good thermal conductor particles in inactive atmosphere, the good thermal conductor particles having undergone the heating processing is set in a rotating chamber in which sputtering source is provided, a flowing layer of the good thermal conductor particles are created as a result of the chamber being rotated in a fixed direction, sputtering is carried out in a state in which the chamber is rotated, so that coating material is coated on the good thermal conductor particles, the thus-coated good thermal conductor particles are taken out from the rotating chamber by a principle of vacuum sweeper as a result of a combination of inactive gas introduction and vacuum pumping. Thus, the metal coated good thermal conductor particles can be obtained.

Next, the surface layer producing process with the use of the complex powder is described.

For a base material, for example, a fixing roller core metal surface made of aluminum of ϕ 40 mm, and having a fixing part with a wall thickness of 1.5 mm is roughened by blast processing.

Good thermal conductor having a high melting point than that of fluorocarbon resin and having shape anisotropy mixed with the thus-produced powder is electrostatically coated, burning is carried out, and the surface layer is produced.

Electrostatic coating is carried out on the fixing roller core metal made of aluminum, it is heated at 380° C. for 30 minutes for example, and is rapidly cooled outside of the furnace by means of strong air blasting. Thereby, the desired surface layer can be obtained.

In the burning process, the good thermal conductor particles mutually contact successively by means of the melted low melting point metal, and thus, both rigidity and thermal conductivity characteristics can be improved.

When the fluorocarbon resin particles applied as row material has a spherical shape or a modification thereof, such a configuration is provided in which the good thermal conductor successively contacting is shaped in a spherical shell, or a modification thereof, these spherical shells contact successively, and thus, improvement of thermal conductivity is available even with a filling amount so small as to avoid reduction of releasability.

Depending on a type or a mixing ratio of powders, surface roughness of the surface layer may be large. When surface roughness should be controlled within a predetermined amount, this can be achieved by carrying out grinding with the use of a tape grinding apparatus, for example. For example, as a result of grinding was carried out with corundum #800, #1500. surface roughness could be controlled equal to or less than 2 μm in Rz.

Embodiment 14

Figure 48:
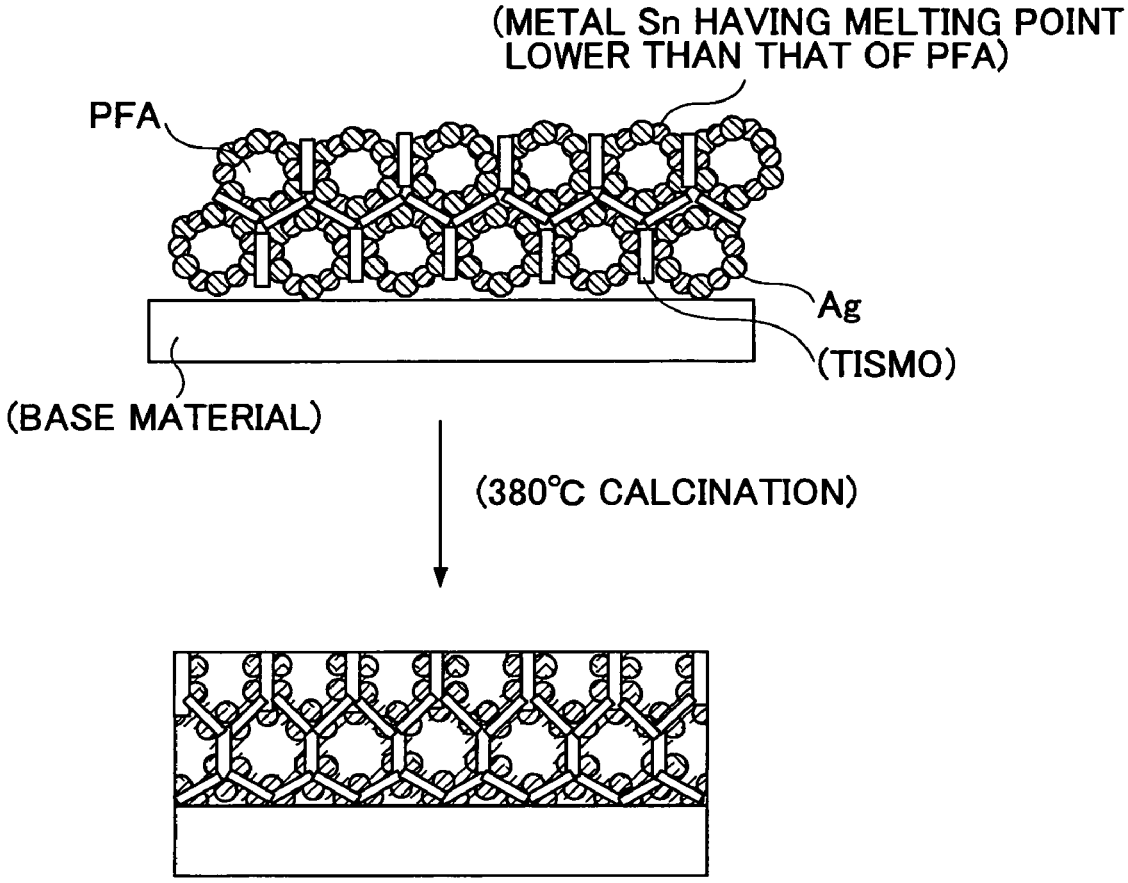
FIG. 48 is a sectional view of a surface layer shown in FIG. 46.

In PFA powder (MP102 average particle diameter ϕ 20 μm), 5% of Ag powder (average particle diameter 0.5 μm) in reduced volume ratio and 5% of Sn powder (average particle diameter 0.5 μm) in reduced volume ratio were mixed, this was then input to a hybridization system of Nara Machinery Co., Ltd., and Ag powder and Sn powder were fixed on PFA powder. In observation with SEM, it was confirmed that Ag powder and Sn powder almost covered PFA powder. This powder was mixed with 'Tismo (potassium titanate fiber indicated by K2O.nTiO2, with fiber diameter of 0.2 through 0.6 μm, fiber length of 10 through 20 μm)' (made by Otsuka Chemical Co., Ltd.) which amounts to 5% in reduced volume with respect to the PFA powder, this was electrostatically coated on an aluminum substrate, burning was carried out at 380° C., the resin was melted and then cooled, this was pealed from the substrate, and a sample was produced. FIG. 48 shows a sectional view of this sample.

The configuration is provided in which good thermal conductor includes Sn having a low melting point (approximately 232° C.) than that of PFA melting point (approximately 310° C.), includes Tismo having a high melting point (approximately 1300 through 1350° C.) than that of fluorocarbon resin and also having shape anisotropy, and Tismo is surrounded by Sn having the lower melting point than that of fluorocarbon resin. Thereby, when the surface layer is produced, Sn coats or adheres to a surface of Tismo, diffusion is controlled, and production of heat conduction path with the melted Sn is accelerated. Thereby, thermal conductivity can be sufficiently improved.

Therefrom, a sheet with a thickness of 100 μm was produced, and thermal diffusivity was measured in a laser flash method. Then, together with volume specific heat measured separately and specific gravity, thermal conductivity was calculated. There, the volume ratio is one obtained from a weight ratio and a specific gravity, and does not mean a volume ratio of the powder.

Embodiment 15

In PFA powder (MP102 average particle diameter ϕ 20 μm), 5% of Ag powder (average particle diameter 0.5 μm) in reduced volume ratio and 5% of Sn powder (average particle diameter 0.5 μm) in reduced volume ratio were mixed, this was then input to a hybridization system of Nara Machinery Co., Ltd., and Ag powder and Sn powder were fixed on PFA powder. In observation with SEM, it was confirmed that Ag powder and Sn powder almost covered PFA powder. This powder was mixed with 'Super Dentall SD-100 (silver coated electrically conductive potassium titanate fiber' (made by Otsuka Chemical Co., Ltd.) which amounts to 5% in reduced volume with respect to the PFA powder, this was electrostatically coated on an aluminum substrate, burning was carried out at 380° C., the resin was melted and then cooled, this was pealed from the substrate, and a sample was produced.

Figure 49:
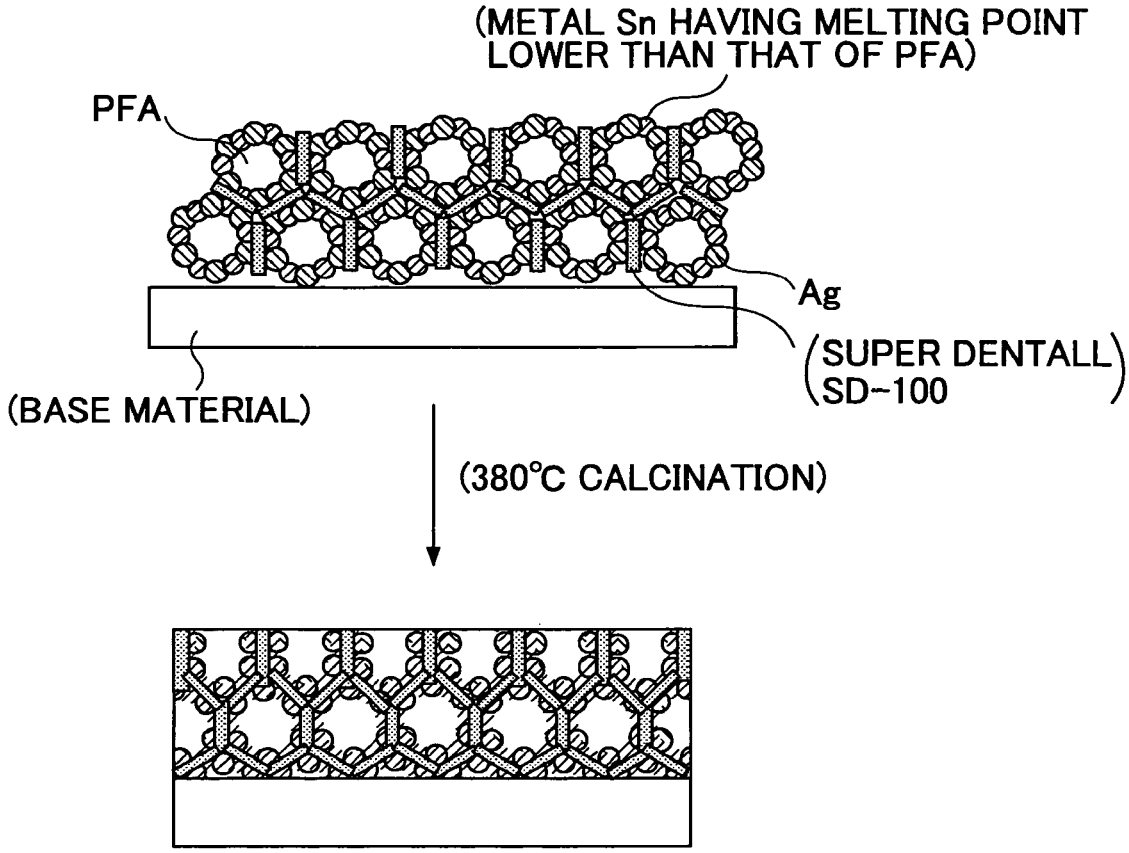
FIG. 49 shows a sample of embodiment 15.

FIG. 49 shows a sectional view of this sample.

A configuration is provided in which good thermal conductor includes Sn having a low melting point (approximately 232° C.) than that of PFA melting point (approximately 310° C.), includes Super Dentall SD-100 having a high melting point (approximately 1300 through 1350° C.) than that of fluorocarbon resin and also having shape anisotropy, and Super Dentall SD-100 is surrounded by Sn having the lower melting point than that of fluorocarbon resin. Thereby, when the surface layer is produced, Sn coats or adheres to a surface of Super Dentall SD-100, diffusion is controlled, and production of heat conduction path with the melted Sn is accelerated.

Thereby, thermal conductivity can be sufficiently improved.

Therefrom, a sheet with a thickness of 100 μm was produced, and thermal diffusivity was measured in a laser flash method. Then, together with volume specific heat measured separately and specific gravity, thermal conductivity was calculated. There, the volume ratio is one obtained from a weight ratio and a specific gravity, and does not mean a volume ratio of the powder.

Embodiment 16

In PFA powder (MP102 average particle diameter ϕ 20 μm), 5% of Ag powder (average particle diameter 0.5 μm) in reduced volume ratio and 5% of Sn powder (average particle diameter 0.5 μm) in reduced volume ratio were mixed, this was then input to a hybridization system of Nara Machinery Co., Ltd., and Ag powder and Sn powder were fixed on PFA powder. In observation with SEM, it was confirmed that Ag powder and Sn powder almost covered PFA powder. This powder was mixed with 'Panatetra (three-dimensionally (tetrapod-shaped) acicular single-crystal (whisker) of zinc oxide, acicular short fiber diameter (average diameter) 0.2 through 3.0 μm, acicular short fiber length 2 through 50 μm)' (made by Matsushita Electric Industries, Co., Ltd.) which amounts to 5% in reduced volume with respect to the PFA powder, this was electrostatically coated on an aluminum substrate, burning was carried out at 380° C., the resin is melted and then cooled, this was pealed from the substrate, and a sample was produced.

Figure 50:
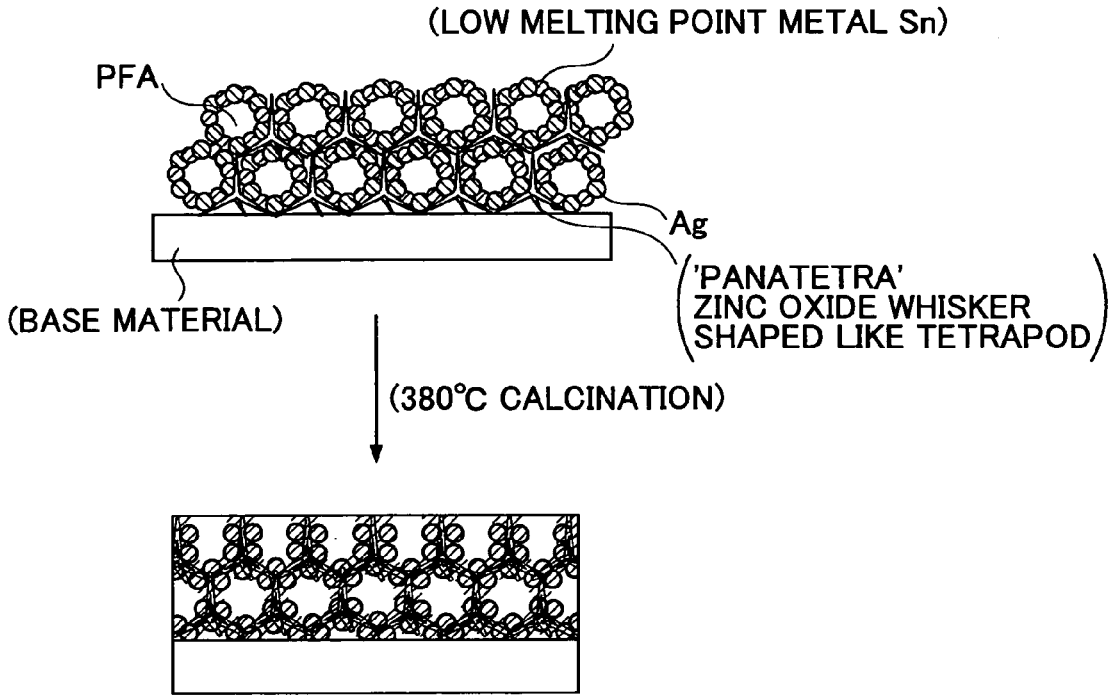
FIG. 50 shows a sample of embodiment 16.

FIG. 50 shows a sectional view of this sample.

A configuration is provided in which good thermal conductor includes Sn having a low melting point (approximately 232° C.) than that of PFA melting point (approximately 310° C.), includes Panatetra having a high melting point (approximately 2000° C. under pressure (sublimation point: approximately 1720° C.) than that of fluorocarbon resin and also having shape anisotropy, and Panatetra is surrounded by Sn having the lower melting point than that of fluorocarbon resin. Thereby, when the surface layer is produced, Sn coats or adheres to a surface of Panatetra, diffusion is controlled, and production of heat conduction path with the melted Sn is accelerated.

Therefrom, a sheet with a thickness of 100 μm was produced, and thermal diffusivity was measured in a laser flash method. Then, together with volume specific heat measured separately and specific gravity, thermal conductivity was calculated. There, the volume ratio is one obtained from a weight ratio and a specific gravity, and does not mean a volume ratio of the powder.

Embodiment 17

In PFA powder (MP102 average particle diameter ϕ 20 μm), 5% of Ag powder (average particle diameter 0.5 μm) in reduced volume ratio and 5% of Sn powder (average particle diameter 0.5 μm) in reduced volume ratio were mixed, this was then input to a hybridization system of Nara Machinery Co., Ltd., and Ag powder and Sn powder were fixed on PFA powder. In observation with SEM, it was confirmed that Ag powder and Sn powder almost covered PFA powder. This powder was mixed with 'Panatetra' with metal plating according to a well-known art (for example, elecroless Ni plating) which amounts to 5% in reduced volume with respect to the PFA powder, this was electrostatically coated on an aluminum substrate, burning was carried out at 380° C., the resin is melted and then cooled, this was pealed from the substrate, and a sample was produced.

Figure 51:
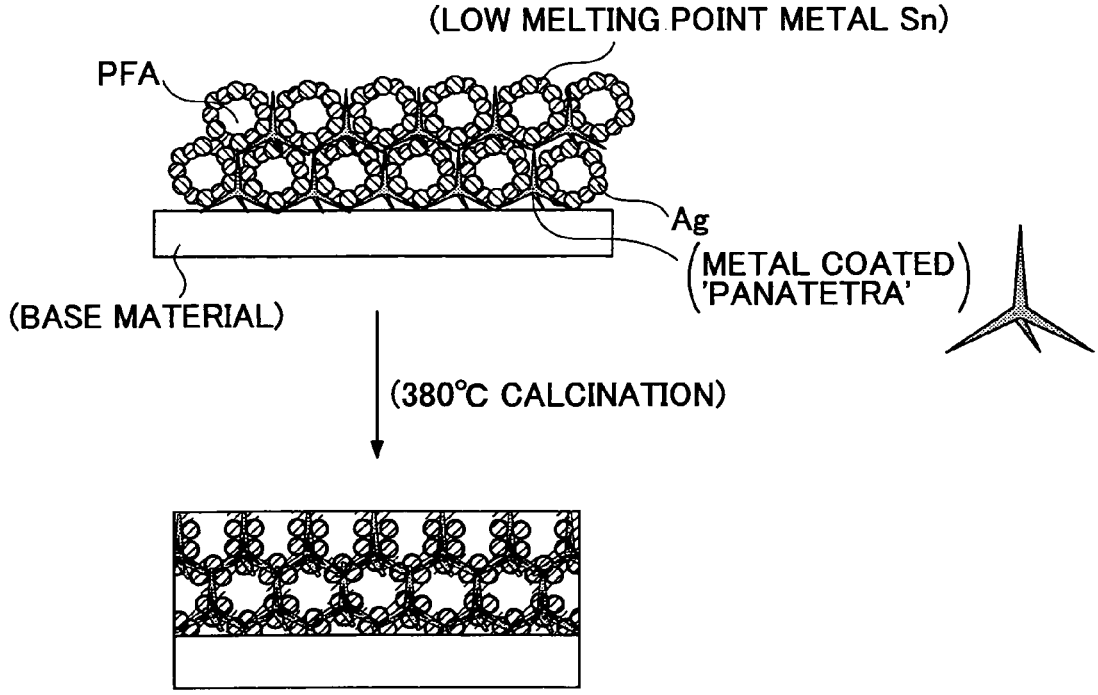
FIG. 51 shows a sample of embodiment 17.

FIG. 51 shows a sectional view of this sample.

A configuration is provided in which good thermal conductor includes Sn having a low melting point (approximately 232° C.) than that of PFA melting point (approximately 310° C.), includes elecroless Ni plated Panatetra having a high melting point (approximately 2000° C. under pressure (sublimation point: approximately 1720° C.), melting point of Ni: 1455° C.) than that of fluorocarbon resin and also having shape anisotropy, and the elecroless Ni plated Panatetra is surrounded by Sn having the lower melting point than that of fluorocarbon resin. Thereby, when the surface layer is produced, Sn coats or adheres to a surface of elecroless Ni plated Panatetra, diffusion is controlled, and production of heat conduction path with the melted Sn is accelerated.

Therefrom, a sheet with a thickness of 100 μm was produced, and thermal diffusivity was measured in a laser flash method. Then, together with volume specific heat measured separately and specific gravity, thermal conductivity was calculated. There, the volume ratio is one obtained from a weight ratio and a specific gravity, and does not mean a volume ratio of the powder.

COMPARISON EXAMPLE

As a comparison example 1, a sample was produced in the same way by PFA powder (MP102, average particle diameter ϕ 20 μm).

As comparison example 2, a sample 2 was produced in the same way only by PFA powder on which Ag powder 5% and Sn powder 5% in reduced volume were fixed.

As comparison example 3, a sample 3 was produced in the same way by PFA powder (MP102, average particle diameter ϕ 20 μm) in which Ag powder (average particle diameter 1.2 μm) was mixed to amount to 5% in reduced volume in a stirring manner. A reason why 5% was applied is that film forming is difficult more than this value.

Table 54 shows multiplying ratio of thermal conductivity of each sample with respect to the sample 1.

TABLE 54

| SAMPLE | MULTIPLYING FACTOR OF THERMAL CONDUCTIVITY |
|---|---|
| COMPARISON EXAMPLE 1 | 1.0 |
| COMPARISON EXAMPLE 2 | 2.7 |
| COMPARISON EXAMPLE 3 | 1.2 |
| EMBODIMENT 14 | 3.4 |
| EMBODIMENT 15 | 4.2 |
| EMBODIMENT 16 | 4.8 |
| EMBODIMENT 17 | 5.7 |

Embodiment 18

In the same way as that of the embodiments 14 through 17 and comparison examples, coating was carried out on an aluminum tube to be the core metal of the fixing roller in an electrostatic manner, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiments 14 through 17 and comparison examples. A final thickness of the surface layer is 40 μm. This roller was loaded in an image forming apparatus MF4570 of Ricoh Co., Ltd. 10000 sheets of black solid images were passed through, and toner adhesion state on the roller was observed. No particularly large adhesion was observed, and nothing other than ordinary one occurred. Further, cold offset temperature and hot offset temperature which correspond to a range in which toner can be fixed were obtained, and therefrom it was seen that, in the embodiments, in comparison to the comparison examples, the cold offset temperature lowers and a fixing temperature range is widened (Table 55). Thereby, it was seen that, even when temperature lowering occurs upon high speed paper passage, stable fixing can be carried out.

TABLE 55

| SURFACE LAYER STRUCTURE OF FIXING ROLLER | COLD OFFSET TEMPERATURE | HOT OFFSET TEMPERATURE |
|---|---|---|
| SAME AS COMPARISON EXAMPLE 1 | 130° C. | 190° C. |
| SAME AS COMPARISON EXAMPLE 2 | 110° C. | 190° C. |
| SAME AS COMPARISON EXAMPLE 3 | 120° C. | 190° C. |
| SAME AS EMBODIMENT 14 | 103° C. | 190° C. |
| SAME AS EMBODIMENT 15 | 100° C. | 190° C. |
| SAME AS EMBODIMENT 16 | 98° C. | 190° C. |
| SAME AS EMBODIMENT 17 | 95° C. | 190° C. |

Embodiment 19

In the same way as that of the embodiments 14 through 17 and comparison examples, coating was carried out on an aluminum tube to be the core metal of the fixing roller in an electrostatic manner, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiments 14 through 17 and comparison examples.

A final thickness of the surface layer is 40 μm. This roller was loaded in an image forming apparatus MF4570 of Ricoh Co., Ltd. Toner of this MF4570 was toner with wax. 10000 sheets of black solid images were passed through, and toner adhesion state on the roller was observed (Table 56). No particularly large adhesion was observed, and nothing other than ordinary one occurred.

TABLE 56

| SURFACE LAYER STRUCTURE OF FIXING ROLLER | WATER CONTACT ANGLE | ADHERING TONER |
|---|---|---|
| SAME AS COMPARISON EXAMPLE 1 | 110° C. | NOTHING |
| SAME AS COMPARISON EXAMPLE 2 | 105° C. | NOTHING |
| SAME AS COMPARISON EXAMPLE 3 | 108° C. | NOTHING |
| SAME AS EMBODIMENT 14 | 105° C. | NOTHING |
| SAME AS EMBODIMENT 15 | 105° C. | NOTHING |
| SAME AS EMBODIMENT 16 | 105° C. | NOTHING |
| SAME AS EMBODIMENT 17 | 105° C. | NOTHING |

In contrast thereto, comparison examples in which toner adheres are shown below:

Mixed powder is produced as a result of PFA powder (DuPont-Mitsui MP102) as fluorocarbon resin and PEEK powder (made by Victrex-MC PEEK (registered trademark) 150XF) as heat resistant resin being mixed in a predetermined weight ratio.

On the other hand, as a base material, for example, a core metal surface of a fixing roller made of aluminum having a diameter ϕ of 40 mm, and wall thickness of a fixing part is 1.5 mm is roughened through abrasive blasting.

Then, the above-mentioned mixture powder is electrostatically coated on the core metal of the aluminum made fixing roller, heating is carried out for 380° C., and rapid cooling is carried out by means of strong air blast outside of a heating furnace.

Surface roughness of the releasing layer may be large depending on a type of powder or a mixture ratio. When surface roughness should be made the same predetermined amount, this can be obtained from grinding by means of a tape grinding apparatus, for example. For example, when tape grinding is carried out with corundum #800, #1500, surface roughness can be made equal to or less than 2 μm in Rz. This fixing roller was loaded in a Ricoh's image forming apparatus MF4570. 10000 sheets of black solid images were passed, and a toner adhesion state on the roller surface was observed (Table 57).

TABLE 57

COMPARISON EXAMPLE BY PFA:PEEK (WEIGHT RATIO)

| PFA:PEEK (WEIGHT RATIO) | CONTACT ANGLE FOR PURE WATER | ADHERING TONER |
|---|---|---|
| 100:0 | 107° | NOTHING |
| 90:10 | 97° | NOTHING |
| 80:20 | 92° | NOTHING |
| 70:30 | 89° | NOTHING |
| 60:40 | 86° | NOTHING |
| 50:50 | 83° | NOTHING |
| 40:60 | 81° | TONER ADHERING TO ROLLER SURFACE |
| 30:70 | 79° | TONER ADHERING TO ROLLER SURFACE |
| 20:80 | 76° | TONER ADHERING TO ROLLER SURFACE |
| 15:85 | 75° | TONER ADHERING TO ROLLER SURFACE |

Embodiment 20

In the same way as that of the embodiment 16, coating was carried out on an aluminum tube to be the core metal of the fixing roller in an electrostatic manner, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiment 16. A final thickness of the surface layer is 40 μm.

This roller was loaded in an image forming apparatus MF4570 of Ricoh Co., Ltd. 10000 sheets of black solid images were passed, and toner adhesion state on the roller was observed.

Further, this roller was loaded in an image forming apparatus MF4570 of Ricoh Co., Ltd. 10000 sheets of black solid images were passed, and toner adhesion state and paper winding state on the roller was observed (Table 58). As a result, it was confirmed that there was an effect for a surface roughness of equal to or less than 5 μm in Rz. For one of 7 μm, jam occurred frequently in 5760, and therefore, experiment was cancelled.

TABLE 58

| SURFACE ROUGHNESS Rz | ADHERING TONER AMOUNT | PAPER WINDING |
|---|---|---|
| 2 μm | NOTHING | NOTHING |
| 3 μm | NOTHING | NOTHING |
| 5 μm | SOME | NOTHING |
| 7 μm | VERY MUCH | FREQUENT JAM |

Embodiment 21

In the same way as that of the embodiment 16, coating was carried out on an aluminum tube to be the core metal of the fixing roller in an electrostatic manner, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiment 16. A final thickness of the surface layer is 40 μm.

This roller was loaded in an image forming apparatus IMAGIO NEO 750 of Ricoh Co., Ltd. Toner of IMAGIO 750 has insufficient releasability, and an oil coating member immersed in silicon oil for coating silicon oil on the fixing roller is added. 10000 sheets of black solid images were passed through the IMAGIO NEO 750, and toner adhesion state on the roller was observed. No particularly large adhesion was observed, and nothing other than ordinary occurred.

Embodiment 22

In the same way as that of the embodiment 16, coating was carried out on an aluminum tube to be the core metal of the fixing roller in an electrostatic manner, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiment 3.

A final thickness of the surface layer is 40 μm. A fixing testing machine was produced with the use of a fixing unit of MF4570, and non-fixed images were passed through the roller with a pressing force changed. In a range equal to or less than 0.5 (kgf/cm$^2$), fixing performance was very bad; in a range equal to or more than 4.0 (kgf/cm$^2$), toner adhesion to the fixing roller occurred. The fixing performance was determined simply in such a manner that, when toner remarkably adhered to a cloth after the solid image after fixing was rubbed by the cloth, it was determined that the fixing was bad (Table 59).

TABLE 59

COMPARISON EXAMPLE BY PRESSING FORCE

| PRESSING FORCE (kgf/cm$^2$) | ADHERING TONER AMOUNT | PAPER WINDING |
|---|---|---|
| 0.3 | NOTHING | NOTHING |
| 0.5 | NOTHING | NOTHING |
| 1.0 | NOTHING | NOTHING |
| 2.0 | SOME | NOTHING |
| 4.0 | VERY MUCH | FREQUENT JAM |

It is noted that a form of the fixing member according to the present invention is not limited to a form of fixing roller, and may be applied to any form such as a fixing belt or such.

Figure 52:
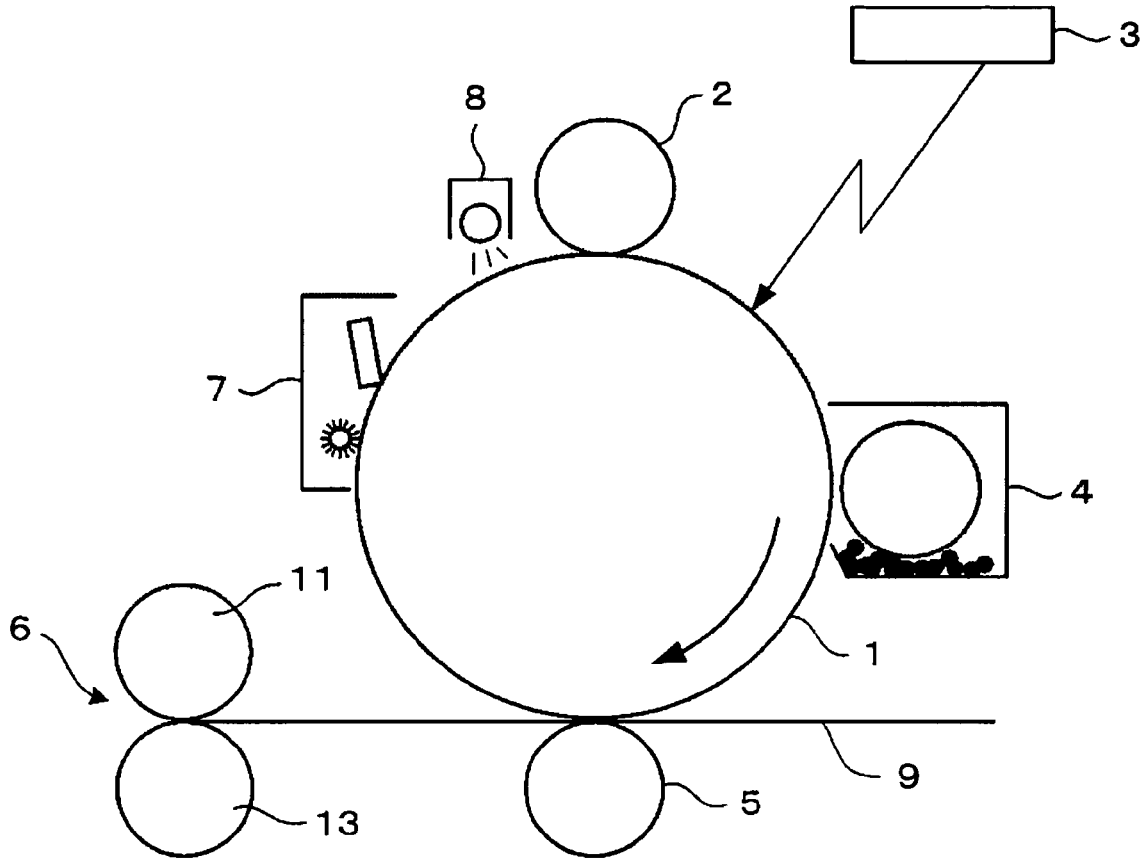
FIG. 52 illustrates an image forming apparatus according to the present invention concerning embodiments 23 through 27.

Below, a heating device, a fixing device and an image forming apparatus according to the present invention concerning embodiments 23 through 27 are described. FIG. 52 shows one embodiment of an image forming apparatus according to the present invention. The image forming apparatus obtains an image by carrying out well-known electrophotographic process, and has a photosensitive body 1 produced to have a cylindrical shape as an image carrying body. Around the photosensitive body 1, a charging roller 2 as charging means, a developing device 4, a transfer roller 5, a cleaning device 7 and an electricity removing device 8 are provided. Other than them, the image forming apparatus has an optical scanning device 3 and a fixing device 6. As the charging means, a corona charger may be used. The optical scanning device carries out exposure by optical scanning between the charging roller and the developing device.

When image forming is carried out, the photosensitive body 1 is rotated counterclockwise of FIG. 52, a surface thereof is uniformly charged by the charging roller 2, after that an electrostatic latent image is formed on the surface of the photosensitive body 1 by means of exposure of the optical scanning device 3. This electrostatic latent image is developed in an inverting manner by the developing device 4, and a toner image is formed on the surface of the photosensitive body 1. This toner image is overlaid by a recording medium overlaid therewith which is fed from a not-shown paper feeding device to a transfer part in timing in which the toner image on the photosensitive body 1 moves to the transfer position. By a function of the transfer roller 5, the toner image is transferred to the recording medium. The recording medium on which the toner image is thus transferred has then the toner image fixed by the fixing device 6, after that the recording medium is ejected to the outside of the apparatus. After the toner image is thus transferred, residual toner or paper dust on the surface of the photosensitive body 1 is cleaned by the cleaning device 7, and after that, electricity on the photosensitive body 1 is removed by the electricity removing device 8.

Figure 53:
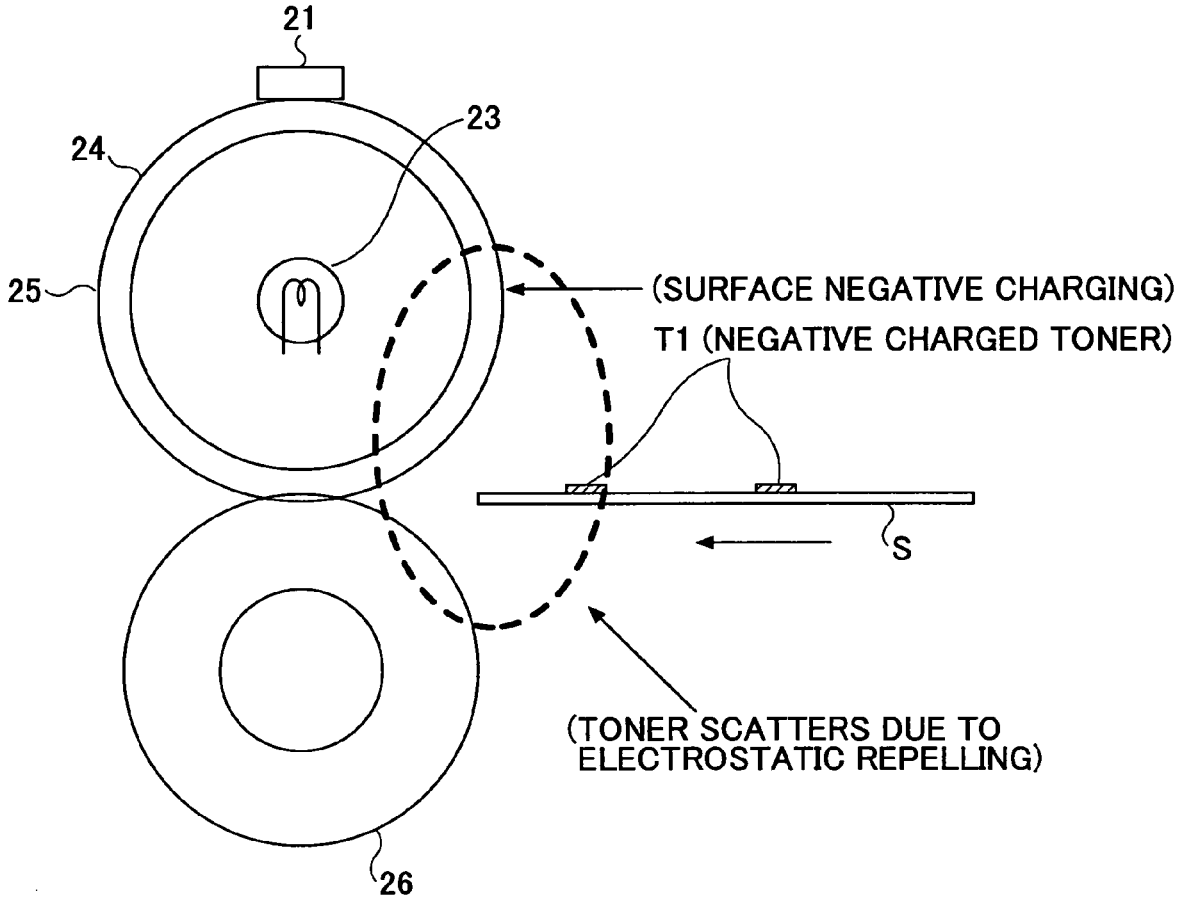
FIG. 53 shows an outline of fixing part shown in FIG. 52.

FIG. 53 shows a general view of a fixing part. 21 denote a temperature detecting device, TI denotes a non-fixed toner image, S denotes a recording sheet. 23 denotes a halogen heater, 24 denotes a fixing roller, 25 denotes a surface layer of the fixing roller 24, and 26 denotes a pressing roller. The fixing device is shown. The fixing roller 24 contacting the pressing roller in a pressing manner is rotated clockwise, and thus, the recording sheet S having the toner image TI to be fixed is conveyed therewith therebetween in a sandwiched and pressed manner in a direction of an arrow. The halogen heater 23 heats from the inside of the fixing roller. A surface temperature of the fixing roller 24 is detected by the temperature detector 21. The surface layer 25 according to the present invention is produced on a surface of the fixing roller 24. The present invention concerning the embodiments 14 through 22 mainly relates to the surface layer 25.

Figure 54:
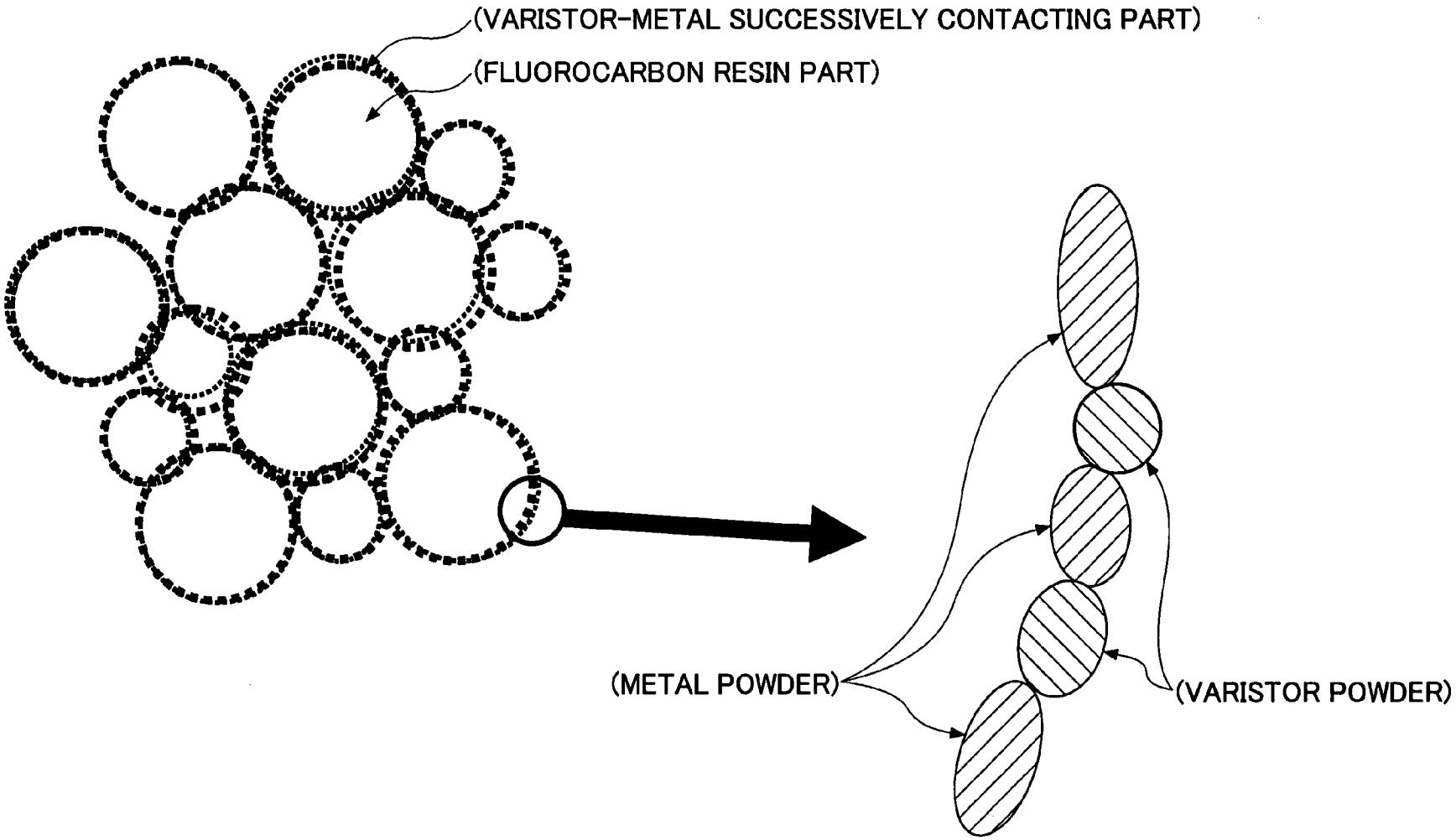
FIG. 54 illustrates a surface layer of a fixing roller shown in FIG. 53.

FIG. 54 shows a configuration example of the surface layer 25 of the fixing roller.

Figure 55:
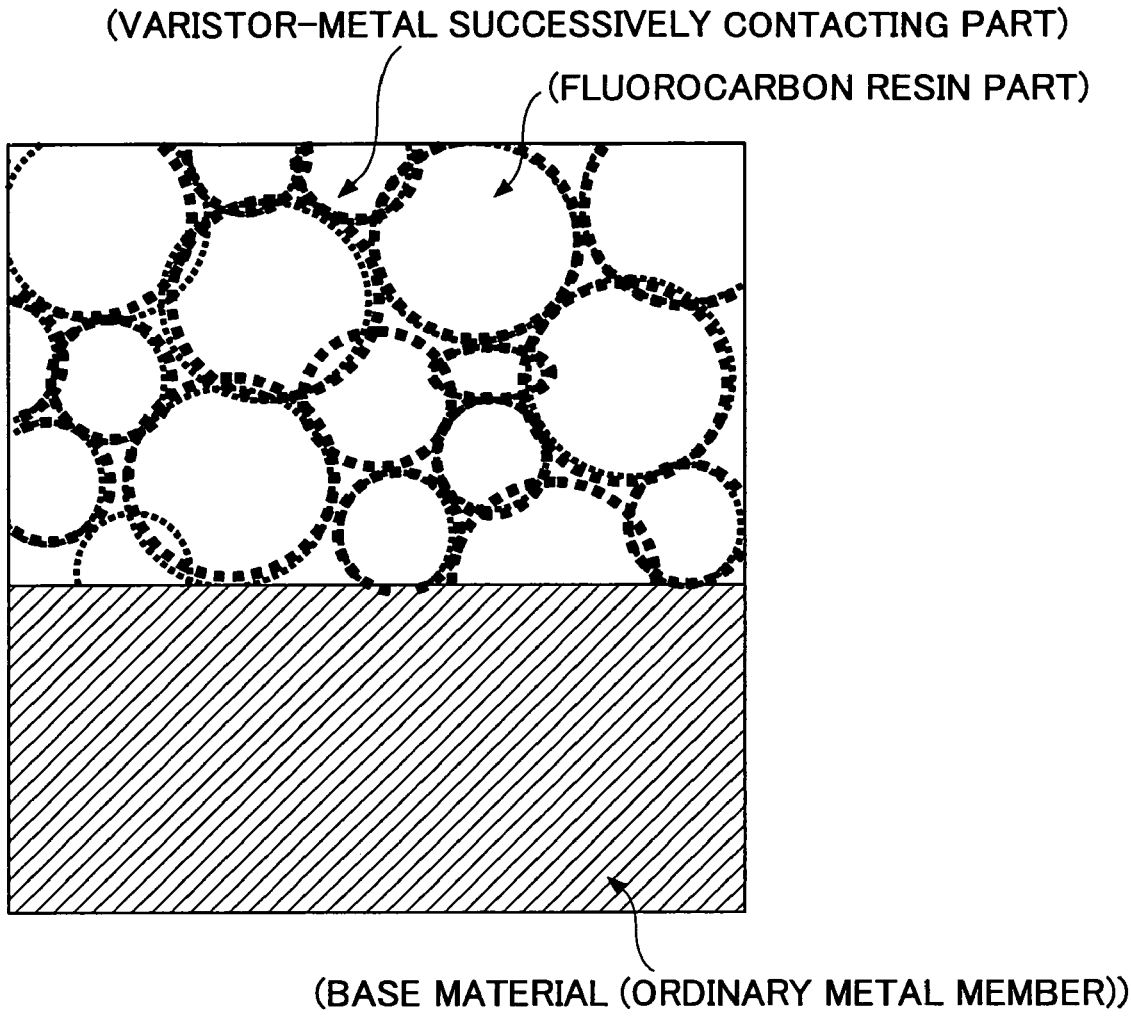
FIG. 55 is a sectional view of a surface layer shown in FIG. 54.

FIG. 54 shows a horizontal sectional view of a part of the surface layer 25. Fluorocarbon resin occupies a wide area, and ensures releasability. A varistor-metal successive contacting part occupies on the order of 5%, but has a large contribution to electrical conductivity since almost all thereof connects. A contribution degree to electrical conductivity in a horizontal direction is also large. On the right side of FIG. 54, a magnified schematic view of a minimal part thereof is shown. A maintaining voltage is controlled by a varistor powder amount and a metal amount. Varistor (ZnO+Pr, La) has non-linear characteristics in a crystal plane, allows a current to flow with a voltage higher than a fixed value, and suppresses a high electric potential. In varistor powder, when ten types of Pr6O11 (praseodymium oxide), La2O3 (lanthanum oxide), CoO (cobalt oxide) and so forth are added to minimal ZnO on the order of ppm as a minor additive, those having ion diameters larger than those of Zn ions such as Pr, La or such, among these additives, do not solve but gather in a crystalline interface. It is considered that a thickness of crystalline interface having voltage dependency is very small, i.e., on the order of 100 Å or less. The higher voltage setting is obtained as the number of these crystalline interfaces increases. For the purpose of the present invention, varistor is produced as a result of one having crystal grains on the order of 0.5 μm being burned in a form of large masses, and then, again these being powdered into powder of 1 through several μm as varistor powder. Therefore, crystalline interfaces exist in the varistor powder, and play a significant role to control a voltage. Hereinafter, one produced in this way is referred to as visitor powder. FIG. 55 shows a vertical sectional view of a part of the surface layer. A varistor-metal successive contacting part continues from a surface to a base material the same as in the horizontal section, and contributes to improve electrical conductivity. In terms of manufacturing method, to produce such a connection state is not easy. According to the present invention, such a structure can be achieved by means of film forming in such a manner that powder is fixed to fluorocarbon reason surface, and then, fluorocarbon resin is softened.

As the fluorocarbon resin applied to the present invention, one which has a superior melted film forming performance with burning, and having a relatively low melting point (preferably, 250 through 300° C.) is preferably applied. Specifically, impalpable powder of low molecular weight polytetrafluoroethylene (PTFE), tetrafluoroethylene-hexafluoropropylene copolymer (FEP), or tetrafluoroethylene-perfluoroalkylvinylether copolymer (PFA) is applied. More specifically, as low-molecular weight polytetrafluoroethylene (PTFE) powder, LUBRON (registered trademark) L-5, L-2 (made by Daikin Industries, Ltd.), MP1100, 1200, 1300, TLP-10F-1 (made by DuPont-Mitsui Fluorochemicals, Co., Ltd.) is known. As tetrafluoroethylene-hexafluoropropylene copolymer (FEP) powder, 532-8000 (made by DUPONT) is known. As tetrafluoroethylene-perfluoroalkylvinylether copolymer (PFA), MP-10, MP102 (made by DUPONT-MITSUI FLUOROCHEMICALS, CO., LTD.) is known.

Figure 56:
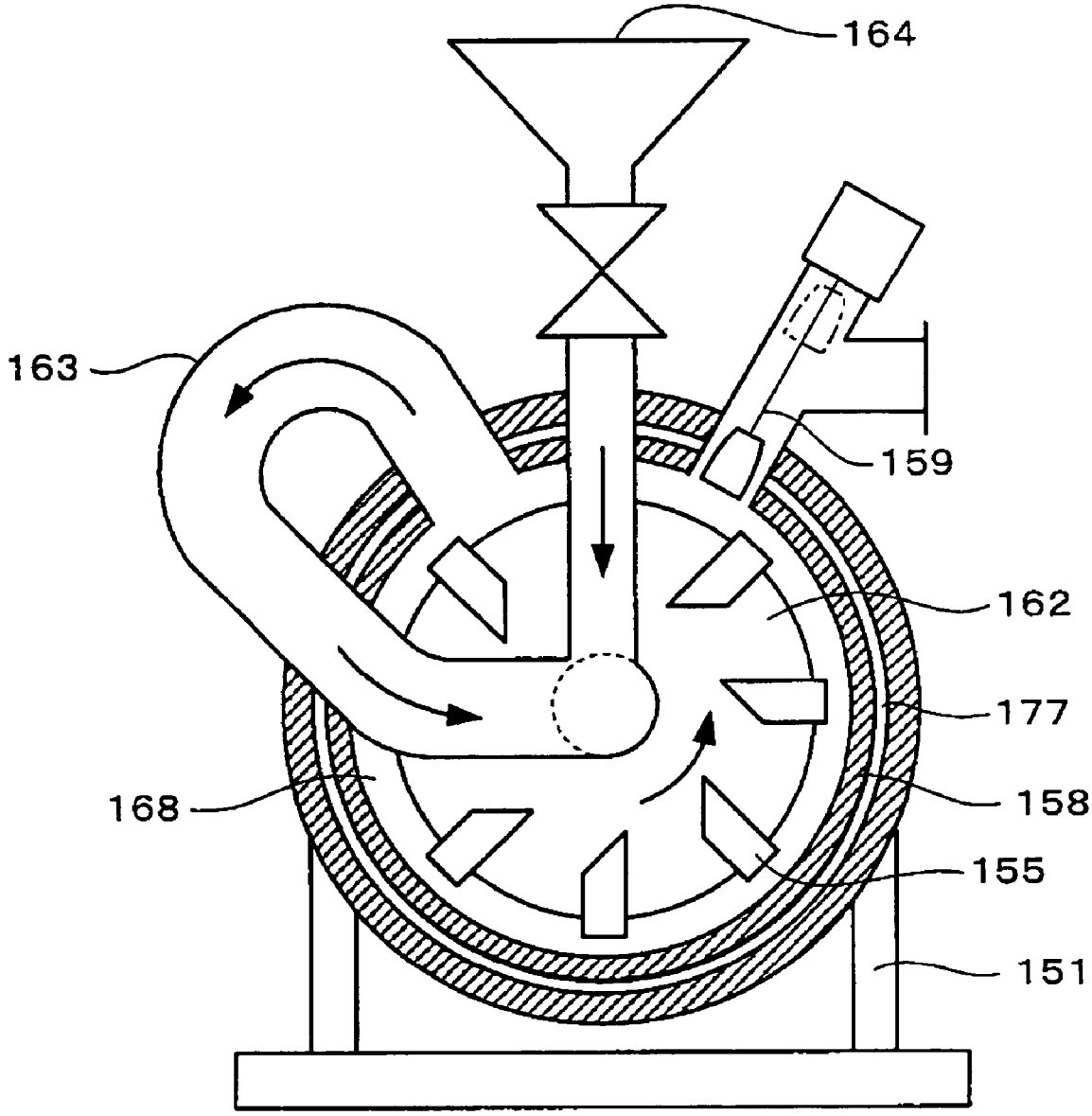
FIG. 56 is a general configuration diagram of a hybridization system.

As the varistor powder, as described above, as minor additive for minimal ZnO, one in which ten types of Pr6O11 (praseodymium oxide), La2O3 (lanthanum oxide), CoO (cobalt oxide) and so forth are added to minimal ZnO on the order of ppm is applied. As metal filler, for example, filler of alloy including at least any one of gold, silver, copper, lead, nickel, zinc, iron, aluminum, magnesium, titanium and so forth may be applied. Spherical or acicular fillers, or fibrous filler as metal fillers and varistor powder are fixed to peripheries of fluorocarbon resin. As an apparatus for the fixing, a hybridization system (Nara Machinery Co., Ltd.) is shown in FIG. 56. 151 denotes a body casing, 158 denotes a stator, 177 denotes a stator jacket, 163 denotes a recycle valve, 159 denotes an ejection valve, and 164 denotes a row material input shooter.

In this apparatus, powder particles and other micro solid particles provide from the row material input shoot 164 are subject to instantaneous impact action manly by a plurality of rotor blades 155 disposed in a rotation rotor 162 rotating at a high speed in an impact chamber 168, further scatter in the system with breakage of mutual aggregation of the powder particles or the other micro solid particles as a result of being hit by the peripheral stator 158, and simultaneously, the other micro solid particles are fixed to surfaces of the powder particles by electrostatic force, Van der Waals force or such, or, for a case of only the powder particles, chamfering or conglobating is carried out. This state progresses along with flying and impact of the particles. That is, along with an air flow generated by rotation of the rotor blades 155, the particles are treated as a result of passing through th recycle pipe 163 several times. Further, as a result of the particles being repeatedly subject to impact action from the rotor blades 155 and stator 158, the other macro solid particles are made to scatter and fixed uniformly on the surfaces or in the vicinity of the powder particles. The produced powder solely or one obtained from mixture with powder produced with ordinary fluorocarbon resin is electrostatically coated, or coated in a form of wet coating, burning is carried out, and thus, the surface layer is produced.

Embodiment 23

In varistor powder, when ten types of Pr6O11 (praseodymium oxide), La2O3 (lanthanum oxide), CoO (cobalt oxide) and so forth are added to minimal ZnO on the order of ppm as a minor additive, those having ion diameters larger than those of Zn ions such as Pr, La or such, among these additives, do not solve but gather in a crystalline interface. It is considered that a thickness of crystalline interface having voltage dependency is very small, i.e., on the order of 100 Å or less. The higher voltage setting is obtained as the number of these crystalline interfaces increases. For the purpose of the present invention, varistor is produced as a result of one having crystal grains on the order of 0.5 μm being burned in a form of large masses, and then, again these being powdered into powder of 1 through several μm as varistor powder. In the present embodiment, this varistor powder (one of average particle diameter 0.8 μm obtained from classification) is mixed together in PFA powder (MP102 average particle diameter ϕ 20) to amount to 5 vol % in reduced volume, and this is input to a hybridization system made by Nara Machinery, and varistor powder was fixed on PFA powder. A state in which varistor powder almost covered PFA powder was confirmed from observation by means of SEM. This varistor powder fixed PFA powder is mixed with PFA powder (MP102 average particle diameter ϕ 20 μm) in a ratio according to the following table with the use of a stirring apparatus KK-500 made by Kurabo Industries Ltd., this was electrostatically coated on an aluminum substrate, burning was carried out at 380° C. and then cooled, this was pealed from the substrate, and thus, a sample was produced. Therefrom, a sheet with a thickness of 100 μm was produced, voltage-current characteristics were measured from both sides with the use of electrodes of 1 cm by 1 cm in a sandwiching manner, and non-linearity thereof was measured. The measurement was carried out for ten samples, and is shown in Table below with standard deviations. There, the volume ratio is one obtained from a weight ratio and a specific gravity, and does not mean a volume ratio of powder. Further, as a comparison example, in PFA powder (MP102 average particle diameter ϕ 20 μm), varistor powder (average particle diameter 0.8 μm obtained from classification) was mixed to amount to 5, 10 and 20 vol % in reduced volume, a stirring apparatus KK-500 made by Kurabo Industries Ltd. was applied, burning was carried out, similarly, and a sheet was produced. A water contact angle was measured for each sample.

TABLE 60

| (VARISTOR POWDER) FIXED PFA POWDER:PFA POWDER (VOLUME RATIO) | INFLECTION POINT (V), STANDARD DEVIATION | WATER CONTACT ANGLE |
|---|---|---|
| 1:4 | 2700,320 | 108° |
| 2:3 | 2500,332 | 104° |
| 3:2 | 2600,352 | 100° |
| 4:1 | 147,38 | 102° |
| 5:0 | 120,18 | 97° |
| SIMPLE MIXTURE 5% VARISTOR POWDER - PFA FILM FOR COMPARISON | 2500,300 | 105° |
| SIMPLE MIXTURE 10% VARISTOR POWDER - PFA FILM FOR COMPARISON | 2250,280 | 92° |
| SIMPLE MIXTURE 20% VARISTOR POWDER - PFA FILM FOR COMPARISON | 520,120 | 76° |

Embodiment 24

The same as the embodiment 23, varistor fixed PFA powder produced with the use of varistor powder was mixed into PFA powder (MP102 average particle diameter ϕ 20) in a ratio according to Table below, this was electrostatically coated on an aluminum tube to be the core metal of the fixing roller, the coated resin was melted at 380° C. and then cooled, grinding was carried out by means of corundum particles, thus one on which surface roughness was made equal to or less than 2 μm in Rz was produced, and thus, a fixing roller was produced. A surface layer structure of the fixing roller was the same as that of the embodiment 16. A final thickness of the surface layer is 40 μm. This roller was loaded in an image forming apparatus MF4570 of Ricoh Co., Ltd. 10000 sheets of black solid images were passed, and toner adhesion state on the roller was observed. Further, occurrence of toner dust occurring in such a manner of trailing in a paper conveyance direction from an image, with the of dot patterns was observed. Comparison was made with an electrically conductive type of graphite carbon 3% PFA. Further, as a comparison example, into PFA powder (MP102 average particle diameter ϕ 20 μm), varistor powder (average particle diameter 0.8 μm obtained from classification) was mixed to amount to 5, 10 and 20 vol % in reduced volume, and a roller was produced in the same way.

TABLE 61

| (VARISTOR POWDER) FIXED PFA POWDER:PFA POWDER (VOLUME RATIO) | TONER DUST | ADHERING TONER |
|---|---|---|
| 1:4 | MUCH | ALMOST NOTHING |
| 2:3 | MUCH | ALMOST NOTHING |
| 3:2 | MUCH | ALMOST NOTHING |
| 4:1 | NOTHING | ALMOST NOTHING |
| 5:0 | NOTHING | ALMOST NOTHING |
| SIMPLE MIXTURE 5% VARISTOR POWDER - PFA FILM FOR COMPARISON | MUCH | ALMOST NOTHING |
| SIMPLE MIXTURE 10% VARISTOR POWDER - PFA FILM FOR COMPARISON | MUCH | ALMOST NOTHING |
| SIMPLE MIXTURE 20% VARISTOR POWDER - PFA FILM FOR COMPARISON | MUCH | MUCH |
| GRAPHITE CARBON 3% PFA FOR COMPARISON | NOTHING | LITTLE |

Embodiment 25

Varistor powder (one of average particle diameter 0.8 μm obtained from classification) and silver powder (average particle diameter 0.4 μm) were mixed together in PFA powder (MP102 average particle diameter ϕ 20) to amount to 4.5 vol % of varistor and 0.5 vol % of silver in reduced volume, and this is input to a hybridization system made by Nara Machinery, and was fixed on PFA powder. A state in which (varistor powder+silver powder) almost covered PFA powder was confirmed from observation by means of SEM. This (varistor powder+silver powder) fixed PFA powder is mixed with PFA powder (MP102 average particle diameter ϕ 20 μm) in a ratio according to the following table, this was electrostatically coated on an aluminum substrate, burning was carried out at 380° C., the resin was melted and then cooled, this was pealed from the substrate, and thus, a sample was produced. Therefrom, a sheet with a thickness of 100 μm was produced, voltage-current characteristics were measured from both sides with the use of electrodes of 1 cm by 1 cm in a sandwiching manner, and non-linearity thereof was measured. The measurement was carried out for ten samples, and is shown in Table below with standard deviations. There, the volume ratio is one obtained from a weight ratio and a specific gravity, and does not mean a volume ratio of powder. A water contact angle was measured for each sample.

TABLE 62

| (VARISTOR + SILVER) FIXED PFA POWDER:PFA POWDER (VOLUME RATIO) | INFLECTION POINT (V), STANDARD DEVIATION | WATER CONTACT ANGLE |
|---|---|---|
| 1:4 | 2700,320 | 105° |
| 2:3 | 2500,332 | 104° |
| 3:2 | 2600,352 | 102° |
| 4:1 | 124,39 | 98° |
| 5:0 | 112,16 | 97° |

Embodiment 26

The same as the embodiment 25, (varistor powder+silver powder) fixed PFA powder produced with the use of varistor powder and silver powder was mixed into PFA powder (MP102 average particle diameter ϕ 20) in a ratio according to Table below, this was electrostatically coated on an aluminum tube to be the core metal of the fixing roller, the coated resin was melted at 380° C. and then cooled, grinding was carried out by means of corundum particles, thus one on which surface roughness was made equal to or less than 2 μm in Rz was produced, and thus, a fixing roller was produced. A final thickness of the surface layer is 40 μm. This roller was loaded in an image forming apparatus MF4570 of Ricoh Co., Ltd. 10000 sheets of black solid images were passed through, and toner adhesion state on the roller was observed. Further, occurrence of toner dust occurring in such a manner of trailing in a paper conveyance direction from an image with the of dot patterns was observed.

TABLE 63

| (VARISTOR POWDER) FIXED PFA POWDER:PFA POWDER (VOLUME RATIO) | TONER DUST | ADHERING TONER |
|---|---|---|
| 1:4 | MUCH | ALMOST NOTHING |
| 2:3 | MUCH | ALMOST NOTHING |
| 3:2 | MUCH | ALMOST NOTHING |
| 4:1 | NOTHING | ALMOST NOTHING |
| 5:0 | NOTHING | ALMOST NOTHING |

Embodiment 27

To wet fluorine coating (EN700CL) of DuPont Co., Ltd., weighing adjustment was carried out for (varistor powder) fixed PFA powder and (varistor+silver) fixed PFA powder so that each of varistor powder and (varistor+silver) powder amounts to 4 vol % in reduced volume calculated from specific gravity. Next, after stirring and dispersion were carried out, then spray coating thereof was carried out on an aluminum tube to be a core metal of a fixing roller, the coated resin was melted at 380° C. and then cooled, grinding was carried out, and thus, a fixing roller was produced. A final thickness of the surface layer is 40 μm. This roller was loaded in an image forming apparatus MF4570 of Ricoh Co., Ltd. 10000 sheets of black solid images were passed through, and toner adhesion state on the roller was observed. Further, occurrence of toner dust occurring in such a manner of trailing in a paper conveyance direction from an image with the of dot patterns was observed. Further, the same as in the above-mentioned embodiment, a sheet with a thickness of 100 μm was produced, voltage-current characteristics were measured from both sides with the use of electrodes of 1 cm by 1 cm in a sandwiching manner, and non-linearity thereof was measured.

TABLE 64

| SAMPLE | INFLECTION POINT (V), STANDARD DEVIATION | WATER CONTACT ANGLE |
|---|---|---|
| (VARISTOR) FIXED PFA POWDER + WET FLUORINE COATING | 168,32 | 103° |
| (VARISTOR + SILVER) FIXED PFA POWDER + WET FLUORINE COATING | 147,50 | 102° |

TABLE 65

| SAMPLE | TONER DUST | ADHERING TONER |
|---|---|---|
| (VARISTOR) FIXED PFA POWDER + WET FLUORINE COATING | NOTHING | ALMOST NOTHING |
| (VARISTOR + SILVER) FIXED PFA POWDER + WET FLUORINE COATING | NOTHING | ALMOST NOTHING |

Figure 57:
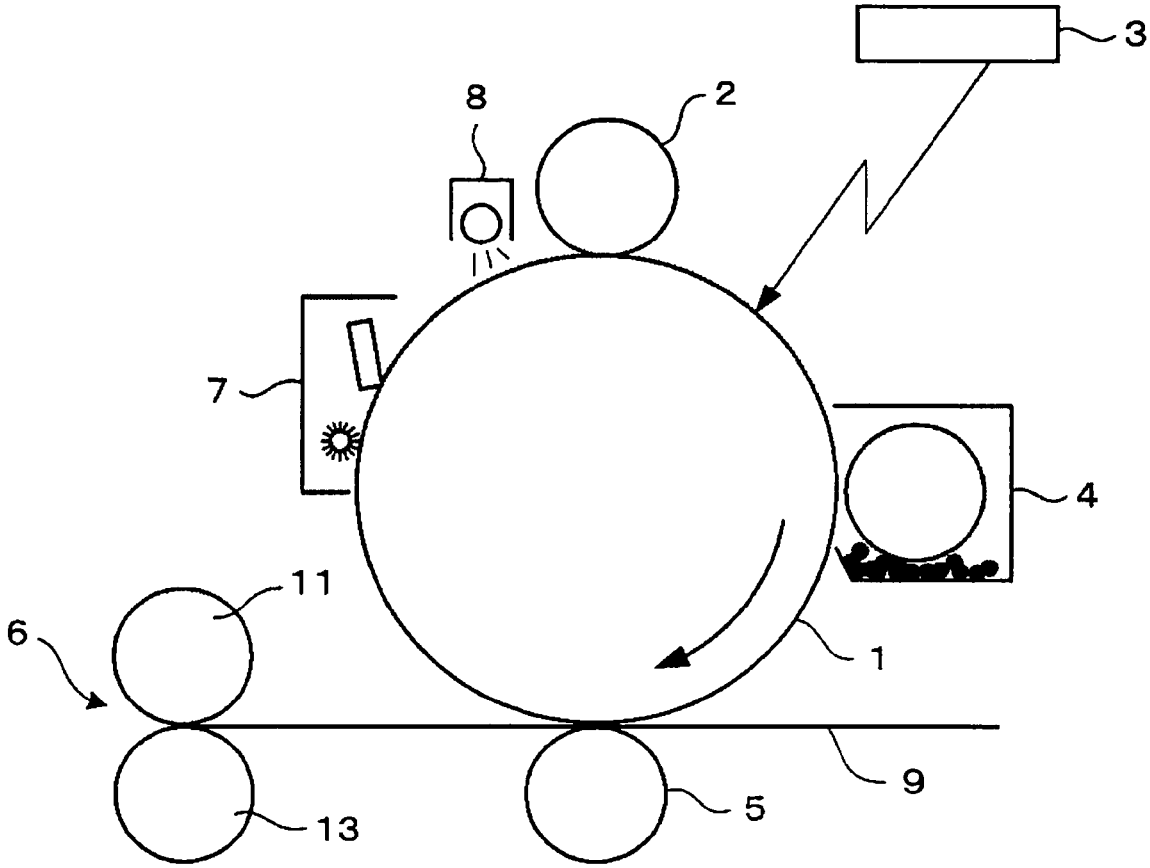
FIG. 57 illustrates an image forming apparatus according to the present invention concerning embodiments 28 through 39.

Below, a heating device, a fixing device and an image forming apparatus according to the present invention concerning embodiments 28 through 39 are described. FIG. 57 shows one embodiment of an image forming apparatus according to the embodiments 14 through 22. The image forming apparatus obtains an image by carrying out well-known electrophotographic process, and has a photosensitive body 1 produced to have a cylindrical shape as an image carrying body. Around the photosensitive body 1, a charging roller 2 as charging means, a developing device 4, a transfer roller 5, a cleaning device 7 and an electricity removing device 8 are provided. Other than them, the image forming apparatus has an optical scanning device 3 and a fixing device 6. As the charging means, a corona charger may be used. The optical scanning device carries out exposure by optical scanning between the charging roller and the developing device.

When image forming is carried out, the photosensitive body 1 is rotated counterclockwise of FIG. 57, a surface thereof is uniformly charged by the charging roller 2, after that an electrostatic latent image is formed on the surface of the photosensitive body 1 by means of exposure of the optical scanning device 3. This electrostatic latent image is developed in an inverting manner by the developing device 4, and a toner image is formed on the surface of the photosensitive body 1. This toner image is overlaid by a recording medium overlaid therewith which is fed from a not-shown paper feeding device to a transfer part in timing in which the toner image on the photosensitive body 1 moves to the transfer position. By a function of the transfer roller 5, the toner image is transferred to the recording medium. The recording medium on which the toner image is thus transferred has then the toner image fixed by the fixing device 6, after that the recording medium is ejected to the outside of the apparatus. After the toner image is thus transferred, residual toner or paper dust on the surface of the photosensitive body 1 is cleaned by the cleaning device 7, and after that, electricity on the photosensitive body 1 is removed by the electricity removing device 8.

Figure 58:
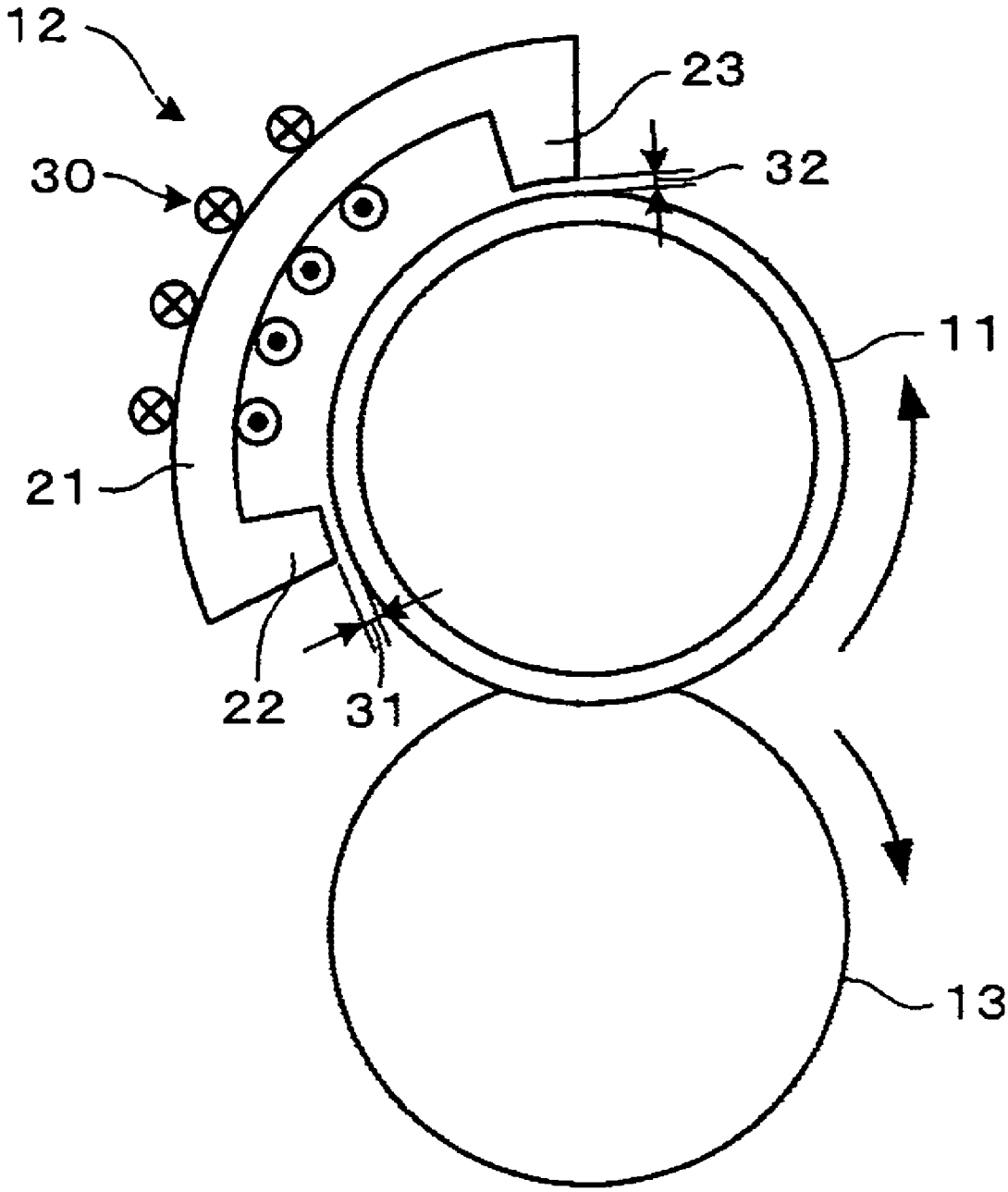
FIG. 58 shows an outline of fixing part shown in FIG. 57.

FIG. 58 is a sectional view showing spatial relationship between a magnetic flux generating coil 12 and the fixing roller 11. In FIG. 58, the reference numeral 11 denotes the fixing roller, 13 denotes the pressing roller, 21 denotes a core of the magnetic flux generating coil, 30 denotes Litz lines of the magnetic flux generating coil 12, 31 and 32 denote gaps between projecting parts 22 and 23 of the core 21 and an external surface of the fixing roller 11. In FIG. 58, for the purpose of easily understanding, dimensions of each part is different from a real one. Further, sections of the Litz lines include only eight sections with omission of many thereof.

The magnetic flux generating coil 12 is disposed at a position as shown in FIG. 58, with respect to the fixing roller 11. That is, the magnetic flux generating coil 12 is disposed to cause the projecting parts 22 and 23 of the core 21 to face the fixing roller 11*b* in such a manner that the core 21 covers an end of an eternal circumferential surface of the fixing roller 11B near to a nip part other than the nip part. Also, arrangement is made such that a separation between the projecting parts 22 and 23 of the core 21 and the external surface of the fixing roller 11B is fixed. The more the projecting parts 22 and 23 of the core 21 apparatus the external surface of the fixing roller 11, the fixing roller 11 can be efficiently heated by means of electromagnetic induction heating. According to the present embodiment, the gap between the projecting parts 22 and 23 of the core 21 and the external surface of the fixing roller 11 is determined as 1 mm. A height of the projecting parts 22 and 23 of the core 21 is ensured so that a gap between the Litz lines 30 and the external surface of the fixing roller 11 is longer than the gap between the projecting parts 22 and 23 of the core 21 and the external surface of the fixing roller 11A. Thereby, when the gap between the projecting parts 22 and 23 of the core 21 and the external surface of the fixing roller 11 is ensured, the Litz lines 30 do not contact the external surface of the fixing roller 11. Thus, the fixing roller 11 is not damaged. Accordingly, contact between the magnetic flux generating coil 12 and the fixing roller 11 can be easily avoided.

According to the present invention, in such a configuration for example, the heat generating part is included in the surface of the fixing roller 11.

As the fluorocarbon resin applied to the present invention, one which has a superior melted film forming performance with burning, and having a relatively low melting point (preferably, 250 through 300° C.) is preferably applied. Specifically, impalpable powder of low molecular weight polytetrafluoroethylene (PTFE), tetrafluoroethylene-hexafluoropropylene copolymer (FEP), or tetrafluoroethylene-perfluoroalkylvinylether copolymer (PFA) is applied. More specifically, as low-molecular weight polytetrafluoroethylene (PTFE) powder, LUBRON (registered trademark) L-5, L-2 (made by Daikin Industries, Ltd.), MP1100, 1200, 1300, TLP-10F-1 (made by DuPont-Mitsui Fluorochemicals, Co., Ltd.) is known. As tetrafluoroethylene-hexafluoropropylene copolymer (FEP) powder, 532-8000 (made by DUPONT) is known. As tetrafluoroethylene-perfluoroalkylvinylether copolymer (PFA), MP-10, MP102 (made by DUPONT-MITSUI FLUOROCHEMICALS, CO., LTD.) is known.

As a low melting point alloy, a metal or an alloy of any one of (1) tin-silver family, (2) tin-copper family, (3) tin-zinc family, (4) tin-silver-copper family, (5) tin-silver-bismuth family, (6) tin-silver-copper-bismuth family, (7) tin, (8) bismuth may be applied. As metal fillers, filters of metal or alloy including at least any one of gold, silver, copper, lead, nickel, zinc, iron, aluminum, magnesium and titanium may be applied. They may be used in a form of fillers of a spherical or acicular shape, or fibrous fillers, and, as a result of being burned together with low melting point metal, fillers contact successively together, an eddy current can be sufficiently made to flow, and it can be applied as the heat generating member. Even when a ratio of the low melting point metal is small, it is possible to improve the electrical conductivity since probability of connection among the filler is high depending on the duration thereof. According to the present invention, the low melting point metal also acts as a safeguard against burning due to abnormal overshooting of temperature of the heating device. That is, when metal becomes liquid, electrical characteristics rapidly change. Thereby, detection by impedance change in a magnetic flux generating circuit can be made possible. Also, for liquid metal, heat generating efficiency degrades since resistance value rapidly increases. Further, it is possible to produce an alloy of magnetic metal into non-magnetic metal and control the Curie temperature, so that heat generating efficiency degrades at a temperature higher than a certain one.

Further, it is preferable that the low melting point metal amounts to 5 through 50 weight part with respect to the filler's loading weight. Further, since the low melting point metal has low corrosion resistance in many cases, it is preferable that it is fewer than the filler. Further, in a fixing part of an image forming apparatus, an environment of steam from recording paper or such is applied. Therefore, it is preferable to avoid an amount more than necessary.

It is noted that, metal particles do not provide electrical conductivity unless it positively contact, different from carbon particles or such. Further, contribution to thermal conductivity cannot substantially be achieved unless a plurality thereof contact. This is the reason why a state of successively contacting is referred to as successive contacting. See Nobuo Saito, Mounting Technology for Electrically Conductive Resin, CMC Co., Ltd., page 46 (2000).

Embodiment 28

In PFA powder (MP102 average particle diameter ϕ 20 μm), Ni powder (average particle diameter 0.3 μm) was mixed to amount to 5% in reduced volume, this was then input to a hybridization system of Nara Machinery Co., Ltd., and thus, Ni powder was fixed on PFA powder (powder 1). Next, nickel is plated on this powder in an elecroless plating manner. As a method thereof, a method applying sodium hypophosphite as reducer may be applied. (For details, Surface Technology, Vol. 47, No. 11, P. 896-899 or such). This plated powder is referred to as powder A. There, an example with Ni is mainly described. However, a separating method with the use of metal as reducer, silver mirror reaction or such may also be applied.

This powder A was electrostatically coated on an aluminum substrate, burning was carried out at 380° C., resin was melted and then cooled, the coating was pealed from the substrate, and a sample was produced. From this sample, a sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, difference from the Ni foil was compared. Specifically, a time required for raising from a room temperature for +30° C. was compared. As a result, in the configuration of the present embodiment, heating was achieved by a time which is 1.2 times a time required for heating the Ni foil of the thickness of 30 μm. Thus, even in the configuration including fluorocarbon resin, heat generating performance equivalent to the Ni foil could be obtained.

Embodiment 29

Figure 59:
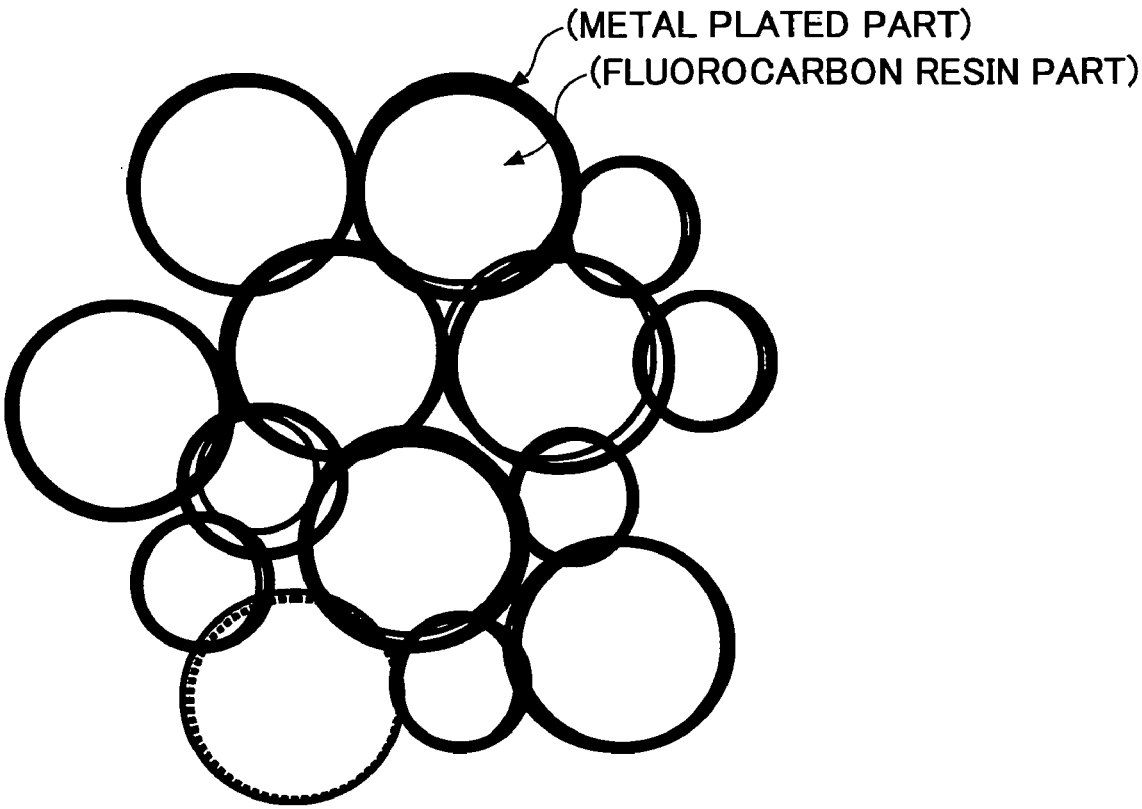
FIG. 59 illustrates a surface layer of a fixing roller shown in FIG. 58 in embodiment 30.
Figure 60:
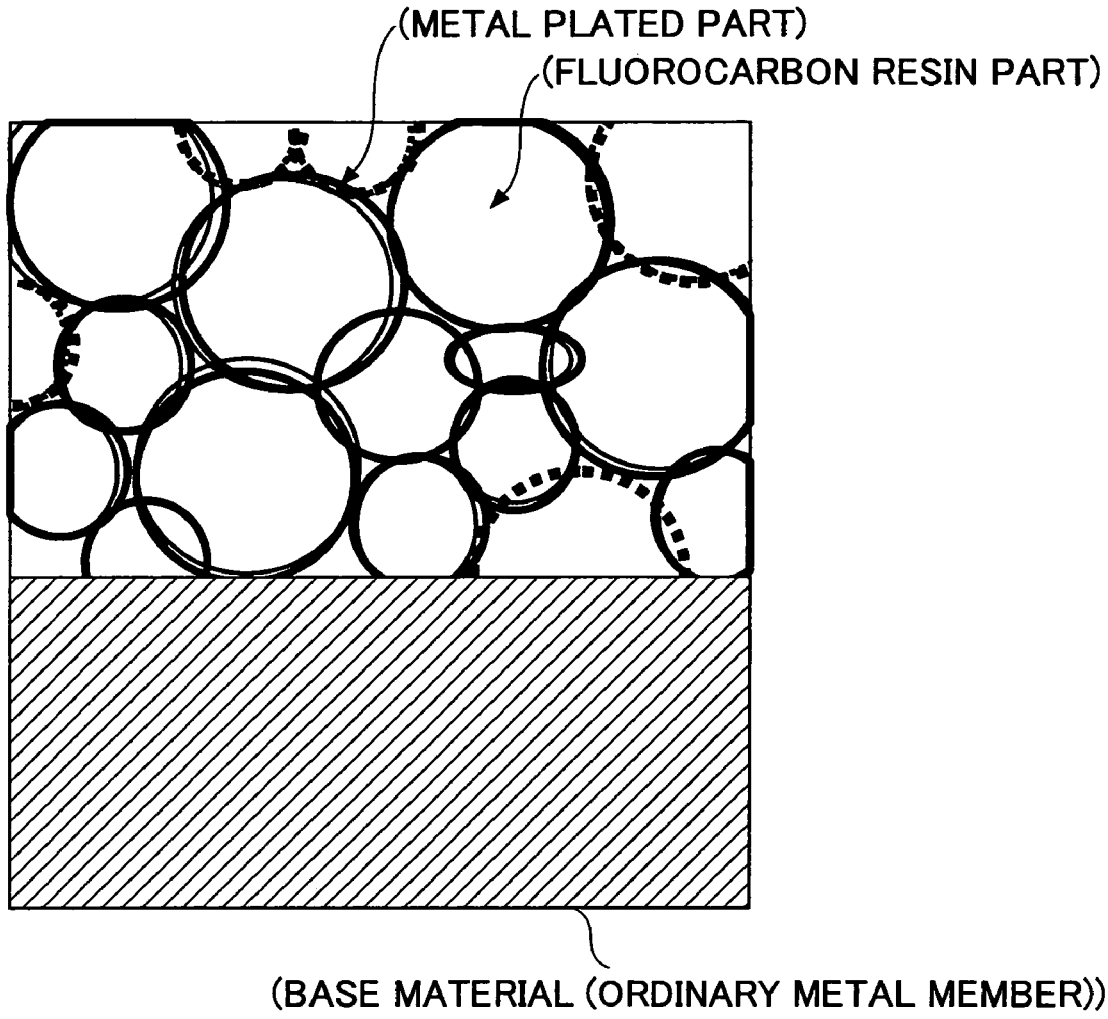
FIG. 60 is a sectional diagram of the surface layer of the fixing roller shown in FIG. 59.

The powder A of the embodiment 28 was electrostatically coated on an aluminum tube to be a core metal of the fixing roller, the coated resin was melted at 380° C. and then cooled, after that grinding was carried out, and the fixing roller was obtained. A final thickness of was 50 μm. This was ground by means of corundum particles having different particle diameters, and one having surface roughness of the surface layer equal to or less than 2 μm in Rz was produced. Its surface is shown in FIG. 59. Since the PFA (MP102) was transparent, all could be seen when viewed from the top. FIG. 60 shows a sectional view of that of FIG. 59. For this fixing roller, a non-fixed image produced by an image forming apparatus MF4570 of Ricoh Co., Ltd. was passed through an induction heating test machine. Toner of this MF4570 was one including wax. When the toner from which the wax was removed was produced, a non-fixed image was produced by cascade development, and it was passed through the testing machine, paper winding occurred due to toner adhesion for the first sheet. A basic configuration of this test machine is shown in FIG. 58. 10000 black solid images were passed therethrough, and a toner adhesion state on the roller surface was observed. As a result, no particularly large toner adhesion was observed, and there was nothing different from an ordinary one. Further, the core metal applied at this time was such that a thickness of the tube of the fixing roller was as thick as 1.5 mm, and thus, 50 seconds are required for the roller surface temperature to reach 180° C. by means of an internal heating by means of a halogen heater. However, with the present fixing roller, the order of 5 seconds were required (a rated output was 800 W for both cases).

Embodiment 30

To wet fluorine coating EN700CL made by DuPont Co., Ltd., with respect to dry PFA weight, the powder A of the embodiment 28 was mixed to amount to 70%, stirring was carried out, after that spray coating was carried out on an aluminum tube to be a core metal of a fixing roller, the coated resin was melted at 380° C. and then cooled, after that grinding was carried out, and the fixing roller was obtained. A final thickness was 50 μm. This roller was ground with corundum particles having different particle diameters, and thus, one having surface roughness equal to or less than 2 μm in Rz was produced. A schematic diagram of this material after burning is show in FIG. 61.

Figure 61:
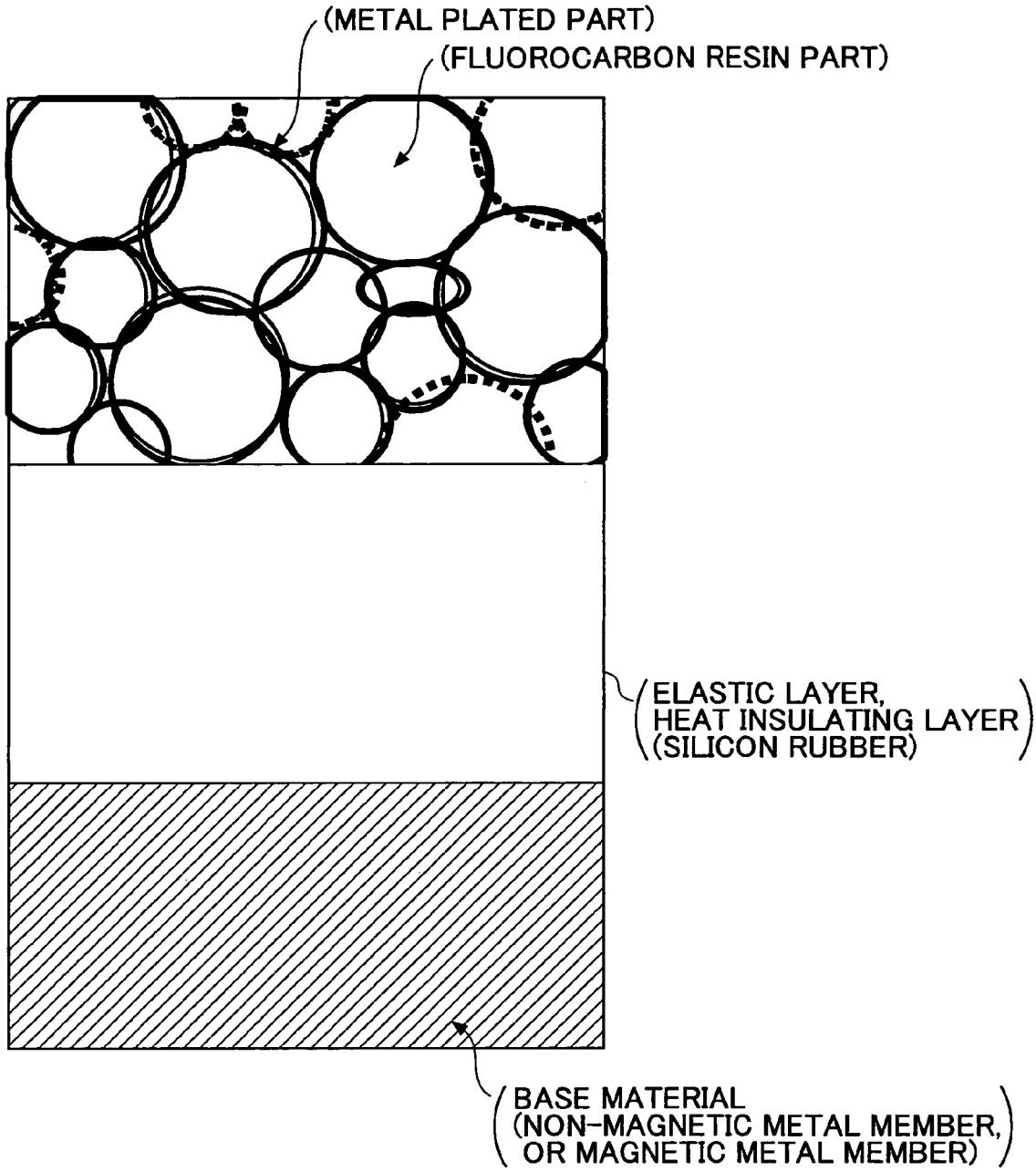
FIG. 61 schematically shows a fixing roller surface layer part in embodiment 30 after burning.

FIG. 61 shows a vertical sectional view of part of the surface layer. A metal successively contacting part absorbs high-frequency wave from the top and generates heat. The surface layer is thermally insulated by a silicon rubber, and thus, repaid temperature rise can be archived. Further, for a horizontal direction, connection was provided also thermally, and thus, even when heat lowering occurs partially, rapid uniformization is carried out.

For this fixing roller, a non-fixed image produced by an image forming apparatus MF4570 of Ricoh Co., Ltd. was passed through an induction heating test machine. 10000 black solid images were passed, and a toner adhesion state on the roller surface was observed. As a result, no particularly large toner adhesion was observed, and there was nothing different from an ordinary one. Further, the core metal applied this time was such that a thickness of the tube of the fixing roller was as thick as 1.5 mm, and thus, 50 seconds are required for the roller surface temperature to reach 180° C. by means of an internal heating by means of a halogen heater. However, with the fixing roller in electromagnetic induction heating type in the present embodiment, the order of 10 seconds were required (a rated output was 800 W for both cases).

Embodiment 31

In carbon included PFA powder (carbon content 3%, average particle diameter ϕ 20 μm), Ni powder (average particle diameter 0.3 μm) was mixed to amount to 5% of Ni in reduced volume, this was then input to a hybridization system of Nara Machinery Co., Ltd., and thus, Ni powder was fixed on PFA powder (powder 1). Next, nickel is plated on this powder in an elecroless plating manner. As a method thereof, a method applying sodium hypophosphite as reducer may be applied. (For details, Surface Technology, Vol. 47, No. 11, P. 896-899 or such). This plated powder is referred to as powder B. There, an example with Ni is mainly described. However, a separating method with the use of metal as reducer, silver mirror reaction or such may also be applied.

This powder was electrostatically coated on an aluminum substrate, burning was carried out at 380° C., resin was melted and then cooled, the coating was pealed from the substrate, and a sample was produced. From this sample, a sheet with a thickness of 30 μm, and a size of 50 mm by 50 mm was produced, was then fixed to an inside bottom surface of a dish made by Pyrex (registered trademark) by means of polyimide tape, after that pure water 100 ml was poured in the dish. This was placed on a general-purpose electromagnetic range (IH cooker: KZ-PH1 made by National (an empty pan detecting system was deactivated), electromagnetic wave was generated, and water temperature increase was measured. Further, a Ni foil having the same size as that of the above-mentioned sample sheet with a thickness of 30 μm was applied, measurement was carried out in the same conditions, and thus, difference from the Ni foil 30 μm was compared. Specifically, a time required for raising from a room temperature for +30° C. was compared. As a result, in the configuration of the present embodiment, heating was achieved by a time which is 1.3 times a time required for heating the Ni foil of the thickness of 30 μm. Thus, a heat generating member could be produced also from PFA including carbon. The meaning of including carbon is improvement of abrasion proof Embodiment 32

The powder B of the embodiment 31 was electrostatically coated on an aluminum tube to be a core metal of the fixing roller, the coated resin was melted at 380° C. and then cooled, after that grinding was carried out, and the fixing roller was obtained. A final thickness of was 50 μm. This was ground by means of corundum particles having different particle diameters, and one having surface roughness of the surface layer equal to or less than 2 μm in Rz was produced. Its surface was the same as that of the embodiment 29. Since the PFA (MP102) was transparent, all could be seen when viewed from the top. For this fixing roller, a non-fixed image produced by an image forming apparatus MF4570 of Ricoh Co., Ltd. was passed through an induction heating test machine. A basic configuration of this test machine is shown in FIG. 58. 10000 black solid images were passed therethrough, and a toner adhesion state on the roller surface was observed. As a result, no particularly large toner adhesion was observed, and there was nothing different from an ordinary one. Further, the core metal applied at this time was such that a thickness of the tube of the fixing roller was as thick as 1.5 mm, and thus, 50 seconds are required for the roller surface temperature to reach 180° C. by means of an internal heating by means of a halogen heater. However, with the present fixing roller, the order of 15 seconds were required (a rated output was 800 W for both cases). Further, to the fixing unit of the MF4570, a separating nail for directly contacting the fixing roller for separating paper winding around the fixing roller contacts. This causes friction on the fixing roller, and thus, abrasion proof characteristics is required to endure it. An abrasion amount by the separating nail was measured while a pressure of the separating nail was set five times that of regular one, and comparison was made with the roller of the embodiment 29. As a result ⅓ was obtained.

Embodiment 33

To wet fluorine coating EN700CL made by DuPont Co., Ltd., with respect to dry PFA weight, the powder B of the embodiment 31 was mixed to amount to 70%, stirring was carried out, after that spray coating was carried out on an aluminum tube to be a core metal of a fixing roller, the coated resin was melted at 380° C. and then cooled, after that grinding was carried out, and the fixing roller was obtained. A final thickness was 50 μm. This roller was ground with corundum particles having different particle diameters, and thus, one having surface roughness equal to or less than 2 μm in Rz was produced. A schematic diagram of this material after burning is show in FIG. 61. For this fixing roller, a non-fixed image produced by an image forming apparatus MF4570 of Ricoh Co., Ltd. was passed through an induction heating test machine. 10000 black solid images were passed, and a toner adhesion state on the roller surface was observed. As a result, no particularly large toner adhesion was observed, and there was nothing different from an ordinary one. Further, the core metal applied this time was such that a thickness of the tube of the fixing roller was as thick as 1.5 mm, and thus, 50 seconds are required for the roller surface temperature to reach 180° C. by means of an internal heating by means of a halogen heater. However, with the fixing roller in electromagnetic induction heating type in the present embodiment, the order of 9 seconds were required (a rated output was 800 W for both cases).

Embodiment 34

Into PFA powder (low temperature burned type, average particle diameter ϕ 20 μm), Ni powder (average particle diameter 0.3 μm) was mixed to amount to 5% in reduced volume, this was then input to a hybridization system of Nara Machinery Co., Ltd., and thus, Ni powder was fixed on PFA powder (powder 1). Next, nickel is plated on this powder in an elecroless plating manner. As a method thereof, a method applying sodium hypophosphite as reducer may be applied. (For details, Surface Technology, Vol. 47, No. 11, P. 896-899 or such). This plated powder is referred to as powder C.

The powder C was electrostatically coated on an aluminum tube to be a core metal of the fixing roller, on which tube 300 μm of silicon rubber had been attached, the coated resin was melted at 340° C. and then cooled, after that grinding was carried out, and the fixing roller was obtained. A final thickness of was 50 μm. This was ground by means of corundum particles having different particle diameters, and one having surface roughness of the surface layer equal to or less than 2 μm in Rz was produced. Its surface was the same as that of the embodiment 29. Since the PFA was transparent, all could be seen when viewed from the top. For this fixing roller, a non-fixed image produced by an image forming apparatus DocuCentre Color 500 CP of Fuji Xerox Co., Ltd. was passed through an induction heating test machine. A basic configuration of this test machine is shown in FIG. 58. 10000 black solid images were passed therethrough, and a toner adhesion state on the roller surface was observed. As a result, no particularly large toner adhesion was observed, and there was nothing different from an ordinary one. Further, the core metal applied at this time was such that a thickness of the tube of the fixing roller was as thick as 1.5 mm, and thus, 50 seconds are required for the roller surface temperature to reach 180° C. by means of an internal heating by means of a halogen heater. However, with the present fixing roller, the order of 30 seconds were required (a rated output was 800 W for both cases). Since the heat generating layer is provided on an outermost surface, a starting up time the same as that of a monochrome machine can be achieved.

Embodiment 35

Into PFA powder (low temperature burned type, average particle diameter ϕ 20 μm), Ni powder (average particle diameter 0.3 μm) was mixed to amount to 5% in reduced volume, this was then input to a hybridization system of Nara Machinery Co., Ltd., and thus, Ni powder was fixed on PFA powder (powder 1). Next, nickel is plated on this powder in an elecroless plating manner. As a method thereof, a method applying sodium hypophosphite as reducer may be applied. (For details, Surface Technology, Vol. 47, No. 11, P. 896-899 or such). This plated powder is referred to as powder C.

This powder C was mixed with bismuth powder (average particle diameter 0.9 μm). The bismuth powder is 3% in reduced volume. This mixture powder was electrostatically further coated on an aluminum tube to be a core metal of the fixing roller, on which aluminum tube a silicon rubber layer 300 μm had been attached, the coated resin was melted at 340° C. and then cooled, after that grinding was carried out, and the fixing roller was obtained. A final thickness of was 50 μm. This was ground by means of corundum particles having different particle diameters, and one having surface roughness of the surface layer equal to or less than 2 μm in Rz was produced. Its surface was the same as that of the embodiment 29. Since the PFA was transparent, all could be seen when viewed from the top. For this fixing roller, a non-fixed image produced by an image forming apparatus DocuCentre Color 500 CP of Fuji Xerox Co., Ltd. was passed through an induction heating test machine. A basic configuration of this test machine is shown in FIG. 58. 10000 black solid images were passed therethrough, and a toner adhesion state on the roller surface was observed. As a result, no particularly large toner adhesion was observed, and there was nothing different from an ordinary one. Further, the core metal applied at this time was such that a thickness of the tube of the fixing roller was as thick as 1.5 mm, and thus, 50 seconds are required for the roller surface temperature to reach 180° C. by means of an internal heating by means of a halogen heater. However, with the present fixing roller, the order of 15 seconds were required (a rated output was 800 W for both cases). Since the heat generating layer is provided on an outermost surface, a starting up time the same as that of a monochrome machine can be achieved. Furthermore, instead of bismuth, fine powder of each of (1) tin-silver family, (2) tin-copper family, (3) tin-zinc family, (4) tin-silver-copper family, (5) tin-silver-bismuth family, (6) tin-silver-copper-bismuth family, and (7) tin was mixed in the same way, and the same result was obtained.

Embodiment 36

Into PFA powder (MP102 average particle diameter ϕ 20 μm), Ni powder (average particle diameter 0.3 μm) was mixed to amount to 5% in reduced volume, this was then input to a hybridization system of Nara Machinery Co., Ltd., and thus, Ni powder was fixed on PFA powder (powder 1). Next, nickel is plated on this powder in an elecroless plating manner. As a method thereof, a method applying sodium hypophosphite as reducer may be applied. (For details, Surface Technology, Vol. 47, No. 11, P. 896-899 or such). This plated powder is referred to as powder A. Next, PFA powder (MP102 average particle diameter ϕ 20 μm) and this powder A were mixed in a ratio according to Table below, this was then electrostatically coated on an aluminum tube to be a core metal of the fixing roller, the coated resin was melted at 380° C. and then cooled, after that grinding was carried out, and the fixing roller was obtained. A final thickness of was 40 μm. This fixing roller was loaded in an image forming apparatus MF4570 of Ricoh Co., Ltd. 10000 black solid images were passed therethrough, and a toner adhesion state on the roller surface was observed. As a result, no particularly large toner adhesion was observed, and there was nothing different from an ordinary one.

TABLE 66

| POWDER A:PFA POWDER (VOLUME RATIO) | WATER CONTACT ANGLE | ADHERING TONER |
|---|---|---|
| 1:9 | 108° | NOTHING |
| 2:8 | 108° | NOTHING |
| 4:6 | 105° | NOTHING |
| 5:5 | 106° | NOTHING |
| 6:4 | 98° | NOTHING |
| 10:0 | 82° | NOTHING |

As a comparison, for one in which 5% in reduced volume of Ni powder was mixed into the powder A and a film was produced, water contact angle was 78° C. and toner adhesion was observed. Further, for one in which Ni powder of average particle diameter 30 μm was mixed to amount to 0.5% in reduced volume, toner adhesion was observed to a part of the Ni on the order of 30 μm.

Embodiment 37

Figure 62:
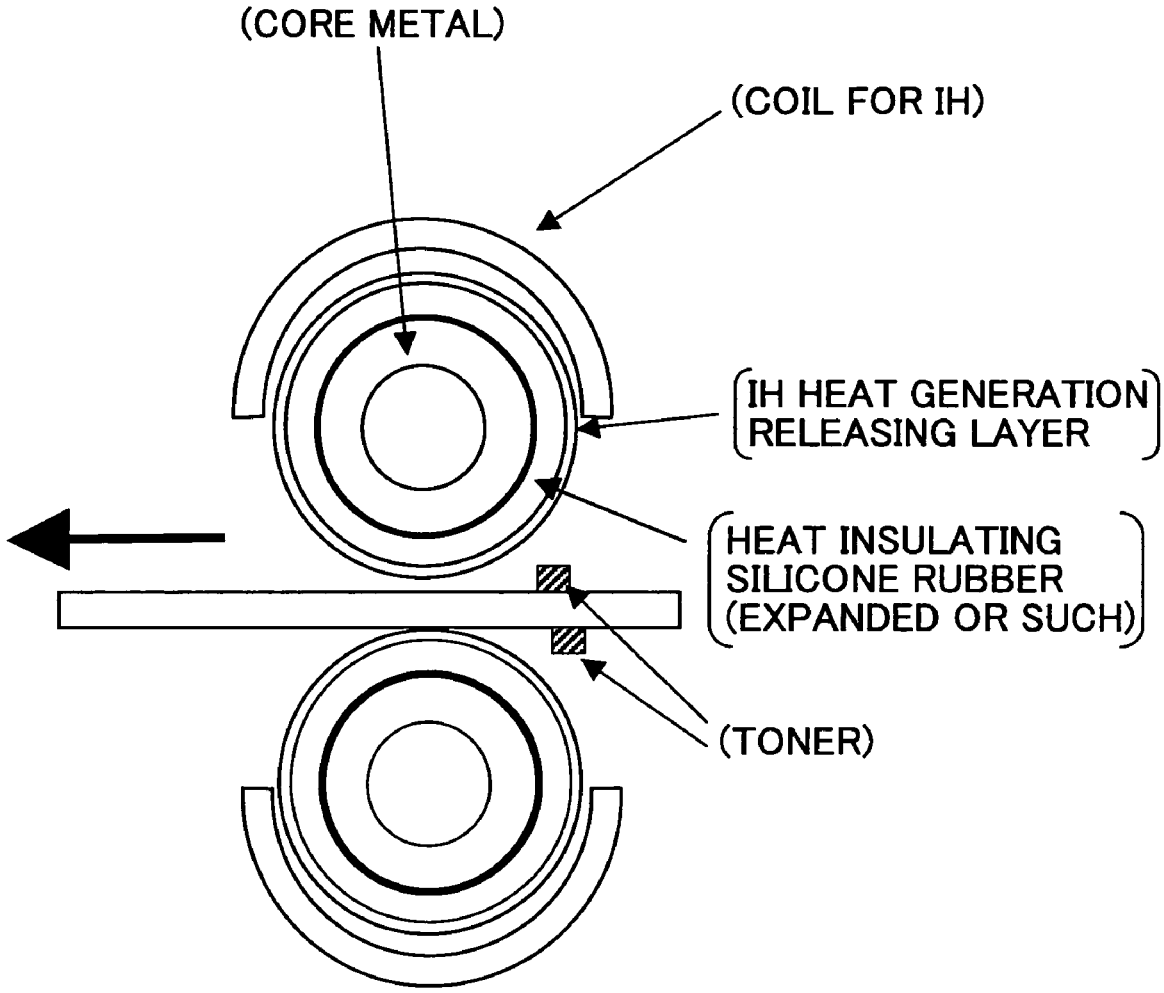
FIG. 62 shows a basic configuration of a fixing part in embodiment 37.

FIG. 62 shows an example in which two sets of heating means are provided. A basic configuration thereof is the same as a top part of FIG. 58. However, since both side heating can be carried out, non-fixed toner adhering to both sides of paper can be fixed.

Embodiment 38

Figure 63:
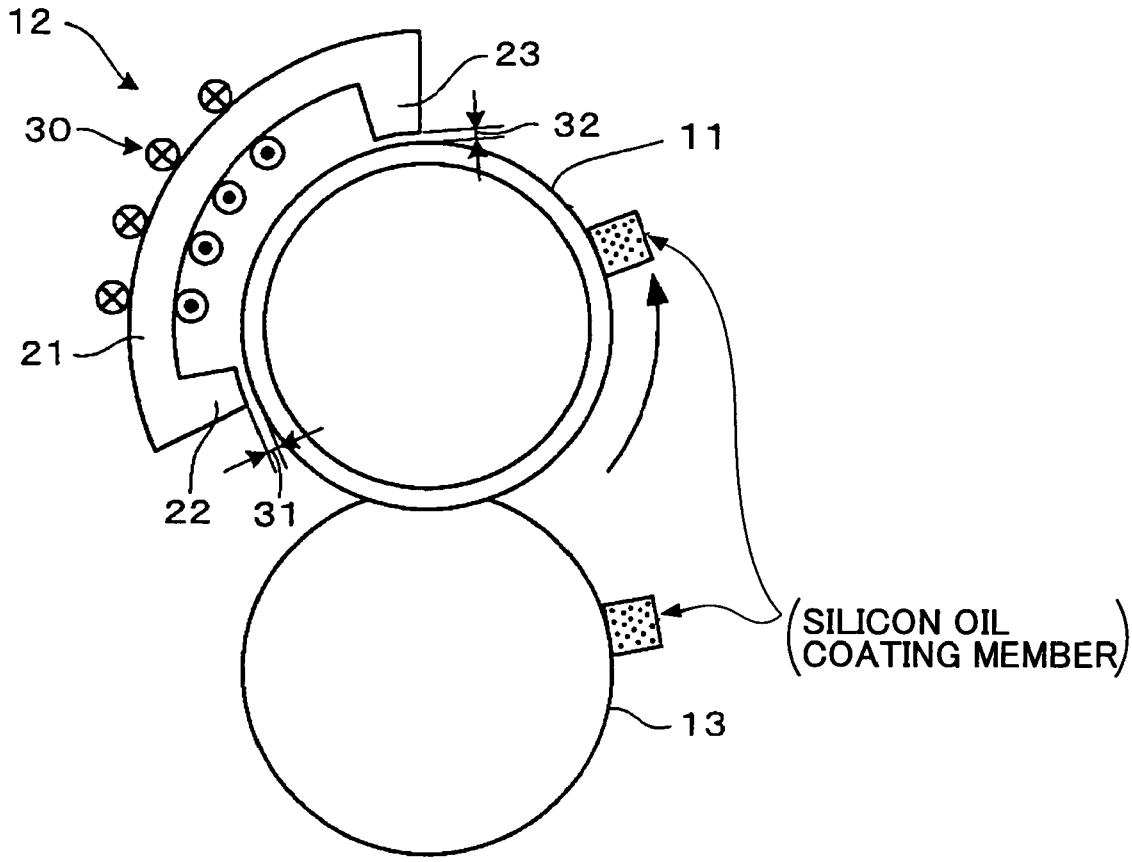
FIG. 63 shows a basic configuration of a test machine in embodiment 38.

The powder A of the embodiment 28 was electrostatically coated on an aluminum tube to be the core metal of the fixing roller, the coated resin was melted at 380° C. and then cooled, grinding was carried out by means of corundum particles, one having surface roughness (Rz) made equal to or less than 2 μm was produced, and thus, the fixing roller was produced. A final thickness of the surface layer is 50 μm. Thereon, grinding was carried out with corundum particles having different particle diameters, and thus, one having a surface roughness equal to or less than 2 μm in Rz was obtained. FIG. 59 shows a surface thereof. Since PFA is transparent, all can be seen viewed from the top. FIG. 60 shows a sectional view of that of FIG. 59. For this roller, non-fixed images produced by means of an image forming part of IMAGIO750 of Ricoh Co., Ltd were passed through an induction heating test machine. Toner of this IMAGIO750 is insufficient in releasability, and therefore, an oil coating member immersed in silicon oil for coating silicon coil to the fixing roller is added. A basic configuration of this test machine is shown in FIG. 63. 10000 sheets of black solid images were passed, and toner adhesion state on the roller was observed. As a result of the observation, no particularly large adhesion and occurrence of electrostatic offset were observed, and nothing other than ordinary one occurred. Further, the core metal applied at this time was such that a thickness of the tube of the fixing roller was as thick as 1.5 mm, and thus, 50 seconds are required for the roller surface temperature to reach 180° C. by means of an internal heating by means of a halogen heater. However, with the present fixing roller, the order of 5 seconds were required (a rated output was 800 W for both cases).

Embodiment 39

The roller was produced in the same manner as that of the embodiment 29, and one of 2 μm in Rz was produced.

In a range equal to or less than 0.5 (kgf/cm$^2$), fixing performance was very bad; in a range equal to or more than 4.0

(kgf/cm$^2$), toner adhesion to the fixing roller occurred. The fixing performance was determined simply in such a manner that, when toner remarkably adhered to a cloth after the solid image after fixing was rubbed by the cloth, it was determined that the fixing was bad.

TABLE 67

COMPARISON EXAMPLE BY PRESSING FORCE

| PRESSING FORCE (kgf/cm$^2$) | ADHERING TONER AMOUNT | PAPER WINDING |
|---|---|---|
| 0.3 | NOTHING | NOTHING |
| 0.5 | NOTHING | NOTHING |
| 1.0 | NOTHING | NOTHING |
| 2.0 | SOME | NOTHING |
| 4.0 | VERY MUCH | FREQUENT JAM |

The present invention may not be limited to the above-described embodiments, and variations may be made within a technical concept of the present invention claimed in the claims below.

The present application is based on Japanese Priority Applications No. 2003-364598 filed on Oct. 24, 2003; 2004-076530 filed on Mar. 17, 2004; and 2004-302585 filed on Oct. 18, 2004, the entire contents of which are hereby incorporated herein by reference.

The invention claimed is:

1. A heating member for contacting a to-be-heated member and heating the same, wherein a surface layer of the heating member is formed by heating a mixture comprising:

a powder comprising particles of a resin material having releasibility; and particles of the resin material having releasibility further comprising a metal powder fixed on peripheries of the particles wherein in the surface layer formed by heating, the metal powder is successively contacting, wherein the successively contacting metal powder comprises a series of spherical shells or a series of modified spherical shells.

2. The heating member for contacting a to-be-heated member as claimed in claim 1, wherein the resin material having releasibility comprises a fluorocarbon resin.

3. The heating member for contacting a to-be-heated member as claimed in claim 1, wherein the metal powder comprises at least one selected from the group consisting of gold, silver, copper, lead, nickel, zinc, iron, aluminum, magnesium, titanium, tin, bismuth and an alloy thereof.

4. The heating member for contacting a to-be-heated member as claimed in claim 1, wherein the metal powder comprises a metal having a melting point higher than a temperature to which the to-be-heated member is heated.

5. The heating member for contacting a to-be-heated member as claimed in claim 1, wherein a surface roughness of the surface layer is equal to or less than 5 μm in ten-point-average roughness (Rz).

6. The heating member for contacting a to-be-heated member as claimed in claim 1, wherein the surface layer is on a roller or endless belt comprising a base material and a heating device.

7. The heating member for contacting a to-be-heated member as claimed in claim 6, wherein the surface layer functions as an electrically conductive layer and heat is generated in said electrically conductive layer as a result of an eddy current.

8. The heating member for contacting a to-be-heated member as claimed in claim 2, wherein the base material comprises an elastic layer or a heat insulating layer.

9. A method to produce the surface layer of the heating member for contacting a to-be-heated member as claimed in claim 2 comprising:

electrostatically coating a base material with a powder of a resin material having releasibility further comprising a metal powder fixed on peripheries of particles of the powder of the resin material having releasibility or a mechanical mixture of a powder of a resin material having releasibility and a metal powder; and heating the coating.

10. A fixing member for contacting a sheet-like recording material or a to-be-heated member, heating the same, and fixing a non-fixed image on the recording material, comprising the heating member claimed in claim 1.

11. A heating device comprising exciting means, and a heating member including heating means applying electromagnetic induction heating by generating eddy current in an electrically conductive layer by means of the exciting means, wherein, as said heating member, the heating member claimed in claim 1 is applied.

12. A heating device comprising two rotating bodies for sandwiching and conveying a sheet-like to-be-heated member and a heating means for heating the rotating bodies, and heating and pressing the to-be-heated member, wherein said heating means comprises exciting means and a heating member including heating means applying electromagnetic induction heating of generating heat by generating eddy current in an electrically conductive layer by means of the exciting means, and either one or both of said two rotating bodies comprises the heating member claimed in claim 7.

13. The heating device as claimed in claim 12, comprising two sets of the heating means, and the two rotating bodies are heated by the two sets of heating means, respectively.

14. An image fixing device comprising the fixing member claimed in claim 10.

15. The image fixing device claimed in claim 14, wherein an image fixed on a recording material comprises a toner and a wax.

16. An image fixing device, comprising the heating device claimed in claim 11, wherein an image fixed on a sheet-like to-be-heated member comprises a toner and a wax.

17. An image fixing device, comprising the heating device claimed in claim 12, wherein of the two rotating bodies is applied as the fixing member and the other is applied as the pressing member, a recording material or a to-be-heated member is sandwiched and conveyed with a part at which the fixing member and the pressing member are pressed by one another, and an image fixed on the recording material comprises a toner and a wax.

18. The image fixing device as claimed in 14, wherein a releasing agent is coated on at least one selected from the group consisting of the heating member, the fixing member and the pressing member.

19. The image fixing device as claimed in claim 14, wherein a quotient obtained from dividing a pressing force F [kgf] of the fixing member and the pressing member with respect to the recording material by an area S [cm$^2$] of a contact portion in which both are pressed by one another is equal to or between 0.5 and 4.0 [kgf/cm$^2$].

20. The image fixing device as claimed in claim 14, wherein a quotient obtained from dividing a pressing force F [kgf] of the fixing member and the pressing member with respect to the recording material by an area S [cm$^2$] of a contact portion in which both are pressed by one another is equal to or less than 4.0 [kgf/cm$^2$].

21. An image forming apparatus comprising an image forming part producing a toner image on a recording material, and a fixing part fixing the toner image onto the recording material wherein the image is fixed as claimed in claim 14.

22. An image forming apparatus comprising an image forming part producing a toner image on a recording material, and a fixing part fixing the toner image onto the recording material comprising the image fixing device claimed in claim 14.

23. The method of claim 9 wherein the metal powder is fixed to the peripheries of the fluorocarbon resin powder particles by one selected from the group consisting of application of mechanical pressure and shearing force, external heating, heating by friction and force of impact.

24. The method of claim 9, wherein the heating the coating comprises heating the coating to a temperature equal to or greater than the melting point of fluorocarbon resin powder.

25. A method to produce the surface layer of the heating member for contacting a to-be-heated member as claimed in claim 2 comprising:

preparing an aqueous dispersion of a powder of a resin material having releasibility further comprising a metal powder fixed on peripheries of particles of the powder of the resin material having releasibility or a mechanical mixture of a powder of a resin material having releasibility and a metal powder;

coating the aqueous dispersion on a base material of the heating member; and heating the coating.

26. The method of claim 25 wherein the metal powder is fixed to the peripheries of the fluorocarbon resin powder particles by one selected from the group consisting of application of mechanical pressure and shearing force, external heating, heating by friction and force of impact.

27. The method of claim 25, wherein the heating the coating comprises heating the coating to a temperature equal to or greater than the melting point of fluorocarbon resin powder.

28. A method to produce the surface layer of the heating member for contacting a to-be-heated member as claimed in claim 2 comprising:

mechanically mixing fluorocarbon resin powder and metal particles coated with fluorocarbon resin or fluorocarbon resin powder particles comprising dispersed metal;

electrostatically coating a base material of the heating member; and heating the coating.

29. A method to produce the surface layer of the heating member for contacting a to-be-heated member as claimed in claim 2 comprising:

preparing an aqueous dispersion of fluorocarbon resin powder and metal particles coated with fluorocarbon resin or fluorocarbon resin powder particles comprising dispersed metal;

coating a base material of the heating member with the aqueous dispersion; and heating the coating.

30. A method for fixing an image on a recording material comprising:

passing a recording material having a non-fixed image through a fixing member as claimed in claim 10 and a pressing member;

heating and pressing the recording material;

wherein a circumferential surface of the fixing member turns, and the pressing member presses the fixing member at a position where the heating occurs.

31. The method for fixing an image on a recording material as claimed in claim 30, wherein the non-fixed image on the recording material comprises a toner and a wax.

32. The method for fixing an image on a recording material as claimed in claim 30, wherein at least one selected from the group consisting of the heating member and the pressing member comprise a releasing agent.

33. A method for fixing an image on a recording material comprising:

passing a recording material having a non-fixed image through a fixing member as claimed in claim 11 and a pressing member;

heating and pressing the recording material;

wherein a circumferential surface of the fixing member turns, and the pressing member presses the fixing member at a position where the heating occurs.

34. The method for fixing an image on a recording material as claimed in claim 33, wherein the non-fixed image on the recording material comprises a toner and a wax.

35. The method for fixing an image on a recording material as claimed in claim 33, wherein at least one selected from the group consisting of the heating member and the pressing member comprise a releasing agent.

36. A method for fixing an image on a recording material comprising:

passing a recording material having a non-fixed image through a fixing member as claimed in claim 12 and a pressing member;

heating and pressing the recording material;

wherein a circumferential surface of the fixing member turns, and the pressing member presses the fixing member at a position where the heating occurs.

37. The method for fixing an image on a recording material as claimed in claim 36, wherein the non-fixed image on the recording material comprises a toner and a wax.

38. The method for fixing an image on a recording material as claimed in claim 36, wherein at least one selected from the group consisting of the heating member and the pressing member comprise a releasing agent.

39. The image fixing device as claimed in claim 15, wherein a releasing agent is coated on at least one selected from the group consisting of the heating member, the fixing member and the pressing member.

40. The image fixing device as claimed in claim 16, wherein a releasing agent is coated on at least one selected from the group consisting of the heating member, the fixing member and the pressing member.

41. The image fixing device as claimed in claim 17, wherein a releasing agent is coated on at least one selected from the group consisting of the heating member, the fixing member and the pressing member.

42. The image fixing device as claimed in claim 15, wherein a quotient obtained from dividing a pressing force F [kgf] of the fixing member and the pressing member with respect to the recording material by an area S [cm$^2$] of a contact portion in which both are pressed by one another is equal to or between 0.5 and 4.0 [kgf/cm$^2$].

43. The image fixing device as claimed in claim 16, wherein a quotient obtained from dividing a pressing force F [kgf] of the fixing member and the pressing member with respect to the recording material by an area S [cm$^2$] of a contact portion in which both are pressed by one another is equal to or between 0.5 and 4.0 [kgf/cm$^2$].

44. The image fixing device as claimed in claim 17, wherein a quotient obtained from dividing a pressing force F [kgf] of the fixing member and the pressing member with respect to the recording material by an area S [$cm^2$] of a contact portion in which both are pressed by one another is equal to or more than 0.5 [$kgf/cm^2$].

45. An image forming apparatus comprising:

an image forming part producing a toner image on a recording material; and a fixing part fixing the toner image onto the recording material wherein the image is fixed as claimed in claim 31.

46. An image forming apparatus comprising:

an image forming part producing a toner image on a recording material; and a fixing part fixing the toner image onto the recording material wherein the image is fixed as claimed in claim 32.

47. An image forming apparatus comprising:

an image forming part producing a toner image on a recording material; and a fixing part fixing the toner image onto the recording material wherein the image is fixed as claimed in claim 34.

48. An image forming apparatus comprising:

an image forming part producing a toner image on a recording material; and a fixing part fixing the toner image onto the recording material comprising the image fixing device claimed in claim 15.

49. An image forming apparatus comprising:

an image forming part producing a toner image on a recording material; and a fixing part fixing the toner image onto the recording material comprising the image fixing device claimed in claim 16.

50. An image forming apparatus comprising:

an image forming part producing a toner image on a recording material; and a fixing part fixing the toner image onto the recording material comprising the image fixing device claimed in claim 17.

51. The heating member for contacting a to-be-heated member according to claim 1, wherein the particles of the resin material having releasibility further comprising a metal powder fixed on peripheries of the particles are 40 per cent by volume of the powder.

* * * * *